US012576316B2

(12) United States Patent
Sanchez et al.

(10) Patent No.: US 12,576,316 B2
(45) Date of Patent: Mar. 17, 2026

(54) GOLF CLUB HAVING AN ADJUSTABLE WEIGHT ASSEMBLY

(71) Applicant: Acushnet Company, Fairhaven, MA (US)

(72) Inventors: Richard Sanchez, Temecula, CA (US); Doug M. Takehara, Encinitas, CA (US); Ronald K. Hettinger, Oceanside, CA (US); Sang Yi, Carlsbad, CA (US); Richard L. Cleghorn, Oceanside, CA (US); Thomas Orrin Bennett, Carlsbad, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 555 days.

(21) Appl. No.: 17/982,371

(22) Filed: Nov. 7, 2022

(65) Prior Publication Data

US 2023/0064631 A1 Mar. 2, 2023

Related U.S. Application Data

(63) Continuation-in-part of application No. 17/876,455, filed on Jul. 28, 2022, which is a continuation-in-part (Continued)

(51) Int. Cl.

| | |
|---|---|
| ***A63B 53/06*** | (2015.01) |
| ***A63B 53/08*** | (2015.01) |
| *A63B 53/04* | (2015.01) |

(52) U.S. Cl.

CPC ..... *A63B 53/08* (2013.01); *A63B 53/06* (2013.01); *A63B 53/0433* (2020.08); *A63B 53/0466* (2013.01); *A63B 2053/0491* (2013.01)

(58) Field of Classification Search

CPC ..... A63B 2053/0491

(Continued)

(56) References Cited

U.S. PATENT DOCUMENTS

| | | | |
|---|---|---|---|
| 645,942 | A | 3/1900 | Cran |
| 1,213,382 | A | 1/1917 | Kent |

(Continued)

FOREIGN PATENT DOCUMENTS

| | | |
|---|---|---|
| CN | 101970061 | 2/2011 |
| CN | 102281927 | 12/2011 |

(Continued)

OTHER PUBLICATIONS

European Search Report for EP Application 22166630.8 mailed Aug. 25, 2022 (12 pages).

(Continued)

*Primary Examiner* — Alvin A Hunter

(74) *Attorney, Agent, or Firm* — Womble Bond Dickinson (US) LLP

(57) ABSTRACT

A golf club head includes: a body having an outer surface; a recessed channel formed in the outer surface; and a weight assembly including: a weight at least partially disposed within the recessed channel and configured to move therein, the weight including a main body and a protruding tongue, the protruding tongue including a distal tongue portion and a proximal tongue portion, a cover extending at least partially over the recessed channel, having a window cutout shaped and sized to block at least part of the distal tongue portion from moving through the window cutout, and having a slot cutout forming, together with a portion of the window cutout, an opening in the cover that is shaped and sized to allow movement of the distal tongue portion through the opening, and a slot wedge at least partially filling the slot cutout and forming a portion of the window cutout.

19 Claims, 110 Drawing Sheets

Related U.S. Application Data of application No. 17/556,154, filed on Dec. 20, 2021, which is a continuation-in-part of application No. 17/362,488, filed on Jun. 29, 2021, now Pat. No. 11,497,974, which is a continuation-in-part of application No. 17/222,774, filed on Apr. 5, 2021, now Pat. No. 11,439,879, which is a continuation-in-part of application No. 17/122,887, filed on Dec. 15, 2020, now Pat. No. 11,229,827, which is a continuation-in-part of application No. 16/843,640, filed on Apr. 8, 2020, now Pat. No. 10,918,917, which is a continuation-in-part of application No. 16/708,255, filed on Dec. 9, 2019, now Pat. No. 11,090,536, which is a continuation-in-part of application No. 16/535,844, filed on Aug. 8, 2019, now Pat. No. 10,926,143, which is a continuation-in-part of application No. 16/387,859, filed on Apr. 18, 2019, now Pat. No. 10,695,628.

(58) Field of Classification Search
USPC ..... 473/335–339
See application file for complete search history.

(56) References Cited

U.S. PATENT DOCUMENTS 2,155,830 A 4/1939 Howard
2,163,091 A 6/1939 Held
2,460,445 A 2/1949 Bigler
3,199,874 A 8/1965 Blasing
3,610,630 A 10/1971 Glover
4,085,934 A 4/1978 Churchward
4,340,230 A 7/1982 Churchward
5,050,879 A 9/1991 Sun
5,916,042 A 6/1999 Reimers
6,015,354 A 1/2000 Ahn
6,277,032 B1 8/2001 Smith
6,409,612 B1 6/2002 Evans
6,592,468 B2 7/2003 Vincent
6,616,547 B2 9/2003 Vincent
6,648,772 B2 11/2003 Vincent
6,663,505 B1 12/2003 Solari
6,811,496 B2 11/2004 Wahl
6,860,818 B2 3/2005 Mahaffey
6,890,267 B2 5/2005 Mahaffey
6,923,734 B2 8/2005 Meyer
6,988,960 B2 1/2006 Mahaffey
7,083,530 B2 8/2006 Wahl
7,108,609 B2 9/2006 Stites
7,121,956 B2 10/2006 Lo
7,166,041 B2 * 1/2007 Evans ..... A63B 53/0466 473/335
7,309,295 B2 12/2007 Solari
7,530,903 B2 5/2009 Imamoto
7,611,424 B2 * 11/2009 Nagai ..... A63B 60/02 473/335
7,704,163 B2 4/2010 Stites
7,758,451 B2 7/2010 Liang
7,775,905 B2 8/2010 Beach
7,806,782 B2 10/2010 Stites
7,854,667 B2 12/2010 Gillig
7,871,339 B2 1/2011 Sanchez
7,927,231 B2 4/2011 Sato
8,016,694 B2 * 9/2011 Llewellyn ..... A63B 53/04 473/335
8,043,167 B2 10/2011 Boyd
8,057,323 B2 11/2011 Liang
8,142,308 B2 3/2012 Gillig
8,192,303 B2 6/2012 Ban
8,202,175 B2 6/2012 Ban
8,206,243 B2 6/2012 Stites
8,303,433 B2 11/2012 Roach
8,337,325 B2 12/2012 Boyd
8,357,057 B2 1/2013 Stites
8,409,031 B2 4/2013 Stites
8,444,505 B2 5/2013 Beach
8,574,094 B2 11/2013 Nicolette
8,684,863 B2 4/2014 Bezilla
8,690,706 B2 * 4/2014 Stites ..... A63B 53/06 473/335
8,696,491 B1 4/2014 Myers
8,753,226 B2 6/2014 Rice
8,790,195 B1 7/2014 Myers
8,834,294 B1 9/2014 Seluga et al.
8,858,362 B1 10/2014 Leposky
8,870,679 B2 10/2014 Oldknow
8,894,506 B1 11/2014 Myers
8,968,116 B1 3/2015 Myers
8,979,671 B1 3/2015 DeMille
9,067,110 B1 6/2015 Seluga et al.
9,072,949 B2 7/2015 Stites
9,079,080 B2 7/2015 Jetson
9,084,921 B1 * 7/2015 Liang ..... A63B 53/0466
9,095,753 B2 * 8/2015 Bezilla ..... A63B 53/0466
9,174,096 B2 * 11/2015 Sargent ..... A63B 60/00
9,180,349 B1 11/2015 Seluga
9,205,312 B2 * 12/2015 Zimmerman ..... A63B 53/0466
9,211,453 B1 * 12/2015 Foster ..... A63B 53/06
9,238,162 B2 * 1/2016 Breier ..... A63B 60/52
9,259,625 B2 * 2/2016 Sargent ..... A63B 53/045
9,259,627 B1 2/2016 Myers
9,289,660 B1 * 3/2016 Myers ..... A63B 53/0466
9,364,728 B1 6/2016 Myers
9,387,373 B1 7/2016 DeMille
9,387,376 B1 7/2016 Hall
9,387,377 B2 * 7/2016 Liang ..... A63B 60/52
9,421,438 B2 8/2016 Beno
9,440,123 B2 9/2016 Beno
9,440,126 B2 9/2016 Boyd
9,498,686 B2 * 11/2016 Breier ..... A63B 53/06
9,561,413 B2 2/2017 Nielson
9,597,561 B1 3/2017 Seluga
9,597,563 B2 3/2017 Voshall
9,616,301 B2 4/2017 Clausen
9,623,302 B1 * 4/2017 Myers ..... A63B 53/0466
9,630,069 B2 * 4/2017 Foster ..... A63B 53/0466
9,636,553 B1 5/2017 Myers
9,636,556 B2 5/2017 Beck
9,682,296 B1 6/2017 Myers
9,694,256 B2 7/2017 Myers
9,694,261 B2 7/2017 Nunez
9,700,764 B2 * 7/2017 Carter ..... A63B 53/0466
9,700,767 B2 * 7/2017 Zimmerman ..... A63B 60/02
9,707,458 B2 * 7/2017 Luttrell ..... A63B 53/04
9,707,459 B1 7/2017 Myers
9,731,175 B1 8/2017 Myers
9,757,630 B2 9/2017 Mata
9,764,210 B2 * 9/2017 Curtis ..... A63B 53/0466
9,795,846 B2 * 10/2017 Sargent ..... A63B 60/00
9,868,036 B1 1/2018 Kleinert
9,878,223 B2 1/2018 Foster et al.
9,937,392 B2 4/2018 Myers
9,968,833 B2 * 5/2018 Breier ..... A63B 60/52
9,975,019 B2 5/2018 Frame
9,981,165 B2 5/2018 Goudarzi
9,993,703 B2 6/2018 Beck
10,004,956 B2 6/2018 Beck
10,029,161 B2 7/2018 Knutson
10,035,051 B2 7/2018 Cleghorn
10,065,085 B2 9/2018 Seluga
10,065,094 B2 9/2018 Wallin
10,071,293 B2 9/2018 Green
10,092,803 B2 * 10/2018 Cleghorn ..... A63B 53/0466
10,166,444 B1 1/2019 Forshner
10,183,203 B1 1/2019 Yi et al.
10,188,916 B2 * 1/2019 Harbert ..... A63B 60/00
10,213,665 B1 * 2/2019 Day ..... A63B 53/0466
10,258,839 B2 4/2019 Beck
10,391,371 B2 * 8/2019 Luttrell ..... A63B 53/0466
10,398,952 B1 9/2019 Yi et al.
10,543,406 B2 1/2020 Carter
10,556,161 B2 2/2020 Jertson

(56) References Cited

U.S. PATENT DOCUMENTS 10,576,337 B2 3/2020 Soracco
10,596,428 B1* 3/2020 Rumble ..... A63B 60/02
10,646,755 B1 5/2020 Kleinert
10,653,926 B2 5/2020 Story
10,695,628 B1* 6/2020 Yi ..... A63B 53/08
10,864,416 B2* 12/2020 Jertson ..... A63B 53/0466
10,874,914 B2 12/2020 Johnson
10,918,917 B2 2/2021 Northcutt
10,926,143 B2 2/2021 Bennett
11,013,965 B2 5/2021 Story
11,052,294 B2 7/2021 Carter
11,090,536 B2 8/2021 Bennett
11,266,889 B2 3/2022 Bamber
11,406,881 B2 8/2022 Harbert
11,413,509 B2 8/2022 Carter
11,439,877 B2* 9/2022 Northcutt ..... A63B 60/04
11,439,878 B2 9/2022 Bennett
11,439,879 B2 9/2022 Yi
11,497,974 B2 11/2022 Northcutt
11,504,589 B2 11/2022 Tassistro
11,684,830 B2 6/2023 Mizutani
11,691,057 B2 7/2023 Bennett
11,773,232 B2 10/2023 Lindenfelzer et al.
11,813,491 B2 11/2023 Cleghorn
11,819,741 B2 11/2023 Oldknow
11,911,672 B1 2/2024 Hettinger
11,925,841 B2 3/2024 Yi
12,005,327 B2 6/2024 Hettinger
12,070,666 B2 8/2024 Nielson
12,090,377 B2 9/2024 Beach
12,102,895 B2 10/2024 Funaki
12,246,227 B2 3/2025 Bennett
12,415,120 B2 9/2025 Yi et al.
2005/0037864 A1 2/2005 Gilbert
2005/0101408 A1 5/2005 Sanchez
2006/0122004 A1 6/2006 Chen
2006/0240908 A1 10/2006 Adams
2007/0099720 A1 5/2007 Gillig
2007/0135231 A1 6/2007 Lo
2008/0020861 A1 1/2008 Adams
2008/0039228 A1 2/2008 Breier
2008/0146370 A1 6/2008 Beach
2008/0261715 A1* 10/2008 Carter ..... A63B 53/047
473/335
2009/0215551 A1 8/2009 Liang
2010/0075773 A1 3/2010 Casati
2010/0331103 A1* 12/2010 Takahashi ..... A63B 53/0466
473/345
2011/0081987 A1 4/2011 Gilig
2011/0250985 A1 10/2011 Stites
2013/0165254 A1 6/2013 Rice et al.
2013/0296070 A1* 11/2013 Stites ..... A63B 53/0466
473/324
2013/0324299 A1 12/2013 Clausen
2014/0038746 A1 2/2014 Beach
2014/0080628 A1* 3/2014 Sargent ..... A63B 53/02
473/336
2014/0080629 A1 3/2014 Sargent
2014/0113741 A1 4/2014 Bezilla
2015/0038258 A1 2/2015 Beach
2015/0072802 A1 3/2015 Myers
2015/0297962 A1* 10/2015 Cleghorn ..... A63B 53/0466
473/337
2015/0306473 A1* 10/2015 Breier ..... A63B 53/06
473/409
2015/0306474 A1* 10/2015 Breier ..... A63B 53/0466
473/332
2015/0306475 A1* 10/2015 Curtis ..... A63B 53/06
473/345
2015/0314176 A1* 11/2015 Liang ..... A63B 53/0466
473/336
2015/0321055 A1 11/2015 Golden
2016/0074716 A1 3/2016 Roach
2016/0089583 A1* 3/2016 Breier ..... A63B 60/52
473/409
2016/0129323 A1 5/2016 Myers
2016/0236048 A1 8/2016 Clausen
2016/0271464 A1 9/2016 Murphy
2017/0072278 A1* 3/2017 Breier ..... A63B 60/52
2017/0173422 A1* 6/2017 Foster ..... A63B 60/52
2017/0304690 A1* 10/2017 Carter ..... A63B 53/0466
2017/0361185 A1 12/2017 Henrikson
2018/0056154 A1 3/2018 Wallin
2018/0065005 A1 3/2018 Cleghorn
2018/0345093 A1* 12/2018 Harbert ..... A63B 53/0466
2019/0009146 A1* 1/2019 Luttrell ..... A63B 53/0466
2019/0022481 A1 1/2019 Mine
2019/0060718 A1 2/2019 Milleman
2019/0083862 A1 3/2019 Jertson
2019/0105544 A1 4/2019 Carter
2019/0118050 A1 4/2019 Cleghorn
2019/0176001 A1 6/2019 Jertson
2019/0192928 A1 6/2019 Soracco
2019/0329106 A1 10/2019 Luttrell
2020/0330834 A1 10/2020 Northcutt
2020/0330835 A1 10/2020 Bennett
2020/0330836 A1 10/2020 Bennett
2021/0128994 A1 5/2021 Yi
2021/0138318 A1* 5/2021 Northcutt ..... A63B 53/0466
2021/0138319 A1 5/2021 Bennett
2021/0178235 A1 6/2021 Halberg et al.
2021/0299525 A1* 9/2021 Mizutani ..... A63B 53/04
2021/0402270 A1 12/2021 Bennett
2022/0111263 A1 4/2022 Yi
2022/0241655 A1 8/2022 Funaki et al.
2022/0379180 A1* 12/2022 Hettinger ..... A63B 53/047
2023/0064631 A1* 3/2023 Sanchez ..... A63B 60/04
2023/0072814 A1 3/2023 Hettinger et al.
2023/0083855 A1 3/2023 Hettinger et al.
2023/0233911 A1* 7/2023 Carr ..... A63B 60/02
473/335
2023/0233912 A1* 7/2023 Yi ..... A63B 53/08
473/335
2023/0271066 A1 8/2023 Mizutani
2023/0285817 A1 9/2023 Bennett
2023/0330499 A1 10/2023 Yi
2023/0338794 A1 10/2023 Hettinger
2023/0347214 A1 11/2023 Cornelius et al.
2024/0066366 A1 2/2024 Yi
2024/0066367 A1 2/2024 Hettinger
2024/0066368 A1 2/2024 Ines
2024/0157206 A1 5/2024 Hettinger
2024/0189675 A1 6/2024 Funaki et al.
2024/0226673 A1 7/2024 Cleghorn
2024/0299814 A1 9/2024 Sugimae et al.
2024/0316420 A1 9/2024 Yi
2024/0316422 A1 9/2024 Yi
2024/0359064 A1 10/2024 Hettinger
2025/0025755 A1 1/2025 Yi

FOREIGN PATENT DOCUMENTS

CN 113491863 10/2021
CN 215841488 2/2022
CN 115245667 10/2022
CN 118217607 6/2024
EP 4070863 10/2022
EP 4070863 A1* 10/2022 ..... A63B 60/04
EP 4400184 7/2024
FR 2581320 11/1986
GB 1387955 3/1975
GB 2094158 9/1982
GB 2327889 2/1999
GB 2407781 5/2005
JP 01043278 2/1989
JP 2729760 3/1998
JP 2002011124 1/2002
JP 2005058765 3/2005
JP 2005296582 10/2005
JP 2005323978 11/2005
JP 2006320493 11/2006
JP 2007319687 12/2007

(56) References Cited

FOREIGN PATENT DOCUMENTS

| | | | | |
|---|---|---|---|---|
| JP | 2008173314 | | 7/2008 | |
| JP | 2008194454 | | 8/2008 | |
| JP | 2010069106 | | 4/2010 | |
| JP | 2010136772 | | 6/2010 | |
| JP | 2010148702 | | 7/2010 | |
| JP | 2010252964 | | 11/2010 | |
| JP | 2011005011 | | 1/2011 | |
| JP | 2011092763 | | 5/2011 | |
| JP | 2012125291 | | 7/2012 | |
| JP | 2012139450 | | 7/2012 | |
| JP | 2014223548 | | 12/2014 | |
| JP | 2015036097 | | 2/2015 | |
| JP | 2016179061 | | 10/2016 | |
| JP | 2017080387 | | 5/2017 | |
| JP | 2019000664 | | 1/2019 | |
| JP | 2019042192 | | 3/2019 | |
| JP | 2020175196 | | 10/2020 | |
| JP | 2021079086 | | 5/2021 | |
| JP | 2021151381 | | 9/2021 | |
| JP | 2021151381 | A * | 9/2021 | ..... A63B 53/04 |
| JP | 2022160000 | | 10/2022 | |
| JP | 2023091773 | | 6/2023 | |
| JP | 2024035113 | | 3/2024 | |
| JP | 7483475 | | 5/2024 | |
| JP | 3246905 | | 6/2024 | |
| JP | 3249412 | | 12/2024 | |
| KR | 19990076463 | | 10/1999 | |
| KR | 20060023226 | | 3/2006 | |
| KR | 20110033462 | | 3/2011 | |
| KR | 20130005384 | | 1/2013 | |
| KR | 101401409 | | 5/2014 | |
| KR | 20160121568 | | 10/2016 | |
| KR | 20200039768 | | 4/2020 | |
| KR | 20220138878 | | 10/2022 | |
| KR | 20230094163 | | 10/2022 | |
| KR | 20240001700 | | 10/2024 | |
| TW | M306126 | | 2/2007 | |
| TW | 201538208 | | 10/2015 | |
| WO | 0243819 | | 6/2002 | |
| WO | 2007044220 | | 4/2007 | |
| WO | 2015123661 | | 8/2015 | |
| WO | 2017205699 | A1 | 11/2017 | |
| WO | 2017025699 | | 2/2019 | |
| WO | 2019035912 | | 2/2019 | |
| WO | 2021012002 | | 1/2021 | |
| WO | 2020132512 | | 2/2021 | |

OTHER PUBLICATIONS

First Office Action Search Report for CN Application No. 2021103693793 mailed May 22, 2025 (8 pages).

"MuCell", Techniplas, Available at: https://web.archive.org/web/20230604001956/https://www.techniplas.com/technology/mucell/, Jun. 4, 2023, 2 pages.

* cited by examiner

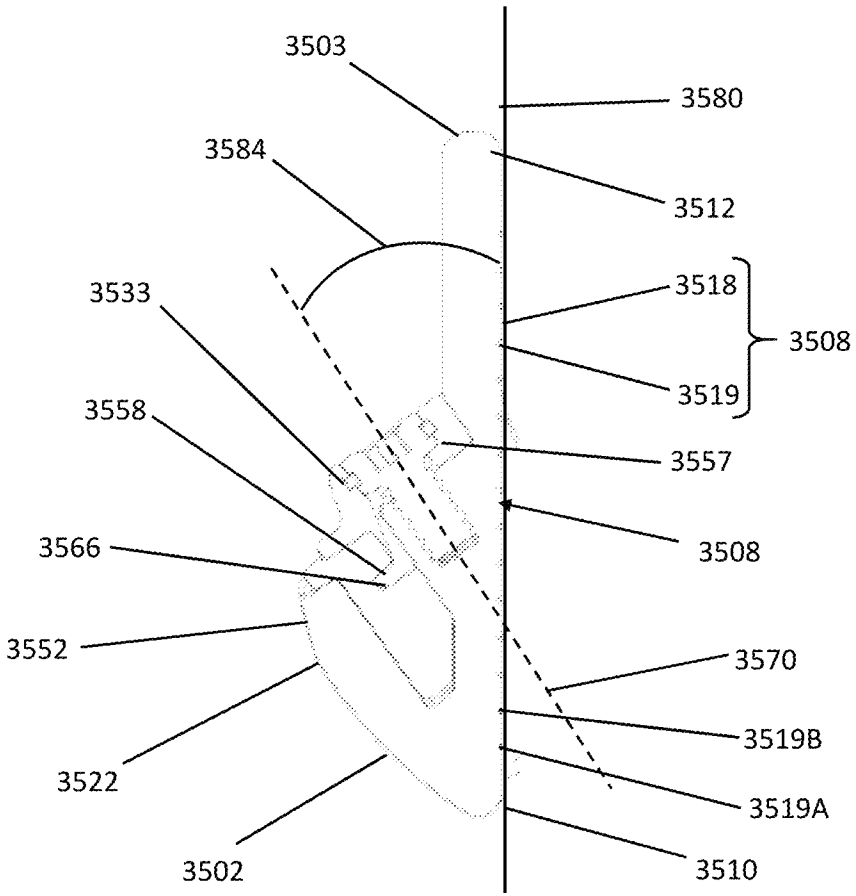
FIG. 111
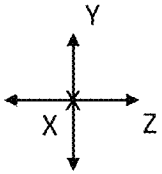

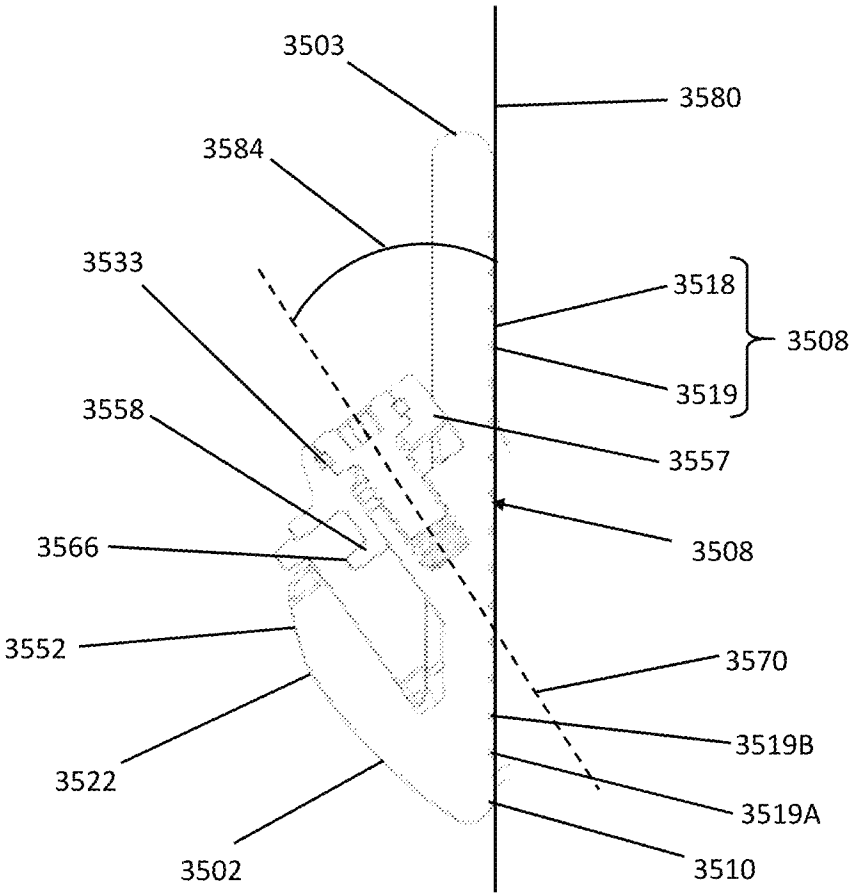
FIG. 112
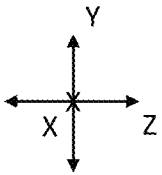

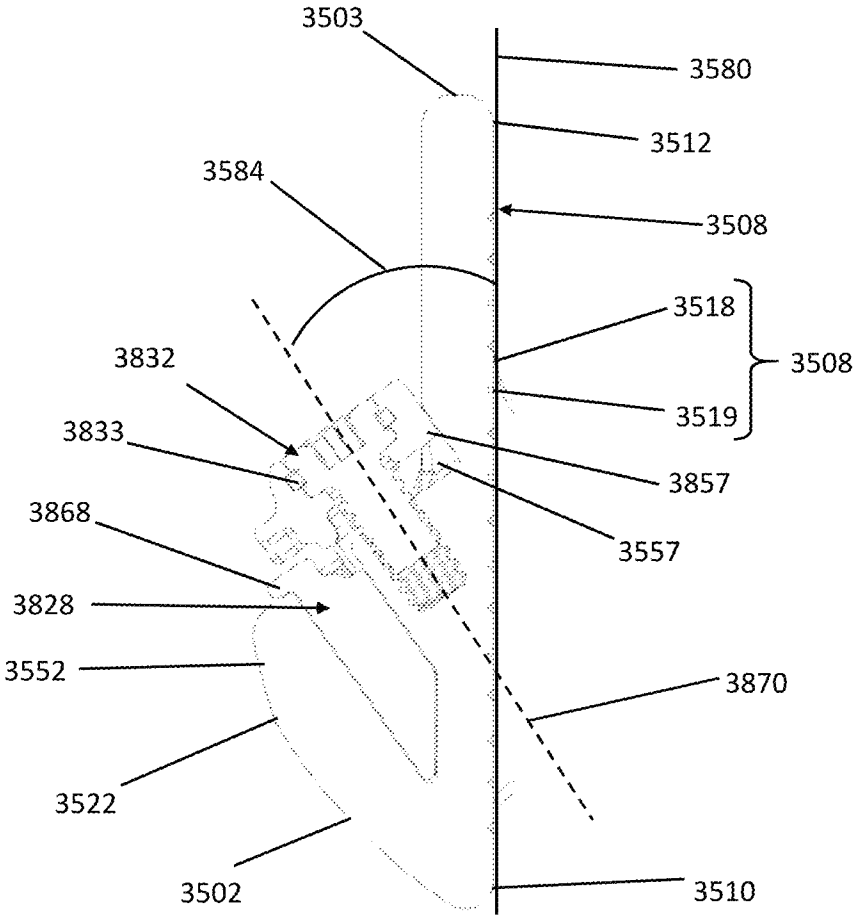
FIG. 120
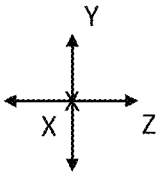

4368: 4368D, 4368P

GOLF CLUB HAVING AN ADJUSTABLE WEIGHT ASSEMBLY

CROSS-REFERENCE TO RELATED APPLICATIONS

This application is a continuation-in-part of U.S. patent application Ser. No. 17/876,455, filed Jul. 28, 2022, which is a continuation-in-part of U.S. patent application Ser. No. 17/556,154, filed Dec. 20, 2021, which is a continuation-in-part of U.S. patent application Ser. No. 17/362,488, filed Jun. 29, 2021, which is a continuation-in-part of U.S. patent application Ser. No. 17/222,774, filed Apr. 5, 2021, now U.S. Pat. No. 11,439,879, which is a continuation-in-part of U.S. patent application Ser. No. 17/122,887, filed Dec. 15, 2020, now U.S. Pat. No. 11,229,827, which is a continuation-in-part of U.S. patent application Ser. No. 16/843,640, filed Apr. 8, 2020, now U.S. Pat. No. 10,918,917, which is a continuation-in-part of U.S. patent application Ser. No. 16/708,255, filed Dec. 9, 2019, now U.S. Pat. No. 11,090,536, which is a continuation-in-part of U.S. patent application Ser. No. 16/535,844, filed Aug. 8, 2019, now U.S. Pat. No. 10,926,143, which is a continuation-in-part of U.S. patent application Ser. No. 16/387,859, filed Apr. 18, 2019, now U.S. Pat. No. 10,695,628, and which are hereby incorporated by reference in their entireties. To the extent appropriate, the present application claims priority to the above-referenced applications.

BACKGROUND

The flight characteristics of a golf ball after being struck by a golf club are dependent not only on the swing of the golf club but also on the golf club itself. For example, flight characteristics of the golf ball, such as fades, draws, launch angles, ball spin, and speed are impacted by the design of the golf club. By adjusting one or more design properties of the golf club, the flight characteristics of the golf ball can be improved, thereby increasing golf club performance. In some examples, adjusting a center of gravity (CG) and/or a moment of inertia (MOI) of a head of the golf club through selective weight placement impacts the flight characteristics of the golf ball. However, these adjustable weights need to be both securely attached to the golf club head and selectively moveable. As such, improvements to adjustable weight assemblies for golf club heads are desired.

SUMMARY

In an aspect, the technology relates to a golf club head including: a body having an outer surface; a recessed channel formed in the outer surface; and a weight assembly including: a weight at least partially disposed within the recessed channel and configured to move therein, the weight including a main body and a protruding tongue, the protruding tongue including a distal tongue portion and a proximal tongue portion extending between the main body and the distal tongue portion, a cover extending at least partially over the recessed channel and the main body, having a window cutout shaped and sized to block at least part of the distal tongue portion from moving through the window cutout, and having a slot cutout forming, together with a portion of the window cutout, an opening in the cover that is shaped and sized to allow movement of the distal tongue portion through the opening, a slot wedge at least partially filling the slot cutout and forming a portion of the window cutout, and a fastener coupling the cover to the body, wherein at least part of the proximal tongue portion extends through the window cutout.

In an example, the slot wedge is fitted into the slot cutout via at least one of a force fit, a snap fit, an adhesive, or a fastener. In an example, the window cutout extends along a toe-heel direction and the slot cutout extends from the window cutout in a direction different from the toe-heel direction. In an example, the protruding tongue forms at least part of a groove of the weight, and the weight is configured to slidingly engage with the cover via the groove. In an example, the protruding tongue is integrally formed with the main body. In an example, the fastener is adapted to retain the weight in the recessed channel only indirectly by the cover. In an example, cover is positionable in at least an unlocked configuration whereby the cover is raised at least partially out of the recessed channel and the weight is selectively movable within the recessed channel, and a locked configuration whereby the cover is at least partially disposed within the recessed channel and the weight is secured within the recessed channel. In an example, the weight engages with the cover via the protruding tongue so that the weight moves with the cover between the locked configuration and the unlocked configuration. In an example, between about 0% and about 30% of an outer surface of the weight is visible in the locked configuration.

In another aspect, the technology relates to a golf club head including: a body having an outer surface; a recessed channel formed in the outer surface; and a weight assembly including: a weight at least partially disposed within the recessed channel and configured to move therein, the weight including a main body and a protruding tongue that is couplable to the main body, the protruding tongue including a distal tongue portion and a proximal tongue portion that, when the protruding tongue is coupled to the main body, extends between the main body and the distal tongue portion, a cover extending at least partially over the recessed channel and the main body, and having a window cutout shaped and sized to block at least part of the distal tongue portion from moving through the window cutout when the protruding tongue is coupled to the main body, and a fastener coupling the cover to the body, wherein at least part of the proximal tongue portion extends through the window cutout when the protruding tongue is coupled to the main body.

In an example, the protruding tongue is couplable to the main body via at least one of a force fit, a snap fit, an adhesive, or a fastener. In an example, the protruding tongue, when coupled to the main body, forms at least part of a groove of the weight, and the weight is configured to slidingly engage with the cover via the groove. In an example, the fastener is adapted to retain the weight in the recessed channel only indirectly by the cover. In an example, the fastener is controllably movable along a fastener axis, and the cover is coupled to the fastener so that the cover moves with the fastener in response to the fastener moving along the fastener axis. In an example, the cover is positionable in at least an unlocked configuration whereby the cover is raised at least partially out of the recessed channel and the weight is selectively movable within the recessed channel, and a locked configuration whereby the cover is at least partially disposed within the recessed channel and the weight is secured within the recessed channel, and, when the protruding tongue is coupled to the main body, the weight is coupled to the cover so that the weight moves with the cover in response to the cover moving between the unlocked configuration and the locked configuration.

In another aspect, the technology relates to a golf club head including: a body having an outer surface; a recessed channel formed in the outer surface; a slide panel protruding into and at least partially through the recessed channel from at least one surface of the recessed channel; and a weight assembly including: a weight at least partially disposed within the recessed channel and configured to move therein, a cover adapted to releasably secure the weight within the recessed channel and to slide along the slide panel, and a fastener coupling the cover to the body.

In an example, the fastener is adapted to retain the weight in the recessed channel only indirectly by the cover. In an example, the weight is slidingly engaged with the cover so that the weight moves with the cover in response to the cover sliding along the slide panel, and at least a portion of the weight and a portion of the cover are positioned on opposite sides of the slide panel. In an example, the cover has a window cutout, the weight has a weight opening, and the cover is positionable in at least: an unlocked configuration whereby the cover is raised at least partially out of the recessed channel, the weight opening is at least partially exposed through the window cutout, and the weight is controllably slidable relative to the cover; and a locked configuration whereby the cover is at least partially disposed within the recessed channel, the slide panel is positioned at least partially between the weight opening and the window cutout, and the weight is secured within the recessed channel. In an example, the weight is configured to slide relative to the cover along a first direction, and the cover is adapted to slide relative to the slide panel along a second direction different from the first direction.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

FIG. 111 is a cross-sectional view in the toe-to-heel direction of the golf club head of FIG. 105 taken along line 110*a*-110*a* in FIG. 110 and with the weight assembly in the locked configuration.

FIG. 112 is a cross-sectional view in the toe-to-heel direction of the golf club head of FIG. 105 taken along line 110*a*-110*a* in FIG. 110 and with the weight assembly in the unlocked configuration.

FIG. 119 is cross-sectional view in the toe-to-heel direction of the golf club head of FIG. 116 taken along line 116*a*-116*a* and when the weight assembly is in the locked configuration.

FIG. 120 is cross-sectional view in the toe-to-heel direction of the golf club head of FIG. 116 taken along line 116*a*-116*a* and when the weight assembly is in the unlocked configuration.

FIG. 121 is a back view of a golf club head with another weight assembly in the locked configuration.

FIG. 122 is another back view of the golf club head of FIG. 121 when the weight assembly is in the unlocked configuration.

FIG. 123 is a perspective view of the golf club head of FIG. 121 when the weight assembly is in the unlocked configuration.

FIG. 124 is a partially exploded, perspective view of the golf club head of FIG. 121.

FIG. 125 is a cross-sectional view in the toe-to-heel direction of the golf club head of FIG. 121 along line 121*a*-121*a* and when the weight configuration is in the locked configuration.

FIG. 126 is a cross-sectional view of the golf club head of FIG. 121 along line 121*a*-121*a* and when the weight configuration is in the unlocked configuration.

FIG. 127 is a back view of a golf club head with another weight assembly in the locked configuration.

FIG. 128 is a front view of the golf club head of FIG. 127.

FIG. 129 is a perspective back view of the golf club head of FIG. 127 when the weight assembly is in the locked configuration.

FIG. 130 is a perspective back view of a golf club head without a weight assembly.

Figure 127:
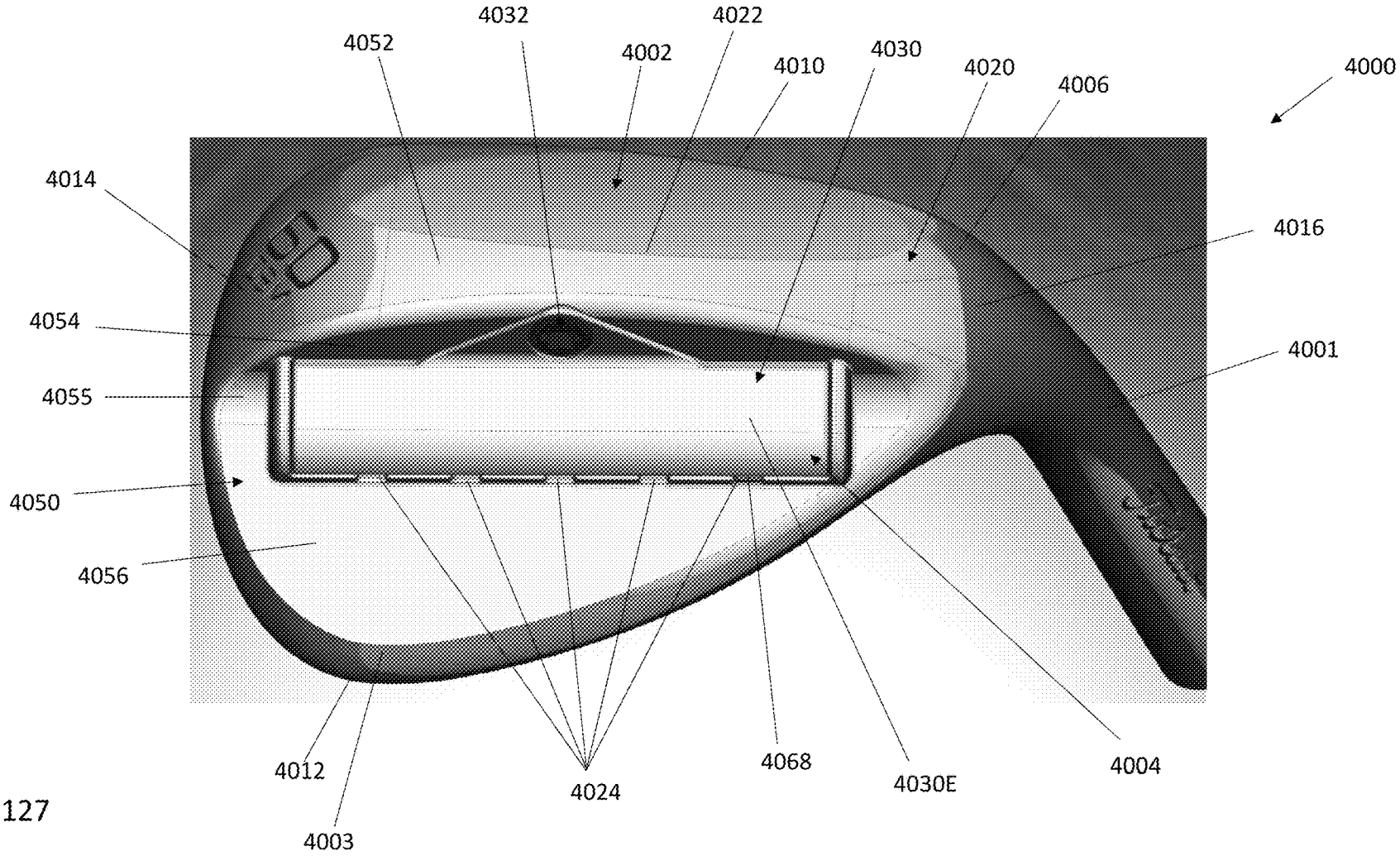
Figure 131:
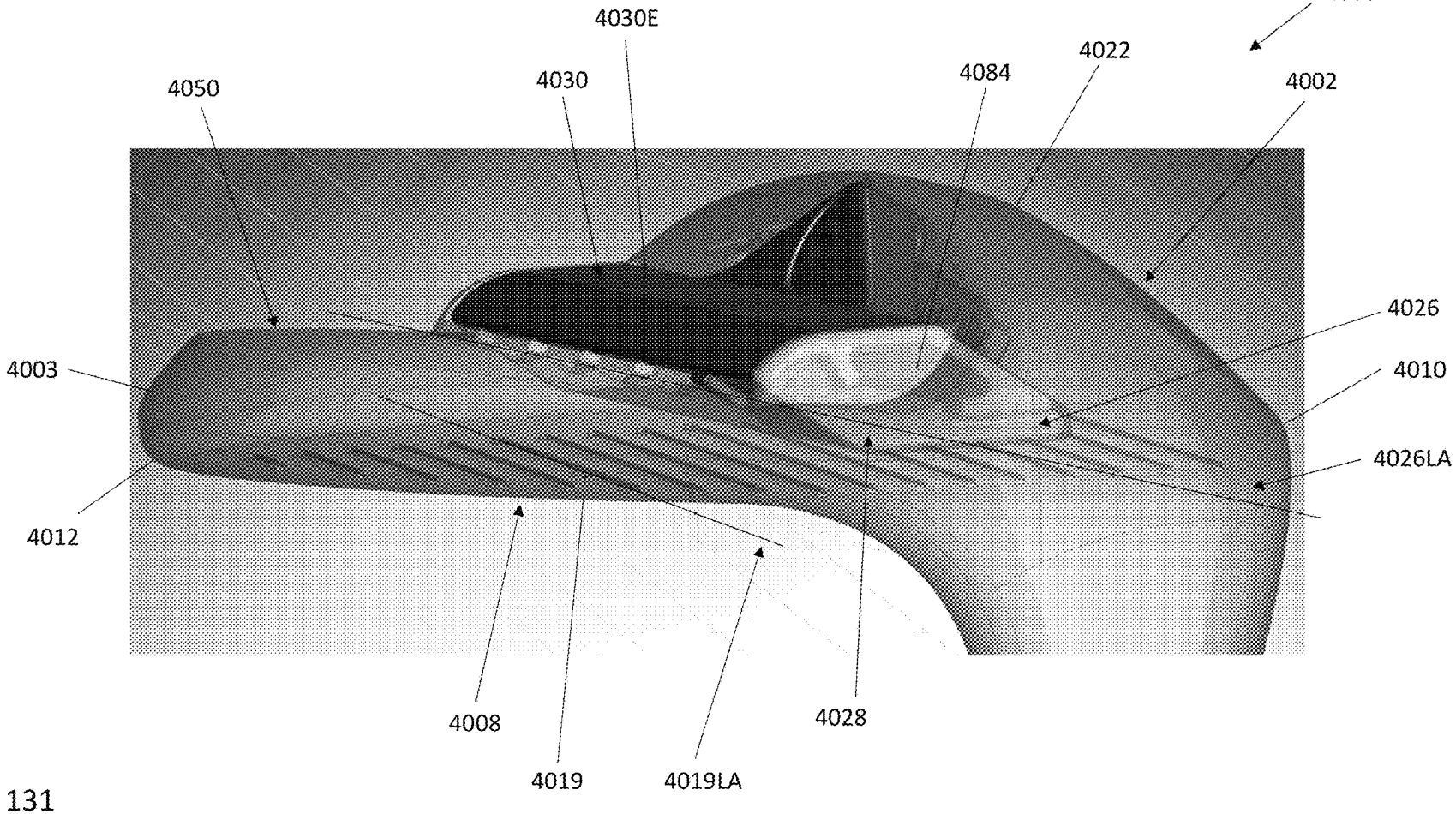

FIG. 131 is a partially transparent perspective view of the golf club head of FIG. 127 when the weight assembly is in the locked configuration.

Figure 132:
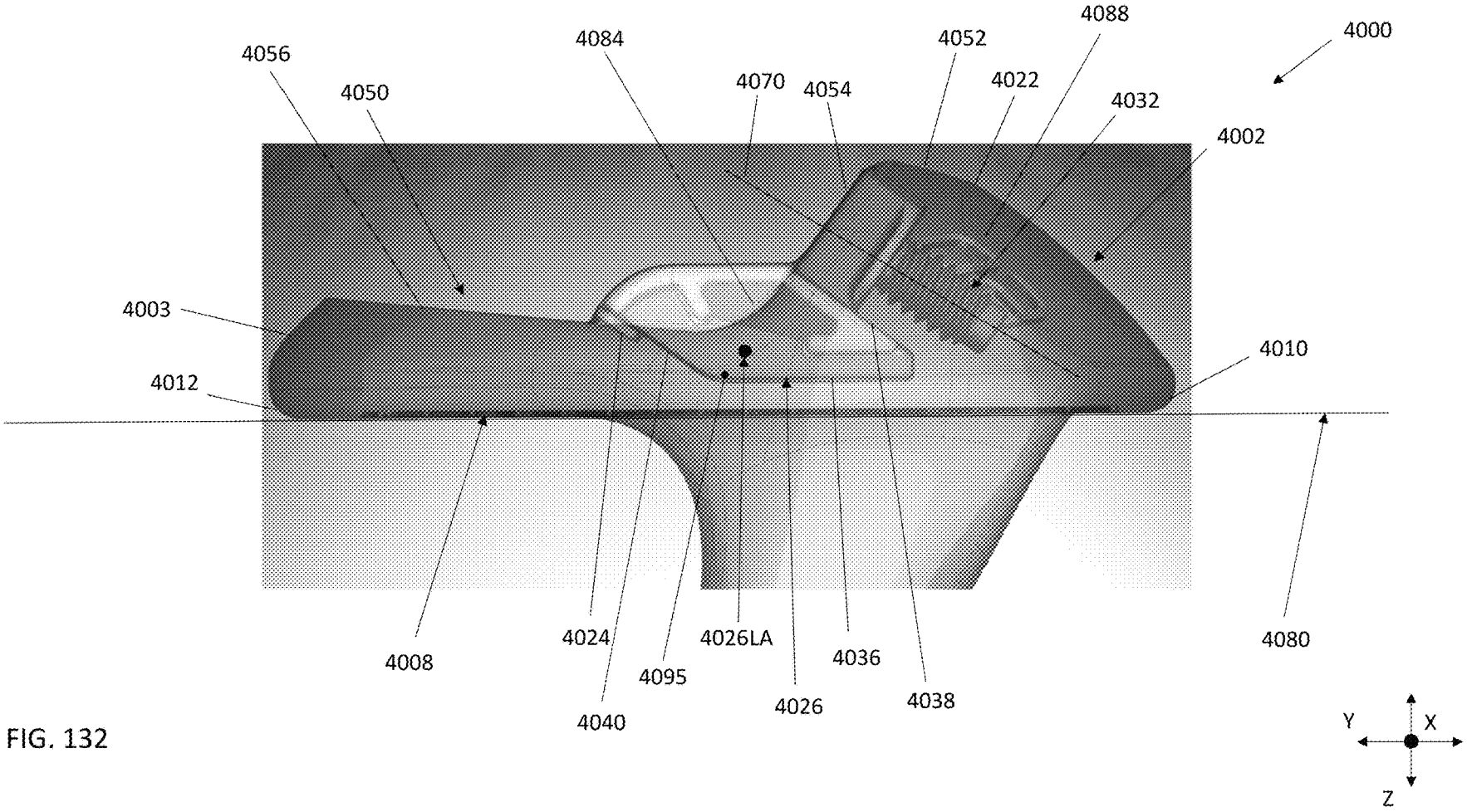

FIG. 132 is a partially transparent side view of the golf club head of FIG. 127 in a heel-to-toe direction when the weight assembly is in the locked configuration.

Figure 133:
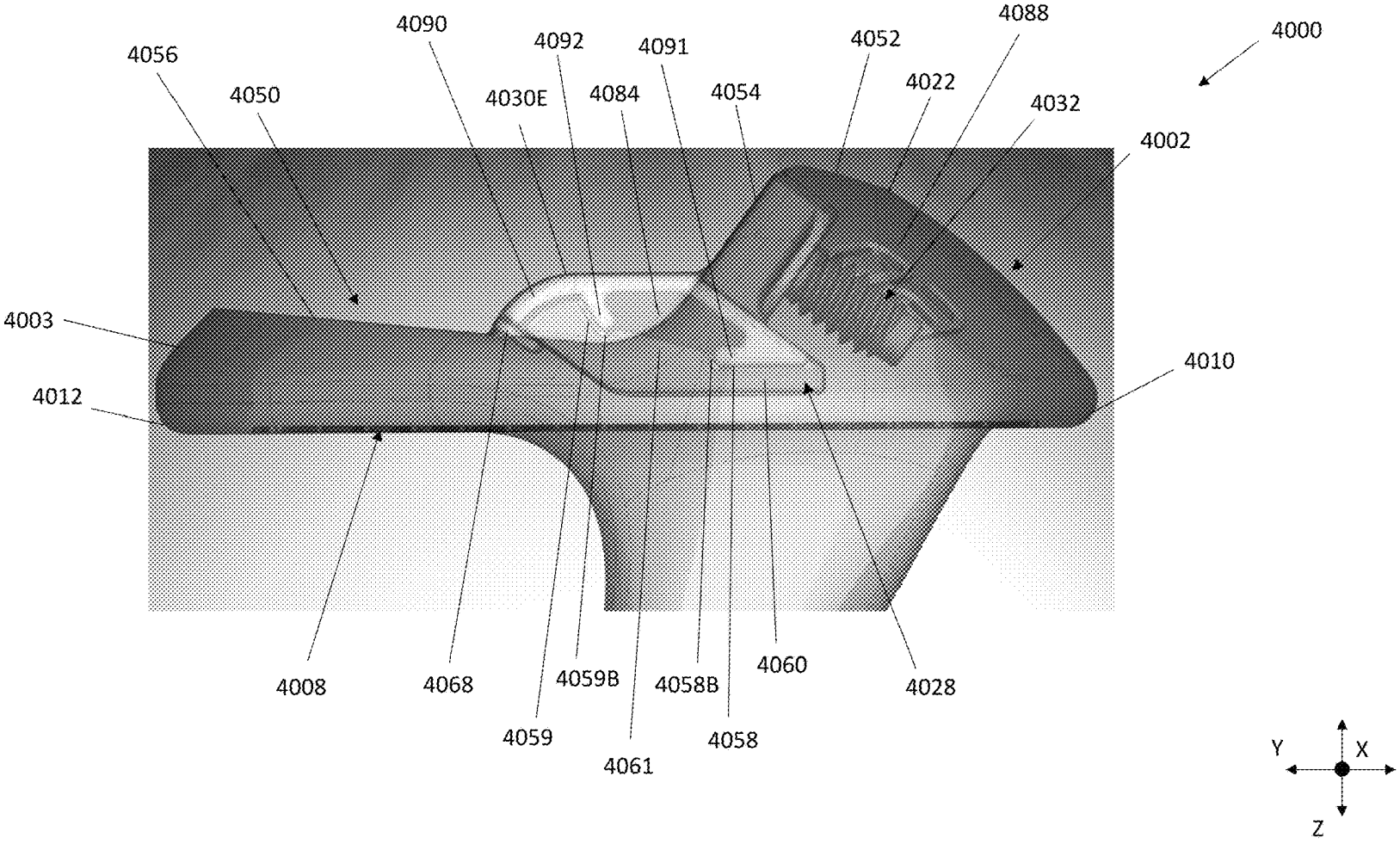

FIG. 133 is another partially transparent side view of the golf club head of FIG. 127 in the heel-to-toe direction when the weight assembly is in the locked configuration.

Figure 134:
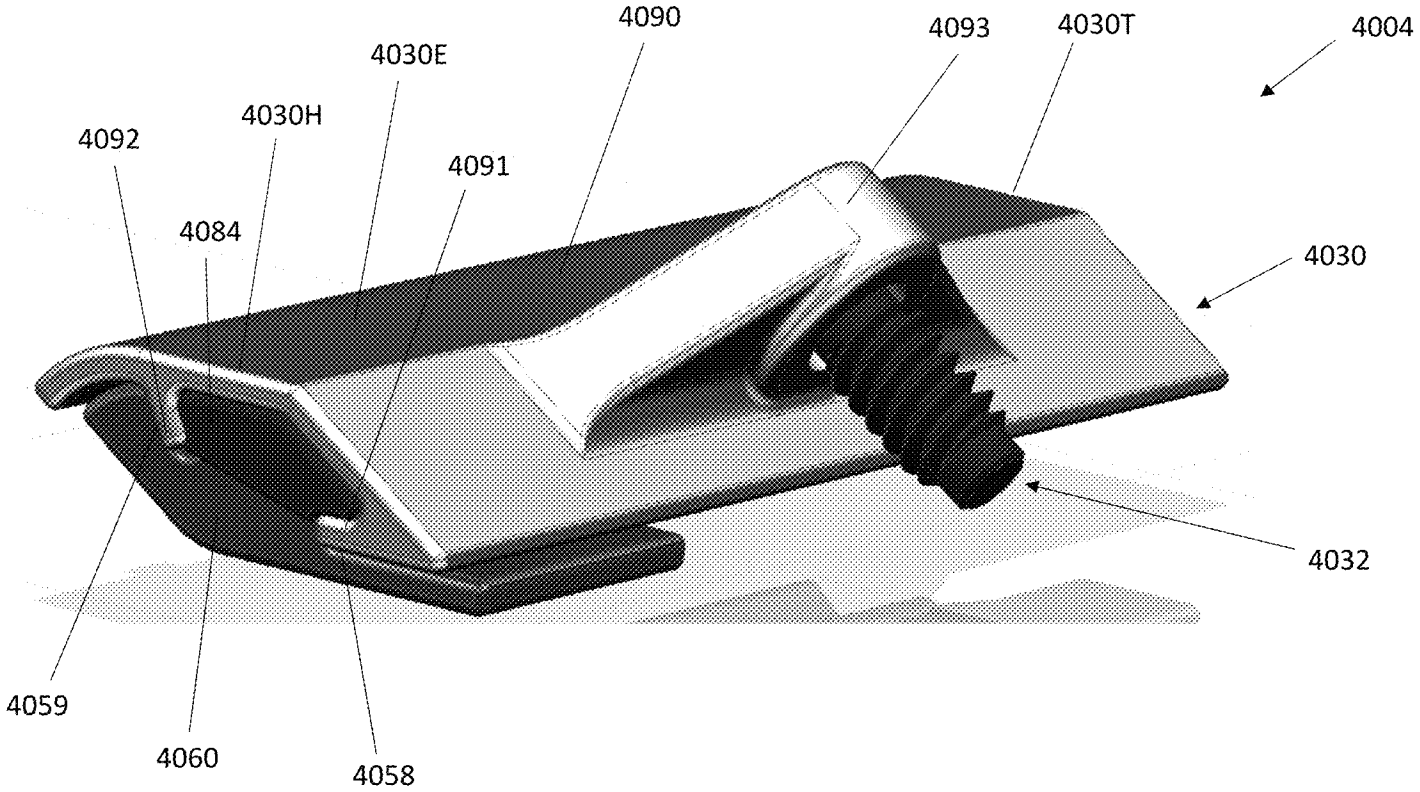

FIG. 134 is a perspective view of the weight assembly of the golf club head of FIG. 127.

Figure 135:
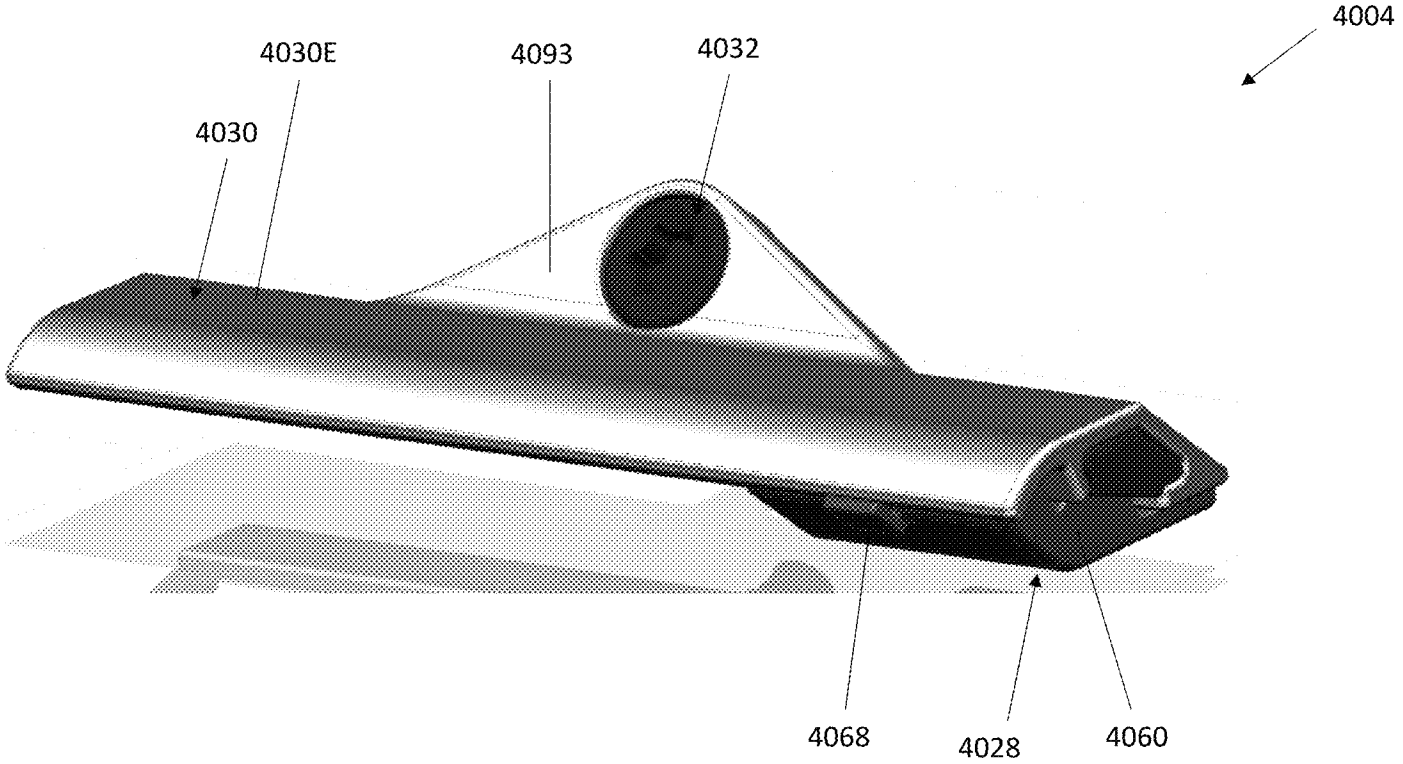

FIG. 135 is a perspective view of the weight assembly of the golf club head of FIG. 127.

Figure 136:
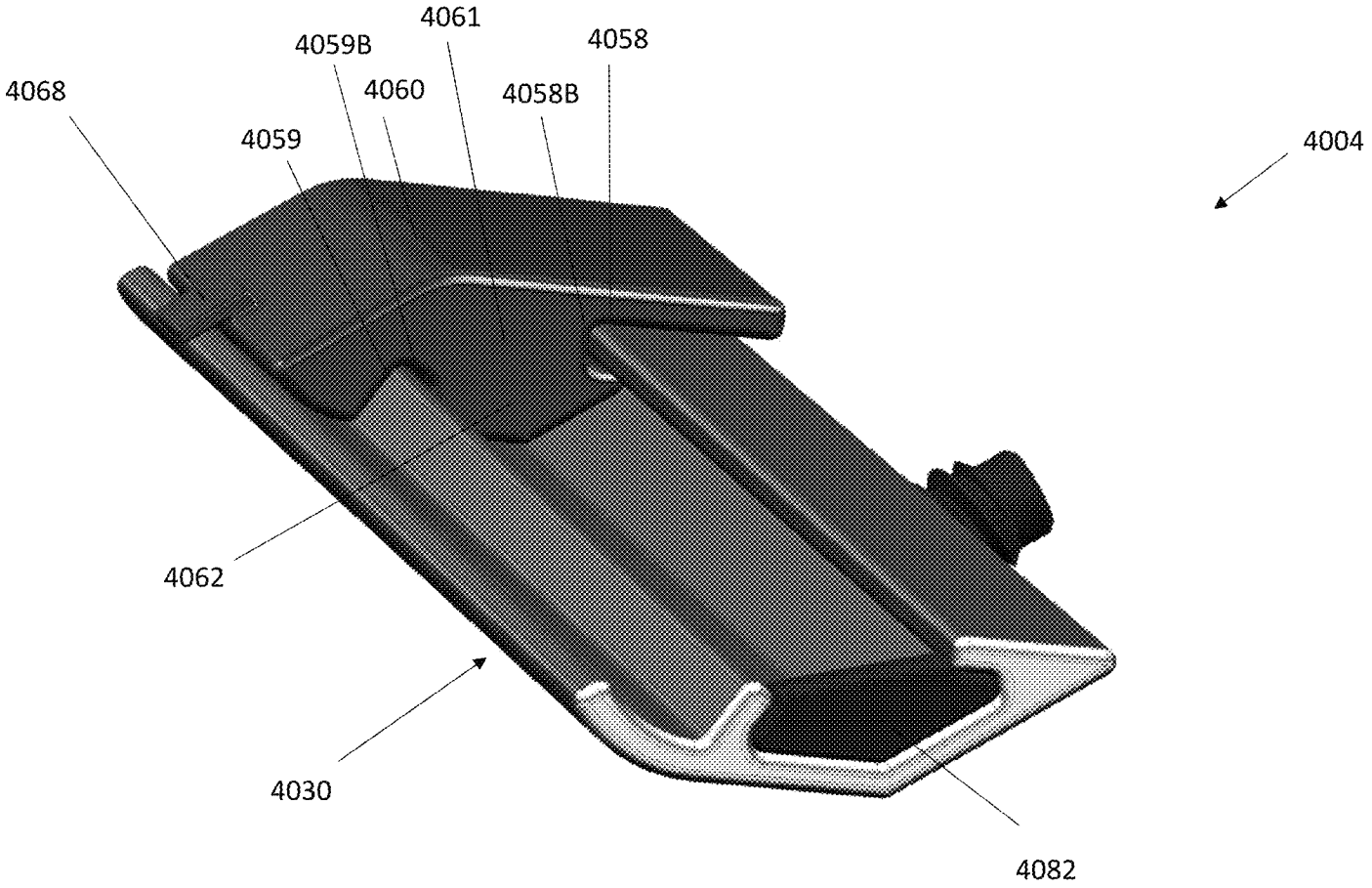

FIG. 136 is a perspective view of the weight assembly of the golf club head of FIG. 127.

Figure 137:
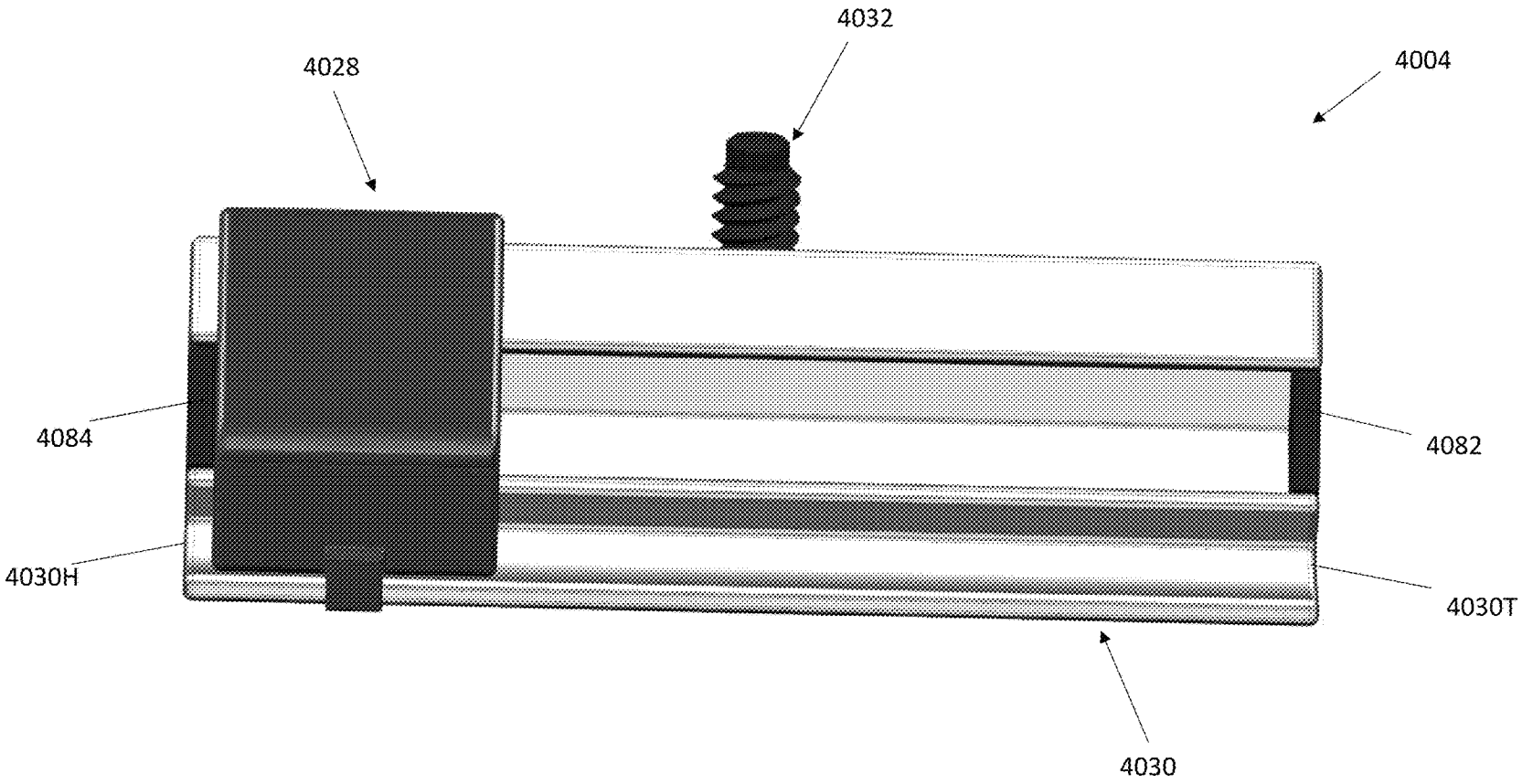

FIG. 137 is a perspective view of the weight assembly of the golf club head of FIG. 127.

Figure 138:
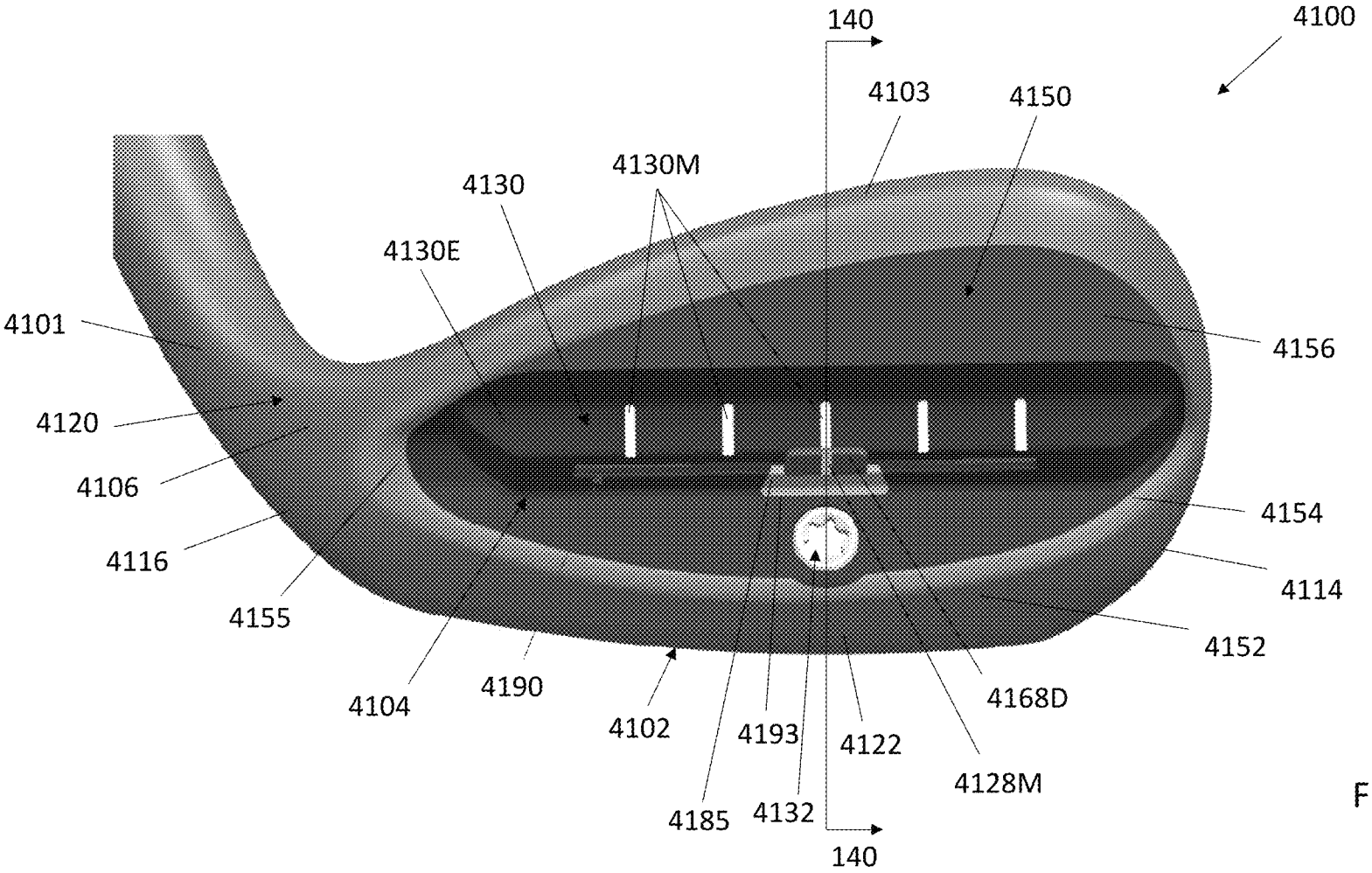

FIG. 138 is a back perspective view of a golf club head with another weight assembly in a locked configuration.

Figure 139:
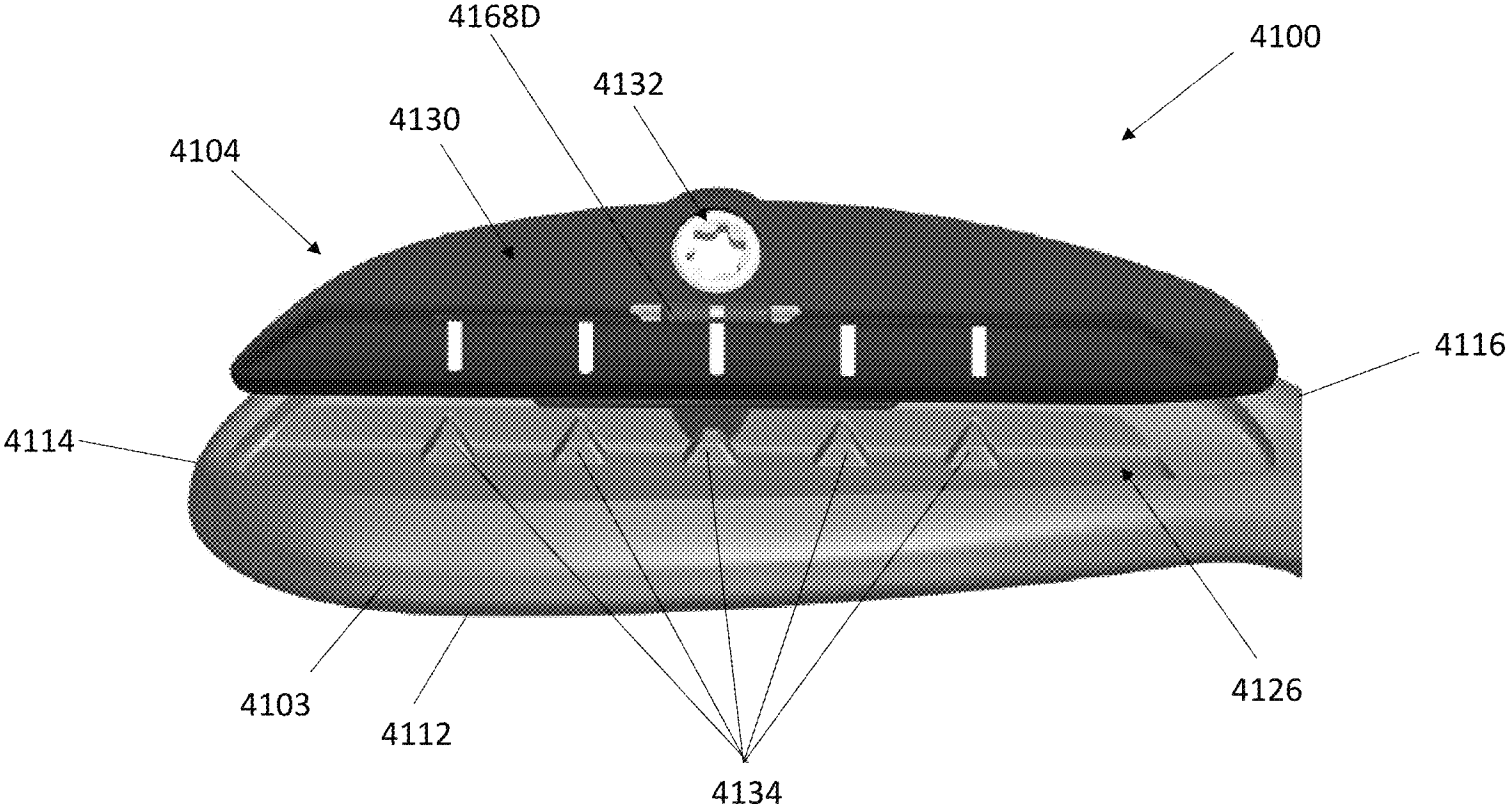

FIG. 139 is a top-down perspective view of the golf club head of FIG. 138 with the weight assembly in an unlocked configuration.

Figure 140:
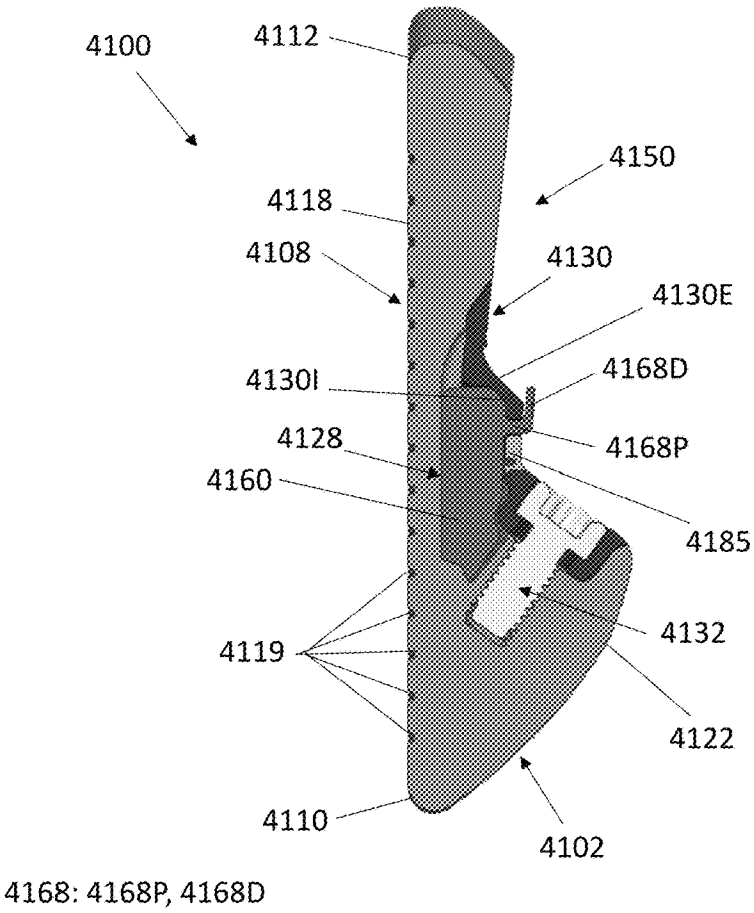

FIG. 140 is a heel-to-toe cross-sectional view of the golf club head of FIG. 138 along line 140-140 in FIG. 138, when the weight assembly is in the locked configuration.

Figure 141:
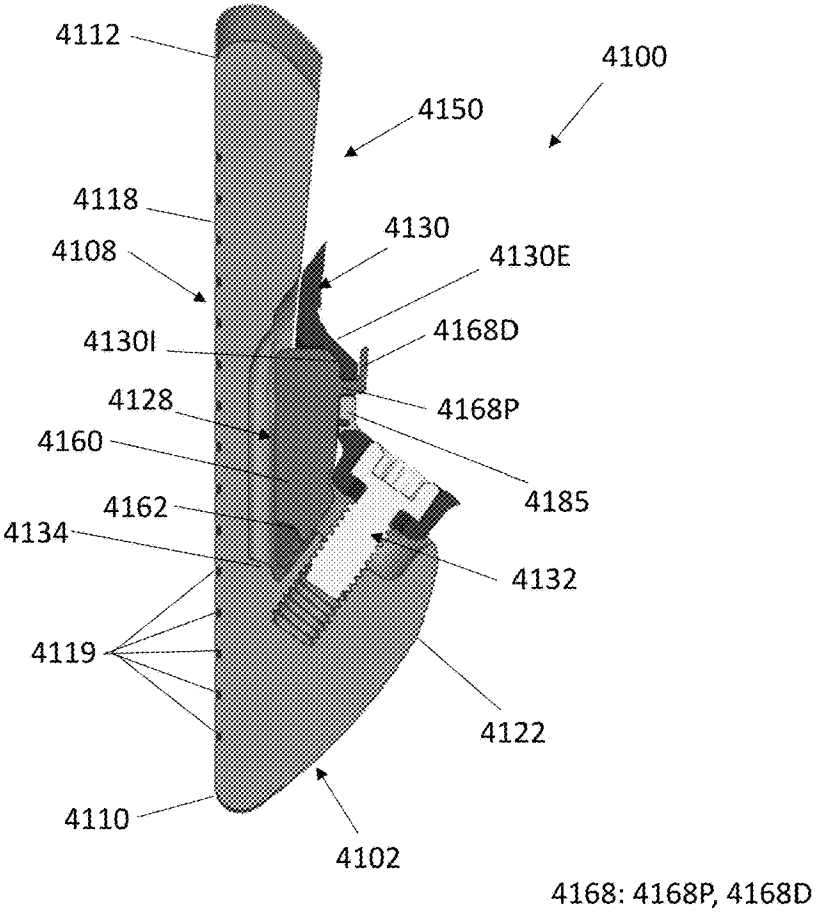

FIG. 141 is another heel-to-toe cross-sectional view of the golf club head of FIG. 138 along the line 140-140 in FIG. 138, when the weight assembly is in the unlocked configuration.

Figure 142:
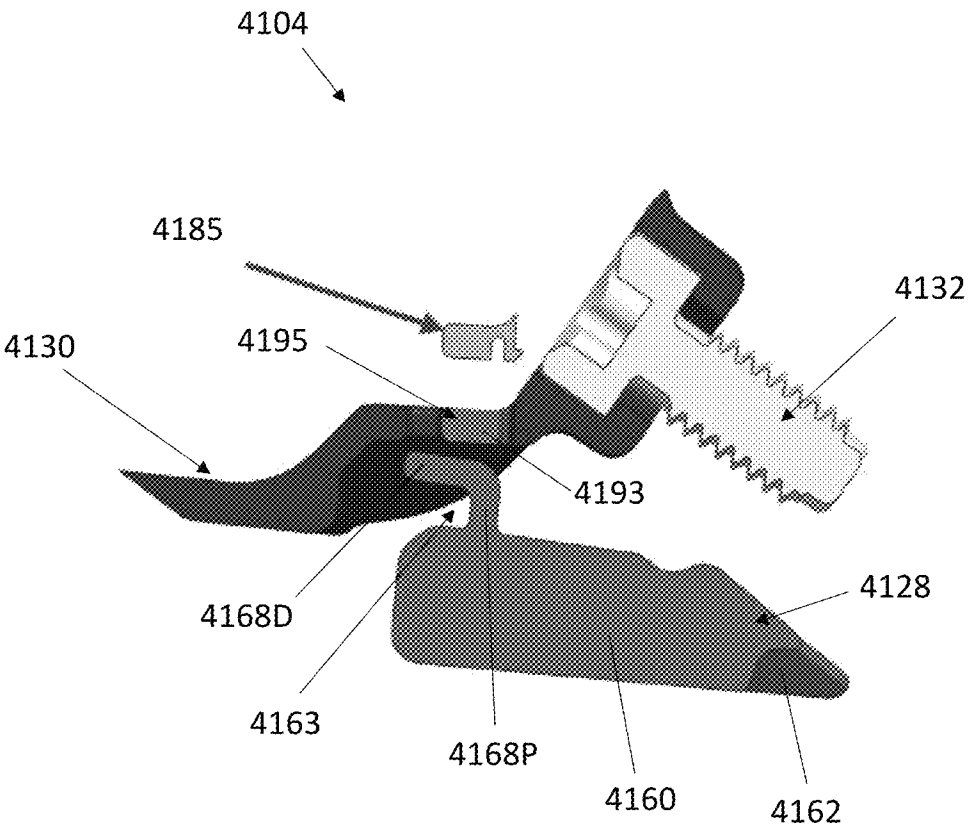

FIG. 142 is a rotated heel-to-toe cross-sectional view of a weight assembly of the golf club head of FIG. 138 along the line 140-140 in FIG. 138.

Figure 143:
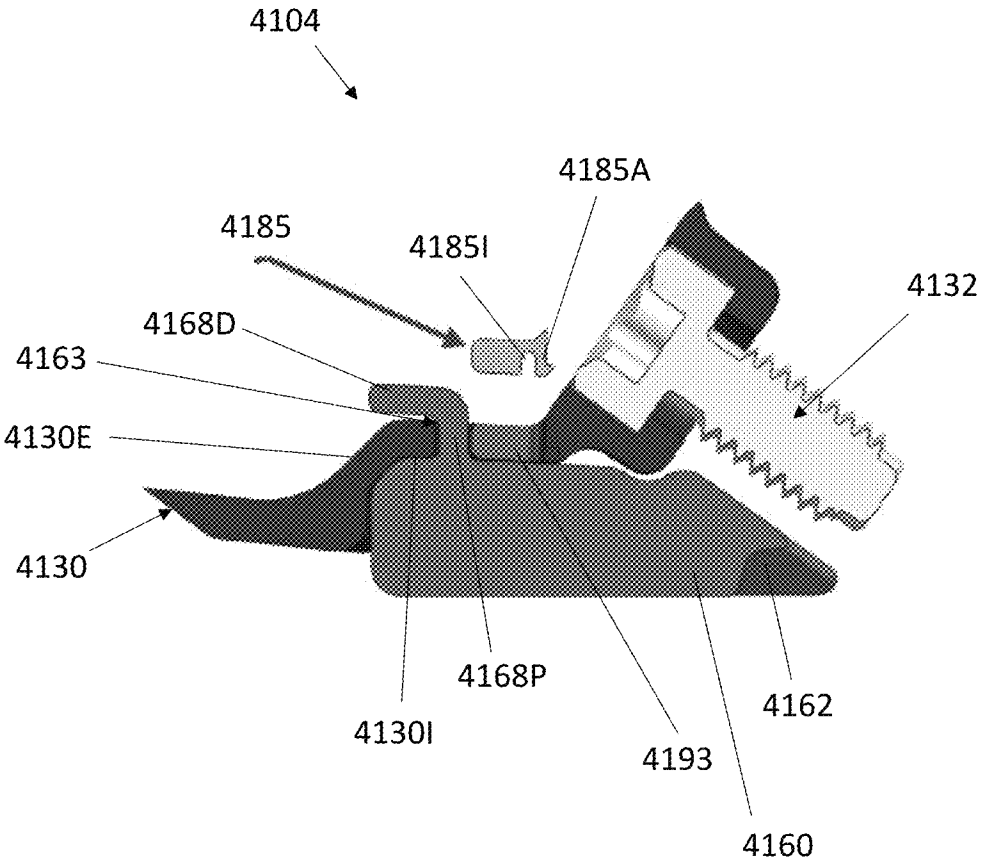

FIG. 143 is another rotated heel-to-toe cross-sectional view of the weight assembly of the golf club head of FIG. 138 along the line 140-140 in FIG. 138.

Figure 144:
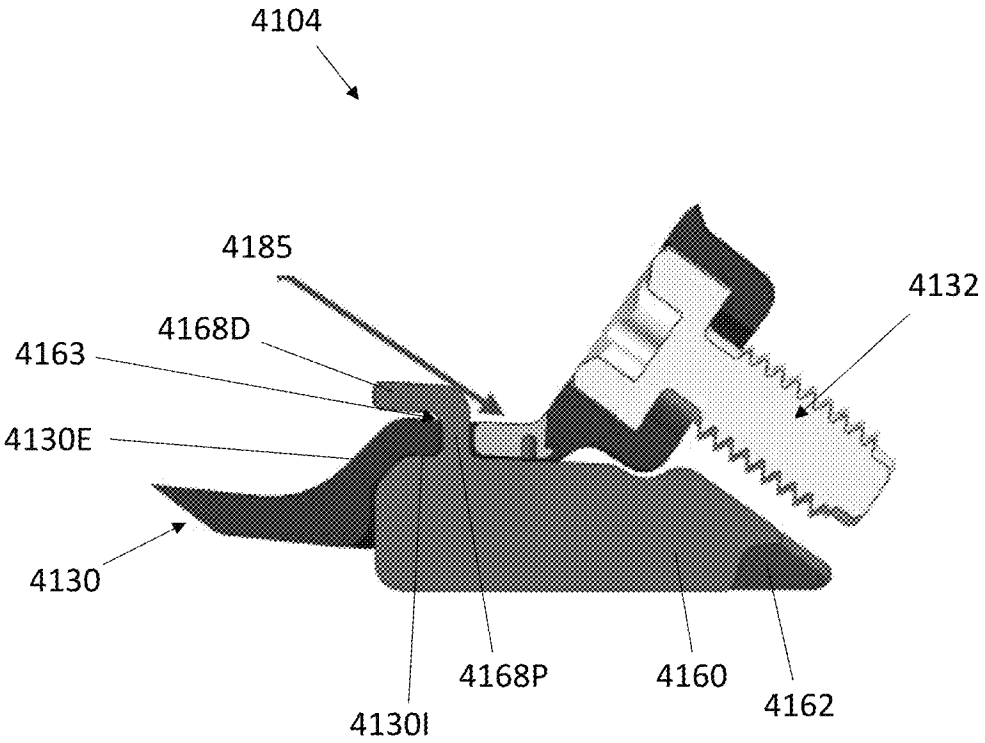

FIG. 144 is another rotated heel-to-toe cross-sectional view of the weight assembly of the golf club head of FIG. 138 along the line 140-140 in FIG. 138.

Figure 145:
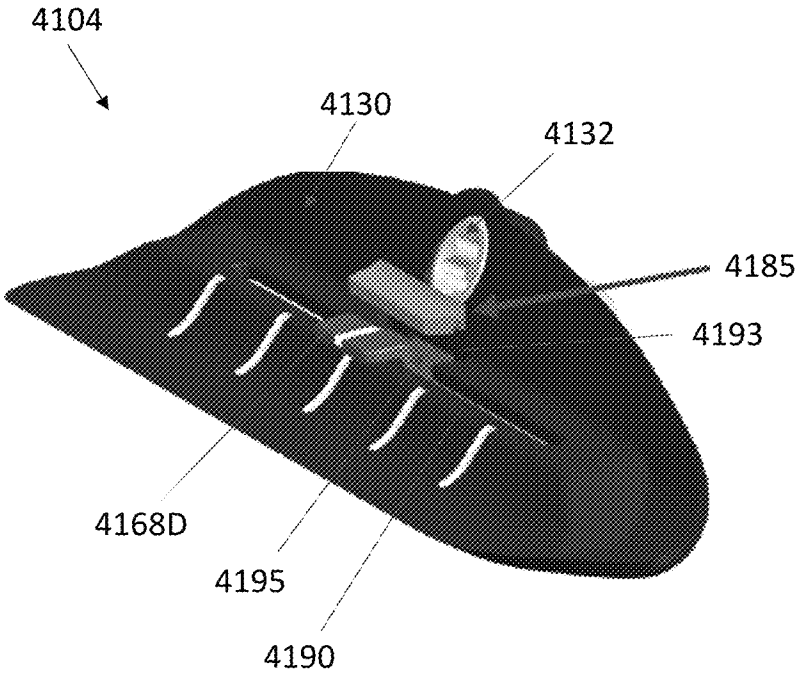

FIG. 145 is a perspective view of the weight assembly of the golf club head of FIG. 138.

Figure 146:
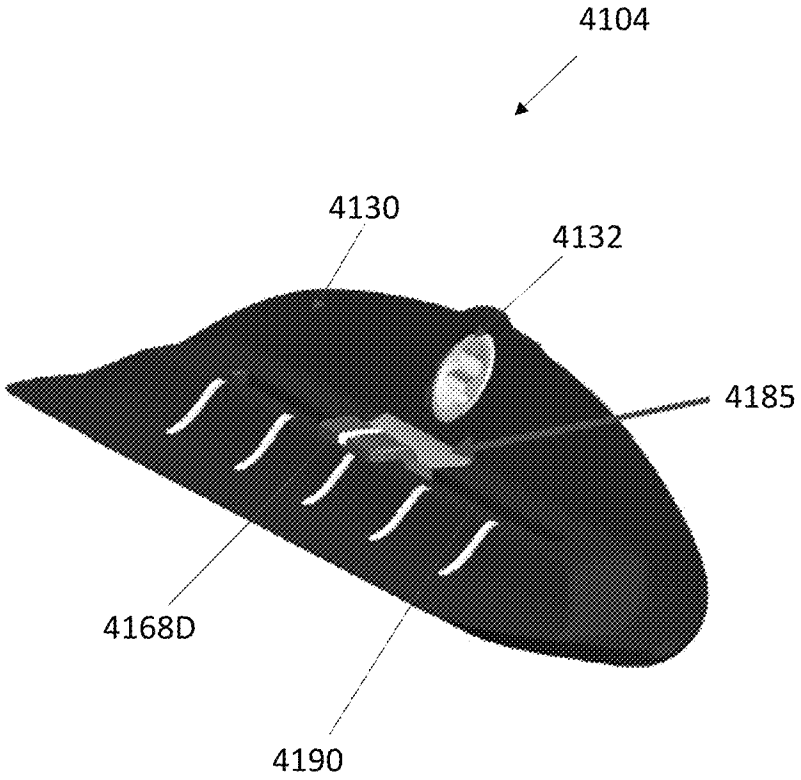

FIG. 146 is another perspective view of the weight assembly of the golf club head of FIG. 138.

Figure 147:
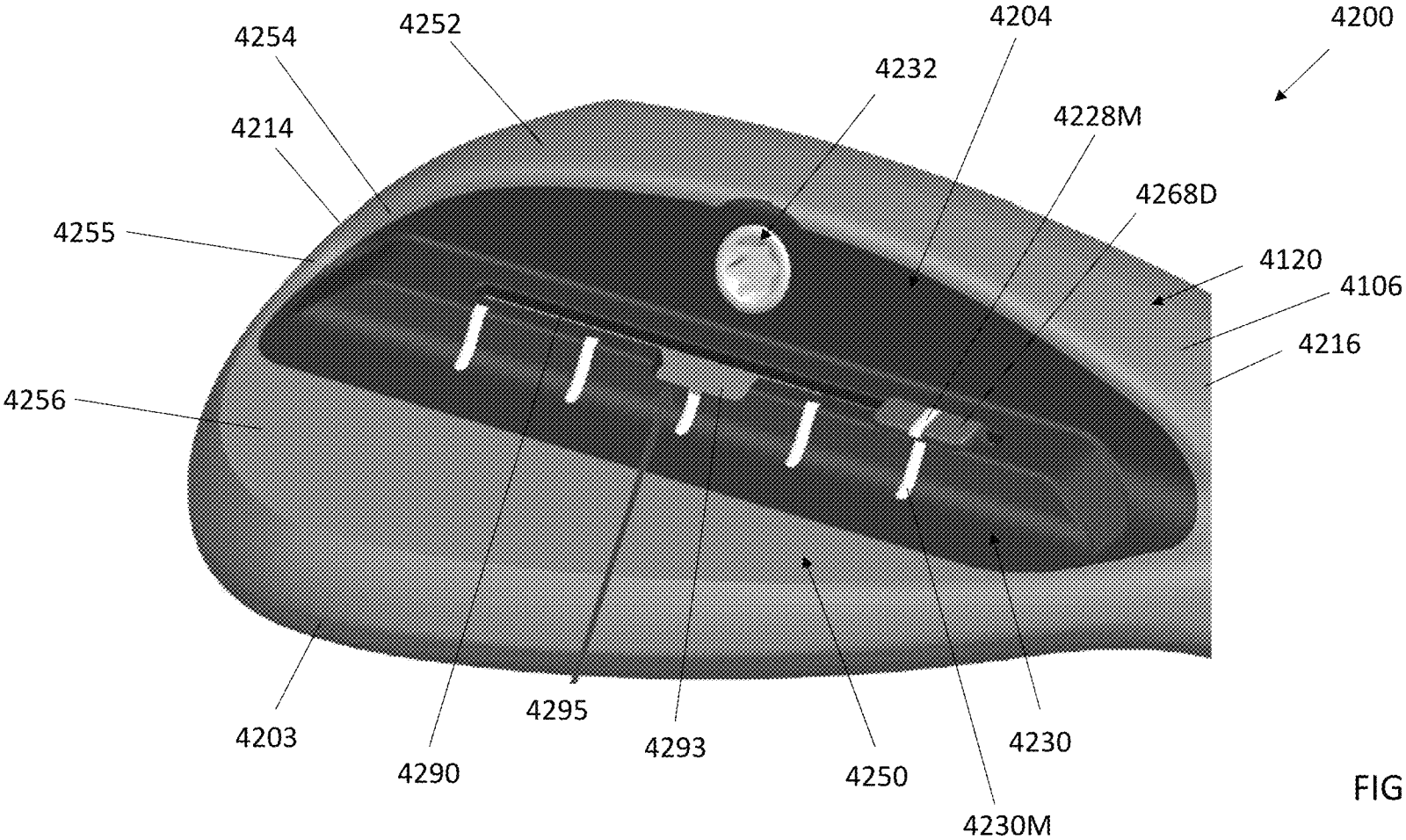

FIG. 147 is a back perspective view of another golf club head with a weight assembly in a locked configuration.

Figure 148:
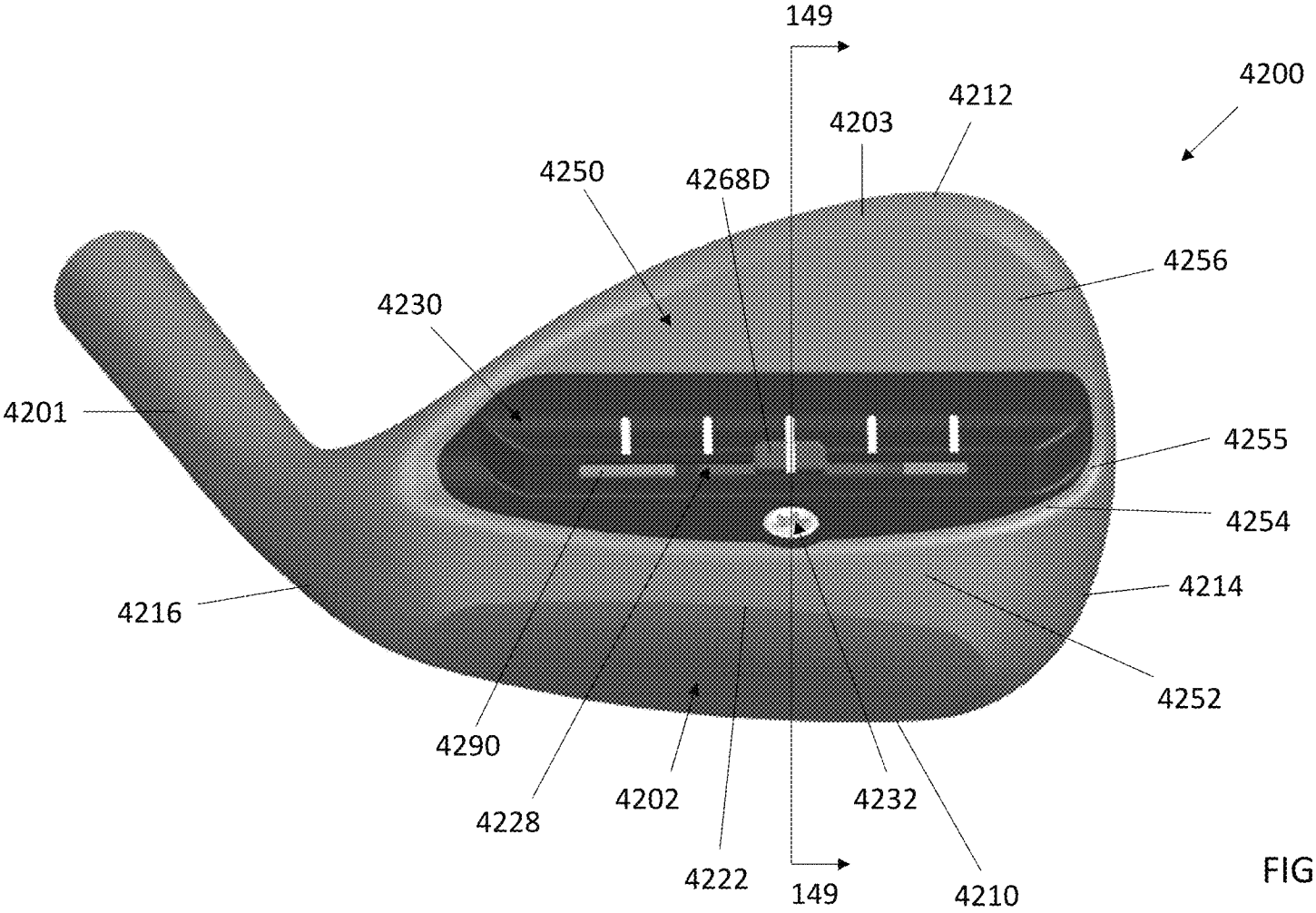

FIG. 148 is another back perspective view of the golf club head of FIG. 147 with the weight assembly in the locked configuration.

Figure 149:
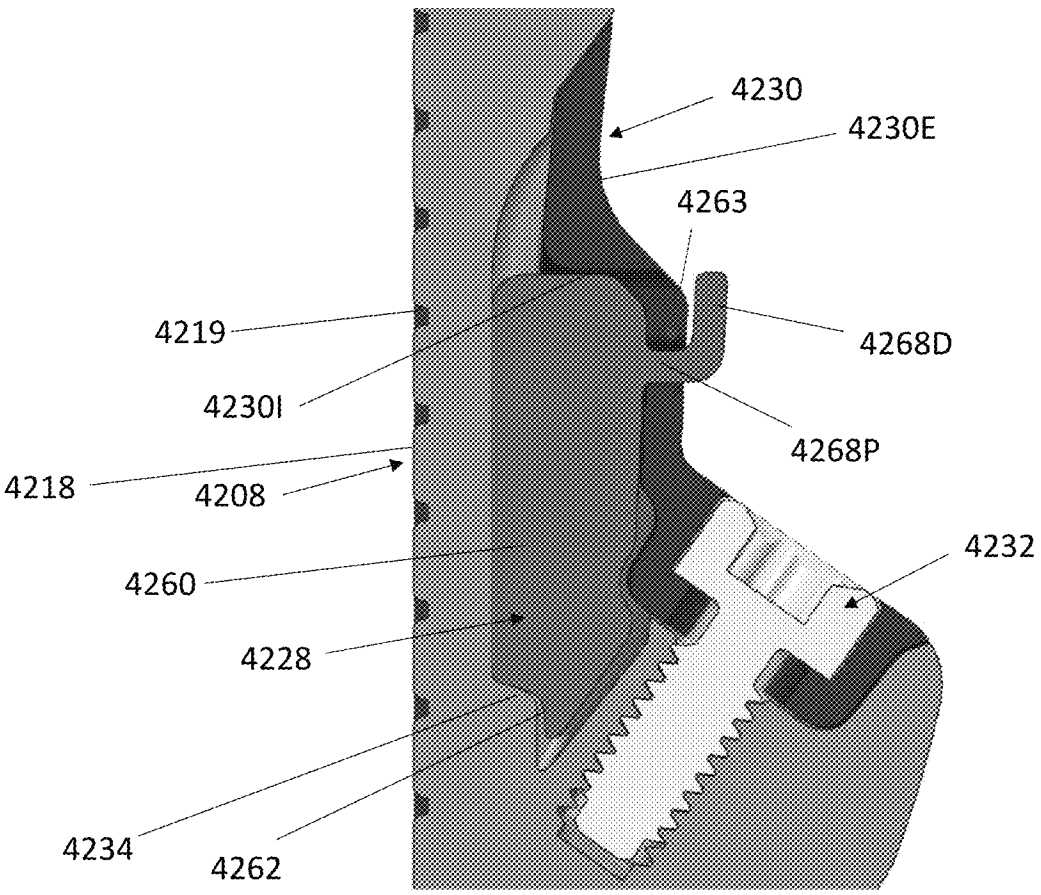

FIG. 149 is a heel-to-toe cross-sectional view of the golf club head of FIG. 147 along the line 149-149 in FIG. 148 and with the weight assembly is in the locked configuration.

Figure 150:
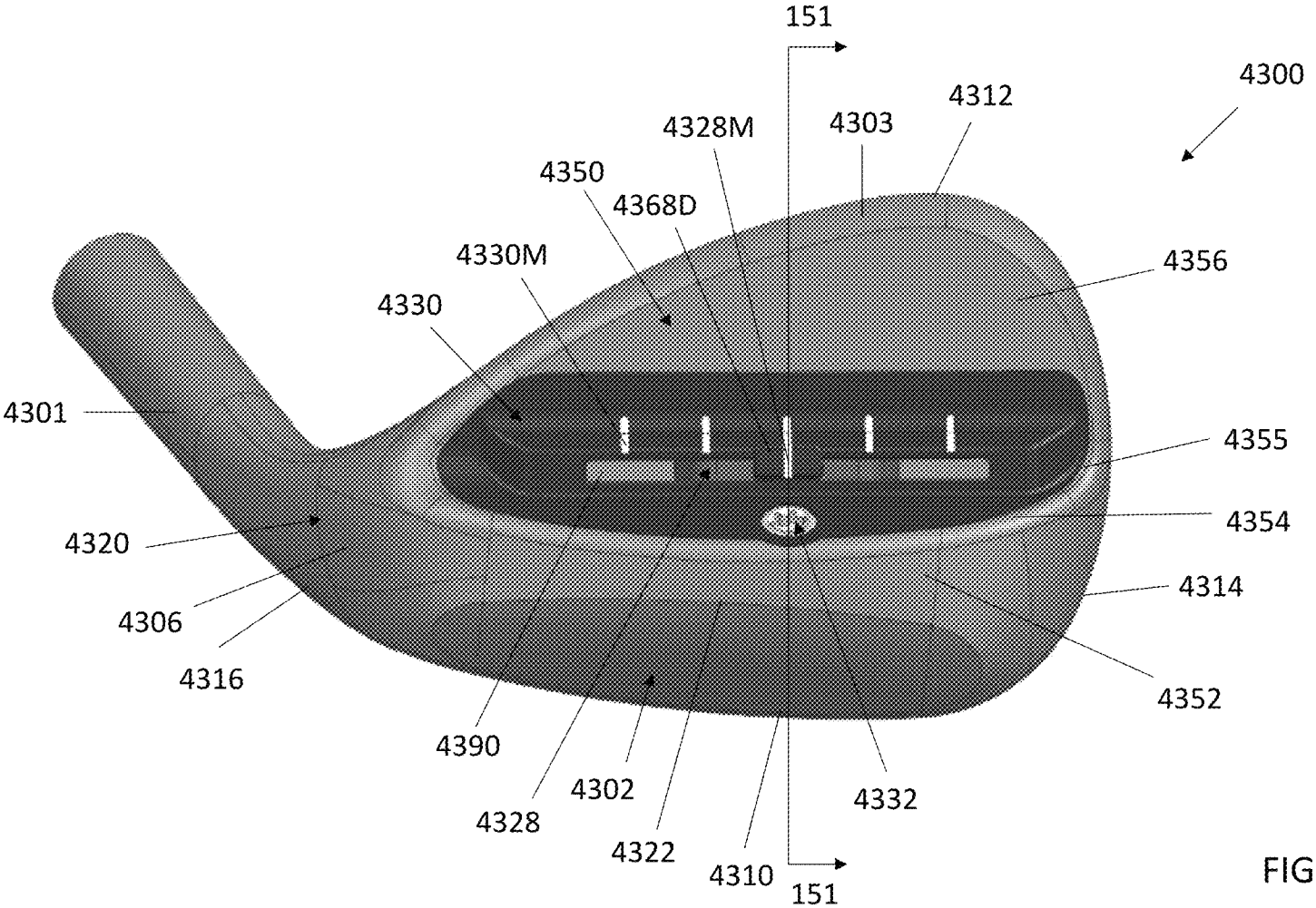

FIG. 150 is a back perspective view of another golf club head with a weight assembly in a locked configuration.

Figure 151:
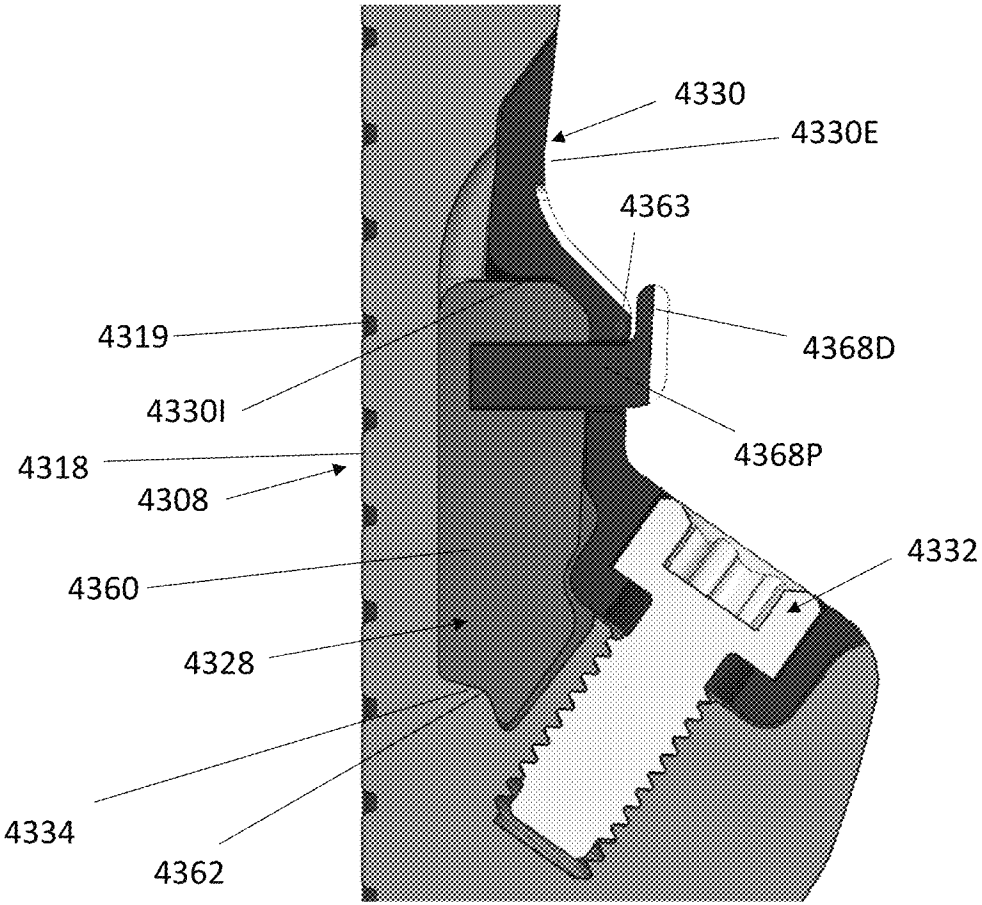

FIG. 151 is a heel-to-toe cross-sectional view of the golf club head of FIG. 150 along the line 151-151 in FIG. 150 and when the weight assembly is in the locked configuration.

Figure 152:
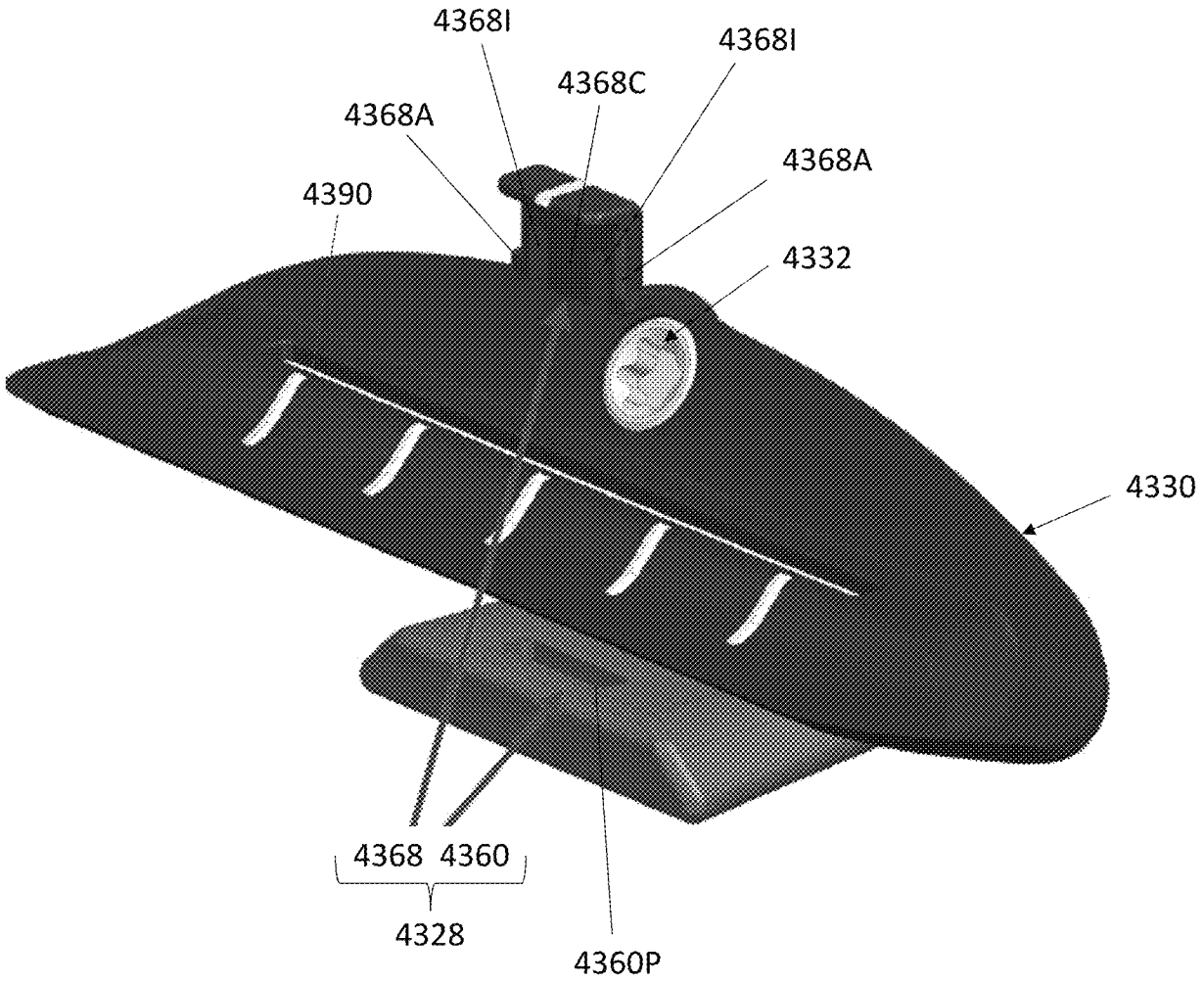

FIG. 152 is a perspective view of the weight assembly of the golf club head of FIG. 150.

Figure 153:
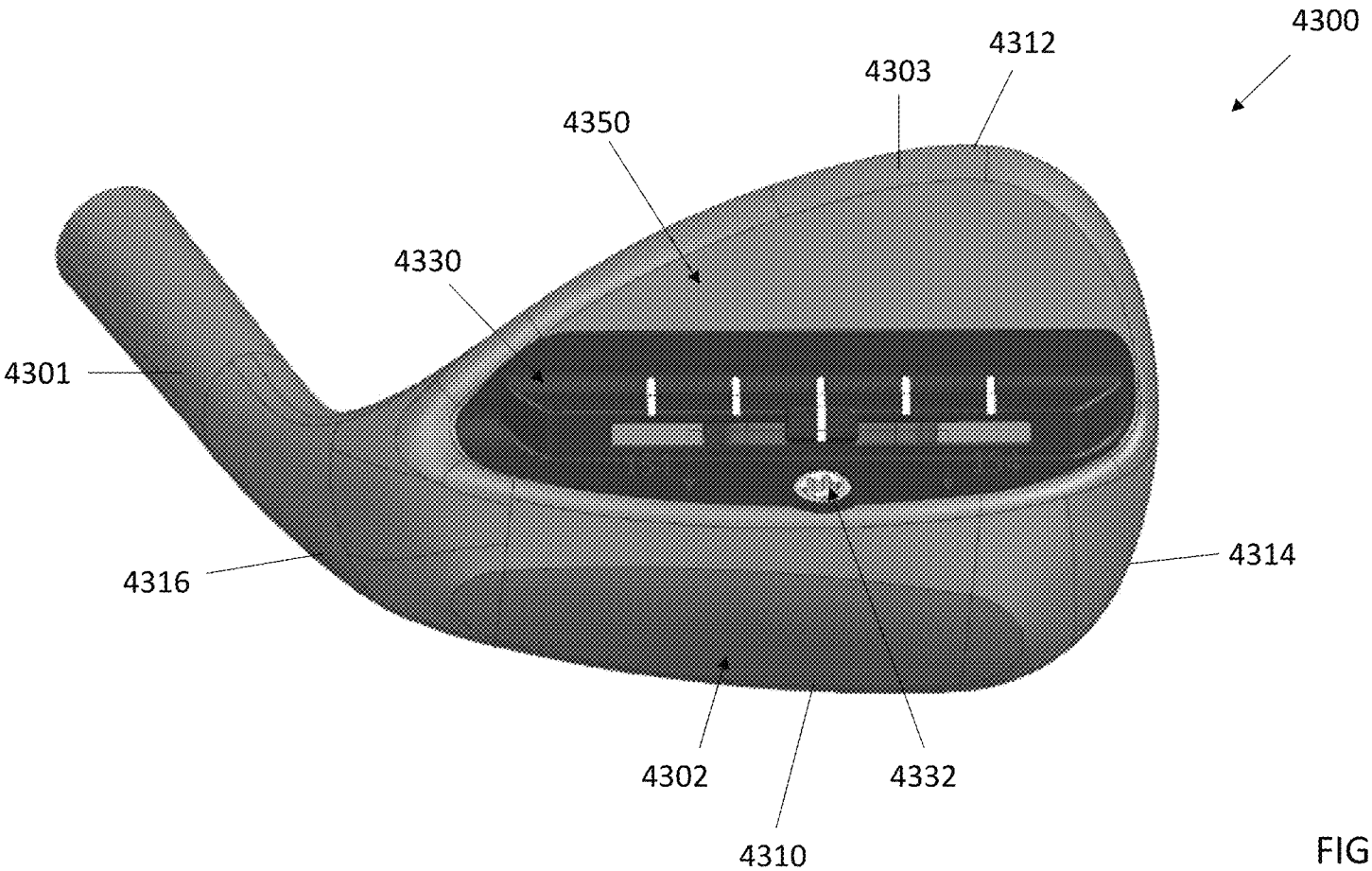

FIG. 153 is another back perspective view of the golf club head of FIG. 150.

Figure 154:
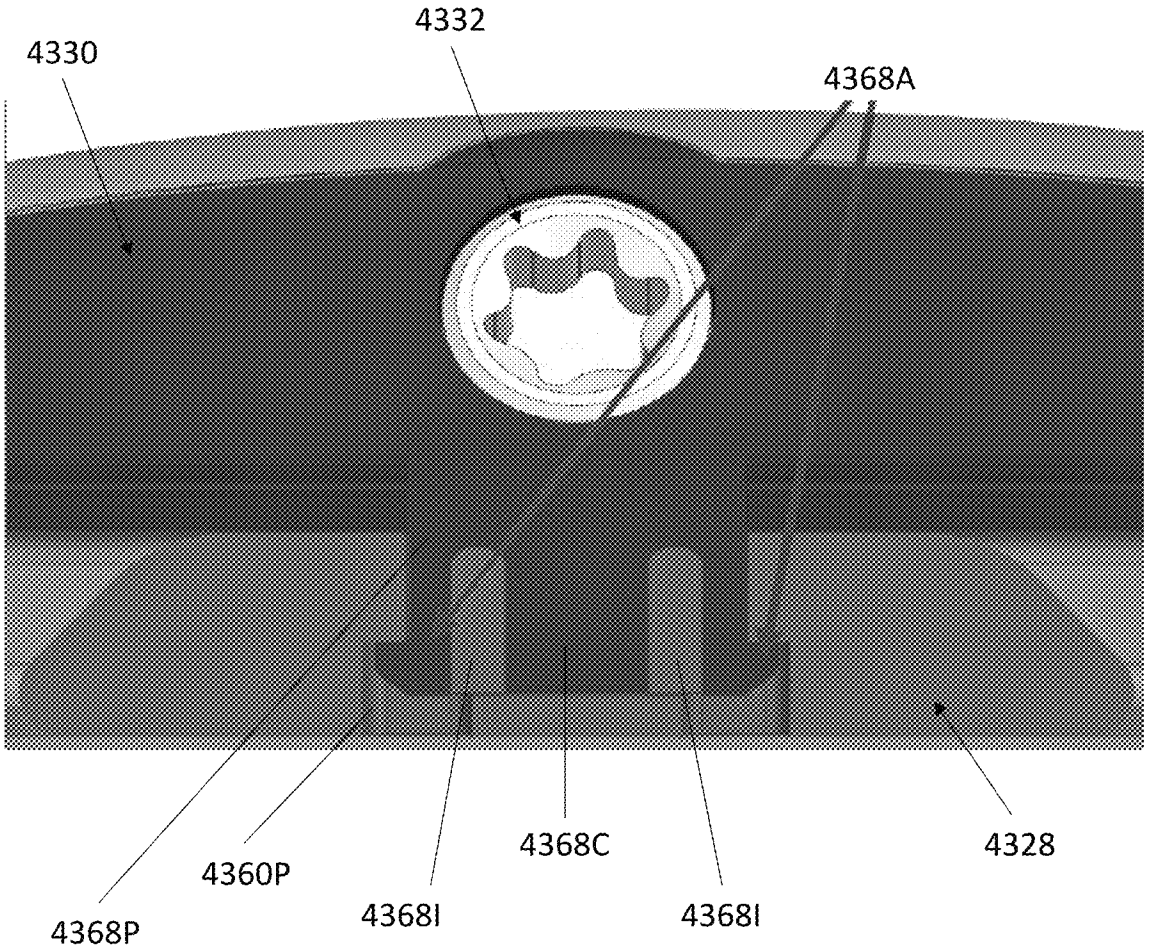

FIG. 154 is a cross-sectional view of the golf club head of FIG. 150 along line 154-154 in FIG. 153.

Figure 155:
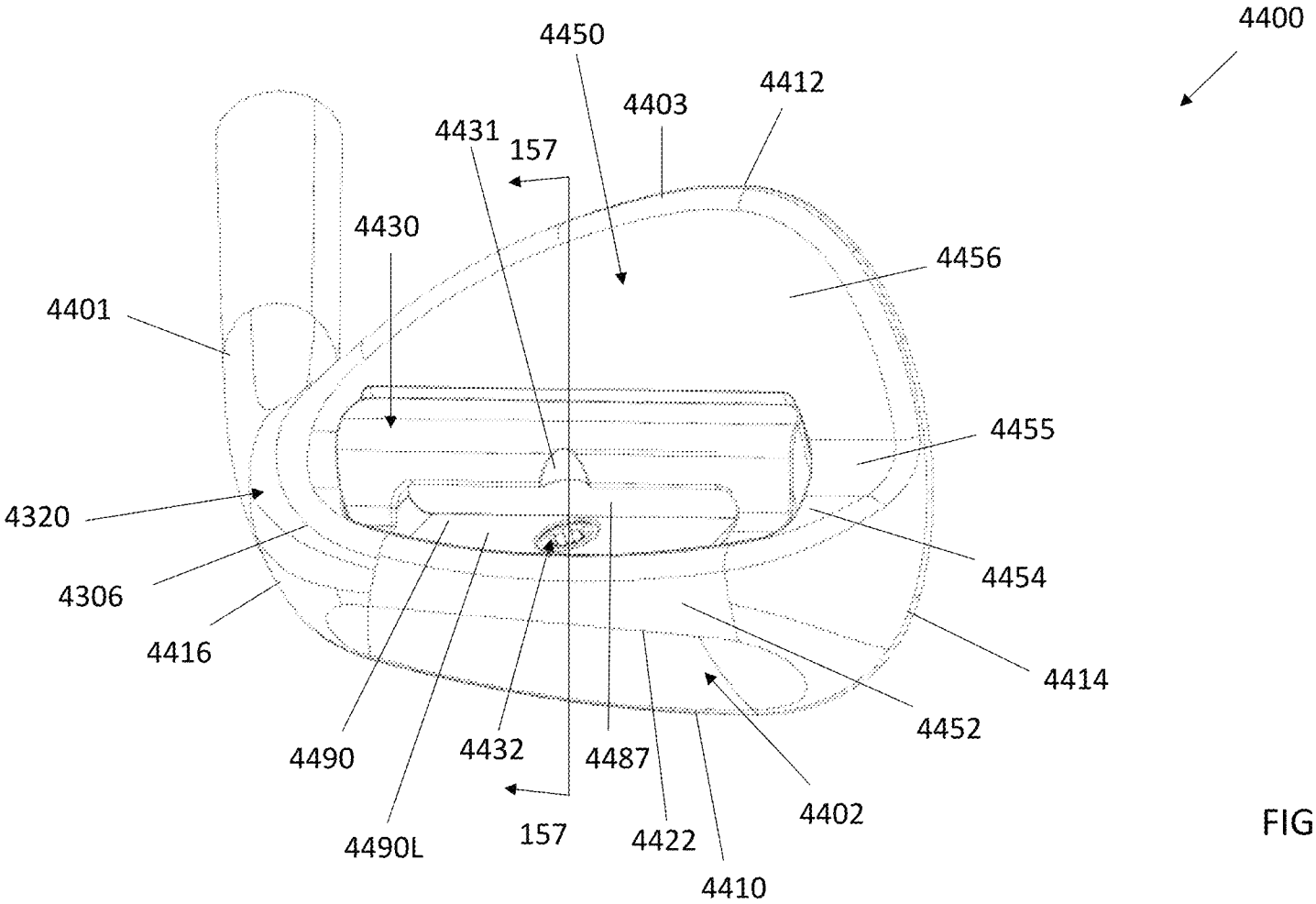

FIG. 155 is a back perspective view of another golf club head with a weight assembly in a locked configuration.

Figure 156:
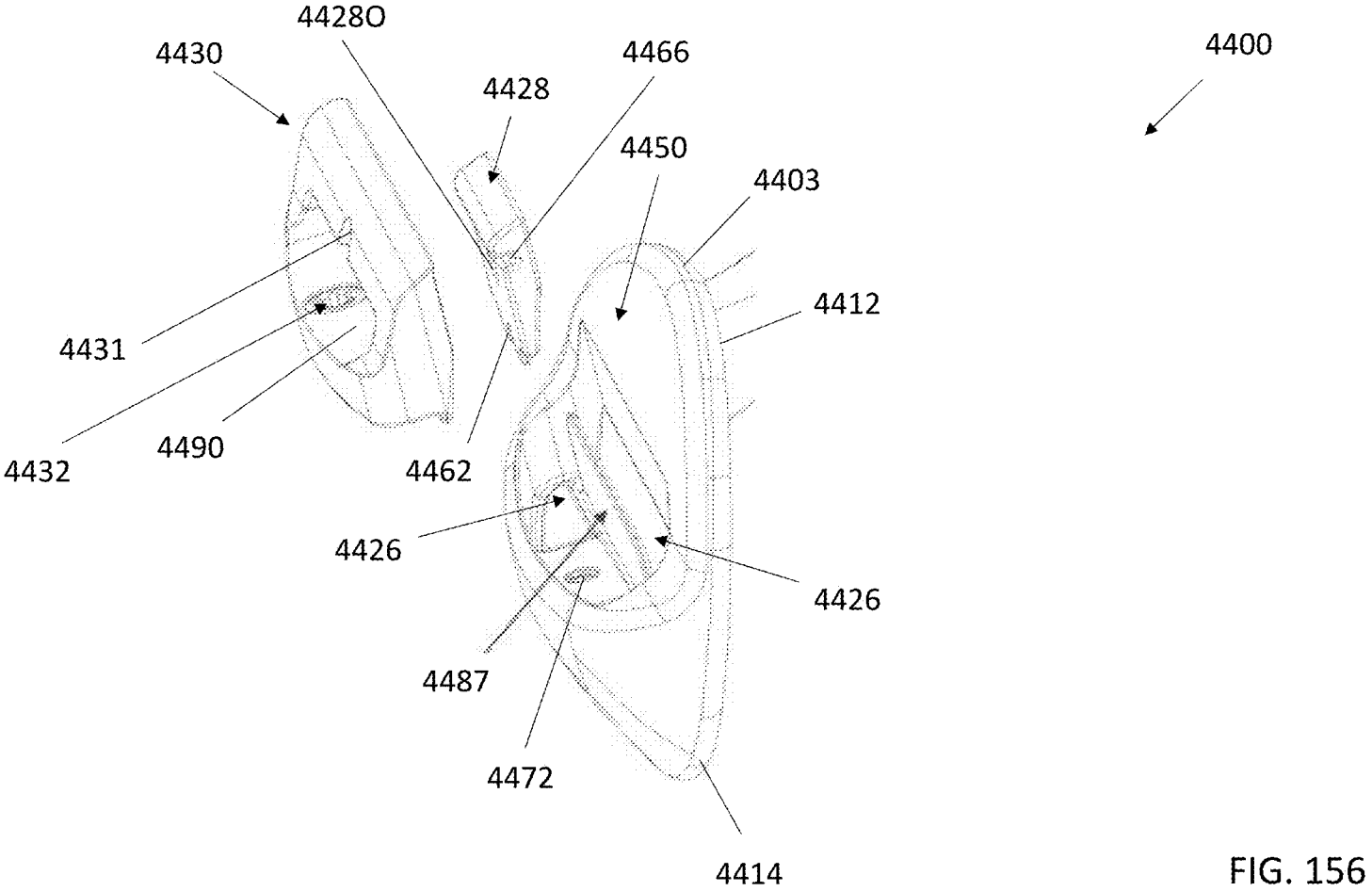

FIG. 156 is a partially exploded toe perspective view of the golf club head of FIG. 155.

Figure 157:
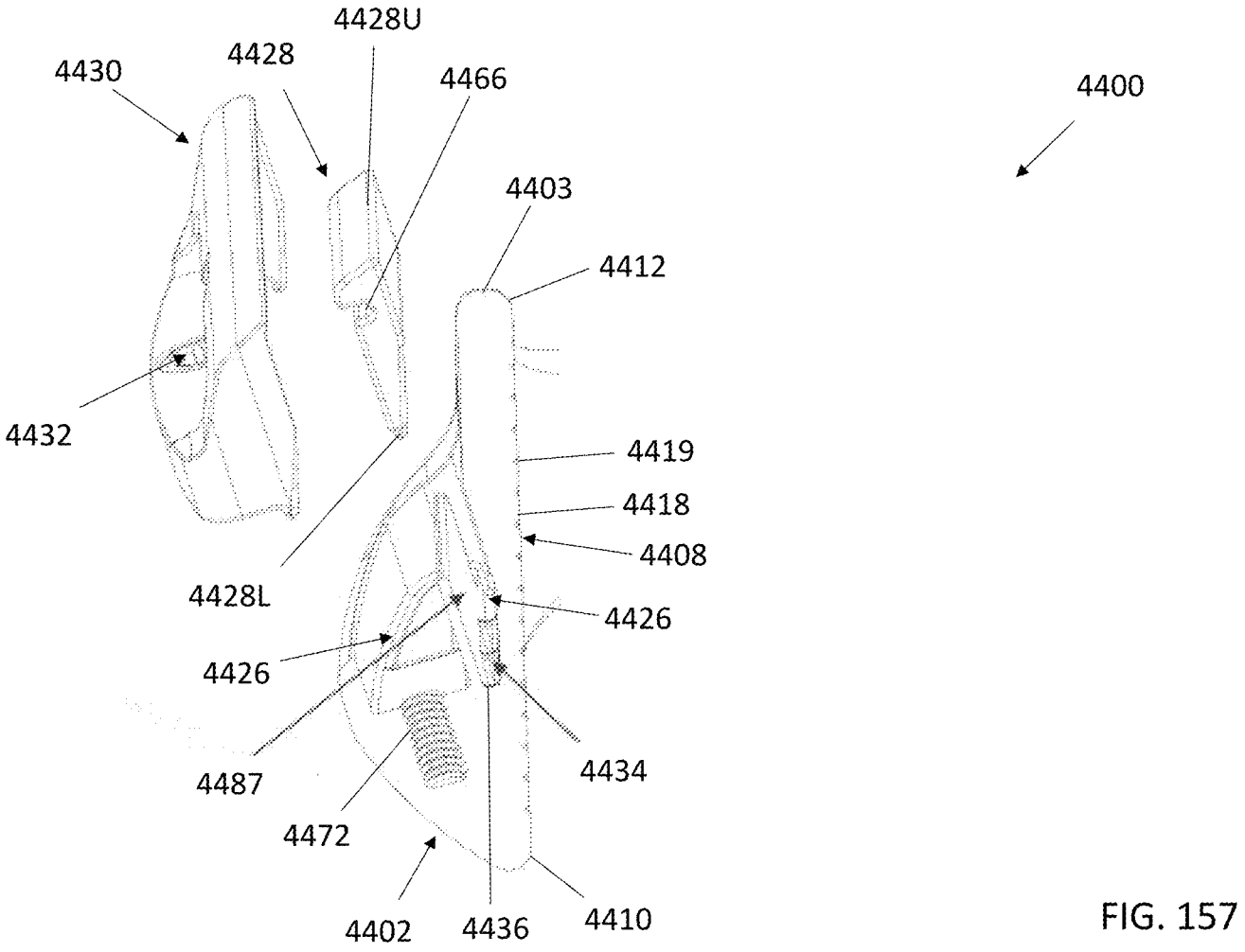

FIG. 157 is a toe-to-heel cross-sectional view of a body of the golf club head of FIG. 155 along line 157-157 in FIG. 155, and a partially exploded view of the weight assembly.

Figure 158:
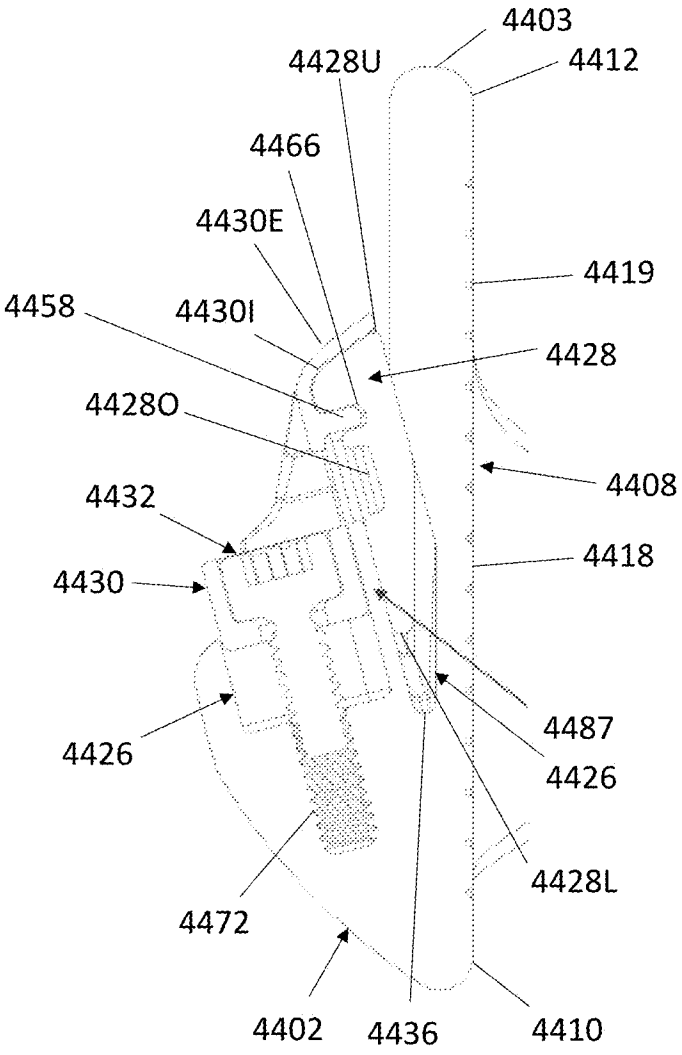

FIG. 158 is a toe-to-heel cross-sectional view of the golf club head of FIG. 155 along line 157-157 in FIG. 155 and with the weight assembly in an unlocked configuration.

Figure 159:
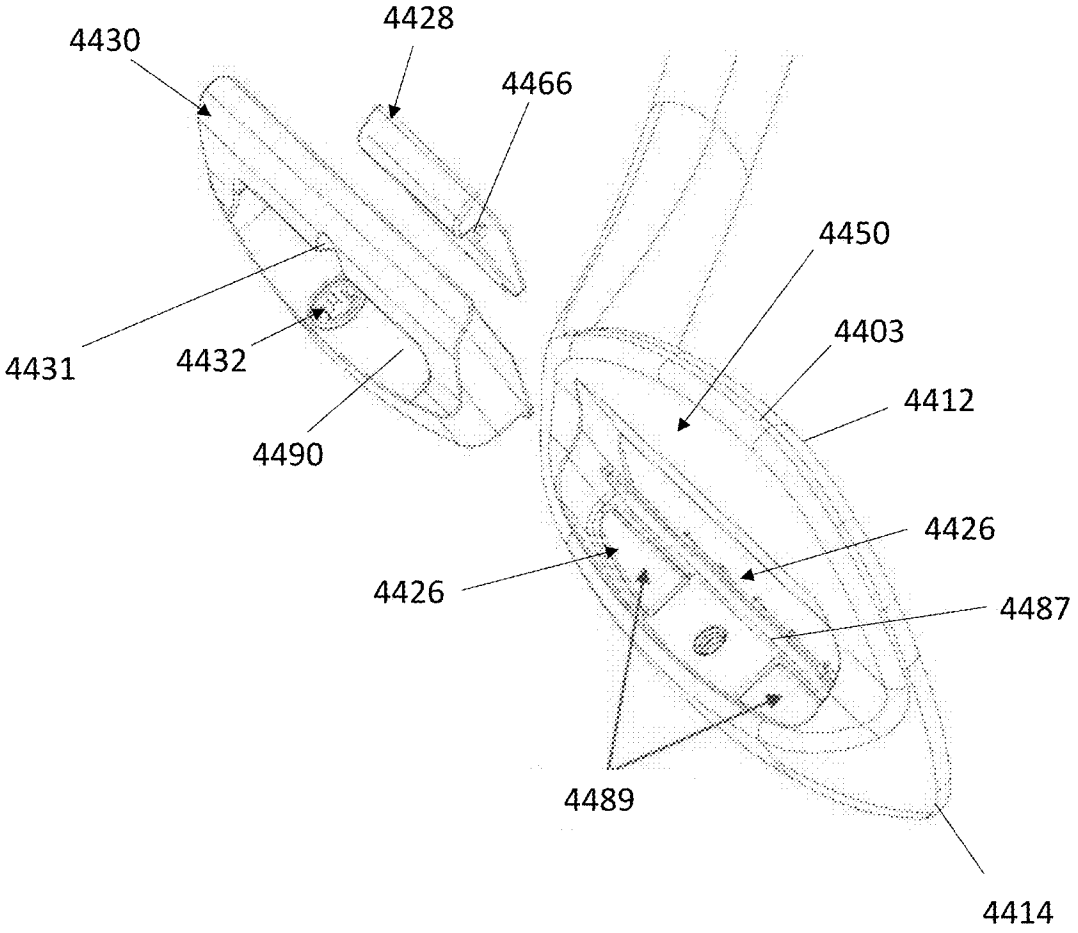

FIG. 159 is a partially exploded back perspective view of the golf club head of FIG. 155.

Figure 160:
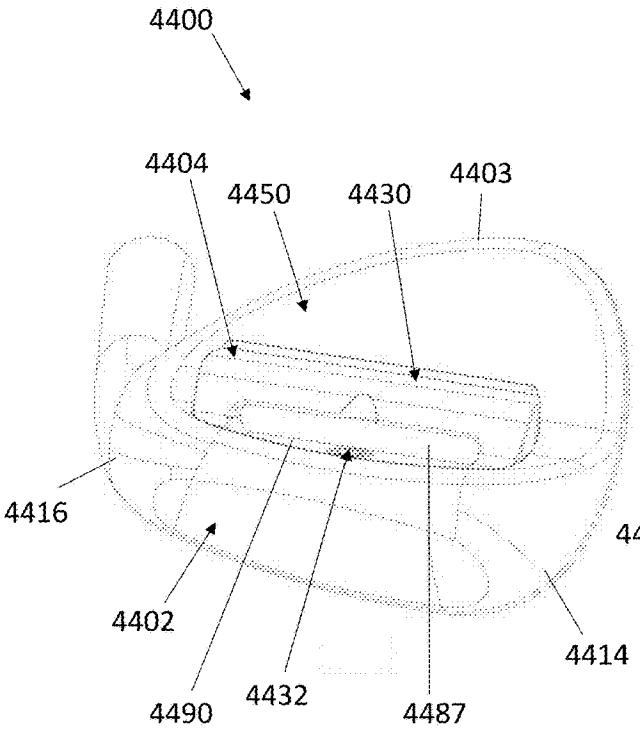

FIG. 160 is a back perspective view of the golf club head of FIG. 155 with the weight assembly in the locked configuration.

Figure 161:
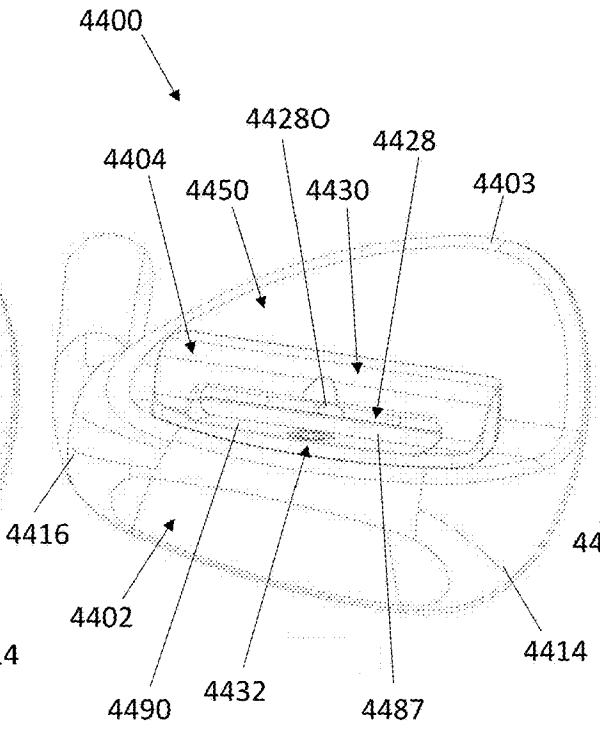

FIG. 161 is another back perspective view of the golf club head of FIG. 155 with the weight assembly part way between the locked configuration and the unlocked configuration.

Figure 162:
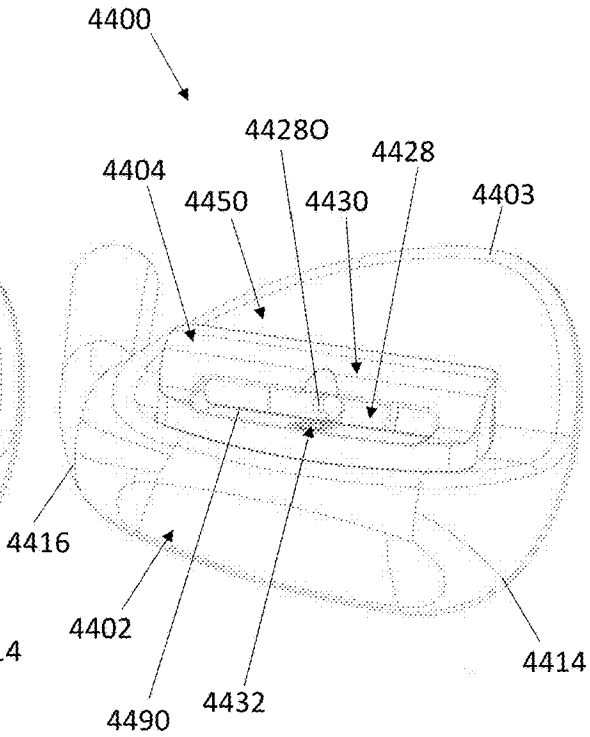

FIG. 162 is another back perspective view of the golf club head of FIG. 155 with the weight assembly in the unlocked configuration.

DETAILED DESCRIPTION

The technologies described herein contemplate a golf club head, such as a fairway metal, driver, or other golf club head, that includes an adjustable weight assembly. Through the weight balance of the golf club head, the flight characteristics of the golf ball can be improved, thereby increasing golf club performance. In the examples described herein, the weight assembly enables for the CG and/or MOI of a head of the golf club to be adjusted through selective weight placement to impact the flight characteristics of the golf ball, such as fades, draws, launch angles, ball spin, and speed. Additionally or alternatively, the weight assembly enables for the swing weight of the golf club head to be adjustable (e.g., increasing or decreasing the weight of the club head).

In examples, the present technologies provide a golf club head with a recessed channel defined therein. A slidable weight is disposed at least partially within the channel and secured therein by a cover and a fastener. The cover is configured to retain the weight within the channel indirectly so that the fastener never engages with the weight. This configuration enables for the size, shape, and/or density of the weight to be defined so that the CG and MOI of the golf club head can be finely tuned. Additionally, the cover includes additional features that increase securement of the weight within the channel and reduce undesirable rattling or movement during the golf club swing. Furthermore, the weight assemblies described herein allow for the weight to be adjusted quickly and easily without requiring any component to be fully detached from the club head. Thereby reducing lost or misplaced components during club head adjustment. In an aspect, the weight is engaged with the cover so that the two components can move together with respect to the golf club head. Additionally, the weight is restricted from tilting relative to the cover so as to reduce or prevent binding of the weight within the channel.

Figure 1:
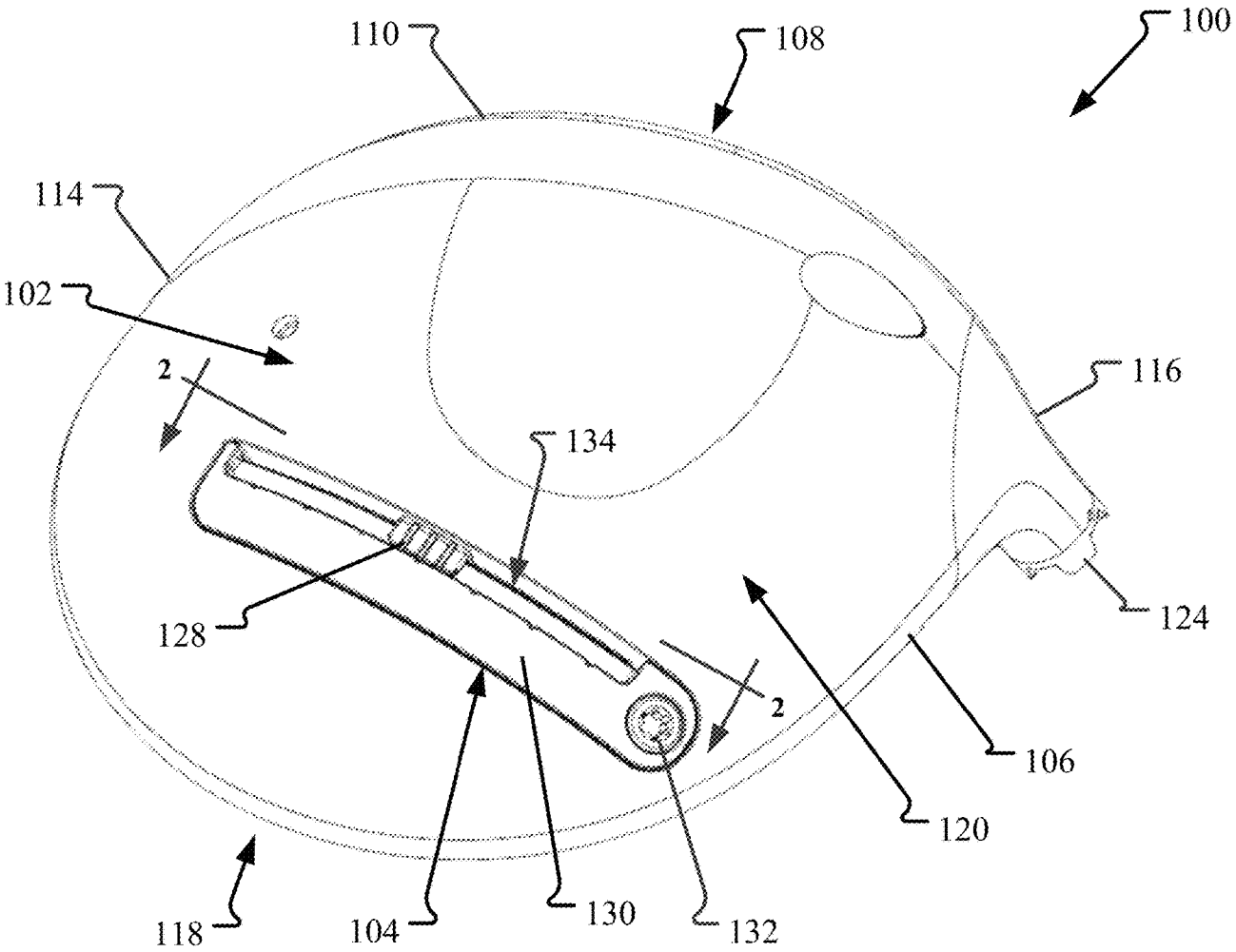
FIG. 1 is a perspective view of a sole of a golf club head with an exemplary weight assembly.

FIG. 1 is a perspective view of a sole 102 of a golf club head 100 with an exemplary weight assembly 104. The golf club head 100 is a metalwood-type golf club head having a body 106 that includes a striking face 108 positioned towards the front of the club head 100 and having a lower edge 110 and an upper edge 112 (e.g., shown in FIG. 8) each extending between a toe 114 and heel 116 of the club head 100. The sole 102 extends from the lower edge 110 on the bottom side of the club head 100 and a crown 118 extends from the upper edge 112 on the top of the club head 100. The sole 102, the striking face 108, and the crown 118 are coupled together so as to define an outer surface 120 of the body 106 with an interior cavity 122 (shown in FIG. 2) formed within. A hosel 124 is disposed at the heel 116 and is configured to couple to a shaft (not shown). In some examples, a skirt 126 (shown in FIG. 8) may also form a portion of the club head 100 and is positioned between the crown 118 and the sole 102. In such examples and for purposes of this application, the crown 118 may still be considered to be attached or coupled to the sole 102, via the skirt 126. Furthermore, the body 106 may form any type club head, such as an iron-type club head or hybrid-type club head, as required or desired.

In operation, the sole 102 generally provides the lower surface of the club head 100 when the club head 100 is placed in an address position. The club head 100 defines a center of gravity (CG) and a moment of inertia (MOI) that impact flight characteristics of a golf ball (not shown) when hit with the striking face 108. The weight assembly 104 is coupled to the club head 100 such that the CG and/or the MOI of the club head 100 can be selectively adjusted as required or desired. In the example, the weight assembly 104 includes a movable weight 128, a cover 130 configured to secure the weight 128 in place, and a fastener 132 for coupling the weight assembly 104 to one or more other portions of the club head 100. In some examples, the weight 128 may be formed from tungsten. In examples, the weight 128 may be between about 2 grams to 15 grams. In some specific examples, the weight 128 may be about 9 grams.

A recessed elongated channel 134 is formed in the outer surface 120 of the club head 100. More specifically, the channel 134 is substantially linear and defined in the sole 102 of the club head 100. In other examples, the channel 134 may be defined at any other location of the body 106 (e.g., the crown 118 or the skirt 126) as required or desired. The channel 134 is sized and shaped to receive at least a portion of the weight 128 so that the weight 128 can be slidable therein. In the example, the channel 134 extends substantially linearly in a toe 114—heel 116 direction so that the CG and the MOI of the club head 100 can be adjusted (by selectively moving the weight 128) for fade or draw bias. The channel 134 can be angularly offset from the plane of the striking face 108 as illustrated in FIG. 1. In other examples, the channel 134 may extend substantially parallel to the striking face 108. In the example, the fastener 132 is positioned proximate to the heel side of the channel 134. In other examples, the fastener 132 may be positioned at any other location relative to the channel 134 to enable the weight assembly 104 to function as described herein. For example, at approximately a midpoint of the channel 134 as described in reference to FIG. 26 or proximate the toe side of the channel 134.

In operation and through use of the fastener 132, the cover 130 is coupled to the body 106 and extends at least partially over the channel 134 so as to selectively secure the weight 128 to the club head 100. Additionally, the cover 130 covers at least a portion of the channel 134 so as to reduce dust and dirt from accumulating therein. However, the fastener 132 is separate from the weight 128 and only indirectly (e.g., via the cover 130) secures the weight 128 to the club head 100. In examples, the fastener 132 and the cover 130 are adapted to retain the weight 128 in the channel 134 only by contact with the cover 130 such that the fastener 132 never engages the weight 128. As described herein, when the fastener 132 indirectly retains the weight 128, the fastener 132 never engages the weight 128 directly and it is a separate component (e.g., the cover 130) that directly engages the weight 128 for securement to the club head 100.

The cover 130 may be loosened or completely removed, via the fastener 132, from the club head 100 to enable the weight 128 to slide within the channel 134 and selectively adjust the CG and the MOI as required or desired. Because the weight 128 is selectively moveable, the weight assembly 104 (e.g., the fastener 132, the weight 128, and the cover 130) enables the movement of the weight 128, while also securing the weight 128 to one or more portions of the club head 100 so that undesirable movement (e.g., during a club swing) is reduced or prevented. By separating the fastener 132 from the weight 128, the size, shape, and/or density of the weight 128 may be configured so that the CG and the MOI of the club head 100 may be more finely tuned, thereby increases the performance of the golf club head 100. The weight assembly 104 is described further below.

Figure 2:
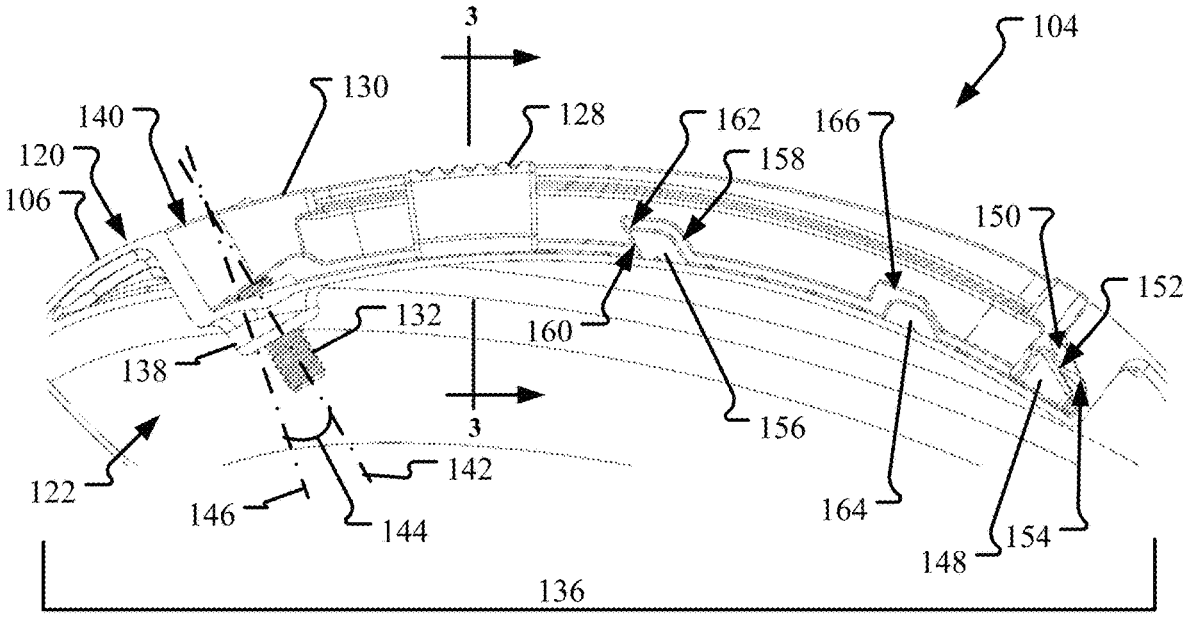
FIG. 2 is a cross-sectional view of the golf club head taken along line 2-2 in FIG. 1 where the weight assembly is in a locked configuration.
Figure 3:
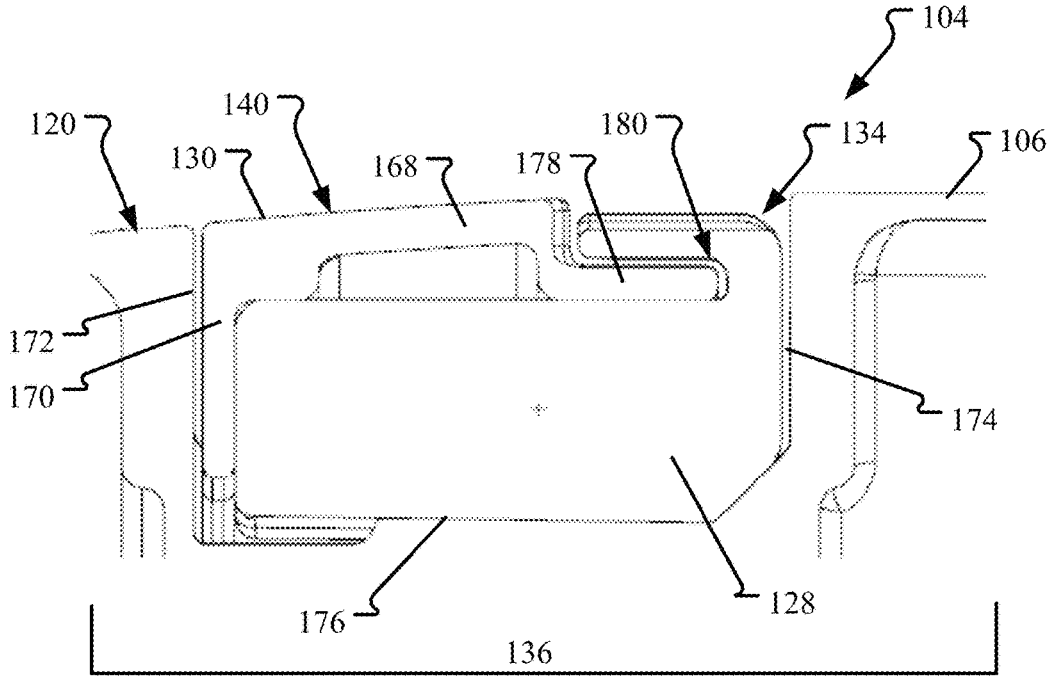
FIG. 3 is a cross-sectional view of the weight assembly taken along line 3-3 in FIG. 2.

FIG. 2 is a cross-sectional view of the golf club head 100 taken along line 2-2 in FIG. 1 and showing the weight assembly 104 in a locked configuration 136. FIG. 3 is a cross-sectional view of the weight assembly 104 taken along line 3-3 in FIG. 2. Referring concurrently to FIGS. 2 and 3, when the weight assembly 104 is in the locked configuration 136, the cover 130 is disposed within the channel 134 and the weight 128 is secured within the channel 134 such that movement is restricted. In the example, to lock the cover 130 to the body 106, the fastener 132 may be a threaded bolt that threadingly engages with a nut 138 positioned within the heel end of the channel 134. In some examples, the nut 138 may be integrally formed within the body 106.

When the cover 130 is in the locked configuration 136, an exterior surface 140 of the cover 130 is substantially aligned (e.g., flush) with the outer surface 120 of the body 106. Additionally, the fastener 132 defines a fastener axis 142. In the example, the fastener axis 142 is disposed at an angle 144 relative to a plane 146 that is normal to the exterior surface 140 of the cover 130 proximate the fastener 132. The angle 144 defines the orientation that the cover 130 may move relative to the body 106. The angle 144 may be between about 0° (e.g., aligned with the plane 146) and about 88°. In examples, the angle 144 may be between about 20° and 50°. In one example, the angle 144 may be about 45°.

In the example, only a single fastener 132 is used to couple the cover 130 to the body 106 and the fastener 132 is positioned at the heel end of the weight assembly 104. As such, to connect the toe end of the cover 130 to the body 106, the cover 130 may include one or more projections 148 that extend from the toe end. The projection 148 is sized and shaped to be received within one or more corresponding chambers 150 defined at the toe end of the channel 134. When the weight assembly 104 is in the locked configuration 136, the projection 148 is received at least partially within the chamber 150 and engaged therewith. By engaging the cover 130 to the body 106 at a position opposite from the fastener 132, when the weight 128 is positioned away from the fastener 132, the cover 130 still enables securement of the weight 128 within the channel 134 and reduces or prevents movement of the weight 128 in the locked configuration 136. In the example, the projection 148 extends in the toe-heel direction of the cover 130 and includes at least one oblique surface 152 that frictionally engages with a corresponding at least one oblique surface 154 of the chamber 150. In some examples, the oblique surfaces 152, 154 may be substantially parallel to the fastener axis 142. In other examples, the oblique surfaces 152, 154 may be oriented at a different angle than the fastener axis 142 (e.g., steeper or shallower angles). Additionally or alternatively, the projection 148 and chamber 150 may extend substantially orthogonal to the toe-heel direction (e.g., in and out of the page of FIG. 2).

The cover 130 may also be engaged with the body 106 at one or more intermediate positions between the fastener 132 and the opposite end. A seat 156 may protrude into the channel 134 at a location between the toe end and the heel end, for example, proximate a midpoint location of the channel 134. The seat 156 is sized and shaped to be received within a corresponding notch 158 defined in the cover 130. When the weight assembly 104 is in the locked configuration 136, the seat 156 is received at least partially within the notch 158 and engaged therewith. This engagement of the cover 130 to the body 106 at a position away from the fastener 132, also secures the weight 128 within the channel 134 and reduces or prevents movement of the weight 128 in the locked configuration 136. In the example, the seat 156 extends in the toe-heel direction of the channel 134 and includes at least one oblique surface 160 that frictionally engages with a corresponding at least one oblique surface 162 of the notch 158. In some examples, the oblique surfaces 160, 162 may be substantially parallel to the fastener axis 142. In other examples, the oblique surfaces 160, 162 may extend at angle relative to the bottom of the channel 134 between about 3° and 88°. In one example, the oblique surfaces 160, 162 may extend at an angle relative to the bottom of the channel 134 of about 30°.

A cam 164 may also protrude into the channel 134 at a location between the toe end and the heel end, for example, between the seat 156 and the chamber 150. The cam 164 is sized and shaped to receive within a corresponding cutout 166 defined in the cover 130. When the weight assembly 104 is in the locked configuration 136, the cam 164 is received at least partially within the cutout 166. The cam 164 and the cutout 166 are described further below in reference to FIG. 4.

In the example, the cover 130 is substantially L-shaped with a long leg 168 and a short leg 170. In the locked configuration 136, the long leg 168 forms the exterior surface 140 and the short leg 170 extends within the channel 134. The channel 134 is formed from two opposing sidewalls 172, 174 and a bottom track 176 offset from the outer surface 120 of the body 106. The long leg 168 of the cover 130 opposes the track 176 of the channel 134 and the short leg 170 of the cover 130 is adjacent to one of the sidewalls 172. The seat 156 and the cam 164 may protrude from the sidewall 172 of the channel 134 and the corresponding notch 158 and cutout 166 may be defined in the short leg 170 of the cover 130. When the weight 128 is secured within the channel 134 and in the locked configuration 136, the weight 128 is compressed between cover 130 and one or more walls (e.g., the sidewall 174 and/or the track 176) of the channel 134. As such, the weight 128 is frictionally secured to one or more portions of the club head 100 by the weight assembly 104.

Additionally, the weight 128 may be slidably coupled to the cover 130. The long leg 168 of the cover 130 may include a flange 178 extending therefrom. The flange 178 is sized and shaped to be received at least partially within a corresponding groove 180 defined in the weight 128. In the locked configuration 136, a portion of the weight 128 is not covered by the cover 130 and exposed within the channel 134 such that the portion forms part of the outer surface 120 of the body 106. This enables for the location of the weight 128 within the channel 134 to be easily determined by visual inspection.

Figure 4:
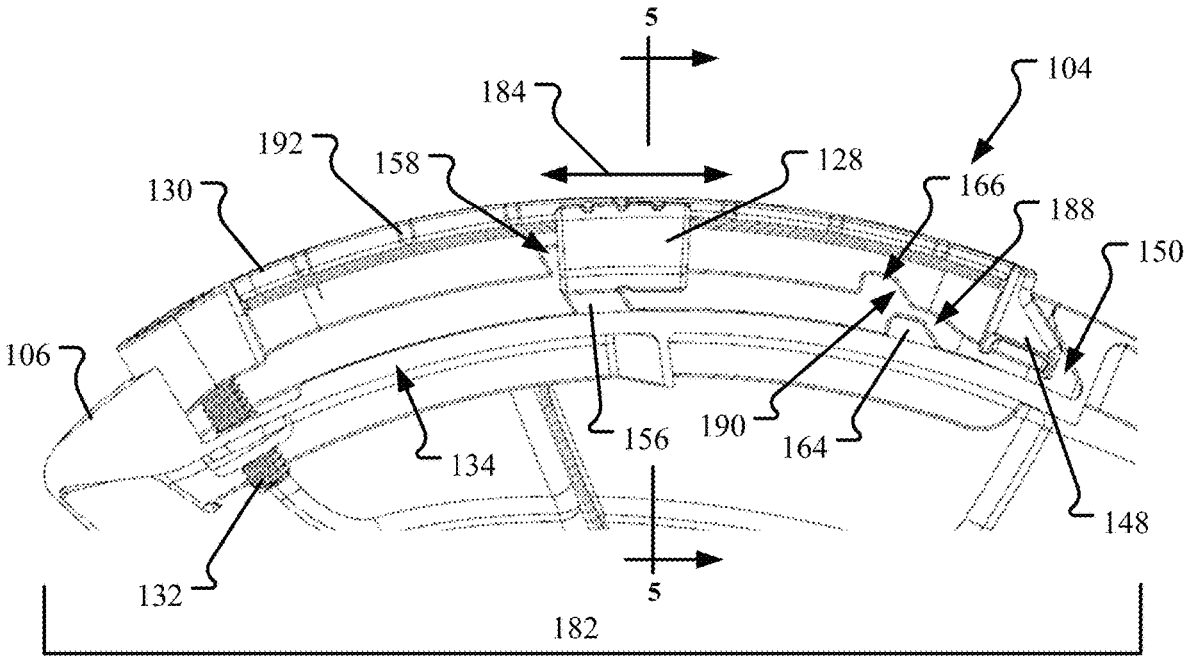
FIG. 4 is a cross-sectional view of the golf club head taken along line 2-2 in FIG. 1 where the weight assembly is in an unlocked configuration.
Figure 5:
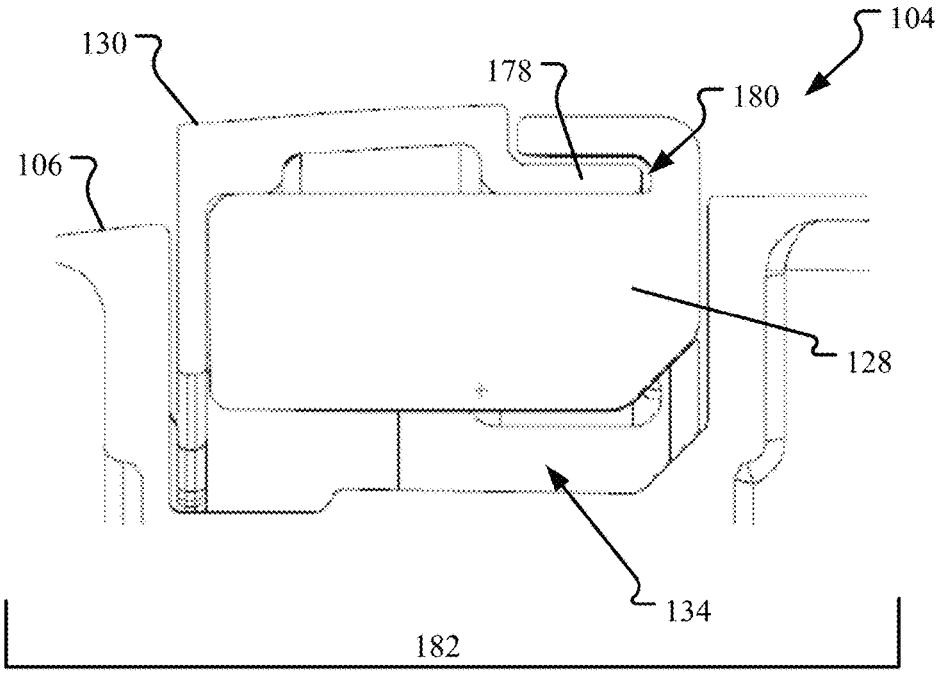
FIG. 5 is a cross-sectional view of the weight assembly taken along line 5-5 in FIG. 4.

FIG. 4 is a cross-sectional view of the club head 100 taken along line 2-2 in FIG. 1 and showing the weight assembly 104 in an unlocked configuration 182. FIG. 5 is a cross-sectional view of the weight assembly 104 taken along line 5-5 in FIG. 4. Referring concurrently to FIGS. 4 and 5, when the weight assembly 104 is in the unlocked configuration 182, at least a portion of the cover 130 is lifted and raised out of the channel 134 such that the weight 128 is selectively slidable (e.g., along a toe-heel direction 184) within the channel 134. In the example, the fastener 132 may be coupled to the cover 130 (e.g., with a lock washer 186 (shown in FIG. 16)), so that the cover 130 moves along the fastener axis 142 (shown in FIG. 2) upon rotation of the fastener 132. The cover 130 and the fastener 132 may be completely removed from the body 106 as required or desired so as to completely remove the weight 128 from the channel 134. However, in examples, moving the weight assembly 104 between the locked configuration 136 (shown in FIGS. 2 and 3) and the unlocked configuration 182 does not require that the weight assembly 104 be uncoupled from the body 106. As such, in the unlocked configuration 182, the cover 130 may remain coupled to the body 106 so that it is less likely that the components become lost or misplaced. In some examples, the fastener 132 and/or the nut 138 may include a hard stop (not shown) that prevents the fastener 132 from being completely de-threaded from the club head 100 as required or desired.

Since only a single fastener 132 is used to couple the cover 130 to the body 106 and the fastener 132 is positioned at the heel end of the weight assembly 104, the cam 164 may be used to assist the toe end of the cover 130 with lifting from the channel 134 in the unlocked configuration 182. This enables the weight 128 to more easily slide to positions away from the fastener 132. In the example, the cam 164 extends in the toe-heel direction of the channel 134 and includes at least one camming surface 188 that slidingly engages with a corresponding camming surface 190 of the cutout 166. As the cover 130 moves from the locked configuration 136, where the cam 164 is received within the cutout 166, toward the unlocked configuration 182, the camming surfaces 188, 190 slide against one another to lift the toe end of the cover 130. In some examples, when the weight assembly 104 is in the unlocked configuration 182, a portion of the cover 130 may be supported on the cam 164. The camming surfaces 188, 190 may be substantially parallel to the fastener axis 142.

Additionally, in the unlocked configuration 182, the notch 158 may lift away from the seat 156 to disengage the oblique surfaces 160, 162 (shown in FIG. 2). In the unlocked configuration 182, the notch 158 may lift partially or completely for the seat 156. The projection 148 may also lift away from the chamber 150. However, the projection 148 may remain at least partially engaged with the chamber 150 so that the weight 128 cannot slide out of the toe end of the cover 130 and remain within the channel 134 in the unlocked configuration 182. Furthermore, because the weight 128 is engaged with the cover 130 (e.g., the flange 178 and the groove 180), the weight 128 moves with the cover 130 between the locked configuration 136 and the unlocked configuration 182. This enables the weight 128 to be more easily slidable in the unlocked configuration 182.

In some examples, one or more of the weight 128, the cover 130, and the channel 134 may include complementary features (e.g., corresponding detents 192 on the cover 130 and recesses (not shown) on the weight 128) that index the location of the weight 128 to the channel 134 and/or the cover 130. These complementary indexing features may provide tactile and/or audible feedback when the weight 128 is moved. Additionally, the complementary indexing features may also provide increased resistance to the relative movement between the weight 128 and the channel 134 and/or cover 130 when the weight assembly 104 is in the locked configuration 136.

Figure 6:
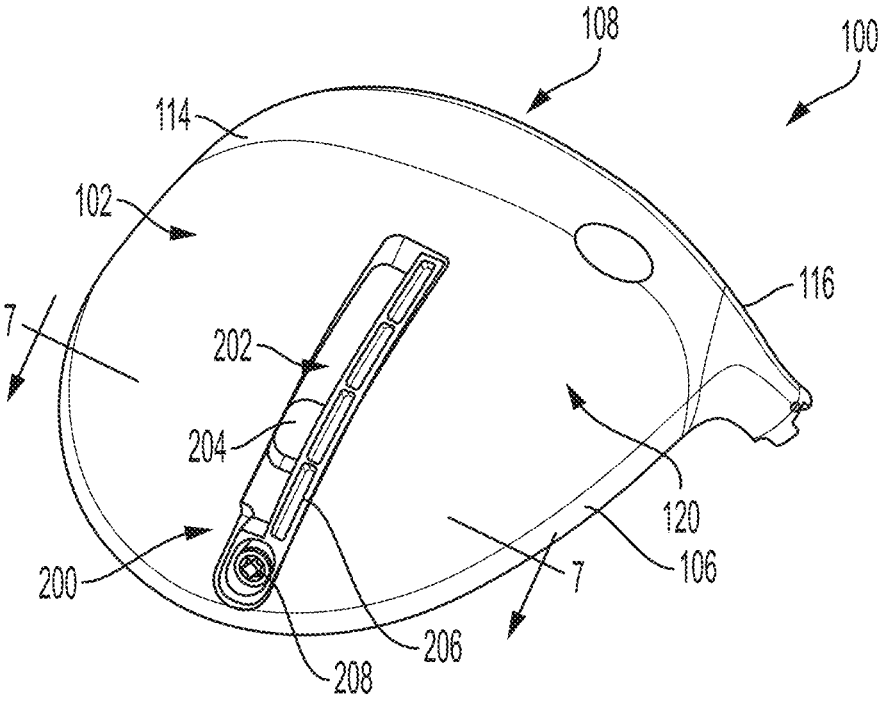
FIG. 6 is a perspective view of the sole of the golf club head with another weight assembly.
Figure 7:
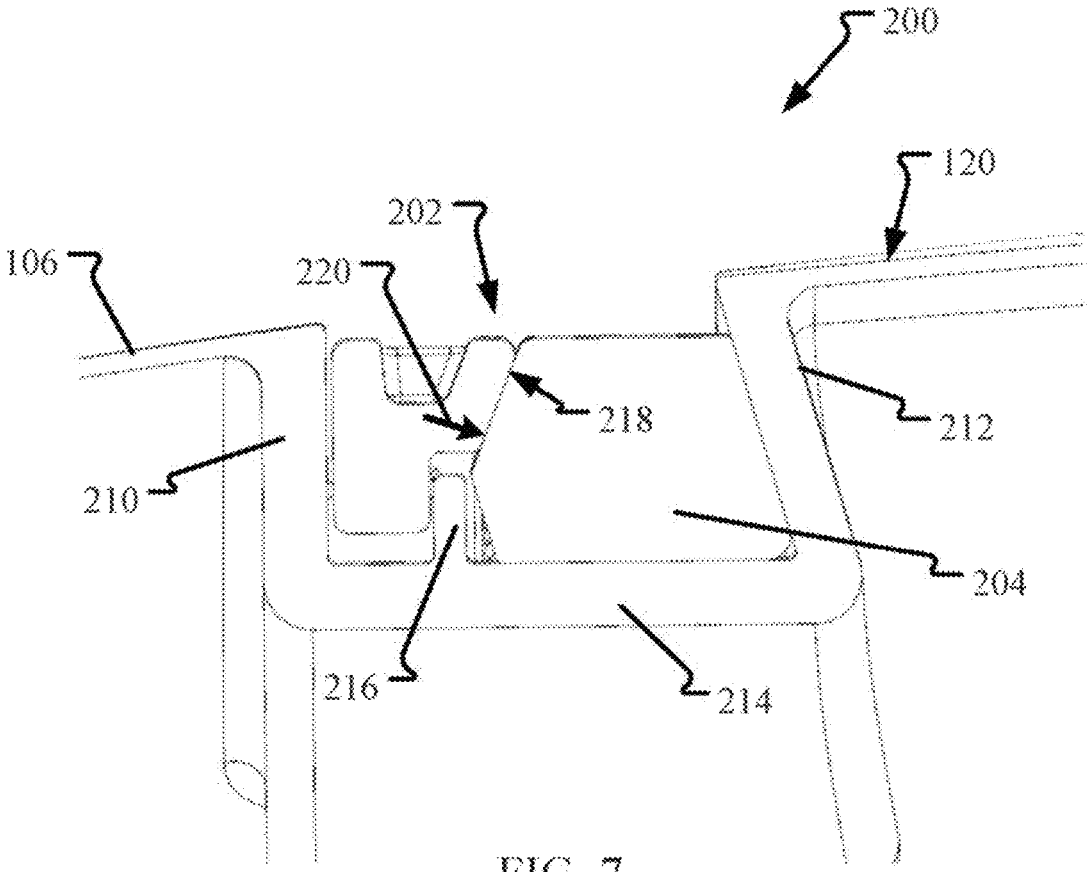
FIG. 7 is a cross-sectional view of the weight assembly taken along line 7-7 in FIG. 6.

FIG. 6 is a perspective view of the sole 102 of the golf club head 100 with another weight assembly 200. FIG. 7 is a cross-sectional view of the weight assembly 200 taken along line 7-7 in FIG. 6. Certain components are described above, and thus, are not necessarily described further. Referring concurrently to FIGS. 6 and 7, the weight assembly 200 includes a recessed channel 202 defined within the sole 102 of the body 106 of the club head 100, however, the channel 202 extends substantially linearly in a front-rear direction so that the CG and the MOI of the club head 100 can be adjusted for launch angle bias. The channel 202 can be substantially orthogonal to the striking face 108 as illustrated in FIG. 6. In other examples, the channel 202 may extend at either an acute or obtuse angle relative to the striking face 108. The weight assembly 200 also includes a slidable weight 204, a cover 206, and a fastener 208. In this example, the fastener 208 is positioned proximate to the rear of channel 202 and opposite of the striking face 108. In other examples, the fastener 208 may be positioned at any other location relative to the channel 202 to enable the weight assembly 200 to function as described herein. For example, at approximately a midpoint of the channel 202 or proximate the striking face 108 side of the channel 202.

In this example, the channel 202 is formed by two opposing sidewalls, a cover sidewall 210 and an undercut sidewall 212, and a bottom track 214 offset from the outer surface 120 of the body 106. A partial wall 216 also extends from the bottom track 214. Here, the cover 206 is located adjacent to the cover sidewall 210 and includes an angled surface 218. As such, when the weight assembly 200 is in a locked configuration (e.g., FIG. 7), the cover 206 generates a compressive force 220 along the angled surface 218 that acts in both a downward direction and a transverse direction to secure the weight 204 between the cover 206 and the undercut sidewall 212. Accordingly, the weight 204 is frictionally secured to one or more portions of the club head 100 by the weight assembly 200 and at least partially underneath the angled surface 218 and the undercut sidewall 212. The weight 204 is at least partially trapezoidal in cross-sectional shape so that the undercuts of the sidewall 212 and the cover 206 assist in retaining the weight 204 within the channel 202. Additionally, the cover 206 engages with the partial wall 216 so that the portion of the cover 206 away from the fastener 208 is restricted from moving within the channel 202 (e.g., bending or flexing) towards the undercut sidewall 212. Furthermore, the partial wall 216 is substantially parallel to the fastener axis (not shown) of the fastener 208 so that the cover 206 is guided between the locked and unlocked configuration. In some example, the weight assembly 200 may include the seat/notch interface as described above to further engage the cover 206 within the channel 202 and increase the securement of the weight 204 to one or more portions of the club head 100.

Figure 8:
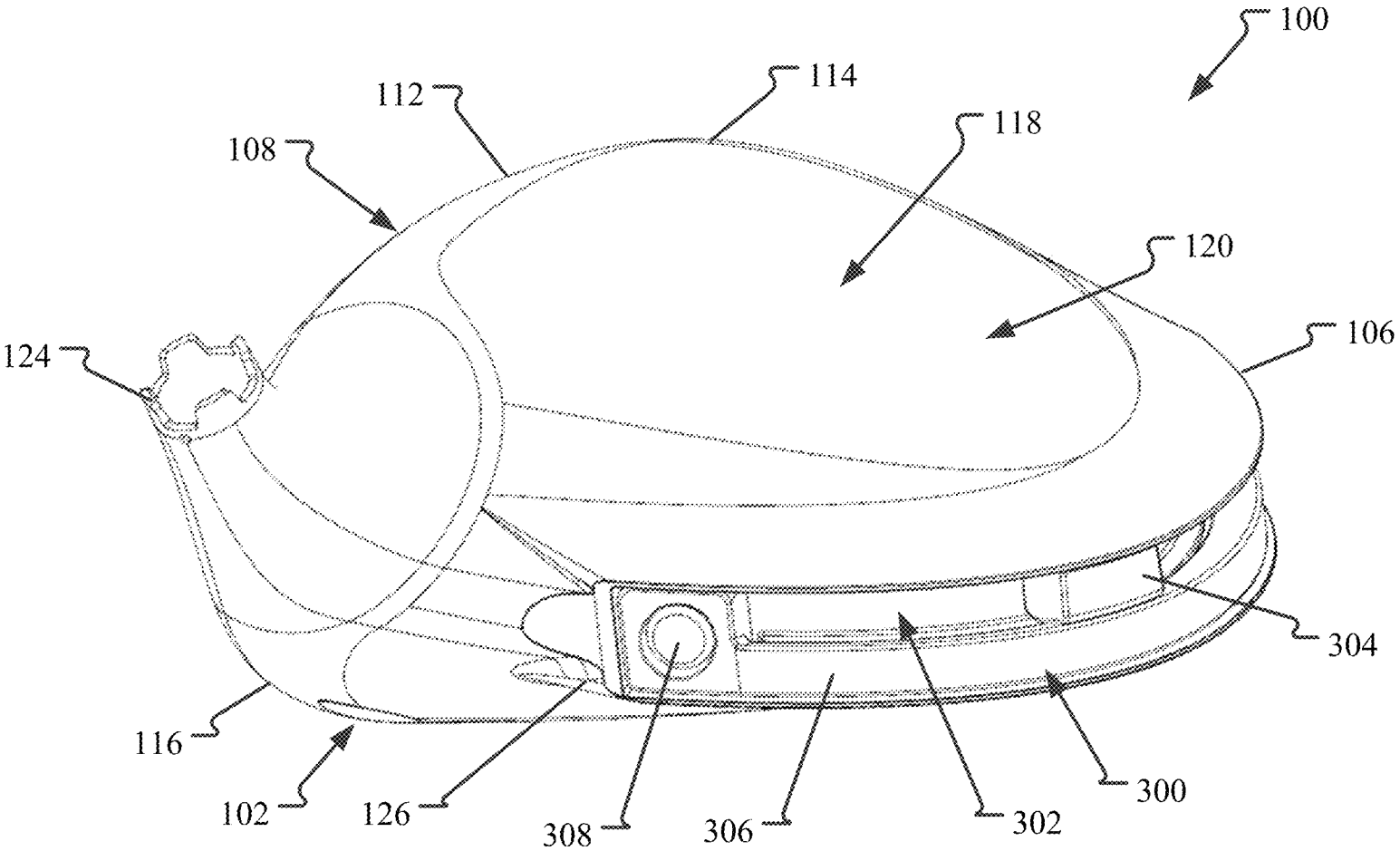
FIG. 8 is a perspective view of the golf club head with another weight assembly.

FIG. 8 is a perspective view of the golf club head 100 with another weight assembly 300. Certain components are described above, and thus, are not necessarily described further. In this example, the club head 100 includes the skirt 126 positioned between the crown 118 and the sole 102, opposite of the striking face 108. The weight assembly 300 includes a recessed channel 302 defined within the skirt 126 of the body 106 of the club head 100 and extends along the rear perimeter of the club head 100 such that the channel 302 has a curved shape. The weight assembly 300 also includes a slidable weight 304, a cover 306, and a fastener 308. In this example, the fastener 308 is coupled to the heel 116 side of the body 106. In other examples, the fastener 308 may be coupled to the toe 114 side of the body 106 as required or desired. The weight assembly 300 may include one or more of the weight assembly features described herein to enable the CG and the MOI of the club head 100 to be adjustable for fade-draw bias, while securing the weight 304 in a locked configuration (as shown in FIG. 8).

Figure 9:
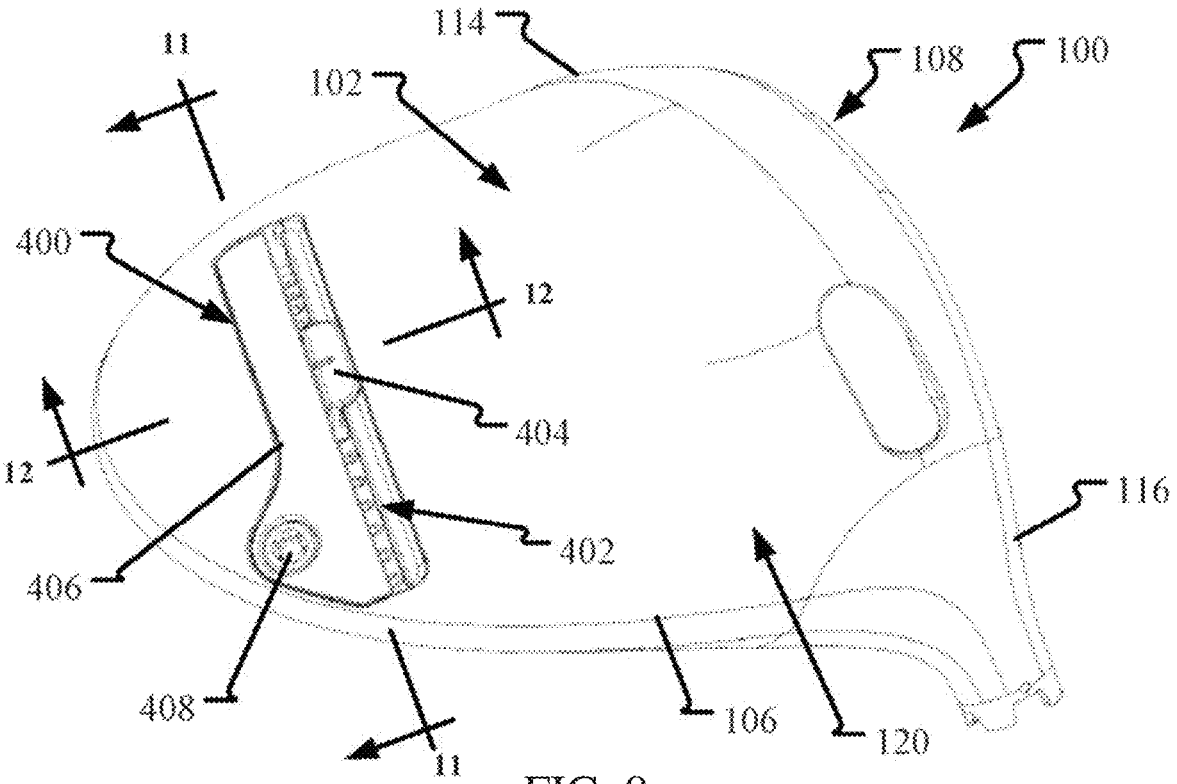
FIG. 9 is a perspective view of the sole of the golf club head with another weight assembly.
Figure 10:
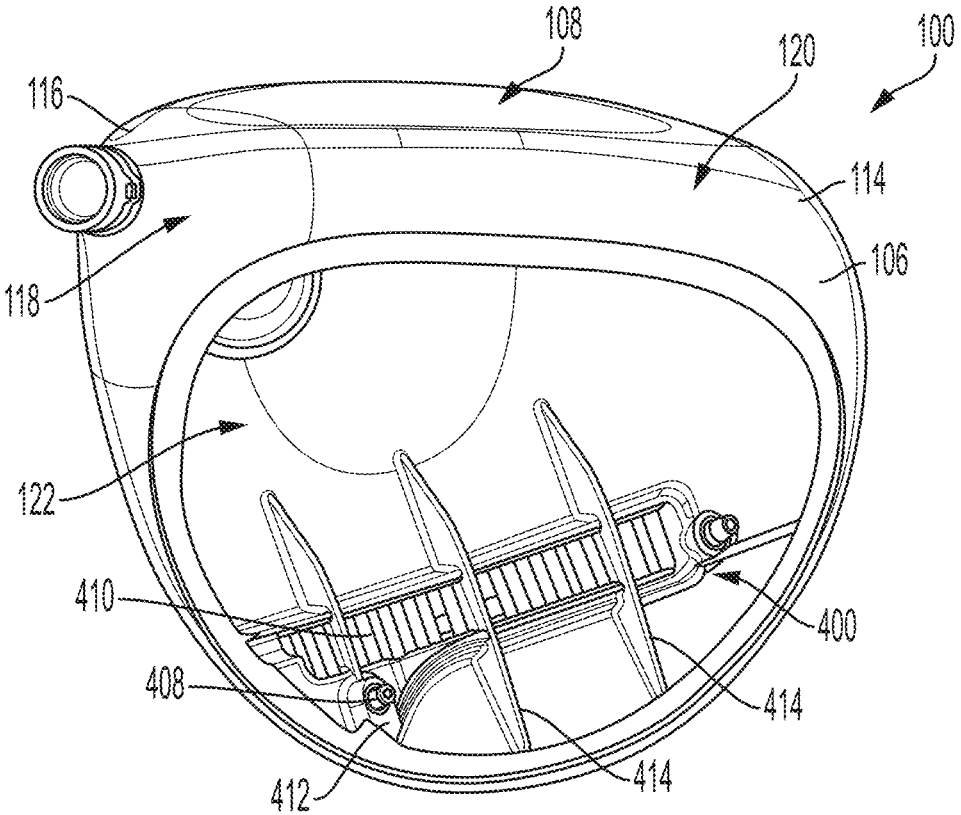
FIG. 10 is a top view of the golf club head shown in FIG. 9 with a portion of a crown removed.

FIG. 9 is a perspective view of the sole 102 of the golf club head 100 with another weight assembly 400. FIG. 10 is a top view of the golf club head 100 shown in FIG. 9 with a portion of the crown 118 removed. Certain components are described above, and thus, are not necessarily described further. Referring concurrently to FIGS. 9 and 10, the weight assembly 400 includes a recessed channel 402 defined within the sole 102 of the body 106 of the club head 100 that extends substantially linearly in the toe 114—heel 116 direction. The weight assembly 400 also includes a slidable weight 404, a cover 406, and a fastener 408. The channel 402 includes a bottom track 410 that the weight 404 is slidable on. In this example, the fastener 408, and also a nut 412 that the fastener 408 couples to, are offset from the track 410 and positioned towards the rear of the body 106. By offsetting the fastener 408 from the track 410, the length of the track 410 can be extended in the toe-heel direction so that the weight 404 can be positioned at a greater number of locations on the sole 102. In other examples, the fastener 408 may be offset from the track 410 and positioned towards the front and the striking face 108 of the body 106 as required or desired.

In this example, one or more support ribs 414 may extend from the channel 402 and within the interior cavity 122 of the body 106. The support ribs 414 are substantially orthogonal to the length of the channel 402. The support ribs 414 provide structural strength to the channel 402 so that the channel 402 is resistant to deformation when the cover 406 compresses the weight 404 therein. In some examples, the support ribs 414 may extend the entire distance between the sole 102 and the crown 118 within the interior cavity 122.

Figure 11:
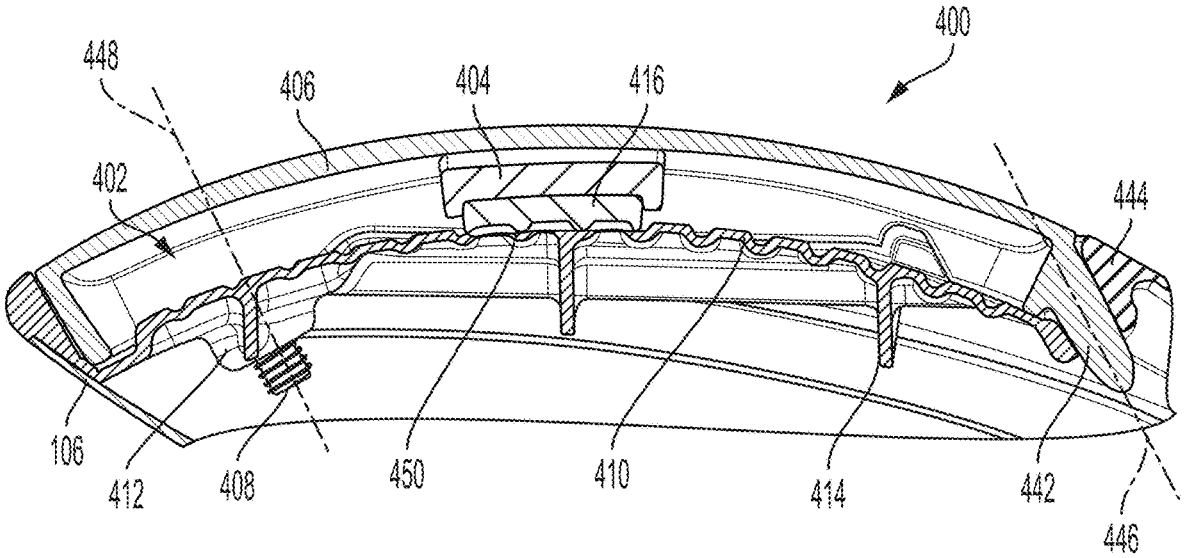
FIG. 11 is a cross-sectional view of the weight assembly taken along line 11-11 in FIG. 9.
Figure 12:
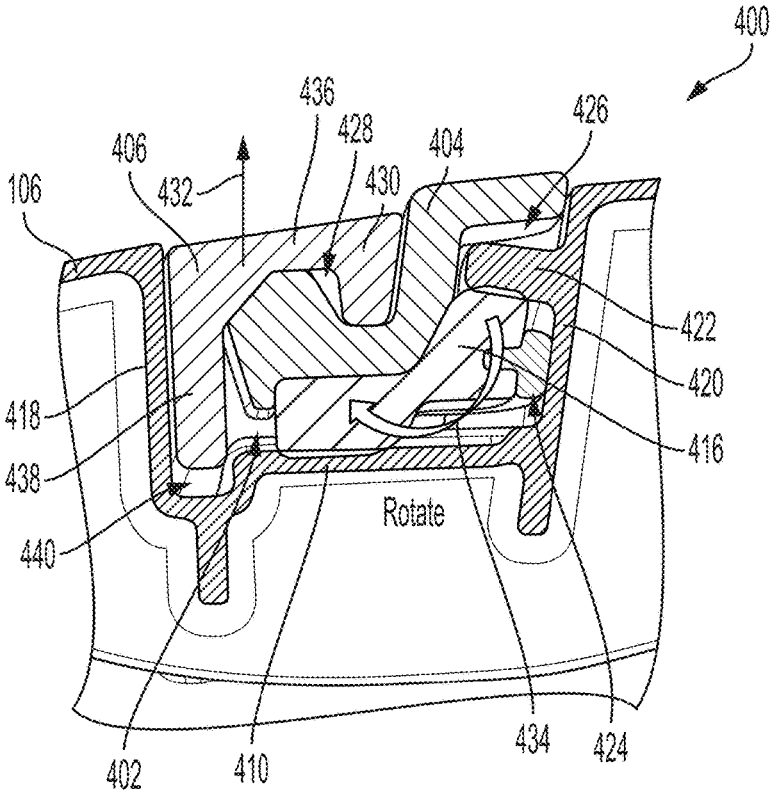
FIG. 12 is a cross-sectional view of the weight assembly taken along line 12-12 in FIG. 9.

FIG. 11 is a cross-sectional view of the weight assembly 400 taken along line 11-11 in FIG. 9. FIG. 12 is a cross-sectional view of the weight assembly 400 taken along line 12-12 in FIG. 9. Certain components are described above, and thus, are not necessarily described further. Referring concurrently to FIGS. 11 and 12, the weight assembly 400 is illustrated in a locked configuration so that the weight 404 is secured within the channel 402. In this example, the weight 404 includes an elastomeric material 416 (e.g., a rubber-based material) that engages with the channel 402 and/or the cover 406 and further increase securement of the weight 404 in the locked configuration. Additionally, the elastomeric material 416 decreases rattling of the weight 404 within the channel 402 during the swing of the club head.

In this example, the channel 402 is formed from two opposing sidewalls 418, 420 and the track 410. One sidewall 420 may include an elongate fin 422 extending into the channel 402. The weight 404 is sized and shaped to be received at least partially within the channel 402 and includes a bottom surface 424 that is positioned adjacent to the track 410 and a slot 426 that engages with the fin 422. Additionally, opposite of the slot 426, the weight 404 includes a groove 428 that engages with a flange 430 of the cover 406. The elastomeric material 416 may be coupled to the weight 404 so that the material 416 extends from the bottom surface 424 and also into the slot 426. In one example, the elastomeric material 416 may be a unitary piece that extends through one or more holes within the weight 404. In other examples, the elastomeric material 416 may be adhered to one or more external surfaces of the weight 404. In still other examples, at least a portion of the elastomeric material 416 may form the weight 404 itself.

In operation, when the cover 406 is in the locked configuration, the flange 430 engages with the groove 428 of the weight 404 and compresses the weight 404 into the channel 402. As such, the elastomeric material 416 may engage with the track 410 and the fin 422 of the channel 402. By engaging the elastomeric material 416 in more than one location, securement of the weight 404 within the channel 402 increases. This reduces undesirable movement and rattling of the weight 404 within the channel 402. In some examples, the elastomeric material 416 may deform when compressed within the channel 402. Since the cover 406 engages with only a portion of the weight 404, when the cover 406 is lifted 432 for the unlocked configuration (not shown), the weight 404 can rotate 434 within the channel 402 so that the elastomeric material 416 may disengage from the track 410 and the fin 422. This rotational movement 434 enables the weight 404 to be more easily slidable within the channel 402 while in the unlocked configuration because the elastomeric material 416 is at least partially positioned away from the channel surfaces. In some examples, the elastomeric material 416 extending from the bottom surface 424 may be only proximate the groove 428 so as to increase rotational movement 434 of the weight 404.

The cover 406 is substantially L-shaped in cross-section (see FIG. 12) and receives at least a portion of the weight 404 therein. The cover includes a first leg 436 that has the flange 430 and a second leg 438 that is adjacent to the sidewall 418 of the channel 402. The flange 430 may be substantially parallel to the second leg 438 so as to increase the structural rigidity of the cover 406 in the lengthwise direction. The second leg 438 may extend at least partially within a depression 440 of the track 410 so as to decrease bending of the cover 406 while in the locked configuration. Additionally, in the example, a projection 442 of the cover 406 may be substantially cylindrical in shape. The projection 442 is received within a corresponding cylindrical chamber 444. This projection 442 and chamber 444 structure increases the engagement of the cover 406 with the body 106 in the locked configuration (as illustrated in FIG. 11). In some examples, a projection axis 446 of the projection 442 may be substantially parallel to a fastener axis 448. This orientation guides the movement of the cover 406 between the locked configuration and the unlocked configuration. In some examples, the projection 442 may include a tapered nose. In this example, the weight 404 and the channel 402 may include complementary features 450 that index the location of the weight 404 to the channel 402.

Figure 13:
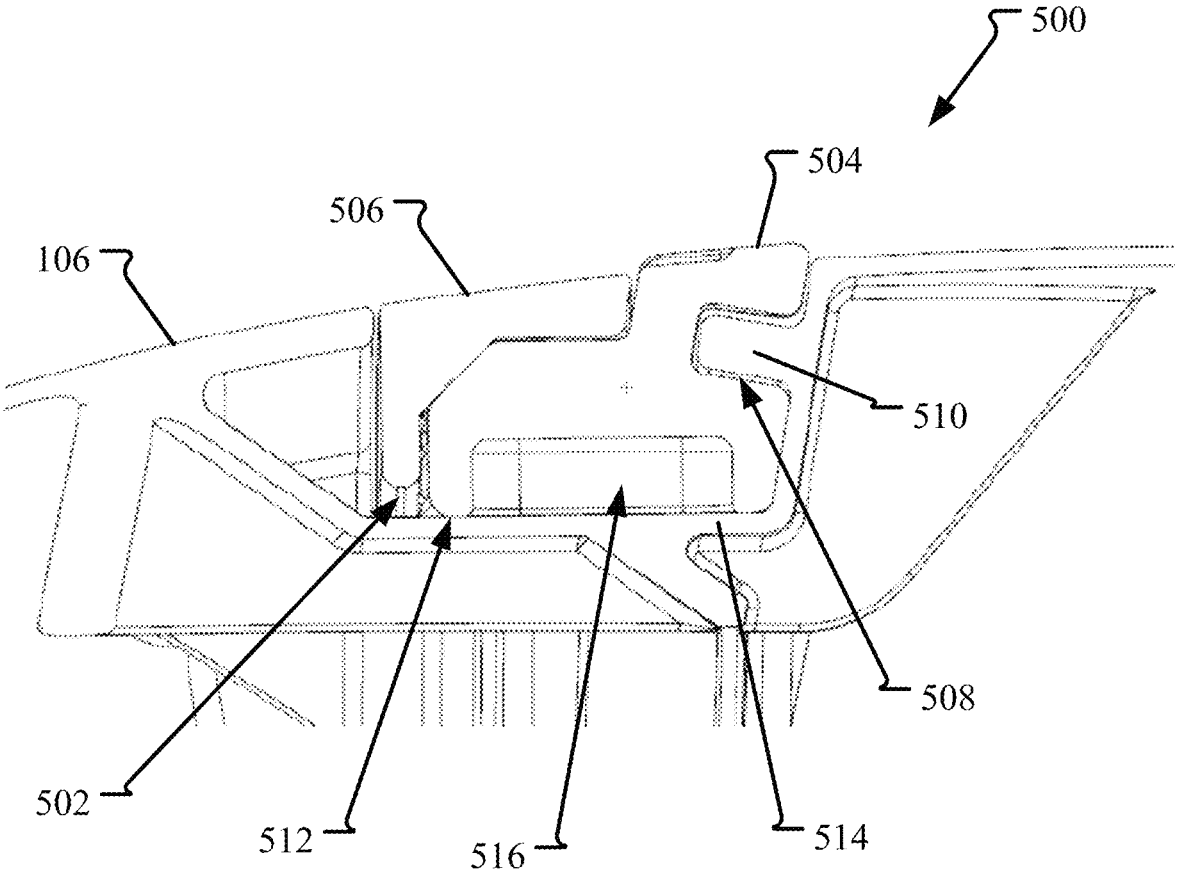
FIG. 13 is a cross-sectional view of another weight assembly.

FIG. 13 is a cross-sectional view of another weight assembly 500. Certain components are described above, and thus, are not necessarily described further. Similar to the example described in FIGS. 9-12, in this example, the weight assembly 500 includes a recessed channel 502 defined within the body 106 of the club head. The weight assembly 500 also includes a slidable weight 504 and a cover 506. The cover 506 is shown in a locked configuration and a slot 508 of the weight 504 is engaged with a fin 510 of the channel 502. However, in this example, a bottom surface 512 of the weight 504 is positioned directly against a track 514 of the channel 502. Additionally, in this example, the bottom surface 512 of the weight 504 includes a hollow 516. The hollow 516 reduces fictional sliding forces on the weight 504, when the weight assembly 500 is in the unlocked configuration (not shown). The hollow 516 also enables for the size and shape of the weight 504 to be formed while maintaining the required or desired mass and/or density of the weight 504. In some examples, an elastomeric material (not shown) may be disposed at least partially within the hollow 516.

Figure 14:
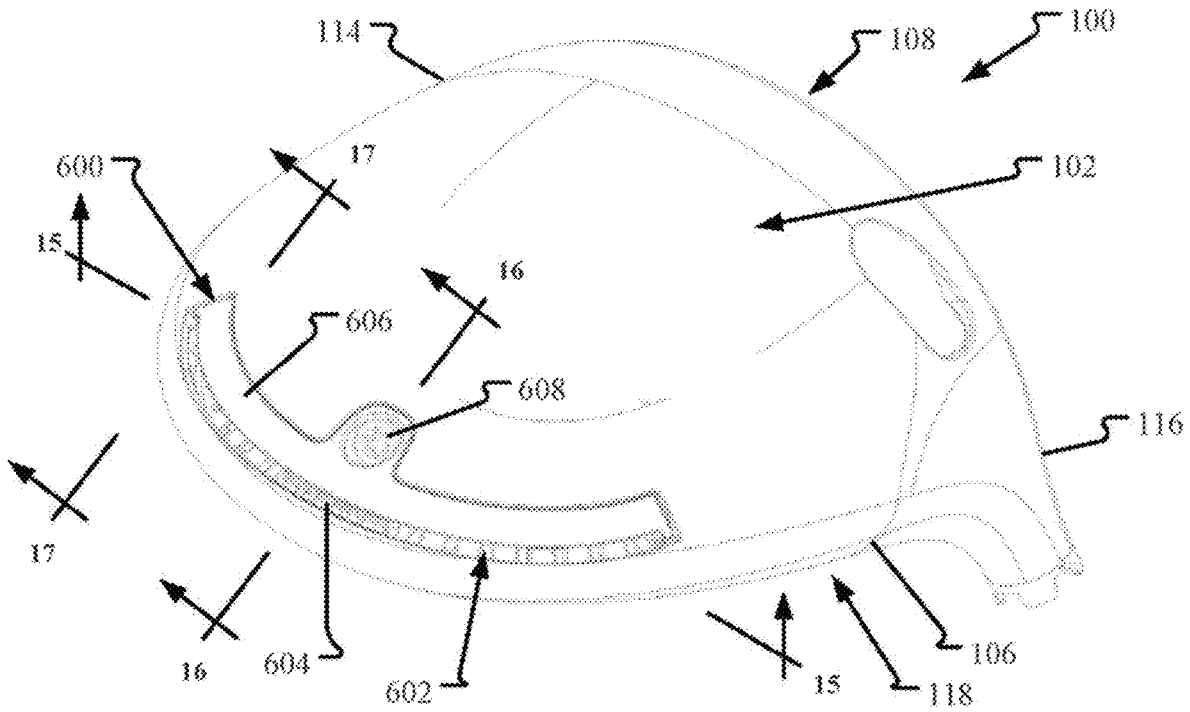
FIG. 14 is a perspective view of the sole of the golf club head with another weight assembly.

FIG. 14 is a perspective view of the sole 102 of the golf club head 100 with another weight assembly 600. Certain components are described above, and thus, are not necessarily described further. The weight assembly 600 includes a recessed channel 602 defined within the sole 102 of the body 106 of the club head 100. The channel 602 has a substantially curved shape in the toe 114—heel 116 direction so that the CG and the MOI of the club head 100 can be adjustable for fade-drawn bias. In some examples, the curve of the channel 602 matches the rear perimeter of the body 106, where the sole 102 and the crown 118 are coupled together. The weight assembly 600 also includes a slidable weight 604, a cover 606, and a fastener 608.

In this example, the fastener 608 is positioned in the concave area of the curved channel 602 and towards the striking face 108 of the body 106. This position enables the weight 604 to be positioned adjacent to the rear perimeter of the body 106 and increase the adjustability of the CG and MOI of the club head 100, when compared to having the fastener 608 positioned in the convex area of the curved channel 602 and the weight 604 being closer to the striking face 108. Additionally, the weight 604 may slide completely from the toe 114 side to the heel 116 side and be located at any position of the channel 602 even adjacent to the fastener 608. In other examples, the fastener 608 may be positioned in the convex area of the curved channel 602 as required or desired. The fastener 608 is also positioned at approximately the midpoint of the channel 602. In other examples, the fastener 608 may be offset from the midpoint of the channel 602, or two or more fastener 608 may be used to couple the cover 606 to the body 106 (e.g., at each end of the channel 602).

Figure 15:
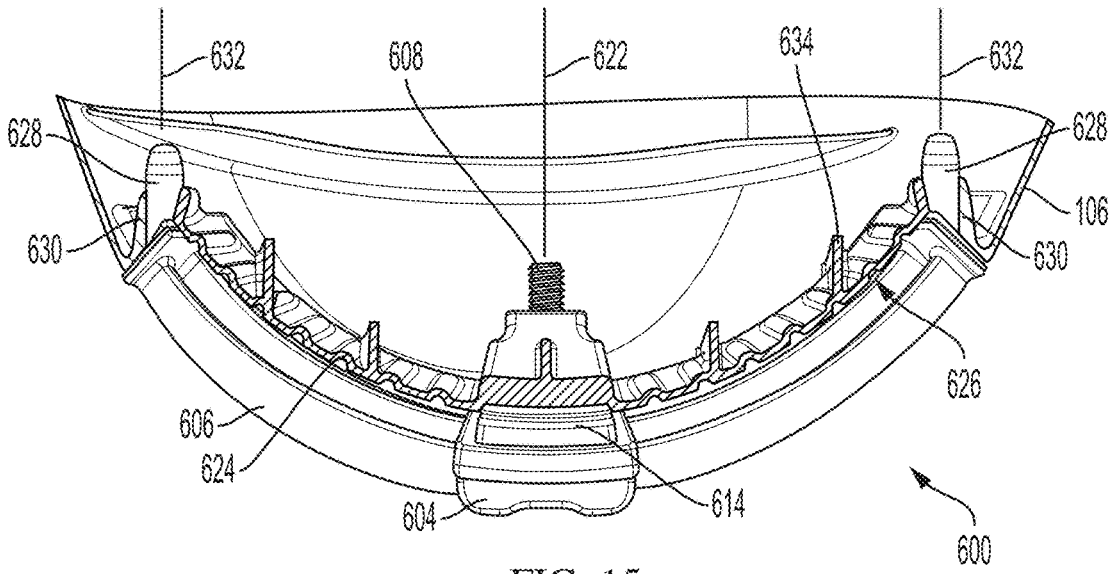
FIG. 15 is a cross-sectional view of the golf club head taken along line 15-15 in FIG. 14 and showing the weight assembly.
Figure 16:
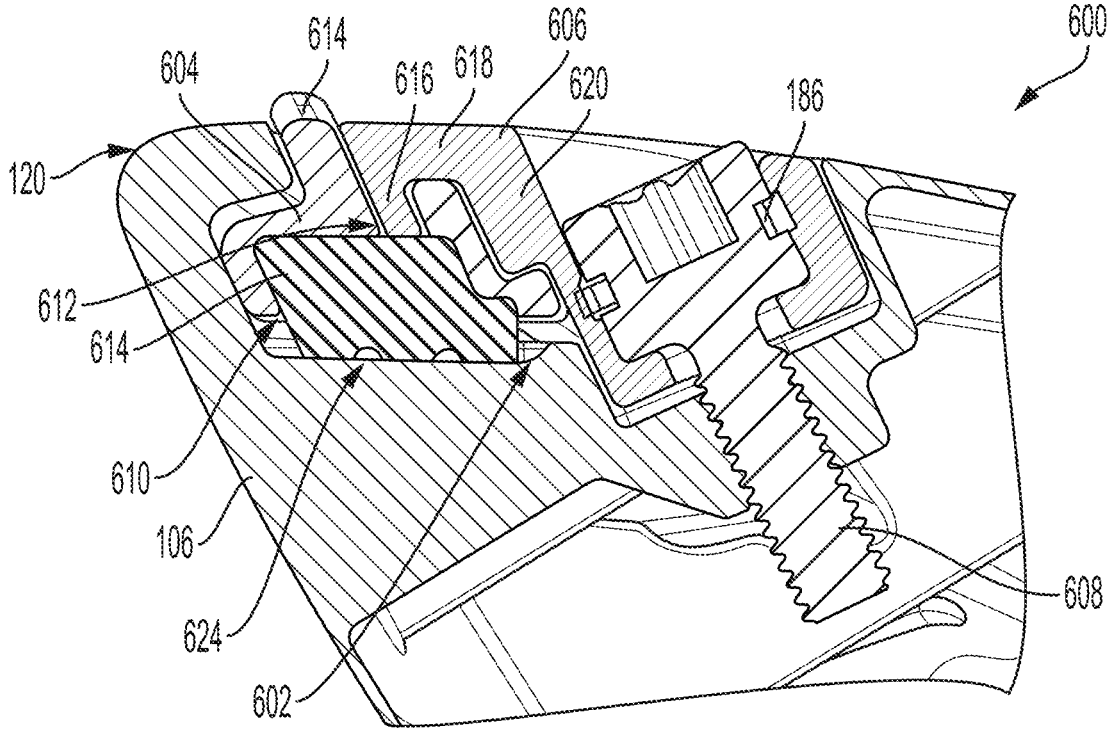
FIG. 16 is a cross-sectional view of the weight assembly taken along line 16-16 in FIG. 14.
Figure 17:
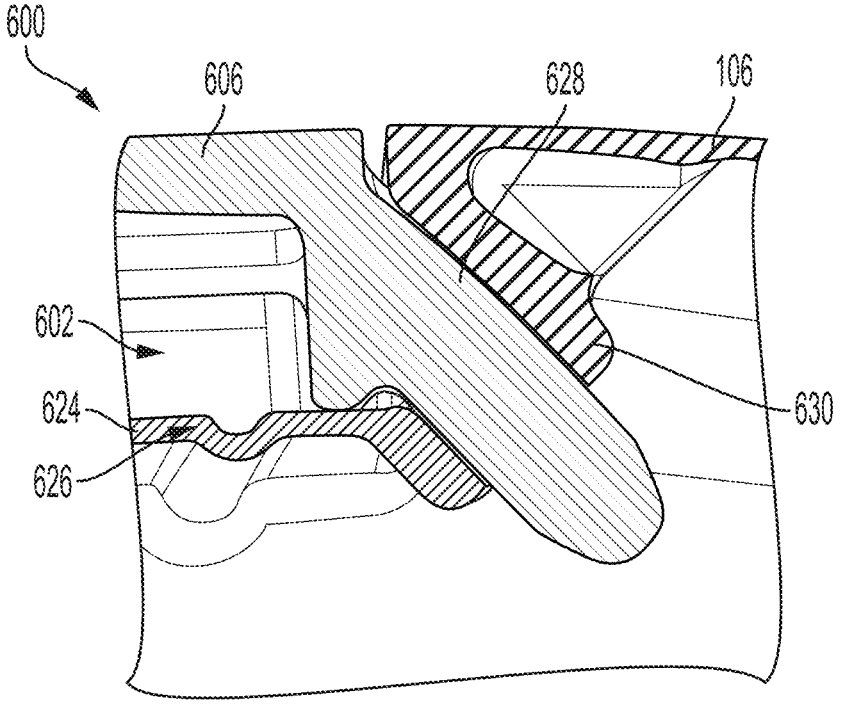
FIG. 17 is a cross-sectional view of the weight assembly taken along line 17-17 in FIG. 14.

FIG. 15 is a cross-sectional view of the club head 100 taken along line 15-15 in FIG. 14 and showing the weight assembly 600. FIG. 16 is a cross-sectional view of the weight assembly 600 taken along line 16-16 in FIG. 14. FIG. 17 is a cross-sectional view of the weight assembly 600 taken along line 17-17 in FIG. 14. Certain components are described above, and thus, are not necessarily described further. Referring concurrently to FIGS. 15-17, the weight assembly 600 is illustrated in a locked configuration and the weight 604 includes a bottom surface 610 and a groove 612. A tab 614 is disposed adjacent to the groove 612. Additionally, the weight 604 includes an elastomeric material 614. In this example, the elastomeric material 614 is coupled to the weight 604 and extends from the bottom surface 610 and also into the groove 612. The elastomeric material 614 is oversized relative to the channel 602 (e.g., between a 0.1 millimeter and 1.0 millimeter overlap) so that the material 614 may deform while being compressed within the channel 602. In other examples, the elastomeric material 614 may be adhered to the exterior surface of the weight 604. In yet other examples, the elastomeric material 614 may at least partially form the weight 604 itself.

The cover 606 is substantially C-shaped with a flange 616 that engages with the groove 612 of the weight 604. Additionally, the cover 606 includes a top leg 618 and a side leg 620 that is opposite of the flange 616. The top leg 618 has a thickness that is greater than the flange 616 and the side leg 620 so as to increase the structural rigidity of the cover 606 in a lengthwise direction. The fastener 608 is coupled to the cover 606 by a lock washer 186 that enables the fastener 608 to rotate relative to the cover 606 while allowing the cover 606 to move along a fastener axis 622 to raise and lower the cover 606 relative to the channel 602.

In operation, when the cover 606 is in the locked configuration, the flange 616 of the cover 606 is engaged within the groove 612 of the weight 604. This compresses the weight 604 between the cover 606 and a bottom track 624 of the channel 602. In the locked configuration, the elastomeric material 614 engages with both the cover 606 and the channel 602 to increase the securement of the weight 604 to one or more portion of the club head 100. In some examples, a plurality of grooves 626 are defined within the track 624 that the elastomeric material 614 deforms into the grooves 626 to facilitate securement of the weight 604 within the channel 602. Additionally, the tab 614 of the weight 604 may be positioned proximate the outer surface 120 of the body 106 so that the position of the weight 604 may be visible. When the weight assembly 600 is in the unlocked configuration (not shown), the cover 606 is lifted at least partially out of the channel 602 so that the weight 604 may be selectively slidable therein, for example, via the tab 614.

Each end of the cover 606 may include a substantially cylindrical projection 628 that is received within a corresponding cylindrical chamber 630 of the channel 602. The projections 628 extend along a projection axis 632 that is substantially parallel to the fastener axis 622. This orientation guides the movement of the cover 606 between the locked configuration and the unlocked configuration. In some examples, the projections 628 may include a tapered nose. Additionally, the chamber 630 may be open into the interior cavity 122 of the body 106 as illustrated in FIGS. 15 and 16. In other examples, the chamber 630 may be closed off from the interior cavity 122. One or more support ribs 634 may also extend from the track 624 and within the interior cavity 122 as required or desired.

Figure 18:
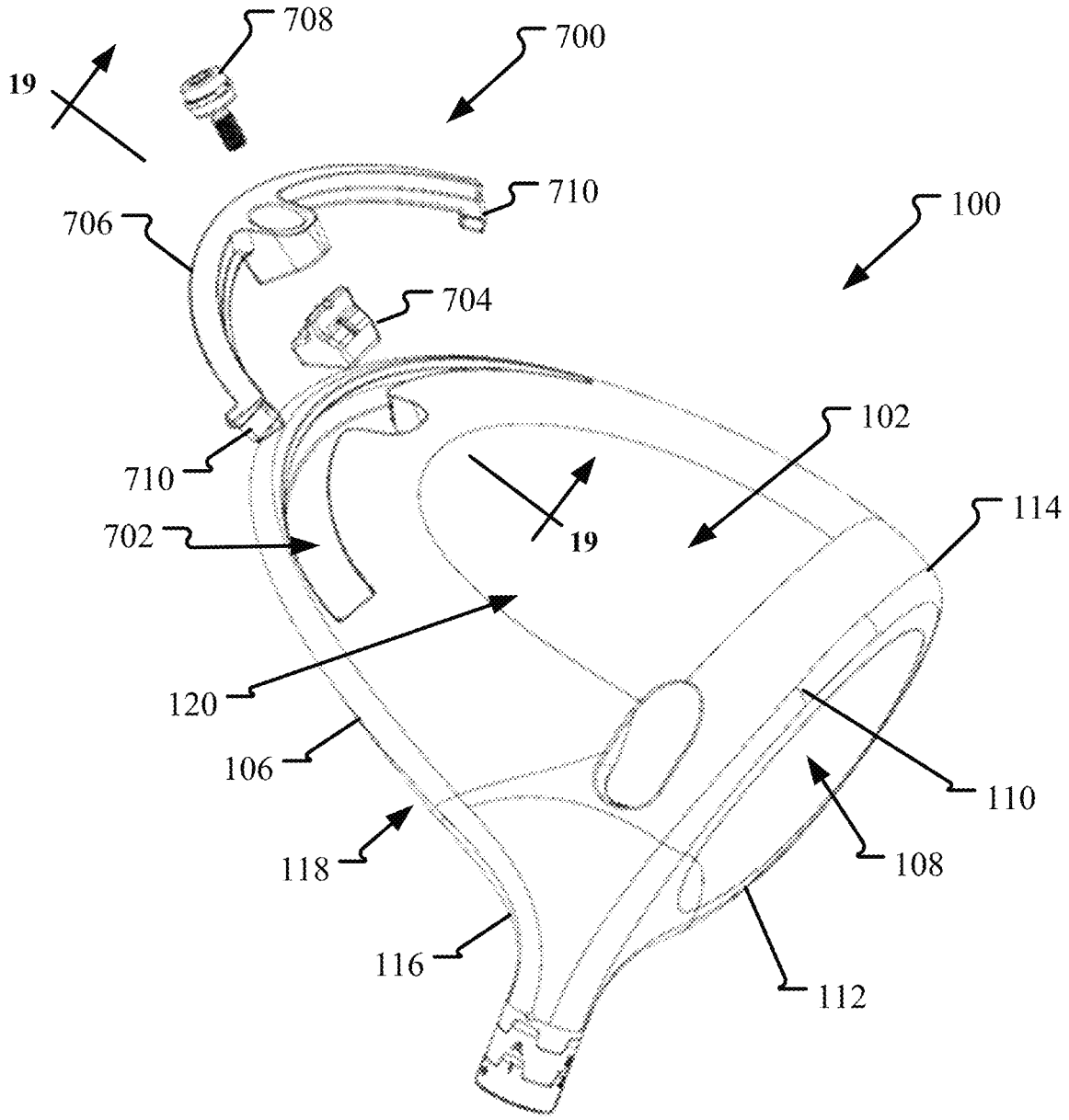
FIG. 18 is an exploded perspective view the golf club head with another weight assembly.

FIG. 18 is an exploded perspective view of the golf club head 100 with another weight assembly 700. Certain components are described above, and thus, are not necessarily described further. Similar to the example described in FIGS. 14-17, in this example, the weight assembly 700 includes a recessed channel 702 defined within the body 106 of the club head 100 and the channel 702 has a substantially curved shape in the toe 114—heel 116 direction. In some examples, the curve of the channel 702 matches the rear perimeter of the body 106, where the sole 102 and the crown 118 are coupled together. The weight assembly 700 also includes a slidable weight 704, a cover 706, and a fastener 708. At each end of the cover 706, projections 710 may extend for engagement within the channel 702.

Figure 19:
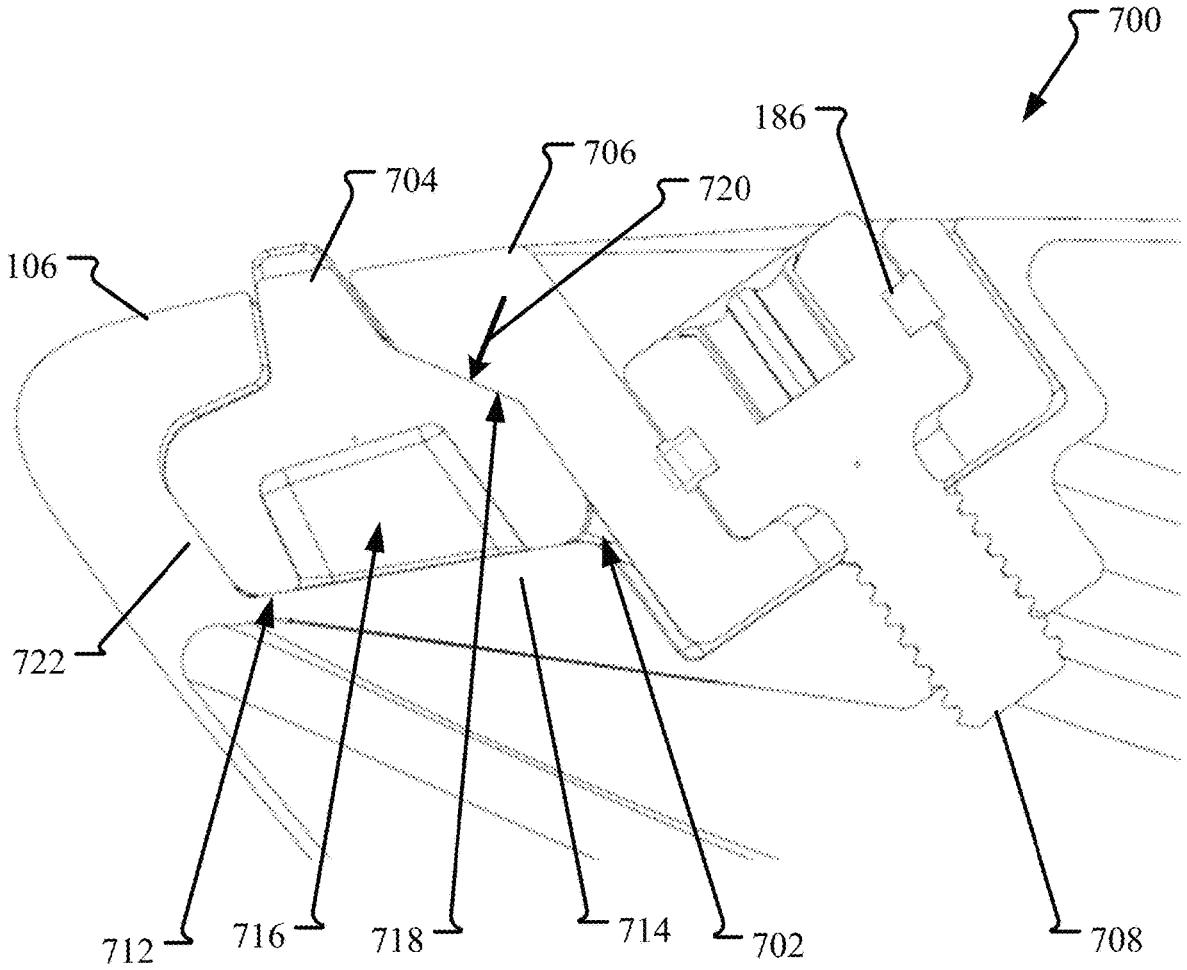
FIG. 19 is a cross-sectional view of the weight assembly taken along line 19-19 in FIG. 18.

FIG. 19 is a cross-sectional view of the weight assembly 700 taken along line 19-19 in FIG. 18. Certain components are described above, and thus, are not necessarily described further. The weight assembly 700 is illustrated in the locked configuration in FIG. 19 and a bottom surface 712 of the weight 704 is positioned directly against a track 714 of the channel 702. Additionally, in this example, the bottom surface 712 of the weight 704 includes a hollow 716. The hollow 716 reduces frictional sliding forces on the weight 704, when the weight assembly 700 is in the unlocked configuration (not shown). The hollow 716 also enables for the size and shape of the weight 704 to be formed while maintaining the required or desired mass and/or density of the weight 704. In some examples, an elastomeric material (not shown) may be disposed at least partially within the hollow 716.

Additionally, the cover 706 includes an angled surface 718 that abuts the weight 704. As such, when the weight assembly 700 is in a locked configuration (e.g., FIG. 19), the cover 706 generates a compressive force 720 along the angled surface 718 that acts in both a downward direction and a transverse direction to secure the weight 704 between the cover 706 and an undercut sidewall 722 of the channel 702. As such, the weight 704 is frictionally secured by the weight assembly 700 to one or more portions of the club head 100.

Figure 20:
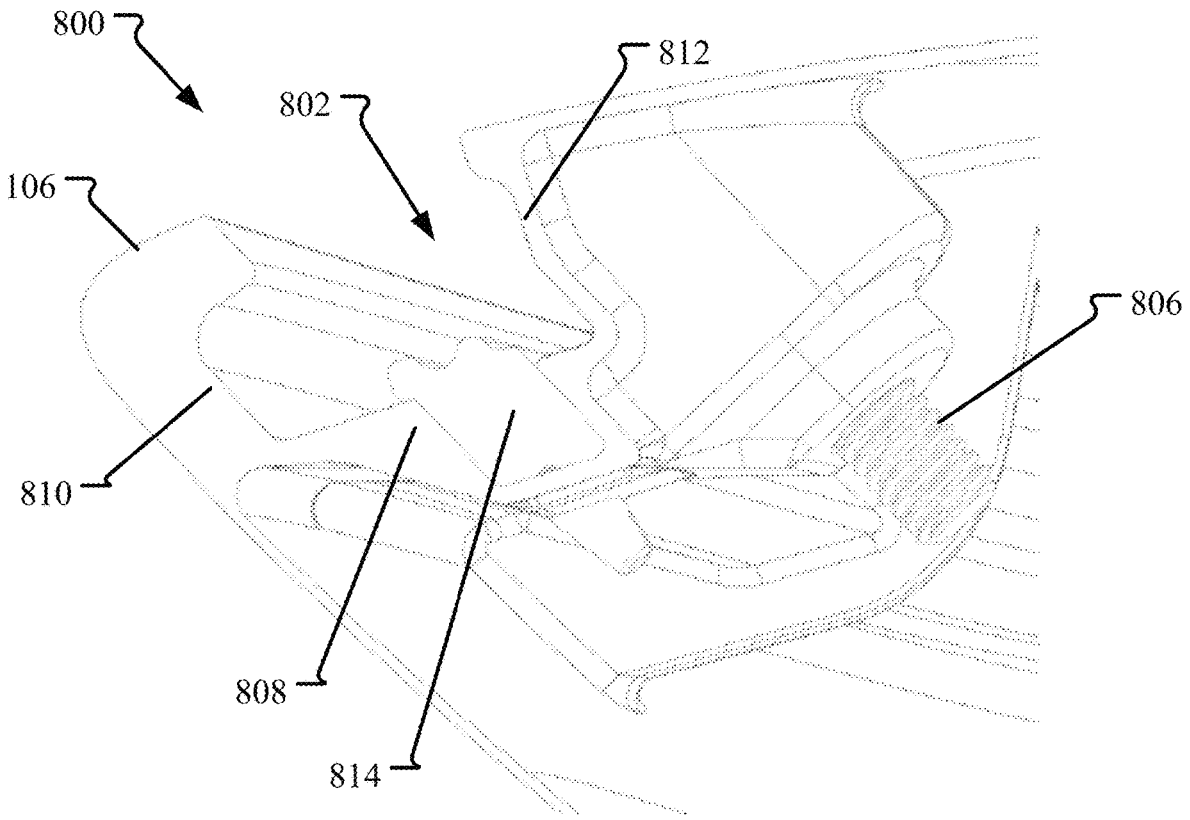
FIG. 20 is a partial cross-sectional perspective view of another weight assembly.
Figure 21:
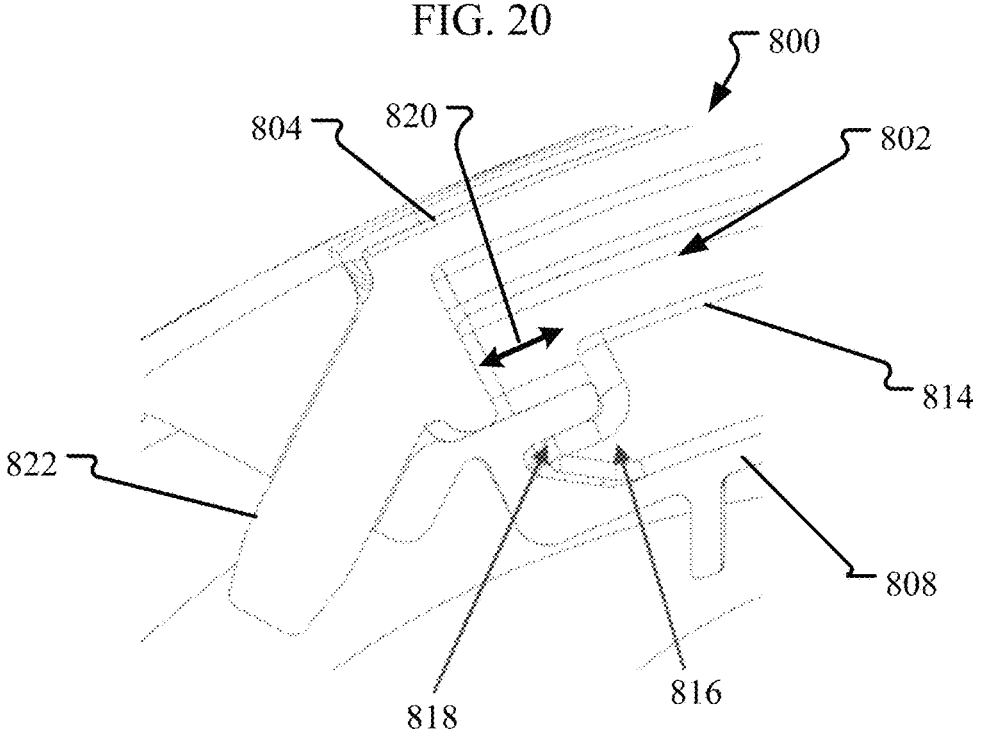
FIG. 21 is another cross-sectional view of the weight assembly shown in FIG. 20.

FIG. 20 is a partial cross-sectional perspective view of another weight assembly 800. FIG. 21 is another cross-sectional view of the weight assembly 800. Certain components are described above, and thus, are not necessarily described further. Referring concurrently to FIGS. 20 and 21, the cross-sectional views are substantially along a front-rear direction of the golf club head and, for example, similar to the examples described above in reference to FIGS. 16 and 17. The weight assembly 800 includes a recessed channel 802 defined within the body 106. The weight assembly 800 also includes a slidable weight (not shown), a cover 804, and a fastener 806. In this example, the channel 802 is defined by a bottom track 808 and two opposing sidewalls 810, 812. The bottom track 808 includes an elastomeric material 814 coupled thereto and that extends at least partially into the channel 802. The elastomeric material 814 engages with the weight and further increases securement of the weight within the channel 802 in the locked configuration. Additionally, the elastomeric material 814 decreases rattling of the weight during the swing of the club head. Additionally or alternatively, the elastomeric material 814 may be coupled to one or more of the sidewalls 810, 812 as required or desired. In still other examples, the elastomeric material 814 can be coupled to the cover 804.

In this example, the elastomeric material 814 extends along the longitudinal length of the channel 802. At each end 816 of the elastomeric material 814, a portion of the material may extend into an undercut area 818 within the channel 802 so as to secure the elastomeric material 814 within the channel 802. In other examples, the elastomeric material 814 may be adhered within the channel 802 or the cover 804 as required or desired. The end 816 of the elastomeric material 814 may be offset 820 from a projection 822 of the cover 804 so that the elastomeric material 814 does not interfere with the movement of the cover 804 between the locked and unlocked configurations as described herein.

Figure 22:
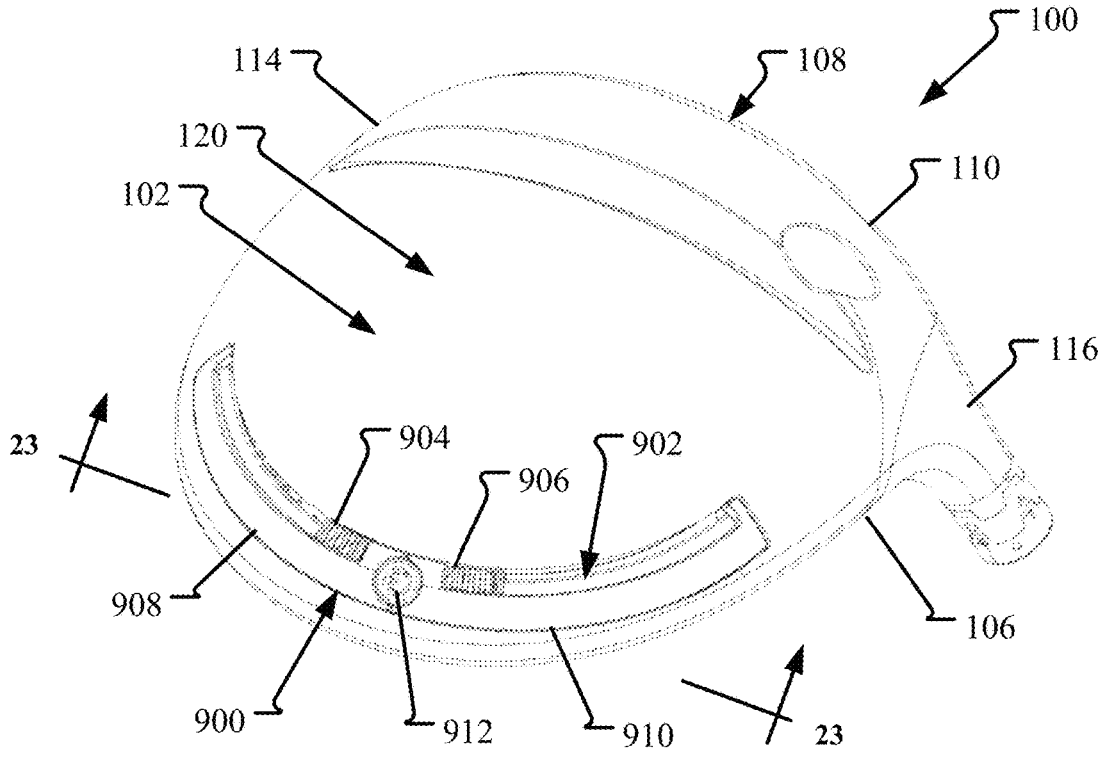
FIG. 22 is a perspective view of the sole of the golf club head with another weight assembly in a locked configuration.
Figure 23:
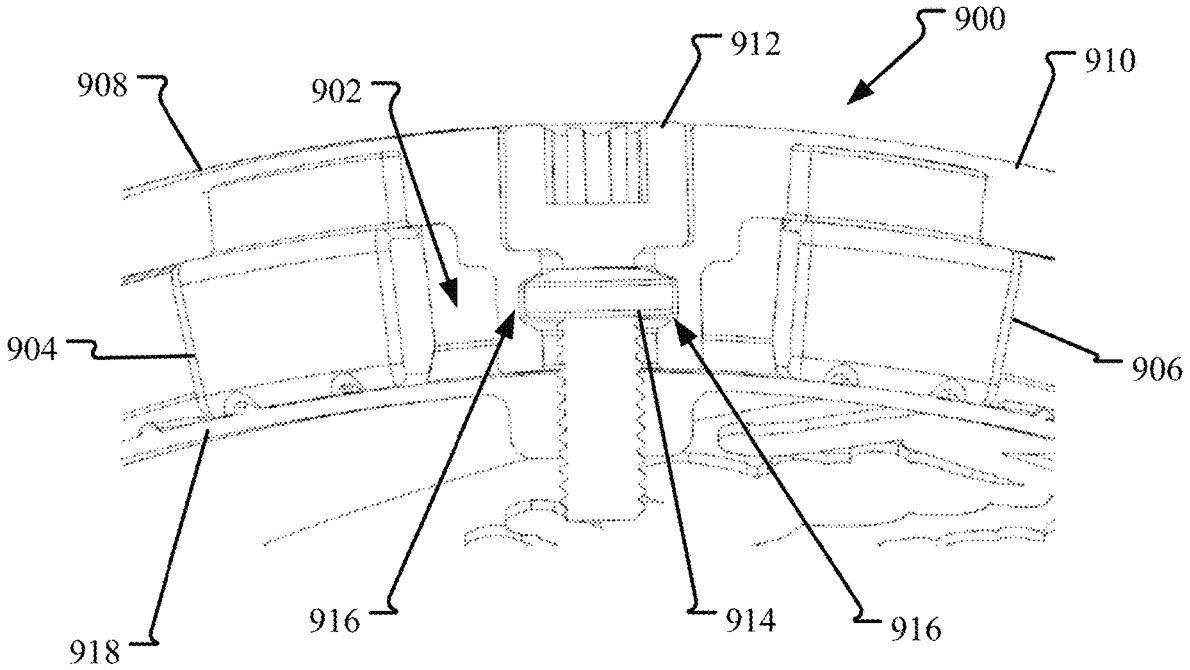
FIG. 23 is a cross-sectional view of the weight assembly taken along line 23-23 in FIG. 22.

FIG. 22 is a perspective view of the sole 102 of the golf club head 100 with another weight assembly 900 in a locked configuration. FIG. 23 is a cross-sectional view of the weight assembly 900 taken along line 23-23 in FIG. 22. Certain components are described above, and thus, are not necessarily described further. Referring concurrently to FIGS. 22 and 23, the weight assembly 900 is illustrated in a locked configuration and includes a recessed channel 902 defined within the sole 102 of the body 106 of the club head 100. The channel 902 has a substantially curved shape in the toe 114—heel 116 direction so that the CG and the MOI of the club head 100 can be adjustable for fade-drawn bias. In some examples, the curve of the channel 902 matches the rear perimeter of the body 106, where the sole 102 and the crown 118 are coupled together. The weight assembly 900 also includes a toe-side slidable weight 904, a heel-side slidable weight 906, a toe side cover 908, a heel side cover 910, and a fastener 912.

In this example, the fastener 912 is disposed within the channel 902 and divides the weight assembly 900 approximately in half. By positioning the fastener 912 within the channel 902 the size of the weight assembly 900 on the club head 100 is reduced. Additionally, the mass of the fastener 912 is moved further rearward from the striking face 108 than those examples described above. The weights 904, 906 extend from the inner convex side of the covers 908, 910 as illustrated in FIG. 22. In other examples, the weights 904, 906 may extend from the outer concave side of the covers 908, 910 as required or desired. In this example, two slidable weights 904, 906 are described since the fastener 912 prevents a weight from sliding completely from the toe side to the head side of the channel 902 and back. In some examples, the weight assembly 900 may include only one slidable weight and the fastener 912 and the covers 908, 910 are configured to allow the weight to pass between the toe 114 side and the heel 116 side. In other examples, the weight assembly 900 may include only one slidable weight that requires the assembly to be completely disassembled so as to move the weight from the toe side to the head side and back. In still other examples, the weights 904, 906 may be completely removable from the channel 902 as required or desired.

One end of each cover 908, 910 is engaged with the channel 902, for example, with the projection/channel interface as described herein, while the other opposite end of each cover 908, 910 is engaged with the fastener 912. In the example, the fastener 912 includes a washer 914 that is disposed below the head. The washer 914 is a substantially cylindrical flange extending from the threaded shaft that engages with both corresponding groove 916 within the covers 908, 910. When the weight assembly 900 is in the locked configuration the covers 908, 910 are disposed within the channel 902 and secured in place with the fastener 912, via the grooves 916, so that the weights 904, 906 cannot slide within the channel 902 and are locked in place. Additionally, the covers 908, 910 are flush with the outer surface 120 of the body 106. In some examples, the portion of the covers 908, 910 that define the grooves 916 may extend all the way to a bottom track 918 of the channel 902 so that overtightening of the fastener 912 is reduced or prevented.

Figure 24:
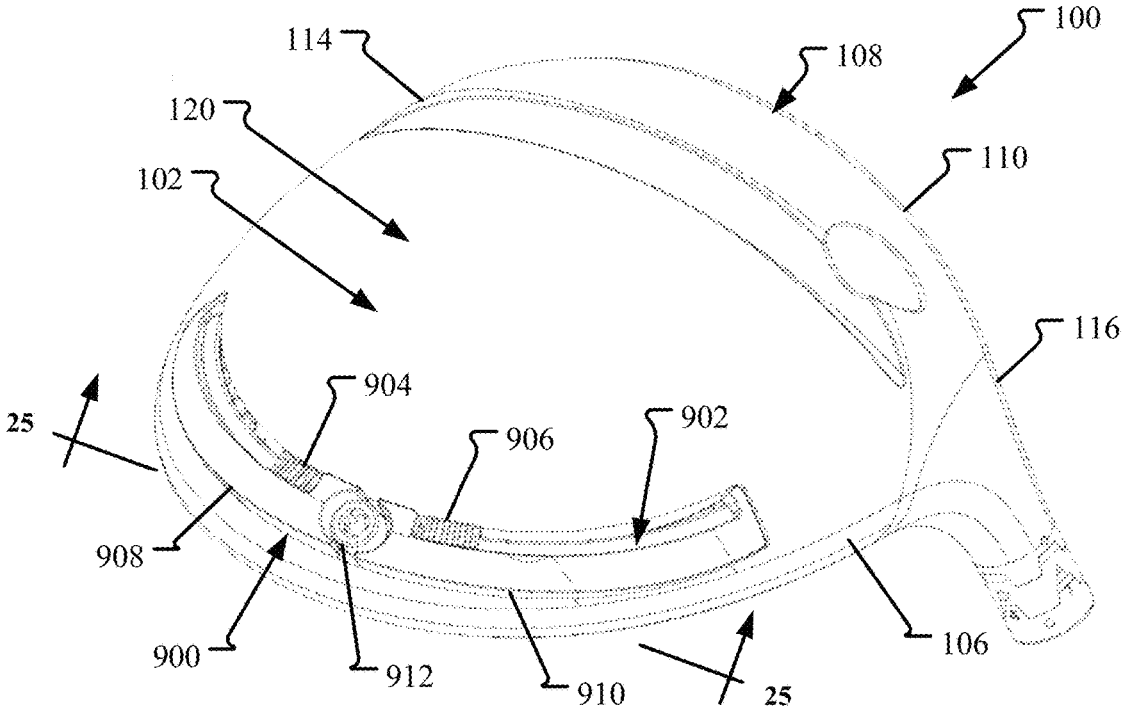
FIG. 24 is a perspective view of the sole of the golf club head with the weight assembly shown in FIG. 22 in an unlocked configuration.
Figure 25:
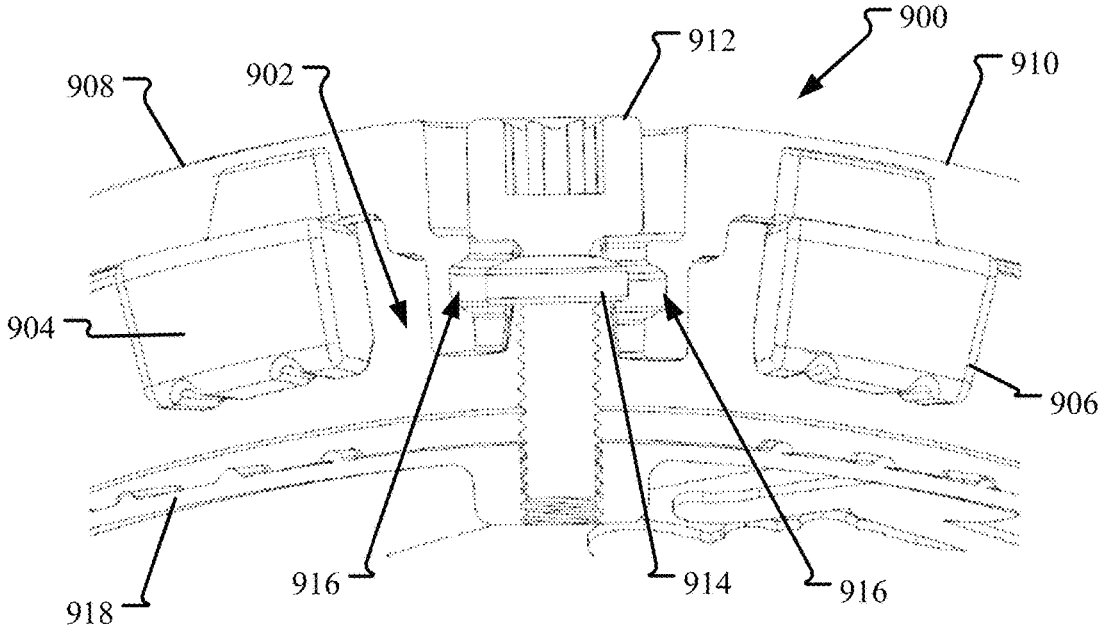
FIG. 25 is a cross-sectional view of the weight assembly taken along line 25-25 in FIG. 24.

FIG. 24 is a perspective view of the sole 102 of the golf club head 100 with the weight assembly shown 900 in an unlocked configuration. FIG. 25 is a cross-sectional view of the weight assembly 900 taken along line 25-25 in FIG. 24. Certain components are described above, and thus, are not necessarily described further. Referring concurrently to FIGS. 24 and 25, the weight assembly 900 is illustrated in an unlocked configuration. When the weight assembly 900 moves from the locked configuration (shown in FIGS. 22 and 23), the fastener 912 is rotated so as to lift at least partially out of the channel 902. This movement of the fastener 912 also lifts the ends of the covers 908, 910 that are engaged with the washer 914 at least partially out of the channel 902 so as to enable the weights 904, 906 to slide within the channel 902. In some examples, the weights 904, 906 may be engaged with the respective cover 908, 910 so as to lift away from the track 918 for ease of movement.

In some examples, the covers 908, 910 and the fastener 912 may be completely removed from the body 106 as required or desired so as to completely remove the weights 904, 906 from the channel 902. However, moving the weight assembly 900 between the locked configuration) and the unlocked configuration does not require that the weight assembly 900 be uncoupled from the body 106. As such, in the unlocked configuration, the covers 908, 910 remain coupled to the body 106 so that it is less likely that the components become lost or misplaced.

In this example, when the covers 908, 910 are in the unlocked configuration, the ends of the covers 908, 910 that are opposite of the fastener 912 and engaged with the channel 902 (e.g., with the projection/channel interface) remain engaged with the channel 902 and may form a pivot point that the covers 908, 910 rotate about. In other examples, the ends of the covers 908, 910 that are opposite of the fastener 912 may lift at least partially out of the channel 902 as described herein. For example, through a cam and cutout interface as described above.

Figure 26:
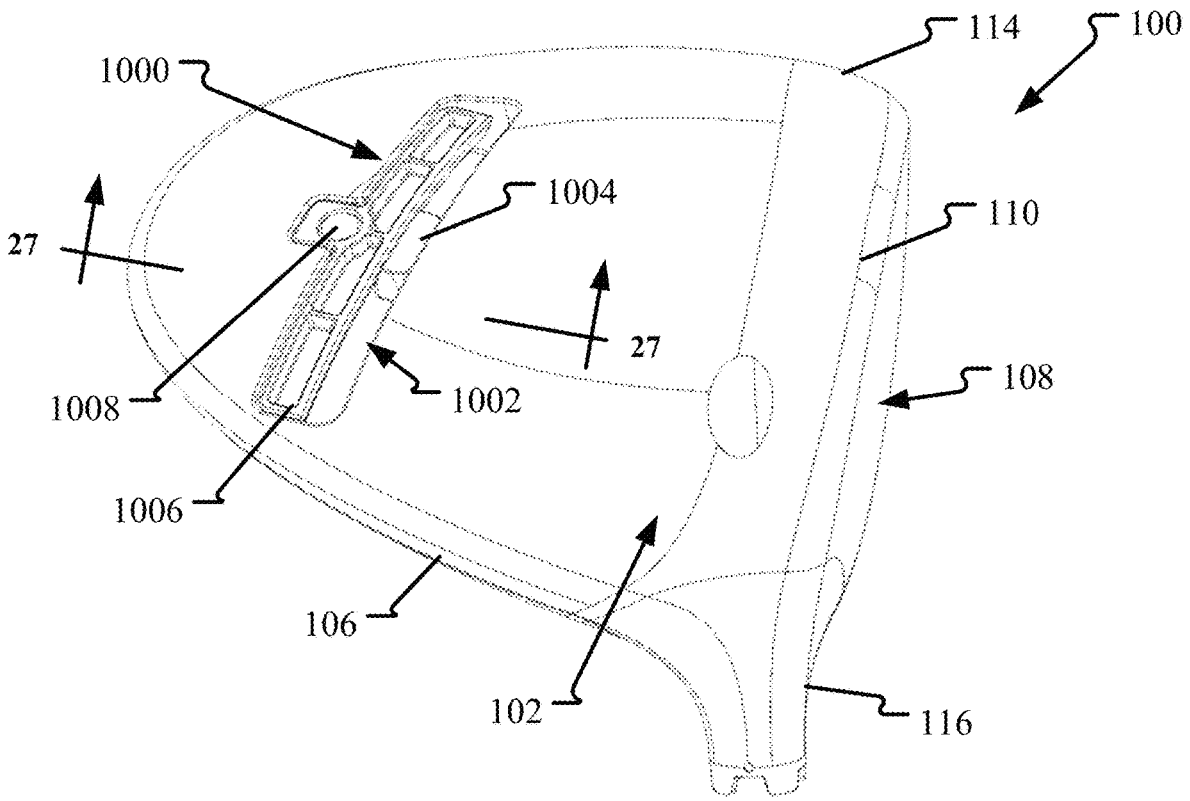
FIG. 26 is a perspective view of the sole of the golf club head with another weight assembly.
Figure 27:
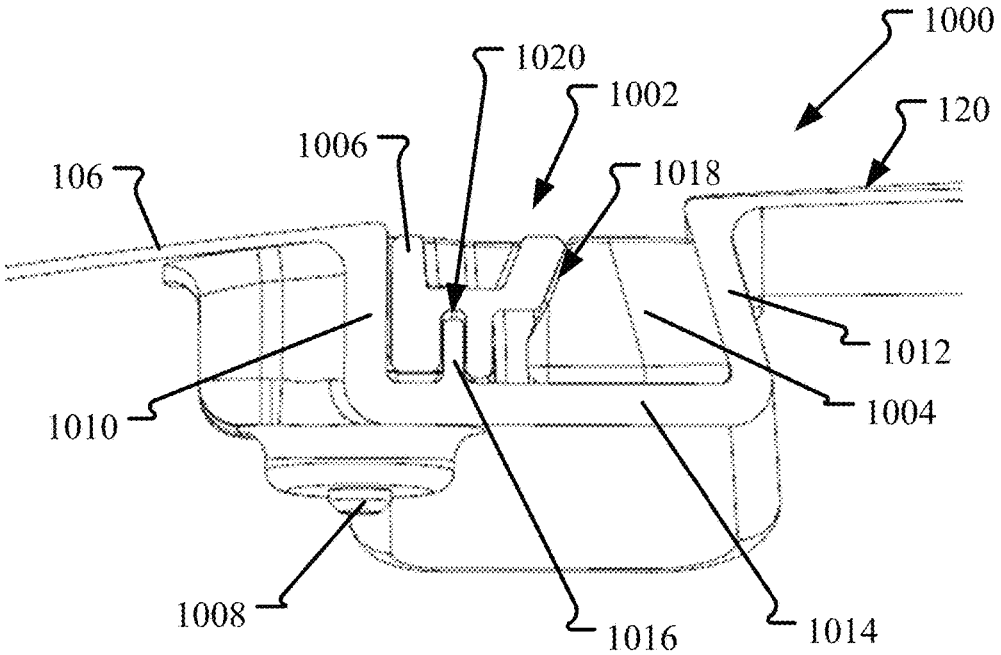
FIG. 27 is a cross-sectional view of the weight assembly taken along line 27-27 in FIG. 26.

FIG. 26 is a perspective view of the sole 102 of the golf club head 100 with another weight assembly 1000. FIG. 27 is a cross-sectional view of the weight assembly 1000 taken along line 27-27 in FIG. 26. Certain components are described above, and thus, are not necessarily described further. Referring concurrently to FIGS. 26 and 27, the weight assembly 1000 includes a substantially linear recessed channel 1002 defined within the sole 102. The weight assembly 1000 also includes a slidable weight 1004, a cover 1006, and a fastener 1008. In this example, the fastener 1008 may be positioned at approximately the midpoint of the channel 1002 and offset towards the rear of the club head 100. By positioning the fastener 1008 at a midpoint location, the distance between the fastener 1008 and the far end(s) of the cover 1006 is reduced so that the engagement between the cover 1006 and the channel 1002 is increased for securement of the weight 1004.

Similar to the example described above in reference to FIGS. 6 and 7, the channel 1002 is formed by two opposing sidewalls, a cover sidewall 1010 and an undercut sidewall 1012, and a bottom track 1014 offset from the outer surface 120 of the body 106. A partial wall 1016 also extends from the bottom track 1014. The cover 1006 is located adjacent to the cover sidewall 1010 and includes an angled surface 1018. As such, when the weight assembly 1000 is in a locked configuration (e.g., FIG. 27), the cover 1006 generates a compressive force along the angled surface 1018 that acts in both a downward direction and a transverse direction to secure the weight 1004 between the cover 1006 and the undercut sidewall 1012. Accordingly, the weight 1004 is frictionally secured by the weight assembly 1000 and at least partially underneath the angled surface 1018 and the undercut sidewall 1012. Additionally, the cover 1006 completely engages with the partial wall 1016 via a groove 1020 so that the portion of the cover 1006 away from the fastener 1008 is restricted from moving within the channel 1002 (e.g., bending or flexing) towards the undercut sidewall 1012. Furthermore, the partial wall 1016 is substantially parallel to the fastener axis (not shown) of the fastener 1008 so that the cover 1006 guides the movement between the locked and unlocked configuration.

Figure 28:
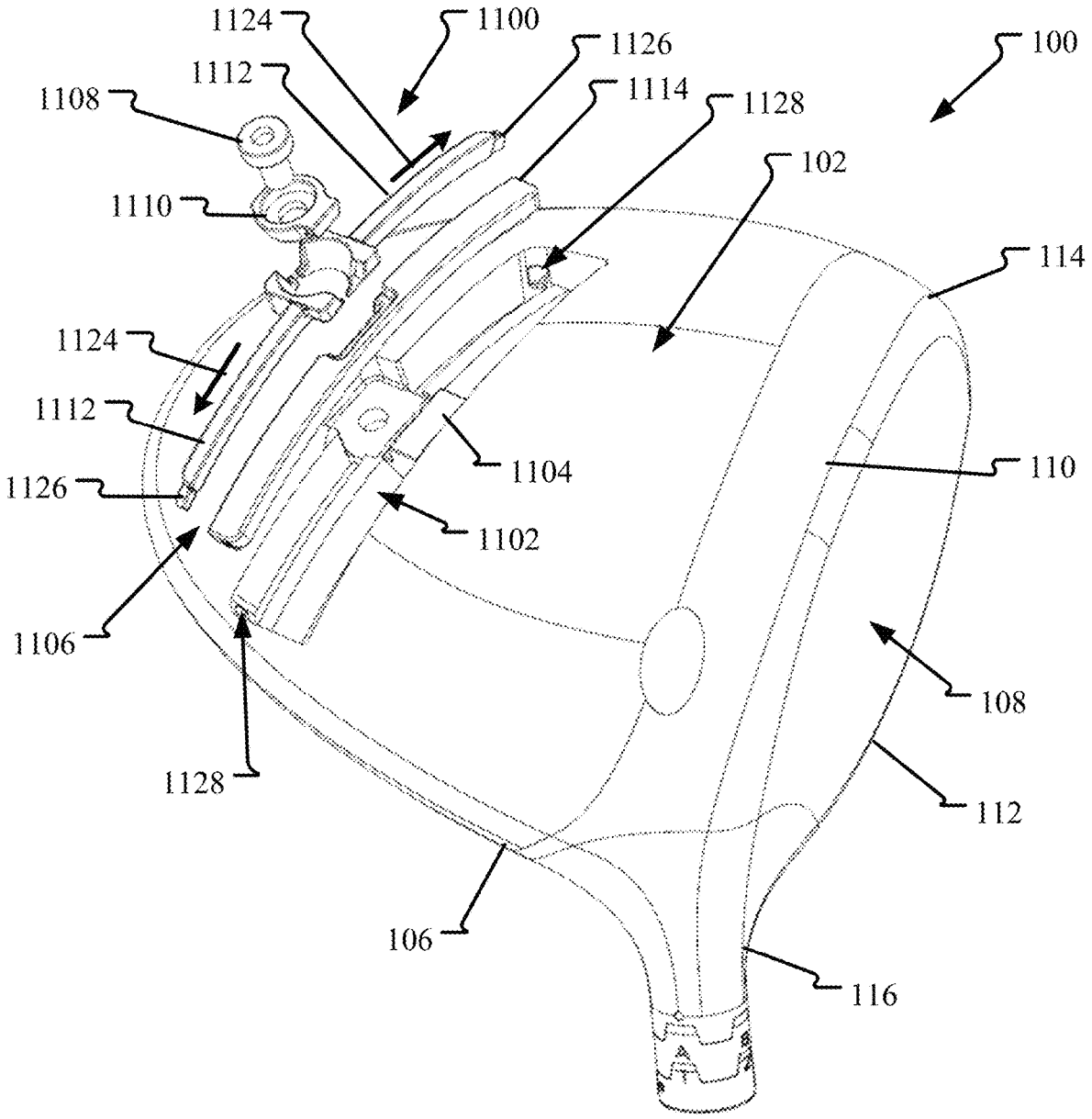
FIG. 28 is an exploded perspective view of the sole of the golf club head with another weight assembly.
Figure 29:
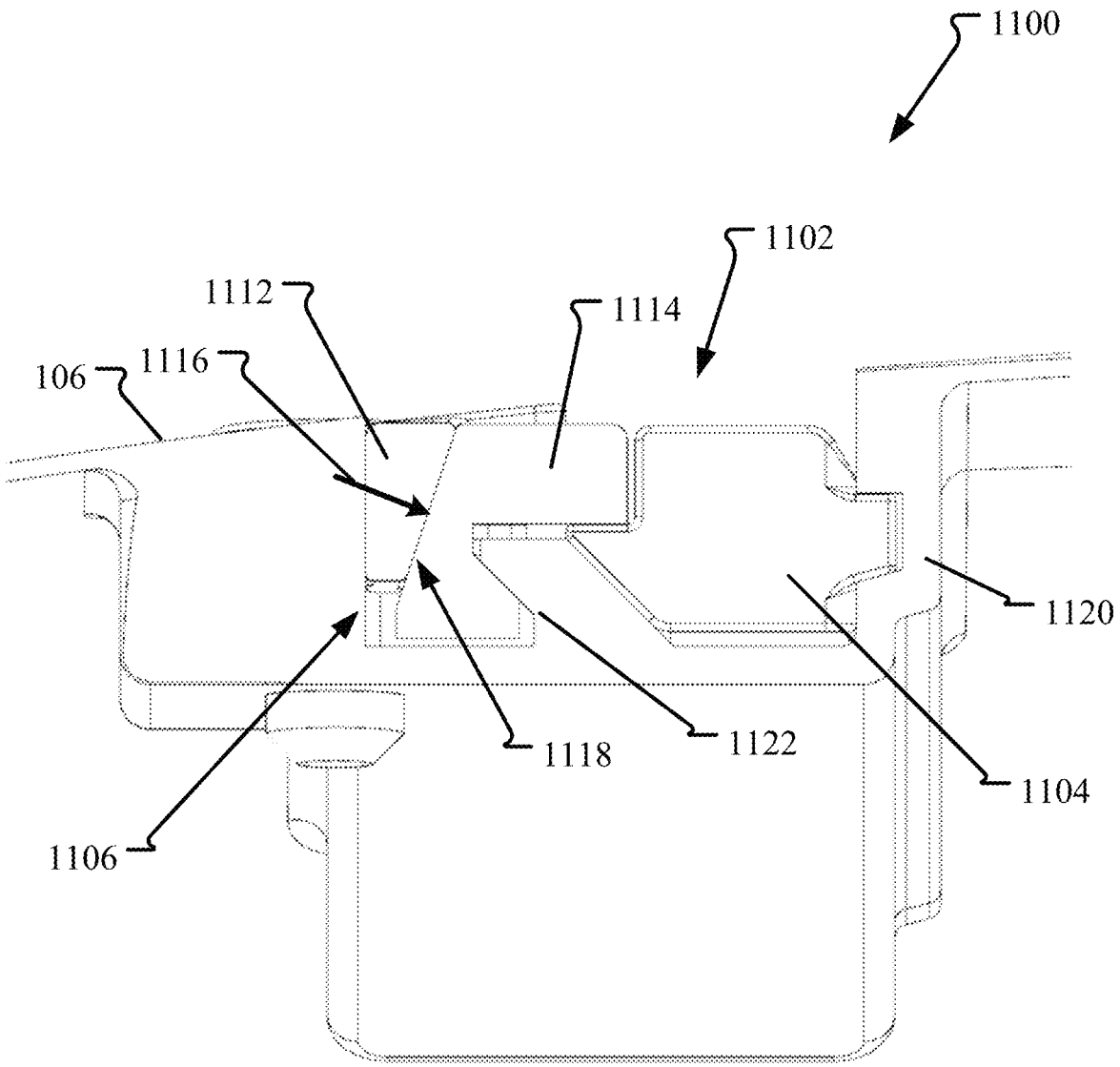
FIG. 29 is a cross-sectional view of the weight assembly shown in FIG. 28.

FIG. 28 is an exploded perspective view of the sole 102 of the golf club head 100 with another weight assembly 1100. FIG. 29 is a cross-sectional view of the weight assembly 1100. Certain components are described above, and thus, are not necessarily described further. Referring concurrently to FIGS. 28 and 29, the weight assembly 1100 includes a substantially linear recessed channel 1102 defined within the sole 102. The weight assembly 1100 also includes a slidable weight 1104, a cover assembly 1106, and a fastener 1108. In this example, the fastener 1108 may be positioned at approximately the midpoint of the channel 1102 and offset towards the rear of the club head 100. As described above, when the cover assembly 1106 is in the locked configuration, the cover assembly 1106 is coupled to the body 106 so that the weight 1104 is be secured within the weight assembly 1100 without movement or rattling. In this example, the cover assembly 1106 is a four piece assembly including a fastener member 1110, two opposing longitudinal members 1112, and a transverse member 1114.

When the cover assembly 1106 is moved towards the locked configuration (e.g., FIG. 29), the fastener 1108 is tightened to the body 106. The fastener 1108 engages with the fastener member 1110 and moves the fastener member 1110 along the fastener axis (not shown) and into the channel 1102. The fastener member 1110 has a tapered surface that engages with both of the longitudinal members 1112 so that as the fastener member 1110 is pulled down within the channel 1102, the longitudinal members 1112 are also pulled down within the channel 1102 and generate a compressive force 1116 along an angled surface 1118. The compressive force 1116 acts in both a downward direction and a transverse direction on the transverse member 1114 to position the transverse member 1114 within the channel 1102 and compress the weight 1104 between the transverse member 1114 and a sidewall 1120 of the channel.

Additionally, to reduce or prevent pull-out of the weight assembly 1100 from the body 106, the transverse member 1114 may engage with an undercut 1122 of the channel 1102. The compressive force 1116 from the longitudinal members 1112 lock the transverse member against the undercut 1122 so as to prevent movement. Additionally or alternatively, a portion of the weight 1104 may engage with the sidewall 1120 of the channel 1102 so as to reduce pull out of the weight assembly 1100 from the body 106. Additionally, the fastener member 1110 also pushes the longitudinal members 1112 away from the fastener 1108 (e.g., arrows 1124) so that ends 1126 of the members 1112 can engage with a corresponding chamber 1128 in the channel 1102 and also reduce pull out of the weight assembly 1100 from the body 106.

Figure 30:
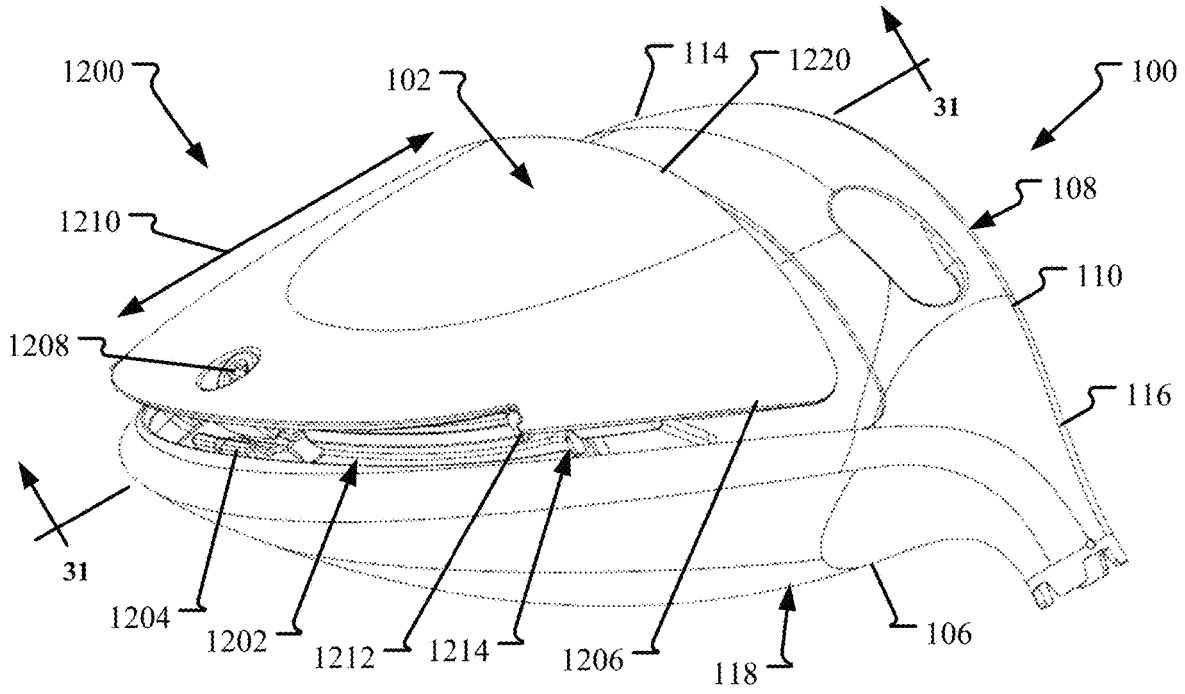
FIG. 30 is a perspective view of the sole of the golf club head with another weight assembly.
Figure 31:
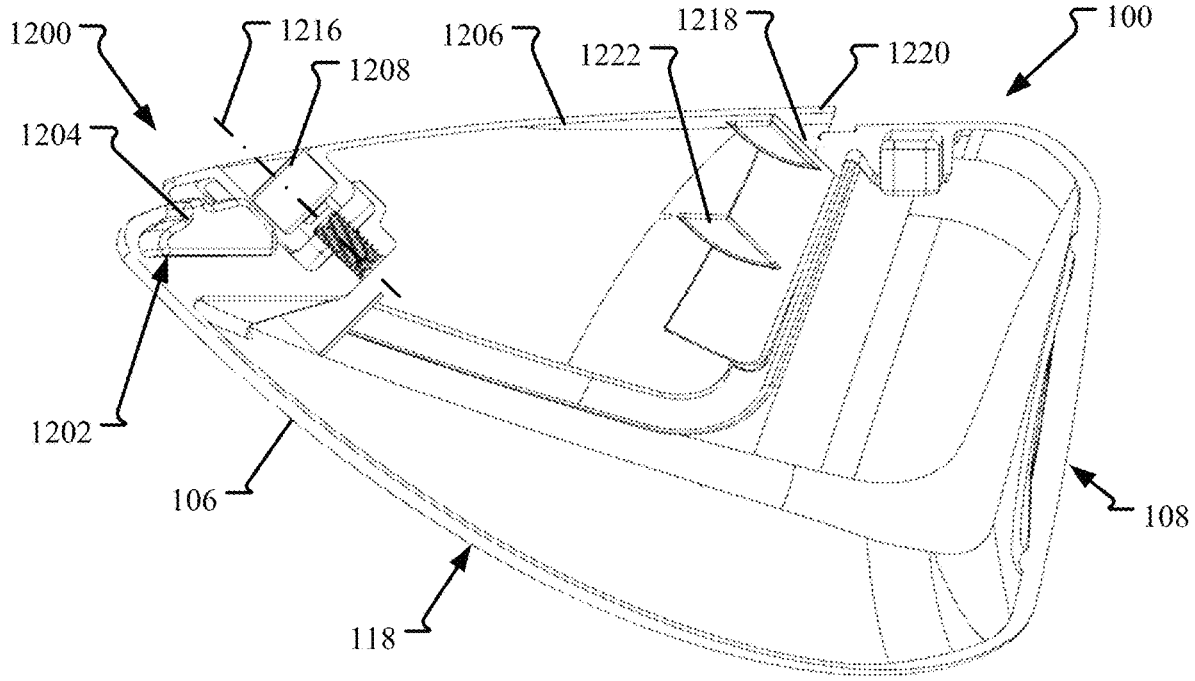
FIG. 31 is a cross-sectional view of the weight assembly taken along line 31-31 in FIG. 30.

FIG. 30 is a perspective view of the sole 102 of the golf club head 100 with another weight assembly 1200. FIG. 31 is a cross-sectional view of the weight assembly 1200 taken along line 31-31 in FIG. 30. Certain components are described above, and thus, are not necessarily described further. Referring concurrently to FIGS. 30 and 31, the weight assembly 1200 is illustrated in an unlocked configuration and includes a recessed channel 1202, a slidable weight 1204, a cover 1206, and a fastener 1208. The structure, size, shape, and orientation of the channel 1202, the weight 1204, and the fastener 1208 may be similar to any of the examples described above. In this example, however, a width 1210 of the cover 1206 is extended towards the striking face 108 so that the cover 1206 forms a greater portion of the sole 102 and does not only cover a portion of the channel 1202.

In some examples, the cover 1206 may form greater than or equal to 75% of the surface area of the sole 102. In other examples, the cover 1206 may form greater than to equal to 50% of the surface area of the sole 102. In still other examples, the cover 1206 may form greater than or equal to 25% of the surface area of the sole 102. In still further examples, the cover 1206 may be between about 10% and 90% of the surface area of the sole 102. In other examples, the cover 1206 may be between about 25% and 75% of the surface area of the sole 102.

By enlarging the cover 1206 of the weight assembly 1200, the golf club head structure that forms the sole 102 of the body 106 can be reduced. In some examples, the cover 1206 can be manufactured from a lighter weight material (e.g., composite materials, plastics, etc.) than the material that the body 106 is manufactured from. As such, the weight saved by the configuration of the sole construction can be used at other locations on the club head 100 as required or desired and further enable adjustment of the CG and MOI of the club head 100 for improving golf ball flight characteristics. In some examples, the weight saved by the sole construction can be included back into the slidable weight 1204. For example, the cover 1206 may reduce the weight of the sole construction by 11 grams or more, some or all of which mass that can then be included at least partially into the weight 1204.

The cover 1206 can include a projection 1212 extending therefrom that is configured to engage with a corresponding chamber 1214 within each end of the channel 1202 for increasing the structural rigidity of the cover 1206 connection as described in the examples above. In one example, the projection 1212 may be substantially cylindrical and parallel to a fastener axis 1216. At the opposite side of the cover 1206 from the fastener 1208, the cover 1206 includes a brace 1218 adjacent to an extended edge 1220 that frictionally engages with the remaining sole 102 of the club head 100 to secure the edge 1220 to the body 106. In some examples, the brace 1218 may extend at an angle that is substantially parallel to the fastener axis 1216 so as to guide the movement of the cover 1206 between the locked and unlocked configurations as described herein. The brace 1218 may include one or more brackets 1222 for increasing the structural rigidity of the brace 1218.

Figure 32:
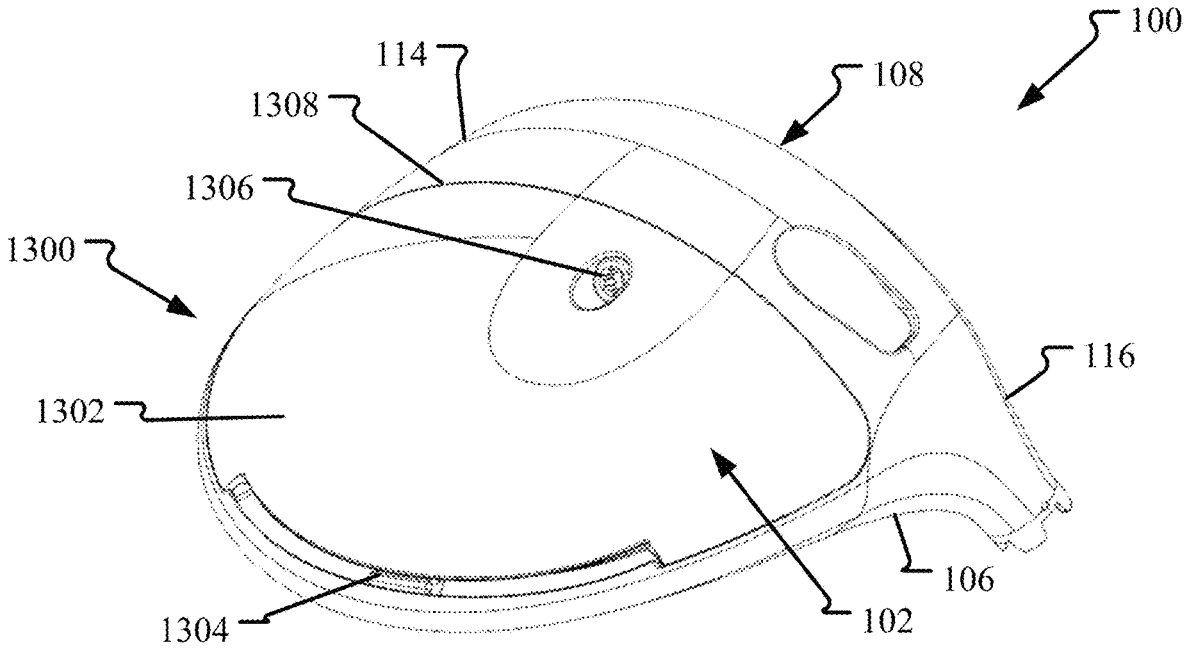
FIG. 32 is a perspective view of the sole of the golf club head with another weight assembly.

FIG. 32 is a perspective view of the sole 102 of the golf club head 100 with another weight assembly 1300. Certain components are described above, and thus, are not necessarily described further. Similar to the example described in FIGS. 30 and 31, the weight assembly 1300 includes an enlarged cover 1302 that selectively secures a slidable weight 1304 to one or more portions of the club head 100. In this example, however, a fastener 1306 is positioned more towards the striking face 108 and adjacent to an extended edge 1308 of the cover 1302. This example increases the securement of the edge 1308 to the body 106 of the golf club head 100. In other examples, the fastener 1306 may be positioned at any other location on the cover 1302 as required or desired. For example, towards the toe side 114, towards the heal side 116, centered on the cover 1302, etc.

Figure 33:
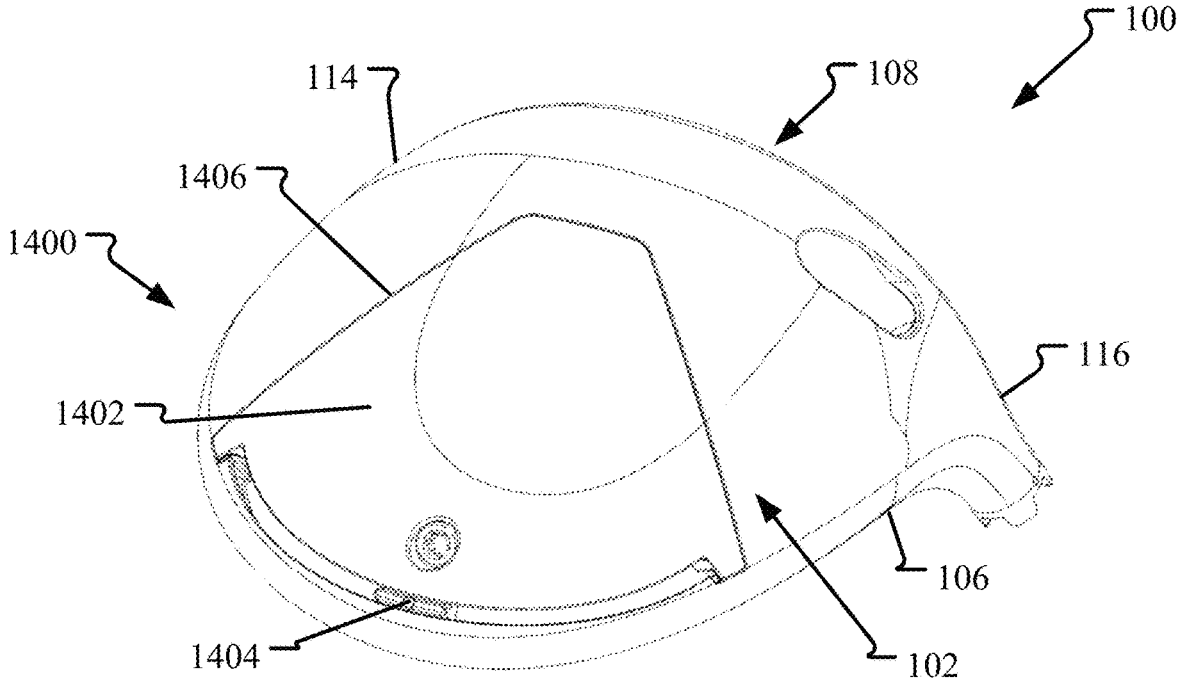
FIG. 33 is a perspective view of the sole of the golf club head with another weight assembly.

FIG. 33 is a perspective view of the sole 102 of the golf club head 100 with another weight assembly 1400. Certain components are described above, and thus, are not necessarily described further. Similar to the example described in FIGS. 30-32, the weight assembly 1400 includes an enlarged cover 1402 that selectively secures a slidable weight 1404 to one or more portions of the club head 100. In this example, however, the cover 1402 has an extended edge 1406 that is substantially V-shaped. Additionally, the cover 1402 is symmetrical in the toe 114—heel 116 direction. In other examples, the cover 1402 may be asymmetrical in the toe 114—heel 116 direction as required or desired.

Figure 34:
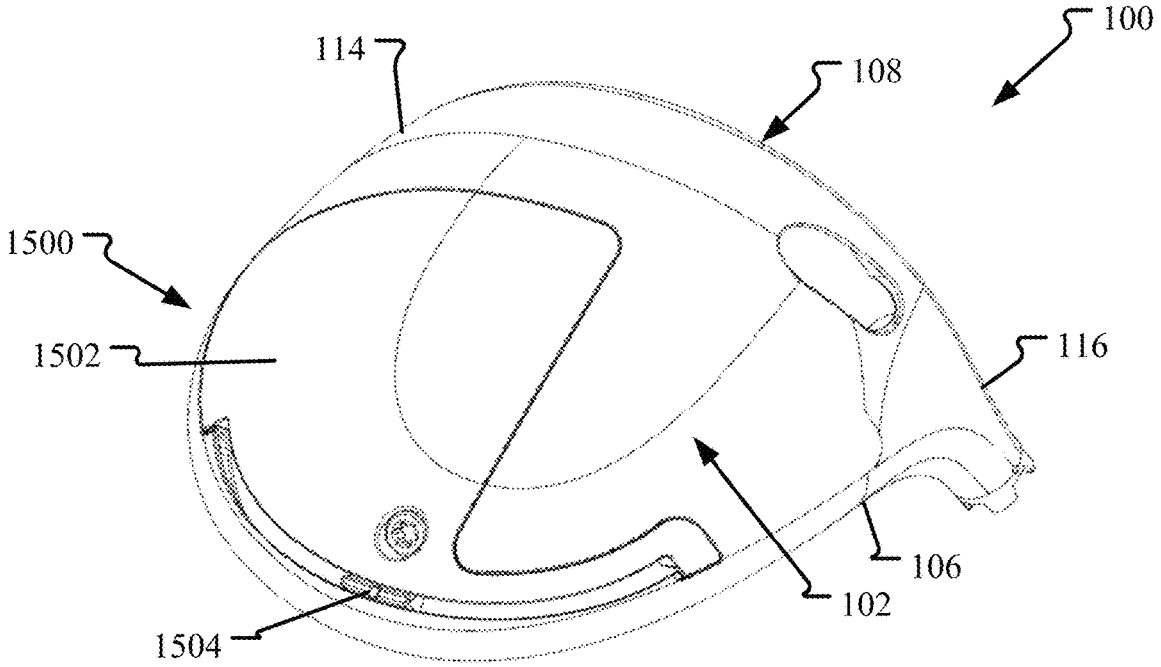
FIG. 34 is a perspective view of the sole of the golf club head with another weight assembly.

FIG. 34 is a perspective view of the sole 102 of the golf club head 100 with another weight assembly 1500. Certain components are described above, and thus, are not necessarily described further. Similar to the example described in FIGS. 30-33, the weight assembly 1500 includes an enlarged cover 1502 that selectively secures a slidable weight 1504 to one or more portions of the club head 100. In this example, however, the cover 1502 is asymmetrical in the toe side 114 direction. In other examples, the cover 1502 may be asymmetrical in the heel side 116 direction as required or desired.

Figure 35:
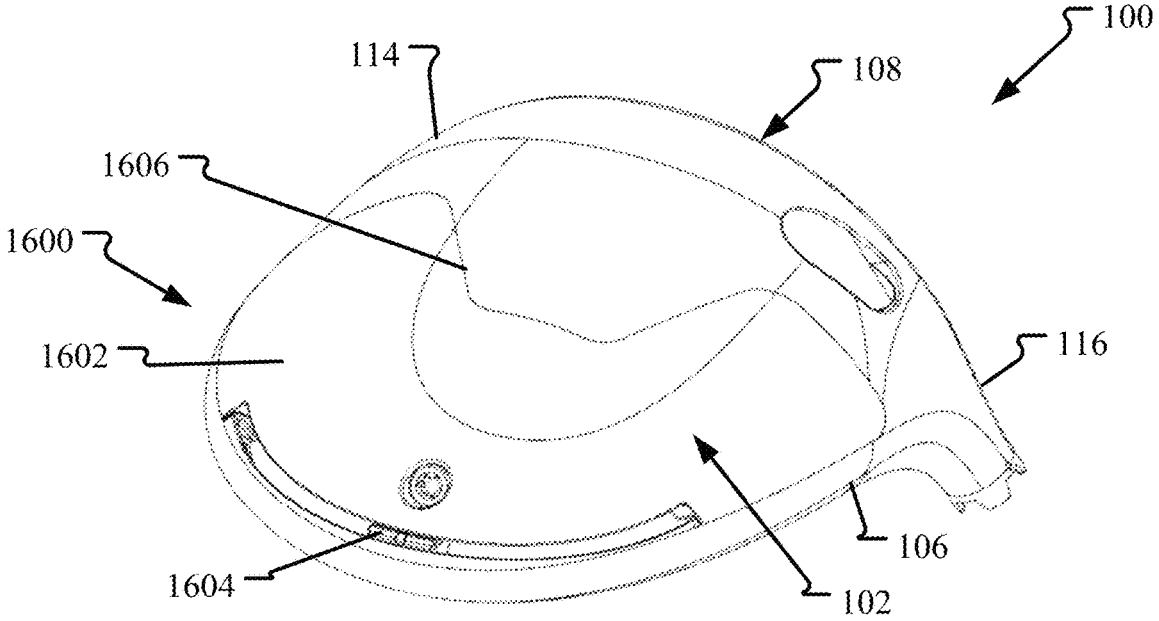
FIG. 35 is a perspective view of the sole of the golf club head with another weight assembly.

FIG. 35 is a perspective view of the sole 102 of the golf club head 100 with another weight assembly 1600. Certain components are described above, and thus are not necessarily described further. Similar to the example described in FIGS. 30-34, the weight assembly 1600 includes an enlarged cover 1602 that selectively secures a slidable weight 1604 to one or more portions of the club head 100. In this example, however, the cover 1602 has an extended edge 1606 that is substantially C-shaped. Additionally, the cover 1602 is symmetrical in the toe 114—heel 116 direction. In other examples, the cover 1602 may be asymmetrical in the toe 114—heel 116 direction as required or desired.

Figure 36:
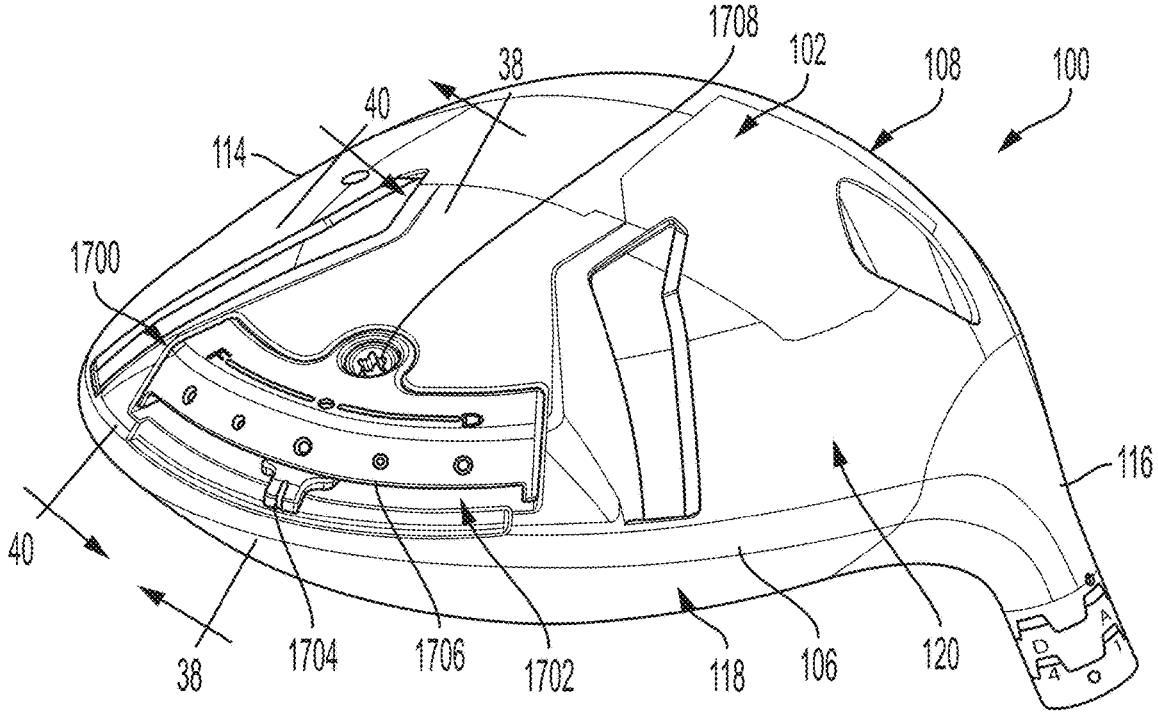
FIG. 36 is a perspective view of the sole of the golf club head with another weight assembly.
Figure 37:
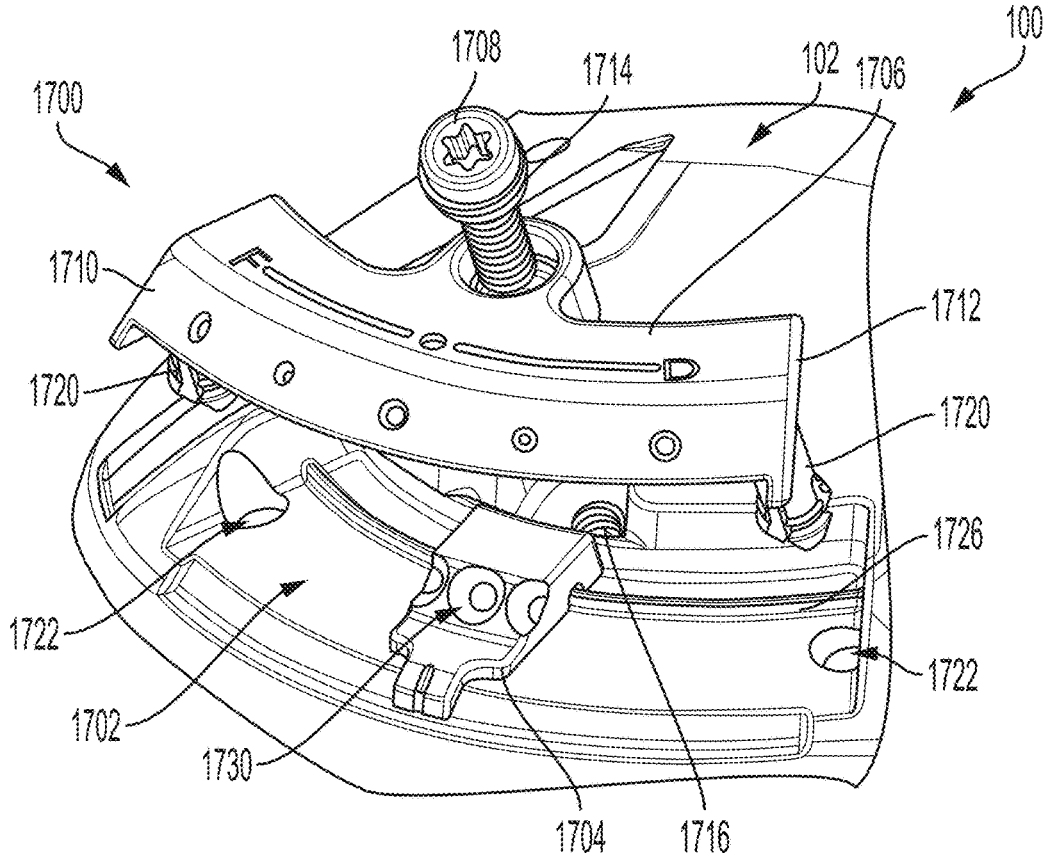
FIG. 37 is an exploded perspective view of the weight assembly shown in FIG. 36.

FIG. 36 is a perspective view of the sole 102 of the golf club head 100 with another weight assembly 1700. FIG. 37 is an exploded perspective view of the weight assembly 1700. Certain components are described above, and thus, are not necessarily described further. Referring concurrently to FIGS. 36 and 37, a recessed channel 1702 is defined within the sole 102 of the body 106 of the club head 100. The channel 1702 has a substantially curved shape in the toe 114—heel 116 direction so that the CG and the MOI of the club head 100 can be adjusted for fade-draw bias (e.g., the "F" and "D" indicia on a cover 1706 of the weight assembly 1700). In the example, the curve of the channel 1702 substantially corresponds to the rear outer perimeter of the body 106, where the sole 102 and the crown 118 are coupled together, and opposite of the striking face 108. The weight assembly 1700 includes a slidable weight 1704, a cover 1706, and a fastener 1708.

In this example, the cover 1706 is substantially U-shaped with a toe end 1710 and an opposite heel end 1712. The fastener 1708 is coupled to the cover 1706 by a lock washer 1714 (e.g., a retainer clip) and it is positioned on the inner concave side of the cover 1706 at approximately a midpoint between the ends 1710, 1712. The fastener 1708 is a threaded bolt that threadingly engages with a nut 1716 formed within the sole 102 of the body 106. The lock washer 1714 enables the cover 1706 to linearly move M (e.g., raise and lower) along a fastener axis 1718 (shown in FIG. 38) with respect to the recessed channel 1702 upon rotation of the fastener 1708. The fastener 1708 is offset from the recessed channel 1702 towards the front and the striking face 108 of the body 106. By offsetting the fastener 1708 from the recessed channel 1702, the length of the recessed channel 1702 can be extended in the toe-heel direction so that the weight 1704 can be positioned at a greater number of locations on the sole 102. Additionally, by positioning the fastener adjacent the inner concave side of the cover 1706, the weight 1704 is disposed closer to the outer perimeter of the body 106 so that the weight 1704 increases the adjustability of the CG and MOI of the club head 100.

Each end 1710, 1712 of the cover 1706 includes a projection 1720 extending therefrom. The projections 1720 are sized and shaped to be received within a corresponding chamber 1722 defined at the ends of the recessed channel 1702 and within the sole 102 of the body 106. The projection 1720 may be substantially cylindrical in shape and increases the engagement of the cover 1706 with the body 106 so that the weight 1704 is restricted from moving or rattling when secured within the recessed channel 1702 by the cover 1706. A projection axis 1724 of the projection 1720 (shown in FIG. 38) is substantially parallel to the fastener axis 1718 so as to facilitate guiding the movement of the cover 1706 relative to the recessed channel 1702.

In operation, the weight assembly 1700 is selectively moveable between at least three configurations to enable the CG and the MOI of the club head 100 to be adjustable. More specifically, in a first or locked configuration, the cover 1706 is at least partially disposed within the recessed channel 1702 so that the weight 1704 is secured within the channel 1702 and movement is restricted. This locked configuration is illustrated in FIG. 36. When the weight assembly 1700 is in the locked configuration, the projection 1720 is received at least partially within the chamber 1722 and engaged therewith. By engaging the cover 1706 to the body 106 at its ends 1710, 1712, when the weight 1704 is positioned away from the fastener 1708, the cover 1706 still enables securement of the weight 1704 within the channel 1702 and reduces or prevents movement of the weight 1704 in the locked configuration. The locked configuration is used when swinging the golf club head 100.

Figure 40:
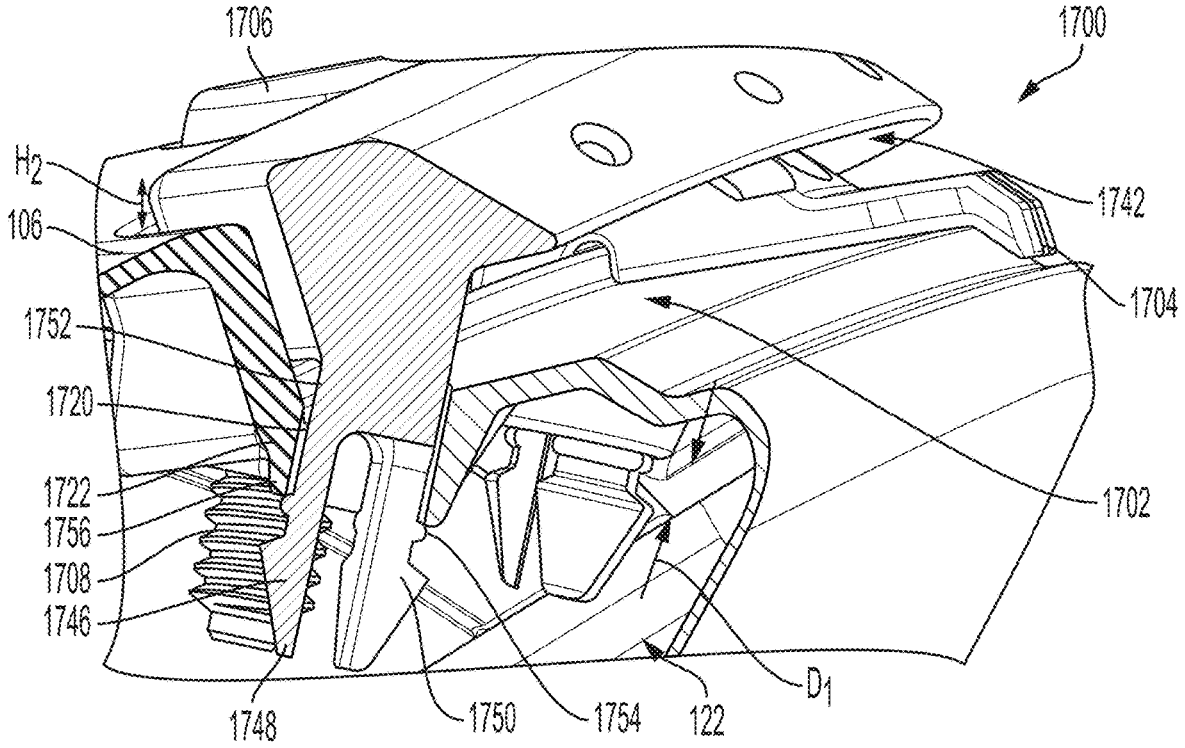
FIG. 40 is a cross-sectional view of the weight assembly taken along line 40-40 in FIG. 36 and in a weight sliding configuration.
Figure 41:
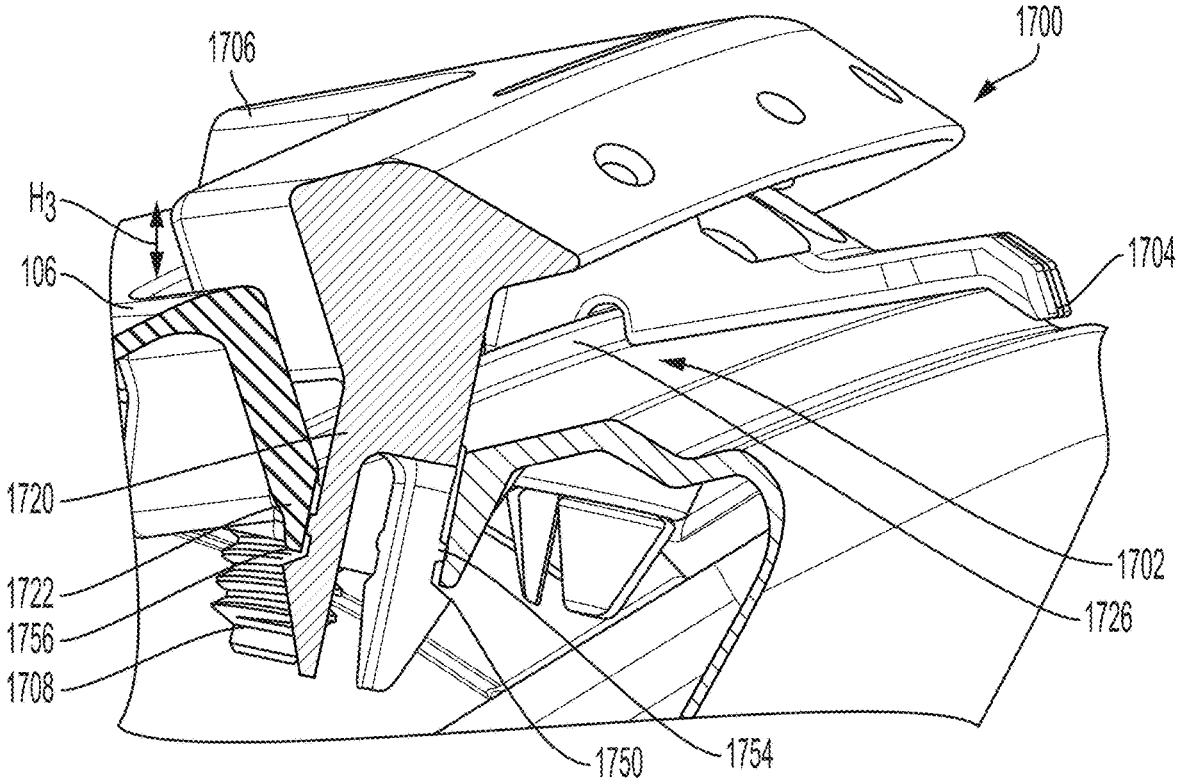
FIG. 41 is a cross-sectional view of the weight assembly taken along line 40-40 in FIG. 36 and in a weight removal configuration.

Additionally, the weight assembly 1700 can be positionable into at least two other configurations that enable the weight 1704 to be selectively slidable with the recessed channel 1702 and that enable the weight 1704 to be completely removable from the weight assembly 1700 and the club head 100. In a second or weight moving configuration, the cover 1706 is partially raised out of the recessed channel 1702 so that the position of the weight 1704 can be adjusted. However, the weight 1704 is still retained within the weight assembly 1700 and cannot be completely removed from the club head 100. This configuration is illustrated in FIG. 40 and described further below. In a third or weight removal configuration, the cover 1706 is positioned so that the weight 1704 can be completely removed, for example, so that a different weight (e.g., having a different mass) can be used with the club head 100 so as to adjust the swing weight. This configuration is illustrated in FIG. 41 and described further below. In each of the three configurations, however, the cover 1706 remains coupled to the body 106 so that the cover 1706 does not have to be completely removed. In some examples, however, the weight assembly 1700 may include a fourth configuration (not illustrated), whereby the cover 1706 is completely removable from the body 106 as required or desired.

A partial wall 1726 is disposed within the recessed channel 1702. The weight 1704 has a corresponding recess 1728 (shown in FIG. 38) so that the weight 1704 can slide along the partial wall 1726. The partial wall 1726 at least partially prevents the weight 1704 from being completely removed when the weight assembly 1700 is in the weight moving configuration. In some examples, the weight 1704 may include at least one locating feature 1730 (FIG. 37). The feature 1730 is sized and shaped to engage with one or more of a plurality of locating lugs 1732 (shown in FIG. 39) that extend from the cover 1706 when the weight assembly 1700 is in the locked configuration. The locating lugs 1732 and feature 1730 facilitate locating the weight 1704 at specific locations within the recessed channel 1702. In the example, the locating lugs 1732 are substantially frustoconical in shape and the locating features 1730 have a corresponding recessed shape. In other examples, the lugs 1732 and features 1730 can have any other shape and/or size that enable the cover 1706 and the weight 1704 to function as described herein.

Figure 38:
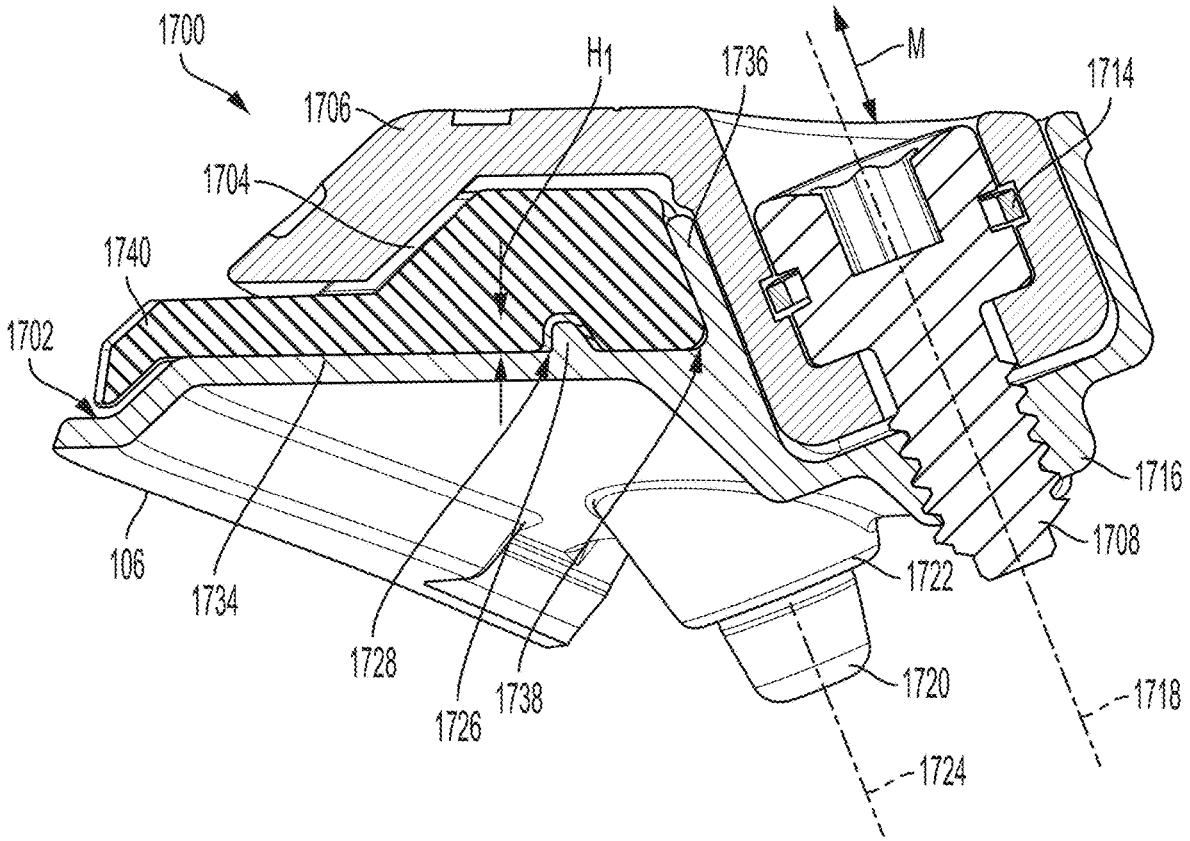
FIG. 38 is a cross-sectional view of the weight assembly taken along line 38-38 in FIG. 36.

FIG. 38 is a cross-sectional view of the weight assembly 1700 taken along line 38-38 in FIG. 36. Certain components are described above, and thus, are not necessarily described further. As described above, the weight 1704 is secured within the recessed channel 1702 by the cover 1706. The fastener 1708 positions and secures the cover 1706 to the body 106 of the golf club head, and thus, the fastener 1708 only retains the weight 1704 indirectly. In some examples, a washer (not shown) may be positioned on the fastener 1708 and between the body 106 and the cover 1706. The recessed channel 1702 is formed in cross-section by a bottom track wall 1734 and a side wall 1736 arranged in a substantially L-shape configuration with a corner 1738. In the example, the corner 1738 has an angle that is equal to or less than 90°. In another aspect, the corner 1738 has an angle that less than 90° so that the side wall 1736 is undercut. As such, when the weight assembly 1700 is in the locked configuration, the cover 1706 wedges the weight 1704 into the corner 1738 and against the side wall 1736 to frictionally secure the weight 1704 within the recessed channel 1702 and at least partially underneath the side wall 1736.

Adjacent to the corner 1738 and on the bottom track wall 1734, the partial wall 1726 extends in an upward direction and has a height $H_1$. The weight 1704 has a corresponding recess 1728 that receives at least a portion of the partial wall 1726. The partial wall 1726 at least partially contains the weight 1704 within the weight assembly 1700 when in the locked and weight sliding configurations. The weight 1704 also includes a tail 1740 that projects from the recessed channel 1702 and out from underneath the cover 1706. The tail 1740 of the weight 1704 provides structure for a user to grasp and slide the weight 1704 as required or desired. The tail 1740 is also visible on the outer surface of the club head so that its position is easily determined by visual inspection. In this example, the tail 1740 is at least partially corresponds to the shape of the bottom track wall 1734 of the recessed channel 1702. In other examples, the tail 1740 can have any other size and/or shape as required or desired.

Figure 39:
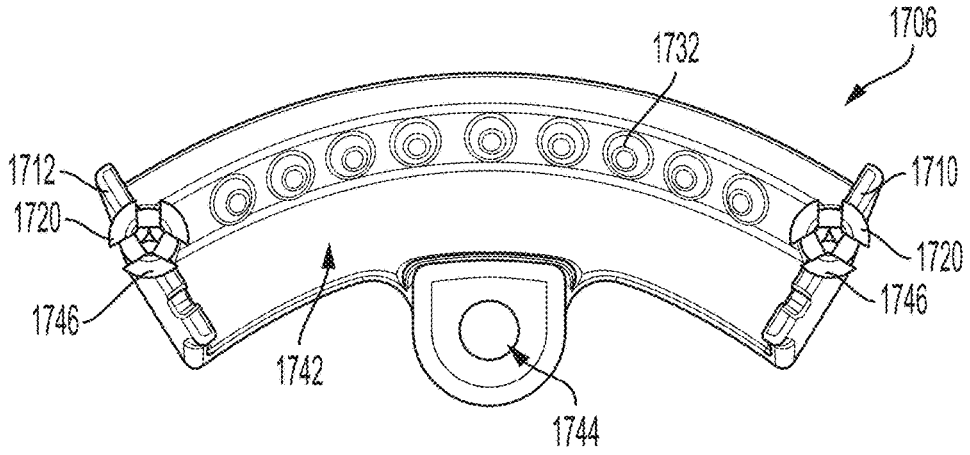
FIG. 39 is an inside surface view of a cover of the weight assembly shown in FIG. 36.

FIG. 39 is an inside surface 1742 view of the cover 1706 of the weight assembly 1700 (shown in FIGS. 36-38). The cover 1706 is substantially U-shaped with a concave side that receives the fastener at an aperture 1744. Proximate the convex side, the inside surface 1742 has the plurality of locating lugs 1732 that are configured to engage with the locating feature 1730 within the weight 1704 (shown in FIG. 37). When engaged (e.g., in the first, locked configuration), the cover 1706 wedges the weight in the corner of the recessed channel and against the side wall. However, when the cover 1706 raised out of the recessed channel, the locating lugs 1732 disengage from the weight so that the weight can be moved (e.g., in the weight sliding configuration) or so that the weight can be completely removed (e.g., in the weight removal configuration).

Each end 1710, 1712 of the cover 1706 includes the projection 1720 that, in addition to the fastener, secures the cover 1706 to the body of the club head. In the example, the projection 1720 engages with the chamber 1722 (shown in FIG. 37) in all three configurations (e.g., locked, weight moving, and weight removal) of the weight assembly. Furthermore, the projection 1720 also at least partially defines each of the three configurations. The projection 1720 is substantially cylindrical in shape and is configured to extend through the sole of the body and into the interior cavity of the club head via the chamber 1722. In the example, the projection 1720 includes a plurality of flexible arms 1746 circumferentially spaced to form the substantially cylindrical projection 1720. As illustrated, the projection 1720 includes three discrete flexible arms 1746. In other examples, the projection 1720 may include any other number of flexible arms 1746 (e.g., 2, 4, 5, etc.) as required or desired.

FIG. 40 is a cross-sectional view of the weight assembly 1700 taken along line 40-40 in FIG. 36 and in a weight sliding configuration. The projection 1720 has a distal end 1748 (relative to the inside surface 1742 of the cover 1706) that is formed as a tapered nose so that the cover 1706 can be press fit into the body 106 of the golf club head and extend all the way into the interior cavity 122 and through the chamber 1722. For example, the flexible arms 1746 can radially deflect so as to extend through the chamber 1722 and snap into place. This connection allows the cover 1706 to be secured to the body 106 and completely removed as required or desired. The cover 1706, however, does not need to be removed to adjust the weight 1704. The distal end 1748 includes at least one stop 1750 that extends radially outward on the projection 1720. In the example, the stop 1750 is formed as part of the tapered nose. The projection 1720 also has a proximal end 1752 (relative to the inside surface 1742 of the cover 1706) that is formed as a substantially cylindrical post. The proximal end 1752 frictionally engages with the chamber 1722 when the cover 1706 is in the locked configuration. This engagement facilitates the cover 1706 securing the weight 1704 within the recessed channel 1702 (in addition to the fastener). Additionally, at least one rib 1754 extends radially on the projection 1720. The rib 1754 is positioned between the distal end 1748 and the proximal end 1752, and offset a distance Di from the stop 1750.

To move the weight assembly 1700 from the locked configuration (shown in FIG. 36), when the cover 1706 secures the weight 1704 within the recessed channel 1702, to the weight moving configuration (shown in FIG. 40) that enables the weight 1704 to slide within the recessed channel 1702, the threaded fastener 1708 is rotated so that the cover 1706 raises out of the recessed channel 1702. When the rib 1754 engages with an end wall 1756 of the chamber 1722, further movement of the cover 1706 is restricted and the cover 1706 is raised to a height $H_2$ relative to the body 106 of the club head. As such, the cover 1706 indicates that the weight assembly 1700 is in the weight moving configuration. To move the weight assembly 1700 past the weight moving configuration to the weight removal position, additional force can be induced into the weight assembly 1700 (e.g., via rotation of the fastener 1708) to overcome the engagement between the rib 1754 and the chamber 1722 until the flexible arm 1746 flexes and the cover 1706 can further raise out of the recessed channel 1702.

FIG. 41 is a cross-sectional view of the weight assembly 1700 taken along line 40-40 in FIG. 36 and in a weight removal configuration. Once the engagement of the rib 1754 and the end wall 1756 is forcefully overcome (e.g., via rotation of the fastener 1708 driving movement of the cover 1706), the weight assembly 1700 can move from the weight moving configuration (shown in FIG. 40) to the weight removal configuration. In the weight removal configuration, the weight 1704 can be completely removed from the recessed channel 1702 because the cover 1706 is raised even further out of the recessed channel 1702. When the stop 1750 engages with the end wall 1756 of the chamber 1722, further movement of the cover 1706 is restricted and the cover 1706 is raised to a height $H_3$. The height $H_3$ is greater than the height $H_2$ of the prior weight sliding configuration (shown in FIG. 40). As such, the cover 1706 indicates that the weight assembly 1700 is in the weight removal configuration and the weight 1704 can be completely removed. In some examples, the weight assembly 1700 can be moved past the weight removal configuration and allow the cover 1706 to be completely removed. If this is the case, additional force is induced into the weight assembly 1700 to overcome the engagement between the stop 1750 and the chamber 1722 until the flexible arm 1746 flexes and the cover 1706 can be completely removed. In the example, the stop 1750 is radially larger than the rib 1754, so that the force required to completely remove the cover 1706 is greater than the force required to move between the weight moving configuration and the weight removal configuration.

Because the rib 1754 at least partially defines the weight moving configuration and the stop 1750 at least partially defines the weight removal configuration, the distance Di (shown in FIG. 40) between the rib 1754 and the stop 1750 defines the height that the cover 1706 rises between the two different configurations $H_2$ and $H_3$. In an aspect, the distance Di may be about five millimeters. Additionally, in an example, the distance Di may be at least equal to the height $H_1$ of the partial wall 1726 (shown in FIGS. 37 and 38), so that in the weight removal configuration, the weight 1704 can be lifted off of the partial wall 1726 and removed from the weight assembly 1700. In other examples, either the rib 1754 or the stop 1750 may be completely removed from the cover 1706 so that the cover 1706 moves between only two configurations as required or desired.

Figure 42:
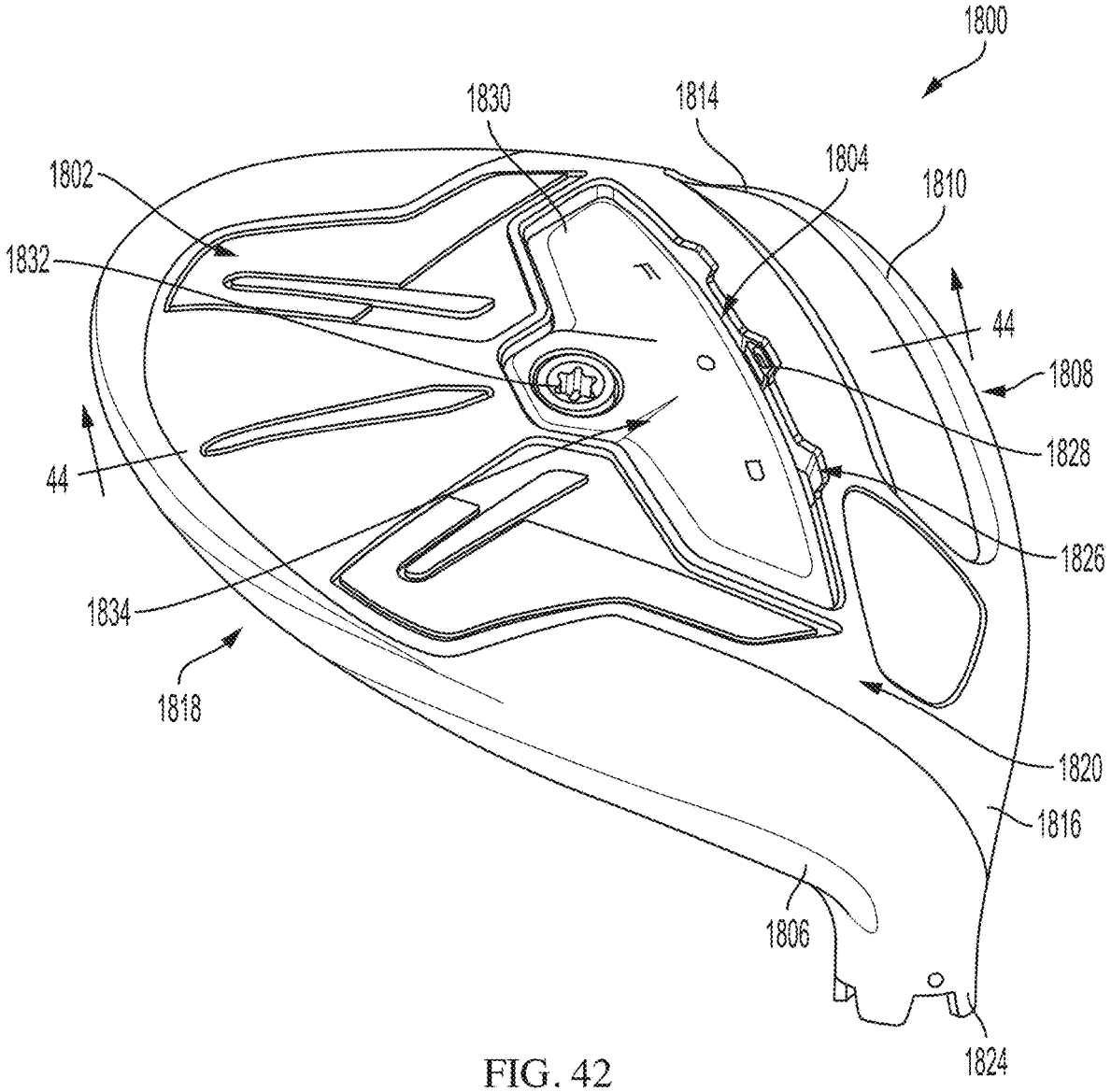
FIG. 42 is a perspective view of a sole of another golf club head with another weight assembly in a locked configuration.

FIG. 42 is a perspective view of a sole 1802 of another golf club head 1800 with another weight assembly 1804 in a locked configuration. The golf club head 1800 is a fairway-metal type golf club head having a body 1806 that includes a striking face 1808 with a lower edge 1810 and an upper edge 1812 (shown in FIG. 43), each extending between a toe 1814 and a heel 1816. The sole 1802 extends from the lower edge 1810 on the bottom side of the club head 1800 and a crown 1818 extends from the upper edge 1812 on the top of the club head 1800. The sole 1802, the striking face 1808, and the crown 1818 are coupled together so as to define an outer surface 1820 of the body 1806 with an interior cavity 1822 (shown in FIG. 44) formed within. A hosel 1824 is disposed at the heel 1816 and is configured to couple to a shaft (not shown). The functions of the components (e.g., sole, striking face, crown, hosel, etc.) of the fairway-metal type club head 1800 are similar to the component functions described above in the metalwood-type golf club head examples of FIGS. 1-41. However, fairway-metal type golf club heads 1800 may strike golf balls directly off the ground surface, thereby requiring or desiring a substantially smooth outer surface 1820 of the sole 1802 without any protruding portions. As illustrated in FIG. 42, the club head 1800 is a fairway-metal type club head, however, the body 1806 may form any type club head, such as an iron-type club head, hybrid-type club head, or metalwood-type club head (e.g., examples illustrated in FIGS. 1-41), as required or desired. Furthermore, the features of the weight assembly 1804 described below can additionally or alternatively be utilized in any type club head described herein as required or desired.

In this example, a recessed channel 1826 is defined within the sole 1802 of the body 1806 of the club head 1800. The channel 1826 extends in the toe 1814—heel 1816 direction so that the CG and the MOI of the club head 1800 can be adjusted for fade-draw bias (e.g., the "F" and "D" indicia on a cover 1830 of the weight assembly 1804). The weight assembly 1804 includes a slidable weight 1828 disposed at least partially within the channel 1826, a cover 1830 that extends at least partially over the channel 1826, and a fastener 1832 configured to couple the cover 1830 to the body 1806. The fastener 1832 retains the weight 1828 in the recessed channel 1826 indirectly via the cover 1830 so that the weight 1828 can be used to adjust the CG and the MOI of the club head 1800. In this example, the weight assembly 1804 and the recessed channel 1826 are located at a frontal section of the golf club head 1800. By "frontal section," it is meant that the weight 1828 is closer to the striking face 1808 than the rearmost outer perimeter of the body 1806, where the sole 1802 and the crown 1818 are coupled together farthest from the striking face 1808.

As illustrated in FIG. 42, the weight assembly 1804 is in a locked configuration with the cover 1830 at least partially disposed within the recessed channel 1826, and the weight 1828 secured within the channel 1826 and movement is restricted. When the cover 1830 and weight assembly 1804 are in the locked configuration, the weight 1828 is completely disposed within the channel 1826 and no portion of the weight 1828 extends above the outer surface 1820 of the body 1806. Additionally, the cover 1830 has an exterior surface 1834 that when the cover 1830 and weight assembly 1804 are in the locked configuration, the exterior surface 1834 of the cover 1830 aligns with the outer surface 1820 of the body 1806 and no portion of the cover 1830 extends above the outer surface 1820 of the body 1806. Because the weight assembly 1804 is completely disposed within the recessed channel 1826 and at least aligned with, or below, the outer surface 1820 of the body 1806, the smoothness of the outer surface 1820 of the club head 1800 is maintained so as to promote good ground interaction.

Figure 43:
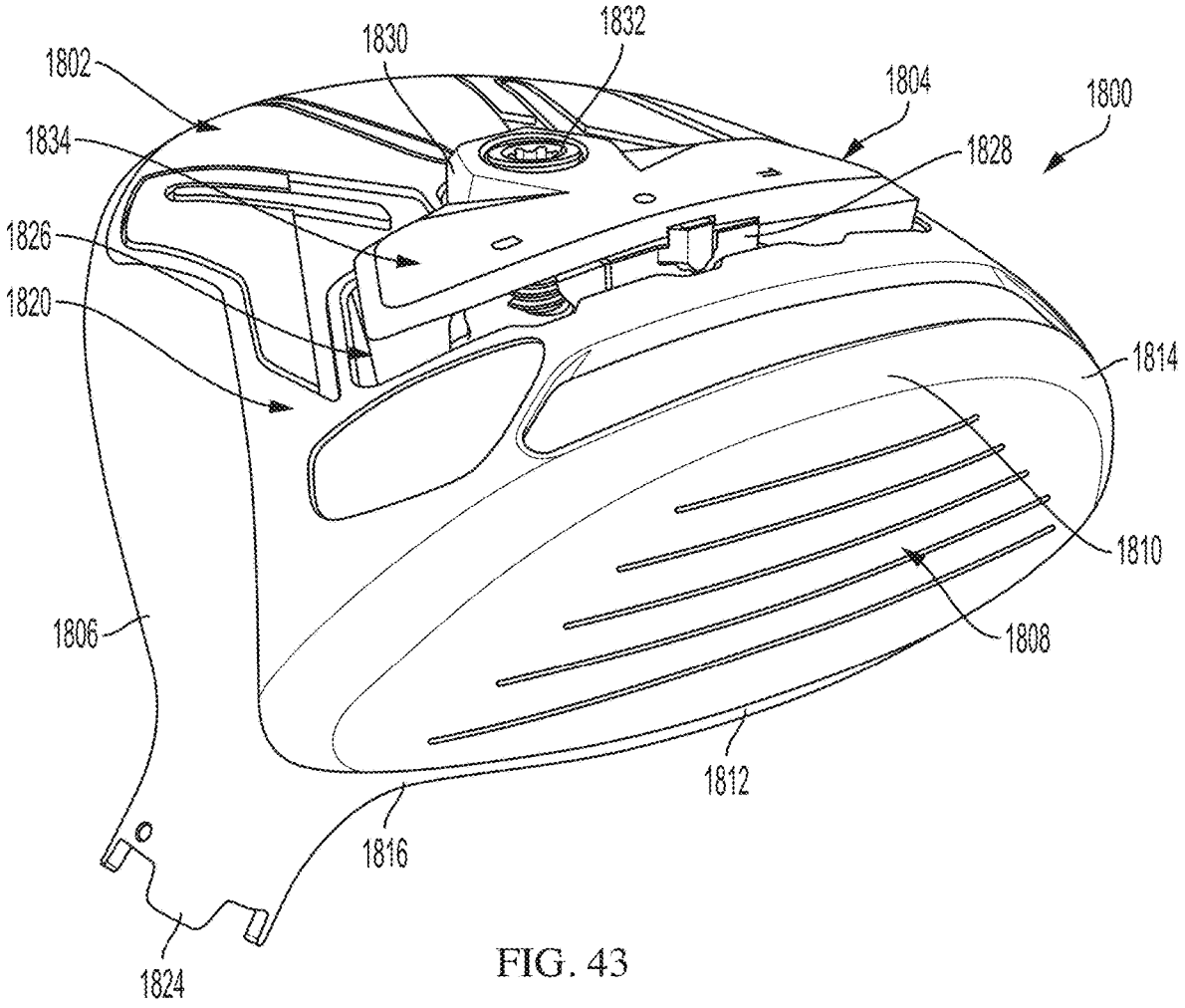
FIG. 43 is a perspective view of the sole of the golf club head with the weight assembly shown in FIG. 42 in an unlocked configuration.

FIG. 43 is a perspective view of the sole 1802 of the golf club head 1800 with the weight assembly 1804 in an unlocked configuration. Certain components are described above, and thus, are not necessarily described further. Via rotation of the fastener 1832, the cover 1830 can be raised at least partially out of the recessed channel 1826 and into the unlocked configuration. In the unlocked configuration, the weight 1828 is selectively slidable within the channel 1826 so as to adjust the CG and the MOI as required or desired. In this example, the weight 1828 is engaged with the cover 1830 so that the weight 1828 moves with the cover 1830 between the unlocked configuration and the locked configuration and raises at least partially out of the recessed channel 1826 when in the unlocked configuration. It should be appreciated, that while FIGS. 42 and 43 illustrate and describe the weight assembly 1804 in two different configurations, a locked configuration and an unlocked configuration, the weight assembly 1804 could be moveable between more than two configurations as required or desired. For example, the weight assembly 1804 can move between at least three configurations, a locked configuration, a weight moving configuration, and a weight removal configuration, as described above in reference to FIGS. 36-41.

Figure 44:
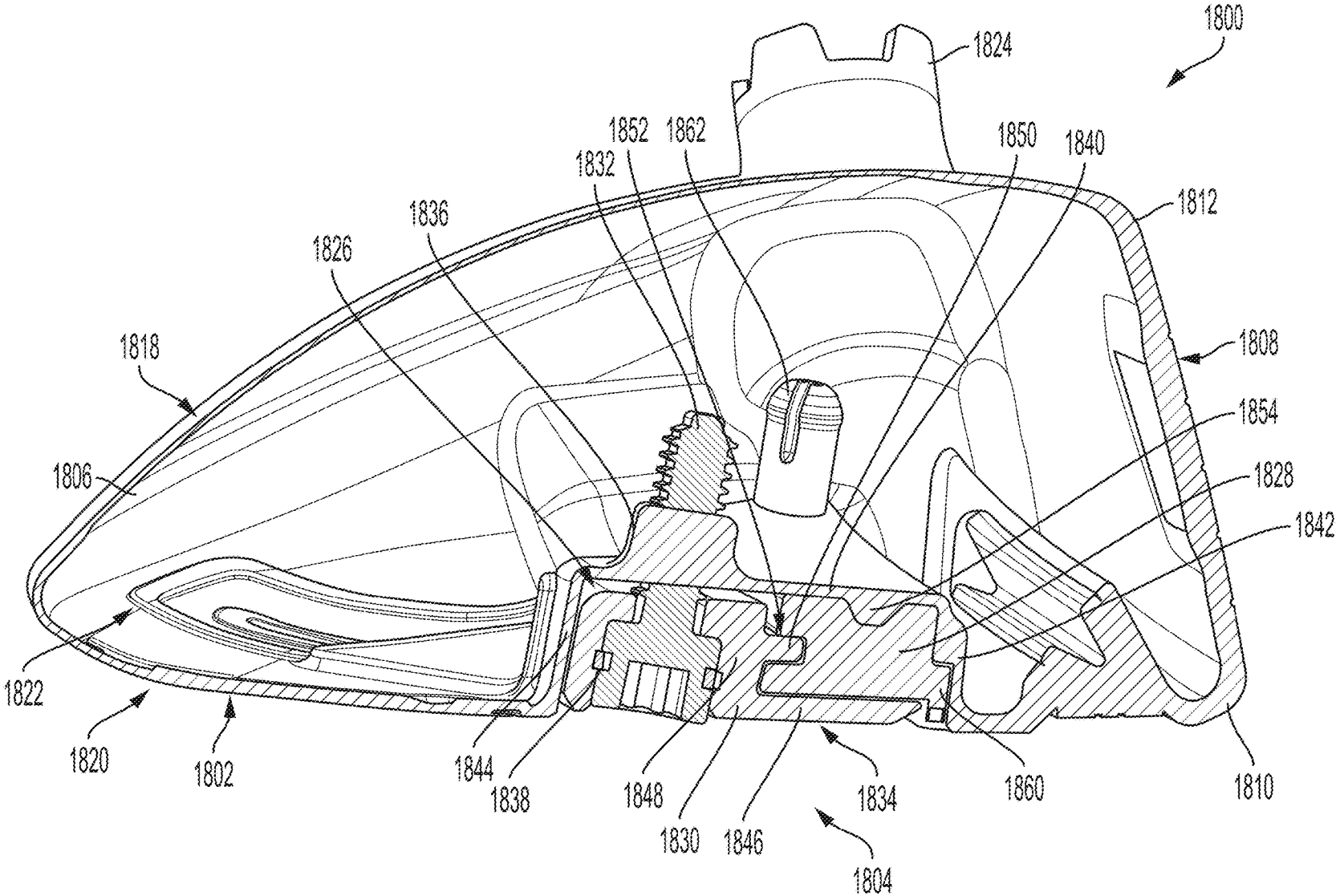
FIG. 44 is a cross-sectional view of the golf club head with the weight assembly taken along line 44-44 in FIG. 42.
Figure 45:
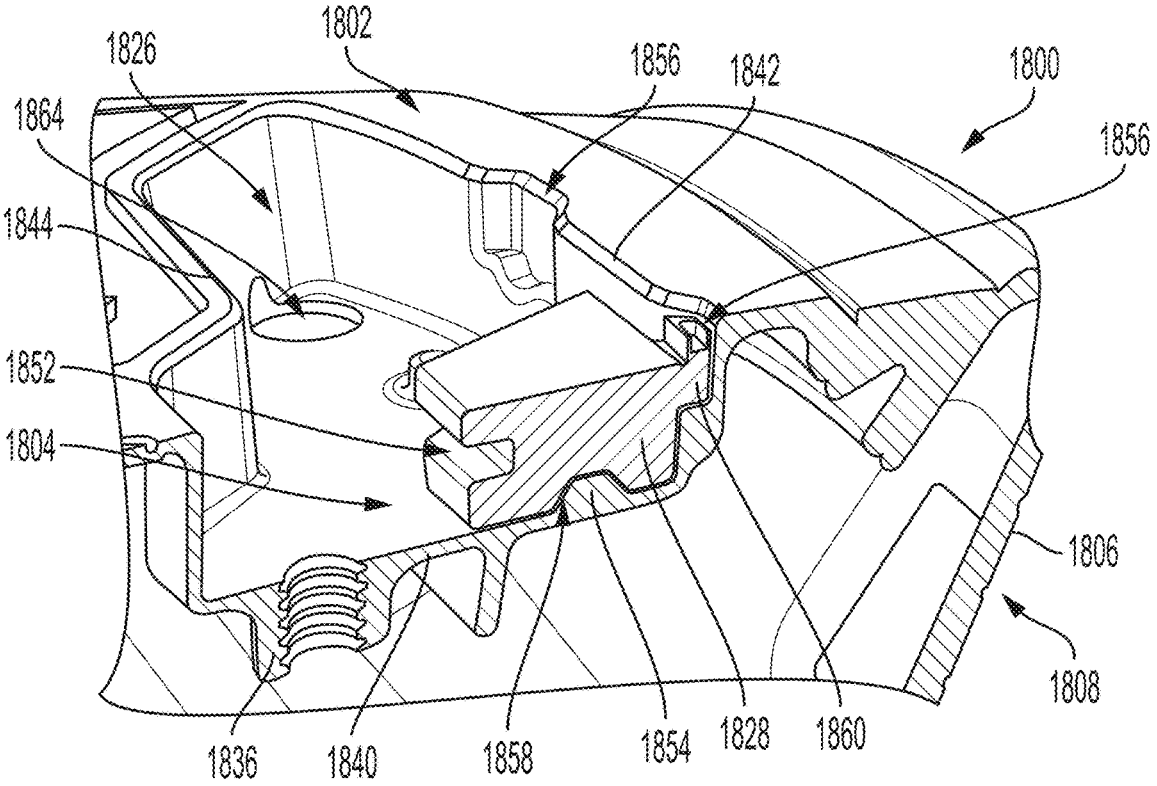
FIG. 45 is a partial perspective cross-sectional view of the weight assembly taken along line 44-44 in FIG. 42.

FIG. 44 is a cross-sectional view of the golf club head 1800 with the weight assembly 1804 taken along line 44-44 in FIG. 42. FIG. 45 is a partial perspective cross-sectional view of the weight assembly 1804 taken along line 44-44 in FIG. 42. Referring concurrently to FIGS. 44 and 45, certain components are described above, and thus, are not necessarily described further. The fastener 1832 is a threaded bolt that threadingly engages with a nut 1836 formed within the sole 1802 of the body 1806. The fastener 1832 is coupled to the cover 1830 by a lock washer 1838 so that linear movement (e.g., via rotation of the fastener 1832) is transferred to the cover 1830 and the cover 1830 can move in and out of the recessed channel 1826 as described herein.

In this example, the channel 1826 is defined by a bottom track 1840 and two opposing sidewalls 1842, 1844. A first sidewall 1842 is adjacent the striking face 1808 and a second sidewall 1844 is adjacent to the rear of the sole 1802. The cover 1830 is substantially L-shaped with a long leg 1846 and a short leg 1848. The short leg 1848 includes a portion that couples to the fastener 1832 and both the short leg 1848 and the fastener 1832 are positioned adjacent the second sidewall 1844. The short leg 1848 also includes a flange 1850. The weight 1828 includes a groove 1852 that is sized and shaped to receive the flange 1850. The weight 1828 is slidably engaged with the cover 1830 and with the flange 1850 received at least partially within the groove 1852. This engagement between the cover 1830 and the weight 1828 enables the weight 1828 to move (e.g., raise out and lower back into the channel 1826) with the cover 1830 between the locked configuration (shown in FIG. 42) and the unlocked configuration (shown in FIG. 43), while also enabling the weight 1828 to slide relative to the cover 1830 in the toe-heel direction when the weight assembly is in the unlocked configuration. When the cover 1830 is in the locked configuration, the long leg 1846 also substantially covers the weight 1828 so as to increase the smoothness of the outer surface 1820 of the club head 1800.

The bottom track 1840 includes a plurality of bosses 1854 extending into the channel 1826. In this example, there are three bosses 1854, each which corresponds respectively to a fade bias position of the weight 1828, a draw bias position of the weight 1828, and a center-neutral position of the weight 1828. Additionally, the first sidewall 1842 includes a plurality of dimples 1856 that correspond to the plurality of bosses 1854. The weight 1828 includes a hollow 1858 that is sized and shaped to receive the boss 1854 and a position indicator 1860 that is sized and shaped to be received within the dimple 1856. In operation, when the weight assembly 1804 is in the unlocked configuration (shown in FIG. 43), the weight 1828 is raised above the bosses 1854 so that it can be selectively moved between the bosses 1854 and the dimples 1856 of the channel 1826. Once the weight 1828 is positioned, the weight assembly 1804 can be moved to the locked configuration (shown in FIG. 42) and the selected boss 1854 is received at least partially within the hollow 1858 of the weight 1828, and the position indicator 1860 is received at least partially within the selected dimple 1856.

In this example, at least a portion of the position indicator 1860 of the weight 1828 is visible on the outer surface 1820 of the club head 1800, when the weight assembly 1804 is in the locked configuration. This allows the user to easily visually verify the position of the weight 1828 on the club head 1800. It should be appreciated that while three bosses 1854 and dimples 1856 are illustrated and described, any other number of bosses and dimples locating features may be provided to define the position of the weight 1828 within the recessed channel 1826. For example, five sets of bosses and dimples may be provided. Additionally, the position indicator 1860 has a cutout so that when the cover 1830 is raised to the unlocked configuration (shown in FIG. 43), the position indicator 1860 can slide completely out of the dimple 1856 and move above the first sidewall 1842 to adjust the position of the weight 1828.

The cover 1830 can also include one or more projections 1862 that are sized and shaped to be received within a corresponding chamber 1864 of the recessed channel 1826. The projections 1862 are configured to increase the engagement of the cover 1830 with the body 1806 so that the weight 1828 is restricted from moving or rattling when secured within the recessed channel 1826 by the cover 1830. In some examples, the projections 1862 may be similar to the projections described above in reference to FIGS. 36-41 and include one or more flexible arms, a tapered nose, a stop, and at least one rib.

Figure 46:
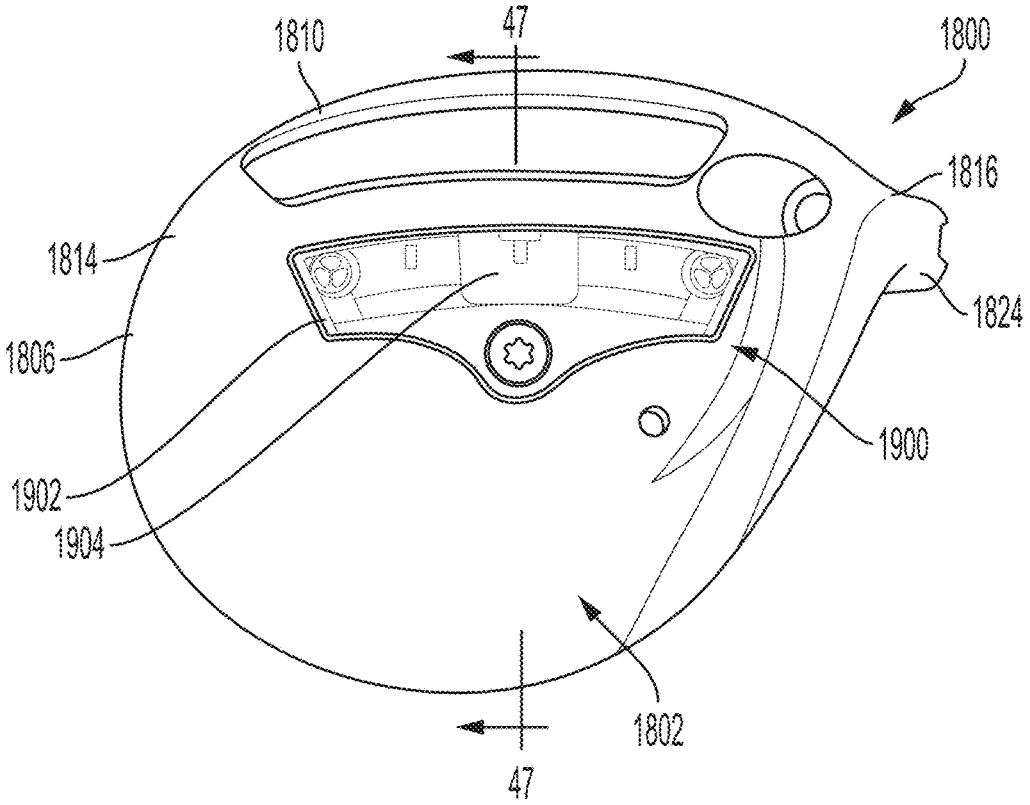
FIG. 46 is a bottom view of the golf club head with another weight assembly.
Figure 47:
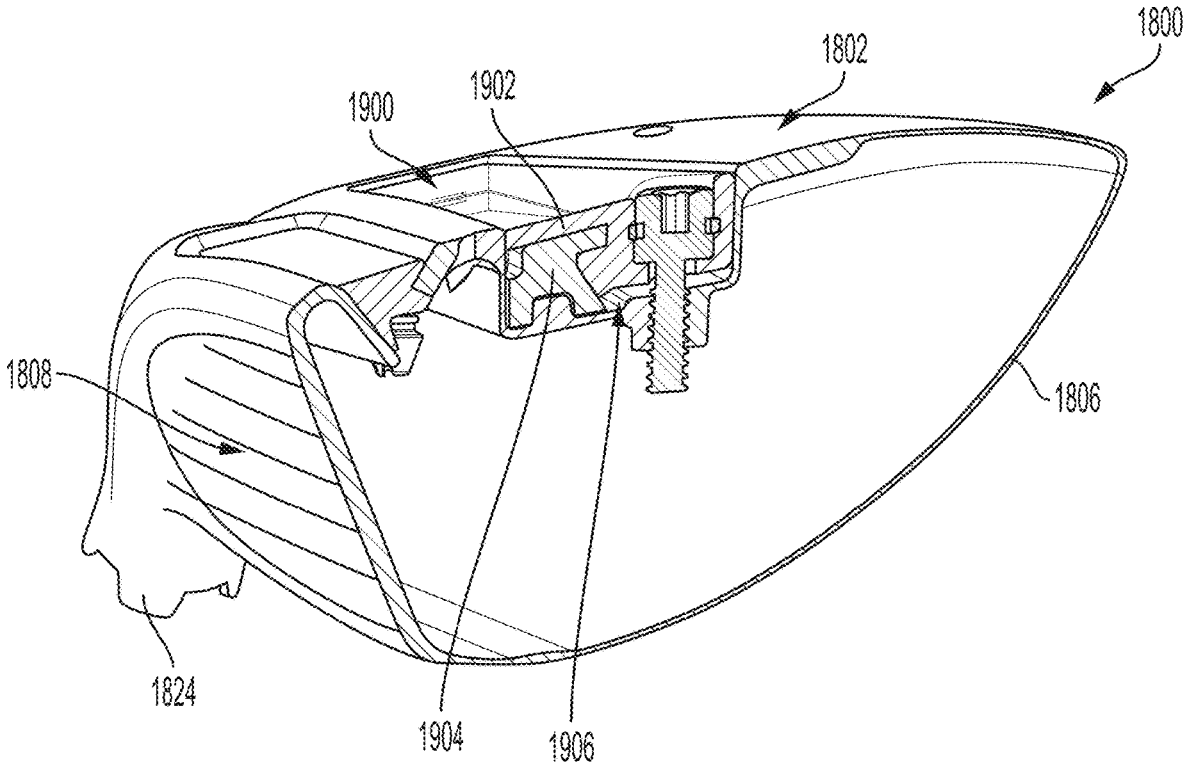
FIG. 47 is a perspective cross-section view of the golf club head with weight assembly taken along line 47-47 in FIG. 46.

FIG. 46 is a bottom view of the golf club head 1800 with another weight assembly 1900. FIG. 47 is a perspective cross-section view of the golf club head 1800 with the weight assembly 1900 taken along line 47-47 in FIG. 46. Referring concurrently to FIGS. 46 and 47, certain components are described above, and thus, are not necessarily described further. Similar to the example described in FIGS. 42-45, the weight assembly 1900 includes a cover 1902 that selectively secures a slidable weight 1904 within a recessed channel 1906. The weight 1904 is engaged with the cover 1902 so that the weight 1904 moves with the cover 1902 between two or more configurations. In this example, however, the cover 1902 completely covers the weight 1904 within the channel 1906, when the cover 1902 is in a locked configuration. The cover 1902 can be formed from an at least partially transparent material so that the position of the weight 1904 is visible to the user.

Figure 48:
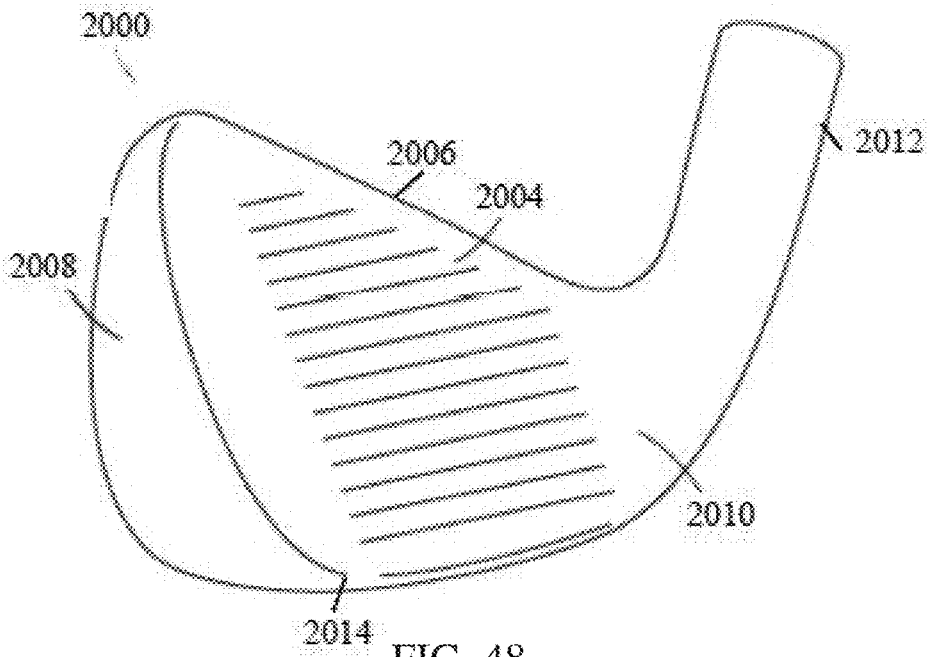
FIG. 48 is a perspective view of another golf club head.
Figure 49:
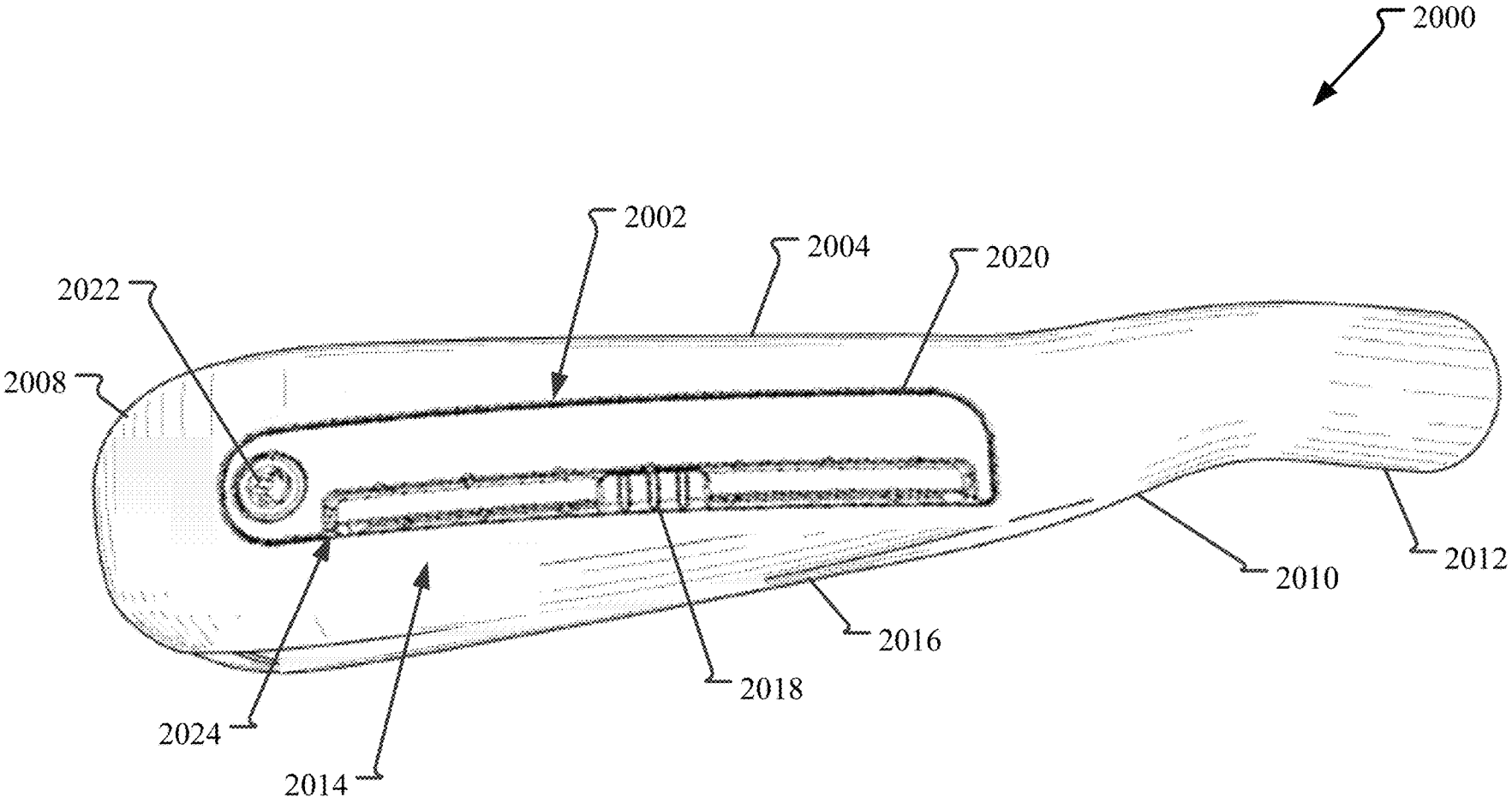
FIG. 49 is a bottom view of the club head shown in FIG. 48 with another weight assembly.

FIG. 48 is a perspective view of another golf club head 2000. FIG. 49 is a bottom view of the club head 2000 with another weight assembly 2002. Referring concurrently to FIGS. 48 and 49, the golf club head 2000 is an iron-type golf club head that includes a striking face 2004 configured to strike a golf ball. The striking face 2004 is connected to a top line portion 2006, a toe portion 2008, and a heel portion 2010. The toe portion 2008 and the heel portion 2010 are also at least in part connected to the top line portion 2006. The heel portion 2010 is connected to a hosel 2012 that is configured to couple to a shaft (not shown). The striking face 2004 is also connected to a sole 2014. The golf club head 2000 also includes a back portion 2016 that is attached at least partially to the sole 2014, the top line portion 2006, the toe portion 2008, and the heel portion 2010.

The components of the golf club head 2000, such as the striking face 2004, the top line portion 2006, the toe portion 2008, the heel portion 2010, and the back portion 2016 may be of a metallic material, such as a steel. The components of the golf club head 2000 may be formed through a casting process. Some of the components may be cast as a single piece and the remainder of the components may be attached subsequent to the casting process. For instance, the sole 2014, the top line portion 2006, the toe portion 2008, the heel portion 2010, and the back portion 2016 may be cast as a single piece. The striking face 2004 may then be attached to that single piece via welding or any other suitable process for attaching two club head components to one another. In such an example, the striking face 2004 may be an insert.

In operation, the sole 2014 generally provides the lower surface of the club head 2000 when the club head 2000 is placed in an address position. The club head 2000 defines a center of gravity (CG) and a moment of inertia (MOI) that impact flight characteristics of the golf ball when hit with the striking face 2004. The weight assembly 2002 is coupled to the club head 2000 such that the CG and/or the MOI of the club head 2000 can be selectively adjusted as required or desired. In this example, the weight assembly 2002 includes a movable weight 2018, a cover 2020 configured to secure the weight 2018 in place, and a fastener 2022 for coupling the weight assembly 2002 to one or more portions of the club head 2000. A recessed elongated channel 2024 is formed in the sole 2014 of the club head 2000 and is sized and shaped to receive at least a portion of the weight 2018. Similar to the examples described above, the fastener 2022 is adapted to retain the weight 2018 in the channel 2024 only indirectly by the cover 2020. Additionally, the cover 2020 can be loosened or completely removed, via the fastener 2022, to enable the weight 2018 to slide within the channel 2024 and selectively adjust the CG and the MOI as required or desired.

In this example, the fastener 2022 is positioned at the toe end of the weight assembly 2002 and aligned with the channel 2024. In other examples, the fastener 2022 may be positioned at the heel end of the weight assembly 2002 as required or desired.

Figure 50:
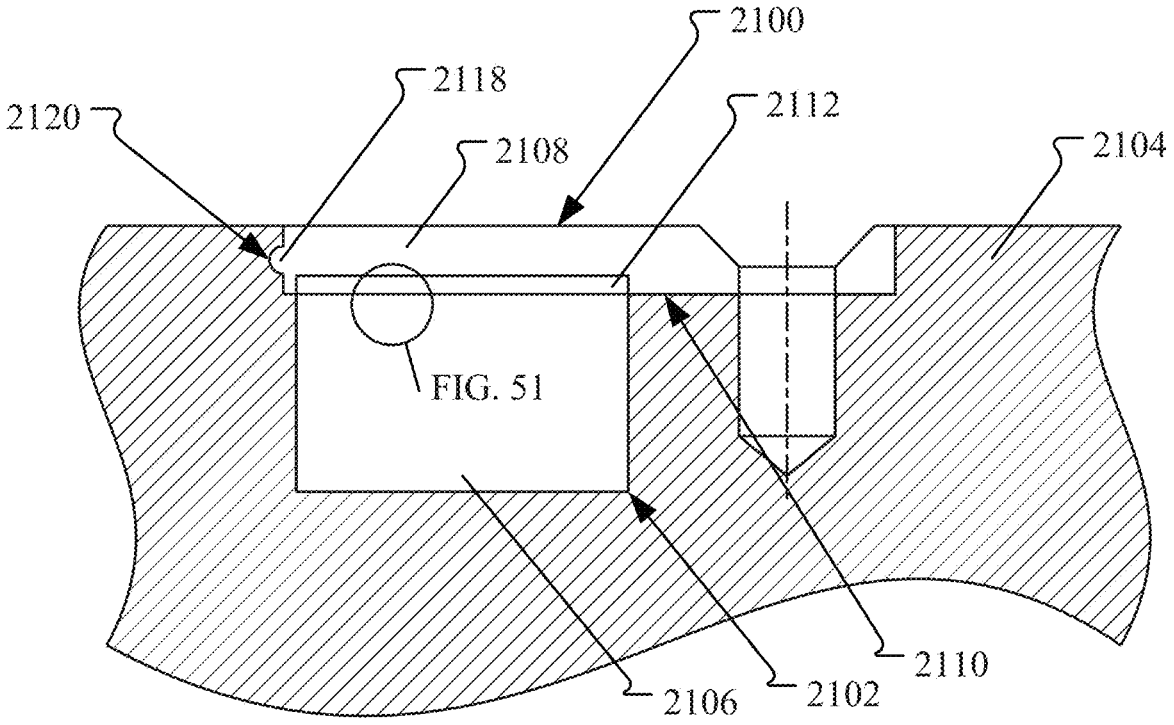
FIG. 50 is a cross-section view of another weight assembly.
Figure 51:
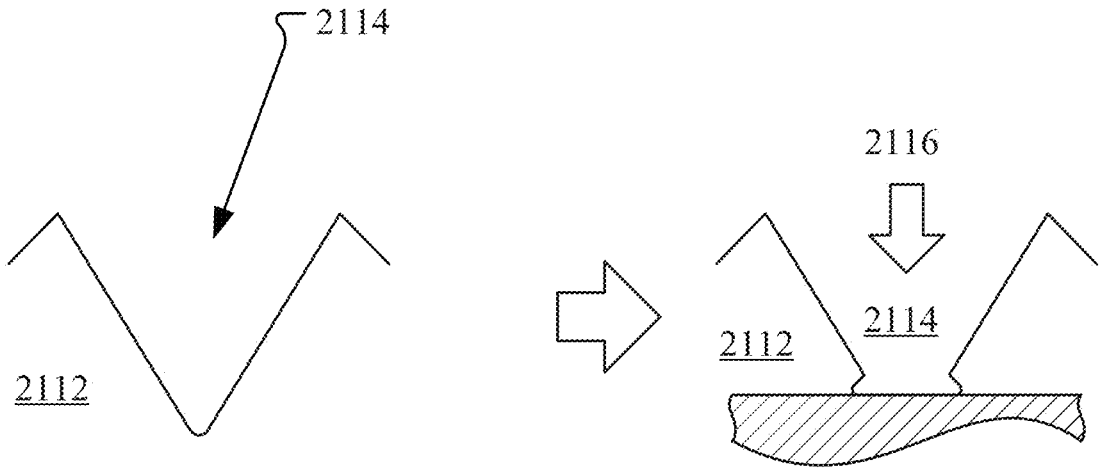
FIG. 51 is a schematic view of the weight assembly shown in FIG. 50.

FIG. 50 is a cross-section view of another weight assembly 2100. FIG. 51 is a schematic view of the weight assembly 2100. Referring concurrently to FIGS. 50 and 51, a recessed channel 2102 is defined within a body 2104 of a club head (e.g., club heads 100, 1800, and/or 2000 described above). The weight assembly 2100 includes a slidable weight 2106 and a cover 2108. A fastener (not shown) is used to retain the weight 2106 within the channel 2102. In this example, the cover 2108 includes an inside surface 2110 that engages with at least a portion of the weight 2106, when the weight 2106 is secured within the channel 2102. In this example, at least a portion of the inside surface 2110 of the cover 2108 includes a friction material liner 2112. The friction material 2112 is configured to frictionally engage with the weight 2106 when the cover 2108 is in a locked configuration. By frictionally engaging the weight 2106 with the cover 2108, the weight 2106 is secured within the channel 2102 while reducing or preventing the weight 2106 from rattling therein. In the example, the friction material can be a soft metal material, such as brass.

The friction material 2112 may include a plurality of grooves 2114 on the mating surface with the weight 2106. In this example, the grooves 2114 may be triangular in shape, although, other shapes are also contemplated herein. When a clamp load 2116 is applied to the friction material 2112, the material yields to hold the weight 2106 in place (as shown in FIG. 51) and match the particular surface combination of the channel 2102, weight 2106, and cover 2108. Once the deformation takes place and contact stress is established, the friction material 2112 will not deform further. By frictionally engaging the weight 2106 with the cover 2108, the weight 2106 can be positioned at any location within the channel 2102 and indexing features do not need to be included. Additionally, by removing the indexing features, the weight 2106 and channel 2102 have more substantially flat surfaces, which increases manufacturing efficiencies.

In this example, the cover 2108 may also include one or more protruding notches 2118 that engage with a corresponding cavities 2120 within the body 2104. The notches 2118 may be substantially circular in shape. The notches 2118 and cavities 2120 are described further below in reference to FIGS. 52 and 53. It should be appreciated that while the friction material 2112 is illustrated as being coupled to the cover 2108, the friction material 2112 can additionally or alternatively be coupled to the weight 2106.

Figure 52:
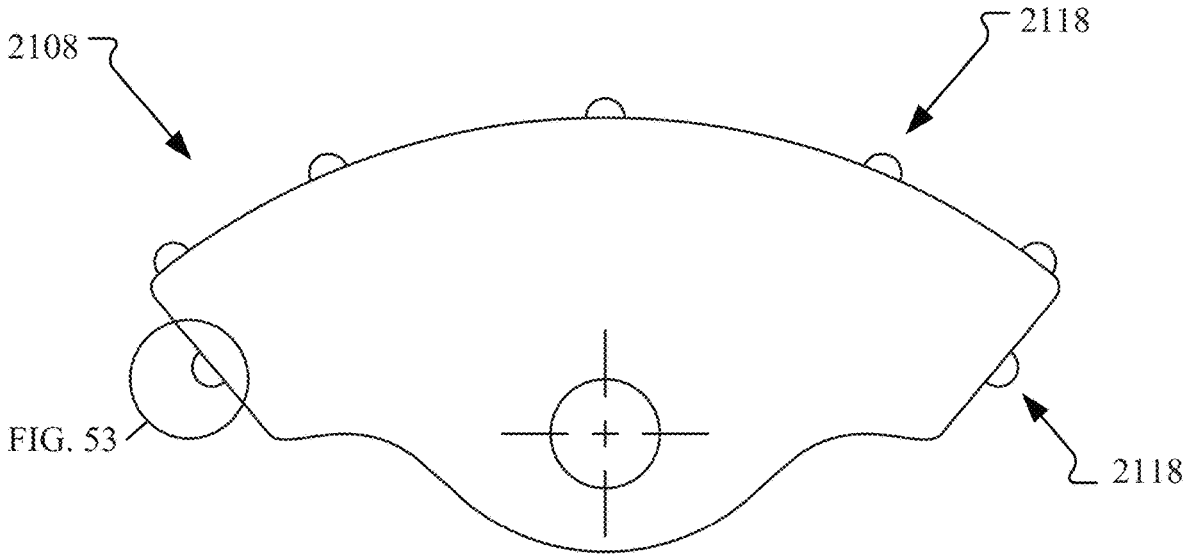
FIG. 52 is a top view of a cover of the weight assembly shown in FIG. 50.
Figure 53:
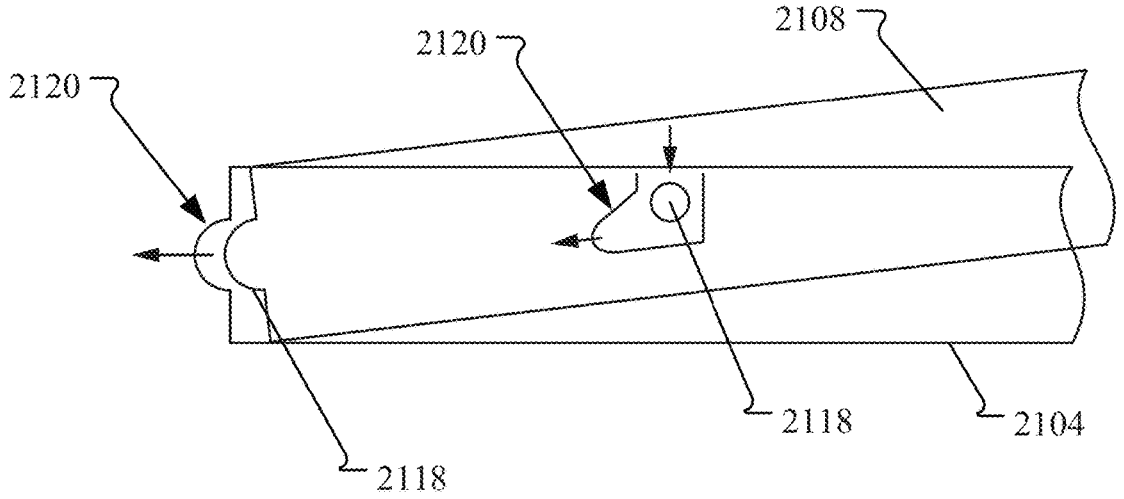
FIG. 53 is a side view of the cover of the weight assembly shown in FIG. 50.

FIG. 52 is a top view of the cover 2108 of the weight assembly 2100 (shown in FIG. 50). FIG. 53 is a side view of the cover 2108. Referring concurrently to FIGS. 52 and 53 certain components are described above, and thus, are not necessarily described further. The cover 2108 includes a plurality of protruding notches 2118 that engage with corresponding cavities 2120 within the body 2104. By engaging the cover 2108 at a plurality of locations, the cover 2108 is restricted or prevented from bowing out of alignment with the outer surface of the body 2104 when securing the weight. As illustrated in FIG. 53, the side cavities may be tapered so as to accept the cover 1206 sliding in at an angle.

Figure 54:
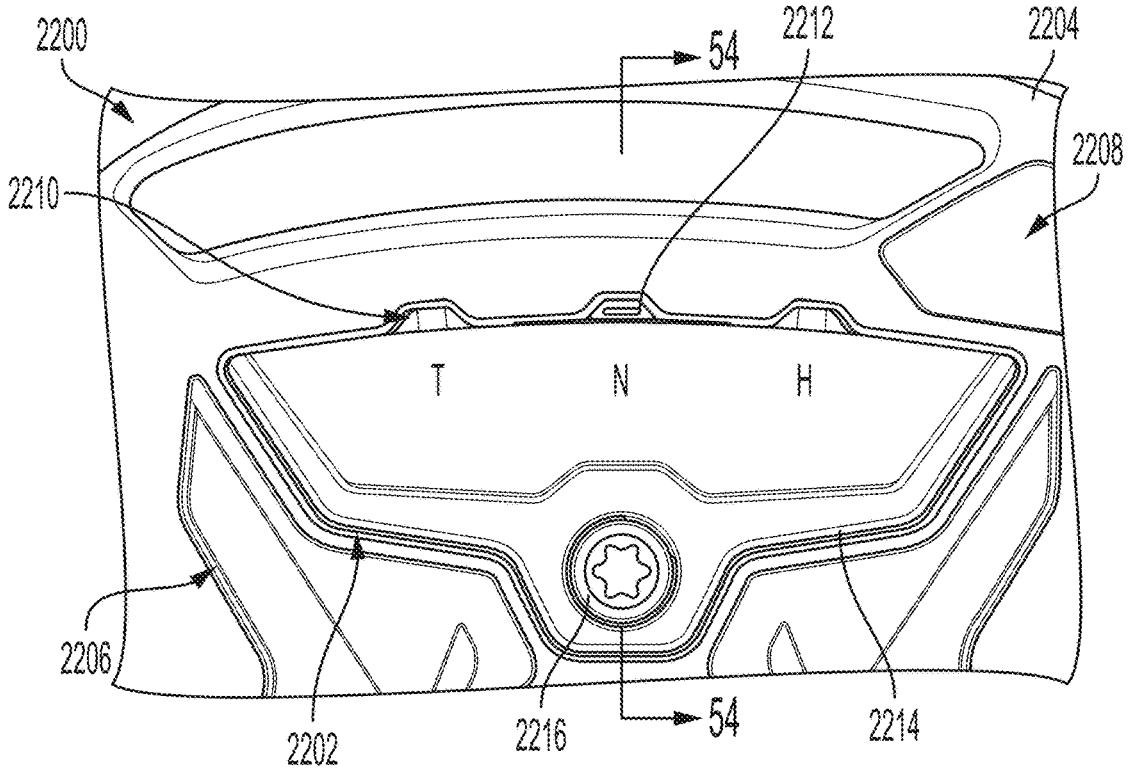
FIG. 54 is a bottom view of another golf club head with another weight assembly.

FIG. 54 is a bottom view of another golf club head 2200 with another weight assembly 2202 in a locked configuration. The golf club head 2200 includes a body 2204 having a sole 2206, and with the weight assembly 2202 disposed on the sole 2206. The body 2204 also includes a striking face and a crown (both not shown), such that the body 2204 has an outer surface 2208. In an aspect, the golf club head 2200 can be a fairway-metal type golf club head, however, the body 2204 can form any type club head, such as an iron-type club head, hybrid-type club head, or driver or other metal-wood type club head (e.g., one or more of the examples illustrated in FIGS. 1-53). Additionally, the functions of the components (e.g., sole, striking face, crown, hosel, etc.) of the club head 2200 are similar to the component functions described above in FIGS. 1-53. Furthermore, the features of the weight assembly 2202 described below can additionally or alternatively be utilized in any type club head described herein, and as required or desired.

In this example, a recessed channel 2210 is defined within the sole 2206 of the body 2204 of the club head 2200. The recessed channel 2210 extends in a toe-heel direction so that the CG and MOI of the club head 2200 can be adjusted (e.g., for fade-draw bias). The weight assembly 2202 includes a slidable weight 2212 disposed at least partially within the channel 2210, a cover 2214 that extends at least partially over the channel 2210, and a fastener 2216 configured to couple the cover 2214 to the body 2204. The fastener 2216 retains the weight 2212 in the recessed channel 2210 indirectly via the cover 2214 so that the weight 2212 can be used to adjust the CG and MOI of the club head 2200.

As illustrated in FIG. 54, the weight assembly 2202 is in a locked configuration with the cover 2214 at least partially disposed within the recessed channel 2210 and the weight 2212 secured within the channel 2210 so as to restrict movement. When the cover 2214 and the weight assembly 2202 are in the locked configuration, at least a portion of the weight 2212 is visible between the body 2204 and the cover 2214. This configuration enables the user to more easily determine the placement of the weight 2212 within the recessed channel 2210. The weight assembly 2202 can also be moved into an unlocked configuration as described herein. For example, via rotation of the fastener 2216, the cover 2214 can be raised at least partially out of the recessed channel 2210 and enable the weight 2212 to be repositioned.

In this example, the weight 2212 overlaps and engages with the cover 2214 so that both move together between the locked configuration and the unlocked configuration. Furthermore, this engagement is such that the weight 2212 is reduced or prevented from twisting and tilting relative to the cover 2214 when raising and lowering with respect to the recessed channel 2210. As such, the weight 2212 is prevented from binding within the recessed channel 2210 during weight adjustment, and thereby, increasing performance of the weight assembly 2202.

Figure 55:
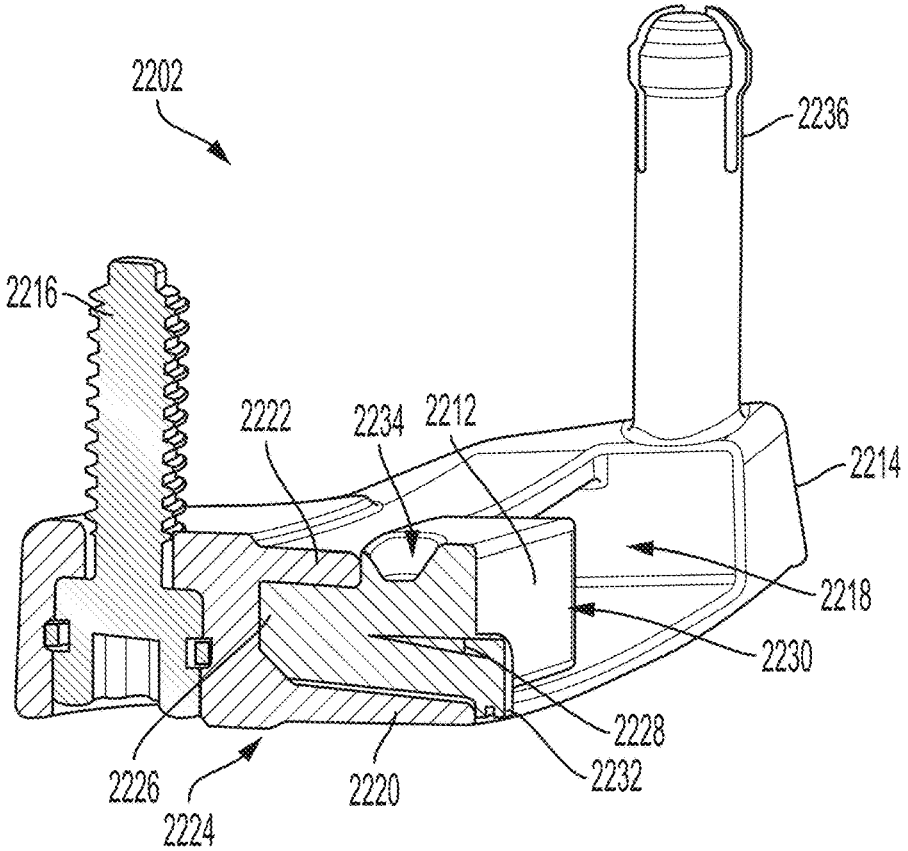
FIG. 55 is a perspective, cross-sectional, view of the weight assembly taken along line 54-54 in FIG. 54.
Figure 56:
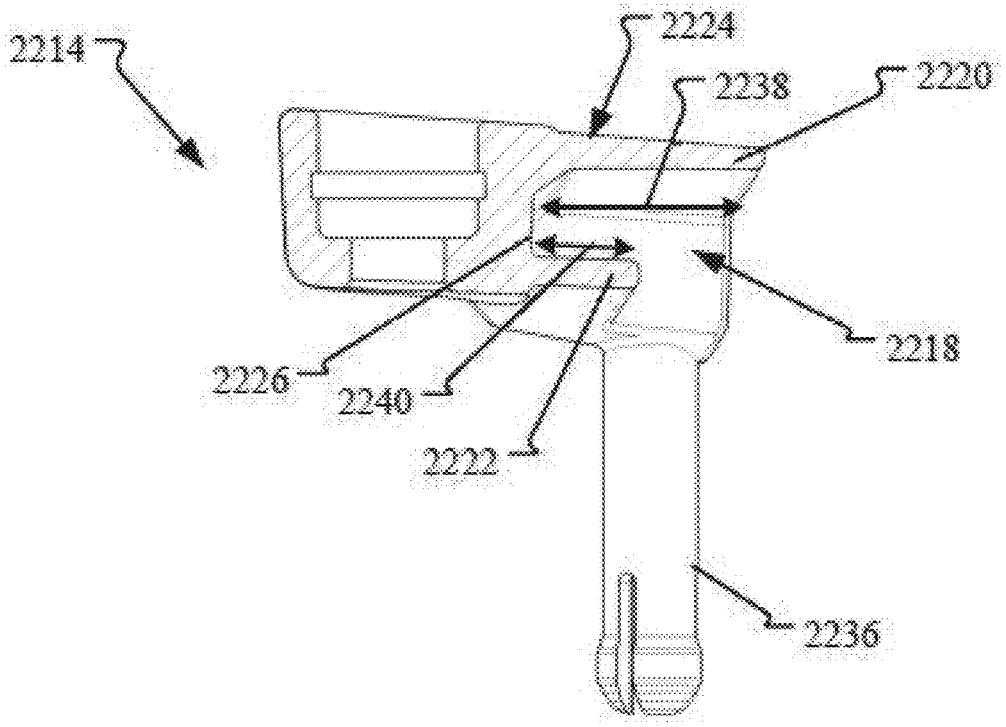
FIG. 56 is a cross-sectional view of a cover taken along line 54-54 in FIG. 54.

FIG. 55 is a perspective, cross-sectional, view of the weight assembly 2202 taken along line 54-54 in FIG. 54. FIG. 56 is a cross-sectional view of the cover 2214 taken along line 54-54 in FIG. 54. Referring concurrently to FIGS. 55 and 56, the cover 2214 has a shelf 2218 that is configured to slidably engage with the weight 2212. In the example, the shelf 2218 is open in a direction that faces towards the striking face of the club head and away from the fastener 2216.

Additionally, the shelf 2218 extends within the cover 2214 in a toe-heel direction. It is appreciated, however, that the shelf 2218 can be defined within the cover 2214 in any other orientation and/or direction as required or desired to achieve the adjustable weight functionality as described herein. When the cover 2214 is in the unlocked position, the weight 2212 is raised relative to the club head such that the weight 2212 is selectively slidable within the shelf 2218 and the recessed channel 2210 (shown in FIG. 54). Conversely, when the cover 2214 is in the locked position, the weight 2212 is disposed at least partially within the recessed channel 2210 and the shelf 2218, and secured therein, so as to restrict or prevent movement of the weight 2212. In the example, the shelf 2218 provides an overlap for the cover 2214 with the weight 2212 so as to reduce the weight 2212 from binding within the recessed channel.

The shelf 2218 includes an outer wall 2220 and an opposite inner wall 2222. As described herein, the outer wall and inner wall of the shelf 2218 are in reference to the interior cavity of the body 2204 of the club head (shown in FIG. 54). As such, the outer wall 2220 is disposed proximate an exterior surface 2224 of the cover 2214. The weight 2212 is configured to be slidably received at least partially between the outer wall 2220 and the inner wall 2222 of the shelf 2218 and against an inner wall 2226 of the shelf 2218. The three walls of the shelf 2218 retain the weight 2212 within the cover 2214 so that the position of the weight 2212 is restricted or prevented from tilting relative to the cover 2214 when being moved between the locked configuration and unlocked configuration. This configuration restricts the weight 2212 from binding within the weight assembly 2202, and thus, increases performance of the weight assembly 2202.

In the example, this position of the weight 2212 within the cover 2214 can be measured by a tilt angle 2228 that is defined as an angular position of the weight 2212 relative to the outer wall 2220 of the shelf 2218. In an aspect, the tilt angle 2228 is substantially the same in both the unlocked configuration and the locked configuration. In another aspect, the tilt angle 2228 is substantially parallel to the outer wall 2220 of the shelf 2218 in both the unlocked configuration and the locked configuration. The weight 2212 has an outer surface 2230 that is positioned directly against the outer wall 2220, the inner wall 2222, and the inner wall 2226 of the cover 2214 when received within the shelf 2218. As such, the outer surface 2230 of the weight 2212 maintains its position directly against the walls of the shelf 2218 in both the unlocked configuration and locked configuration.

The weight 2212 includes a position indicator 2232 that extends at least partially out of the shelf 2218. The position indicator 2232 can be used to selectively slide the weight 2212 when the weight assembly 2202 is in the unlocked configuration. When in the locked configuration, the position indicator 2232 is visible between the cover 2214 and the body of club head so that the user can easily determine the weight characteristics of the club head. Additionally, the position indicator 2232 can be disposed within dimples (e.g., the dimples 1856 shown in FIG. 45) of the recessed channel. The weight 2212 also includes a hollow 2234 that is sized and shaped to receive a boss (e.g., the boss 1854 shown in FIG. 45) of the recessed channel. In the example, the hollow 2234 is disposed adjacent the inner wall 2222 of the shelf 2218.

The cover 2214 can also include one or more projections 2236 that are sized and shaped to be received within a corresponding chamber (not shown) of the recessed channel. The projection 2236 is configured to increase the engagement of the cover 2214 with the golf club head body so that the weight 2212 is restricted from moving or rattling when secured within the recessed channel by the cover 2214. The projection 2236 can also be used to limit the extraction of the cover 2214 from the body 2204 (shown in FIG. 54) to create a soft stop before completely unscrewing and extracting the cover 2214 from the body. In some examples, the projection 2236 may be similar to the projections described above in reference to FIGS. 36-41 and include one or more flexible arms, a tapered nose, a stop, and at least one rib.

In the example, a width 2238 of the outer wall 2220 relative to the inner wall 2226 is greater than a width 2240 of the inner wall 2222. This configuration enables the weight 2212 to be retained within the shelf 2218 without tilting and binding up within the weight assembly 2202. Additionally, the weight 2212 includes the hollow 2234 and the position indicator 2232 that can extend out from the shelf 2218 and enable the function of the weight assembly 2202 as described herein. For example, the inner wall 2226 enables the hollow 2234 of the weight 2212 to engage with corresponding structure within the recessed channel. In an aspect, the width of the outer wall is between approximately 2 to 4 times greater than the width of the inner wall. In another aspect, a ratio of the width 2238 of the outer wall 2220 to the width 2240 of the inner wall 2222 is greater than, or equal to, 2:1. In yet another aspect, the ratio of the width 2238 of the outer wall 2220 to the width 2240 of the inner wall 2222 is greater than, or equal to, 3:1. In still another aspect, the ratio of the width 2238 of the outer wall 2220 to the width 2240 of the inner wall 2222 is between approximately 2:1 and 4:1. It should be appreciated that other ratio values are also contemplated herein and may not be expressly listed above.

Figure 57:
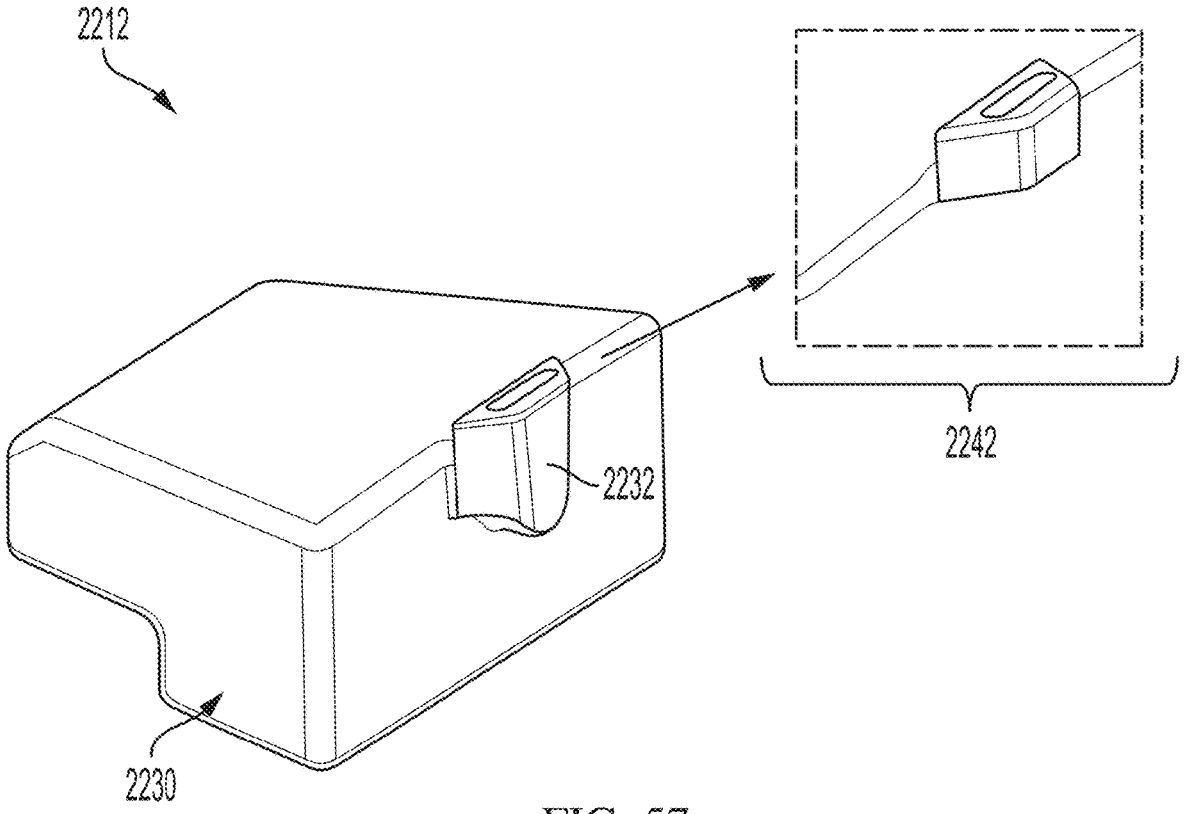
FIG. 57 is a perspective view of a weight of the weight assembly shown in FIGS. 55 and 56.
Figure 58:
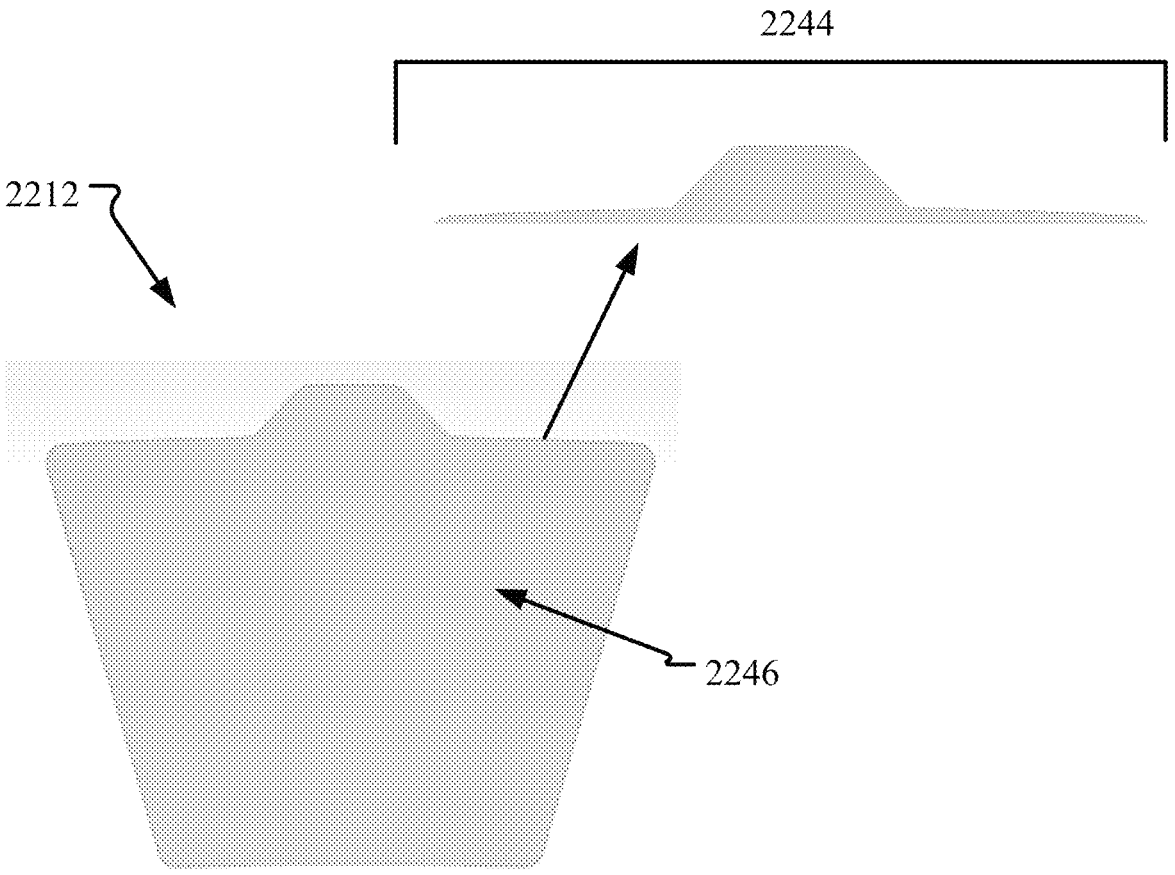
FIG. 58 is a schematic top plan view of the weight shown in FIG. 57.

FIG. 57 is a perspective view of the weight 2212. FIG. 58 is a schematic top plan view of the weight 2212. Referring concurrently to FIGS. 57 and 58, as well as FIG. 54, at least a portion of the weight 2212 is exposed and visible between the exterior surface of the cover 2214 and the outer surface 2208 of the body 2204, when the weight assembly 2202 in the locked configuration. That is, a gap is formed at least partially between a portion of the cover 2214 and the body 2204, and the weight 2212 at least partially fills this gap. For example, the position indicator 2232 may be exposed and visible on the golf club head 2200. This configuration enables the position of the weight 2212 to be easily determined. However, the weight 2212 is not entirely exposed and visible. By reducing the portions of the weight 2212 exposed on the golf club head 2200, the smoothness between the outer surface 1820 of the club head 2200 and the cover 2214 is increased. As such, the golf club head 2200 has increased performance (e.g., striking golf balls directly off the ground surface, aerodynamic performance, etc.), while also including the weight adjustable function via the weight assembly 2202 as described herein.

In the example, between approximately 0% and 30% of the weight 2212 is exposed and visible between the outer surface 2208 of the body 2204 and the exterior surface of the cover 2214 in the locked configuration. In an aspect, between approximately 10% and 20% of the weight 2212 is exposed between the outer surface 2208 of the body 2204 and the exterior surface of the cover 2214 in the locked configuration. In yet another aspect, approximately 16% of the weight 2212 is exposed. It should be appreciated that other percentage values are also contemplated herein and may not be expressly listed above. Although not shown in the figures, the weight 2212 can be completely invisible without departing from the scope and content of the present invention.

With reference to FIG. 57, the percentage of the weight 2212 visible and exposed (e.g., portion 2242) may be based on the outer surface area 2230 of the weight 2212. As used herein, the outer surface 2230 of the weight 2212 includes more than one side of the weight shape and the entire outer perimeter as illustrated in FIG. 57. For example, in an aspect, between approximately 0% and 30% of the outer surface 2230 of the weight 2212 is exposed between the outer surface 2208 of the body 2204 and the exterior surface of the cover 2214 in the locked configuration. In another aspect, between approximately 10% and 20% of the outer surface 2230 of the weight 2212 is exposed between the outer surface 2208 of the body 2204 and the exterior surface of the cover 2214 in the locked configuration. In yet another aspect, approximately 16% of the outer surface 2230 the weight 2212 is exposed. It should be appreciated that other percentage values are also contemplated herein and may not be expressly listed above.

With reference to FIG. 58, the percentage of the weight 2212 visible and exposed (e.g., portion 2244) may be based on a planar surface area 2246 of the weight 2212. As used herein, the planar surface area 2246 is the surface area only on one projection side of the weight shape (e.g., top planar area). While the top planar area is illustrated in FIG. 58, other weight sides (e.g., right planar area, left planar area, etc.) are also contemplated herein. For example, in an aspect, between approximately 0% and 30% of the planar surface area 2246 of the weight 2212 is exposed between the outer surface 2208 of the body 2204 and the exterior surface of the cover 2214 in the locked configuration. In another aspect, between approximately 10% and 20% of the planar surface area 2246 of the weight 2212 is exposed between the outer surface 2208 of the body 2204 and the exterior surface of the cover 2214 in the locked configuration. In yet another aspect, approximately 16% of the planar surface area 2246 the weight 2212 is exposed. It should be appreciated that other percentage values are also contemplated herein and may not be expressly listed above.

Figure 59:
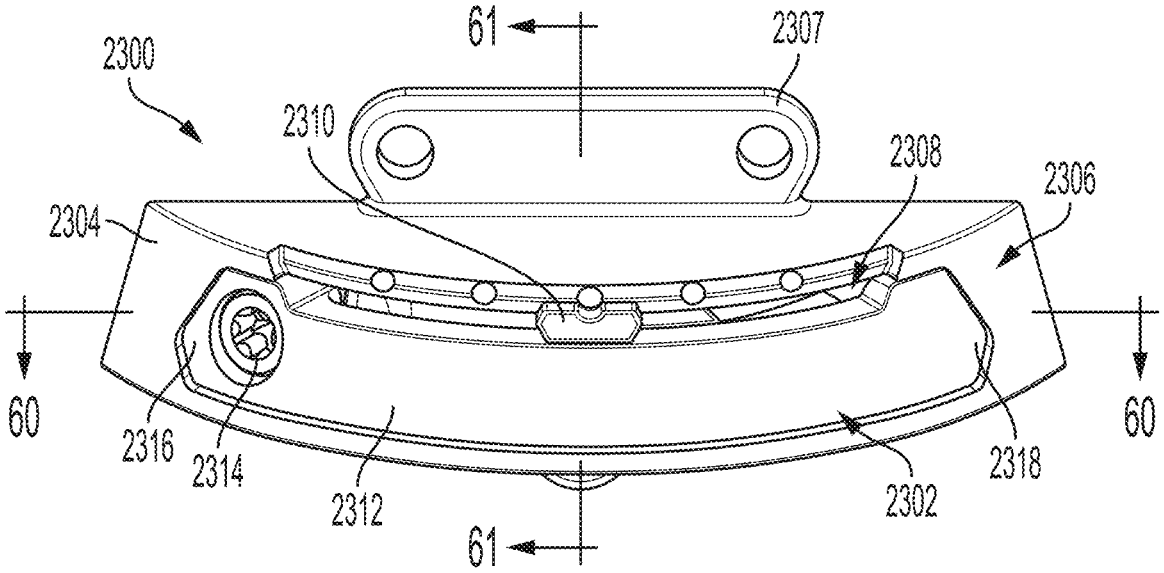
FIG. 59 is a schematic perspective view of an exemplary test mule with another weight assembly.
Figure 60:
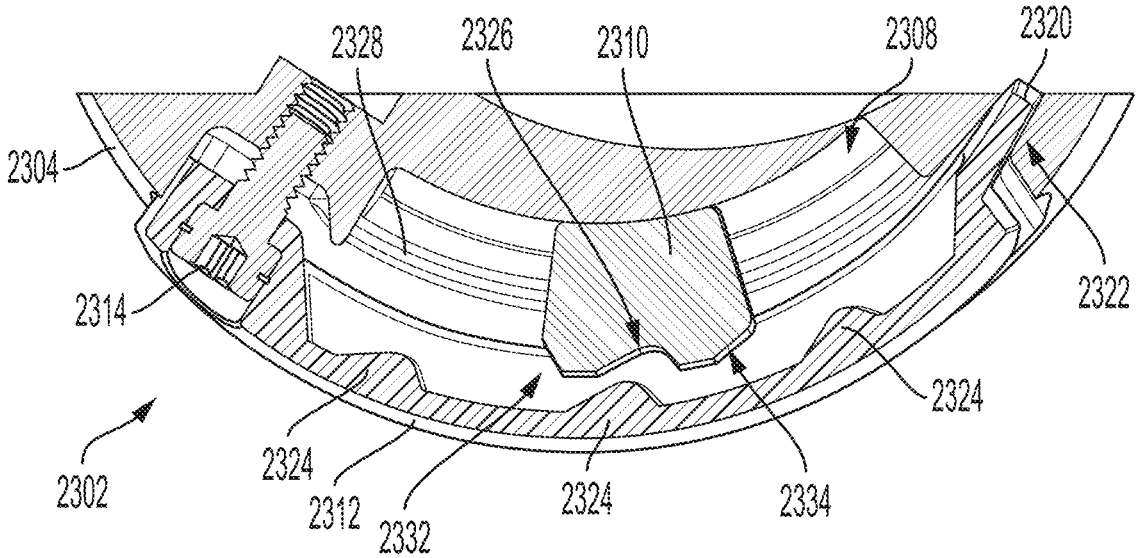
FIG. 60 is a cross-sectional view of the weight assembly taken along line 60-60 in FIG. 59.
Figure 61:
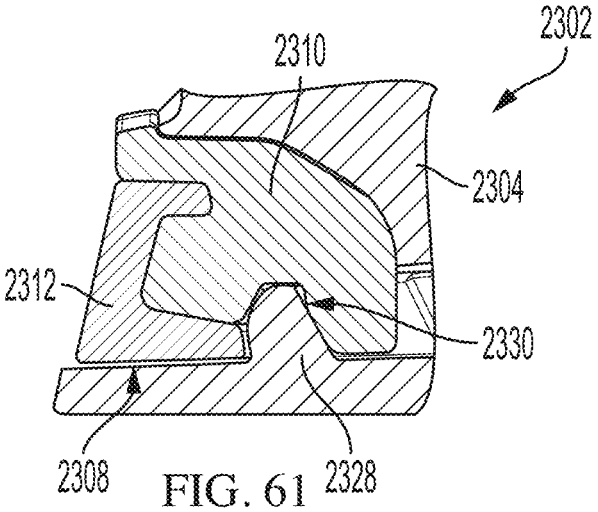
FIG. 61 is another cross-sectional view of the weight assembly taken along line 61-61 in FIG. 59.

FIG. 59 is a schematic perspective view of an exemplary test mule 2300 with another weight assembly 2302. FIG. 60 is a cross-sectional view of the weight assembly 2302 taken along line 60-60 in FIG. 59. FIG. 61 is another cross-sectional view of the weight assembly 2302 taken along line 61-61 in FIG. 59. Referring concurrently to FIGS. 59-61, the test mule 2300 represents a golf club head as described herein and can be utilized to test and develop features of the weight assembly 2302 as required or desired. The club head that the test mule 2300 represents can be any type of club head described herein as required or desired, such as, but not limited to, a metalwood-type golf club head, a fairway-metal type club head, an iron-type club head, or a hybrid-type club head. In an aspect, the club head that the test mule 2300 represents is a metalwood-type club head with a striking face, a sole extending from a lower edge of the striking face, and a crown extending from an upper edge of the striking face (all three components not shown in FIGS. 59-60). In an aspect, a transition area where the sole and the crown couple together opposite the striking face is known as a skirt of the club head, and the weight assembly 2302 is disposed at least partially on the skirt. As such, the weight assembly 2302 is disposed at a rear perimeter of the club head and proximate where the sole and the crown couple together. In an aspect, the weight assembly 2302 is disposed substantially at a rear portion of the club head opposite the striking face. One example of a weight assembly disposed on a skirt of a golf club head is shown in FIG. 8 and described above. In the example, the test mule 2300 includes a body 2304 having an outer surface 2306 that represents the body of the club head. Additionally, a bracket 2307 is coupled to the body 2304 to facilitate testing and development, and the bracket 2307 is not representative of the club head. In an aspect, the bracket 2307 is substantially triangular in shape.

In this example, a recessed channel 2308 is defined in the outer surface 2306 of the body 2304. The channel 2308 extends along a curve in a generally toe-heel direction so that the CG and the MOI of the club head can be adjusted via the weight assembly 2302. The weight assembly 2302 includes a weight 2310 disposed at least partially within the channel 2308 and configured to slide therein, a cover 2312 that extends at least partially over the channel 2308, and a fastener 2314 configured to couple the cover 2312 to the body 2304. The fastener 2314 is configured to retain the weight 2310 in the recessed channel 2308 indirectly via the cover 2312 and so that the weight 2310 can be used to adjust the CG and the MOI of the club head.

Similar to the examples described above, the weight assembly 2302 is configured to move between at least a locked configuration, shown in FIGS. 59 and 61, and an unlocked configuration, shown in FIG. 60. In the locked configuration, the cover 2312 is at least partially disposed within the recessed channel 2308, and the weight 2310 is secured within the channel 2308 with movement restricted. In the unlocked configuration, the fastener 2314 enables the cover 2312 to move along a fastener axis so that the weight 2310 can slide relative to cover 2312 and the body 2304. In an aspect, from the locked configuration, the fastener 2314 may be rotatable between about 2-3 turns to release the cover 2312 from the locked configuration and enable the weight 2310 to slide at least partially within the recessed channel 2308. In another aspect, the fastener 2314 may rotate about 2½ turns to enable the weight 2310 to slide within the weight assembly 2302.

The cover 2312 has a first end 2316 and an opposite second end 2318. The fastener 2314 is coupled to the first end 2316 (e.g., via a lock washer) of the cover 2312 and so that the fastener 2314 is used for attaching the cover 2312 to the body 2304. The second end 2318 of the cover 2312 includes a projection 2320. The projection 2320 of the second end 2318 is configured to engage with a corresponding chamber 2322 defined at the end of the recessed channel 2308. In the locked configuration, the fastener 2314 secures the first end 2316 of the cover 2312 to the body 2304, while the projection 2320 of the second end 2318 engages with the chamber 2322 of the channel 2308 so that a position of the weight 2310 within the recessed channel 2308 is retained between the first end 2316 and the second end 2318 of the cover 2312. When the weight assembly 2302 is moved towards the unlocked configuration, the fastener 2314 is used to move the cover 2312 along the fastener axis and raise the cover 2312 at least partially out of the recessed channel 2308. This configuration enables the weight 2310 to slide and be repositioned on the body 2304 of the golf club head. In this example, the projection 2320 extends in a direction that is substantially parallel to the fastener axis so that the cover 2312 can uniformly raise out of the recessed channel 2308. In an aspect, the chamber 2322 is formed as an undercut in a sidewall of the recessed channel 2308, and this undercut engages with the projection 2320 of the cover 2312. The fastener 2314 is at the opposite end of the undercut.

To assist in positioning the weight 2310 at preselected positions within the recessed channel 2308, the cover 2312 includes at least one locating lug 2324 that extends from an inner surface of the cover 2312. The weight 2310 includes a corresponding hollow 2326 shaped and sized to receive at least a portion of the locating lug 2324. As illustrated in FIG. 60, the cover 2312 has three spaced apart locating lugs 2324 so that the hollow 2326 can selectively engage the lug 2324 at three discrete locations within the recessed channel 2308. In an aspect, the locating lug 2324 may not be symmetrical, for example, one side of the lug 2324 can have a steeper angled side than an opposite more shallower angle side. Furthermore, in this example, the weight 2310 has a first inclined surface 2332 on one end and a second inclined surface 2334 on the opposite end proximate the side of the hollow 2326. The first and second inclined surfaces 2332, 2334 are different and configured to engage with one of the steeper or shallower angled sides of the locating lug 2324. This configuration allows for the weight 2310 to be positioned between two locating lugs 2324 and selectively engage therewith. As such and as illustrated in FIG. 60, the weight 2310 can engage with the cover 2312 at two more discrete locations within the recessed channel 2308 and between pairs of locating lugs 2324. When the locating lug(s) 2324 is engaged with the weight 2310, the weight 2310 is retained more tightly within the cover 2312 to reduce or prevent rattling and further movement of the weight 2310 in the locked configuration. Additionally, one or more of the locating lugs 2324 can define a position of the weight 2310 on the golf club head. In other aspects, the cover 2312 can have five spaced apart locating lugs 2324. Other numbers of locating lugs 2324 are also contemplated herein. It should also be appreciated that in other examples, a locating lug 2324 may be provided for every discrete location of the weight 2310 as required or desired.

In this example, the weight 2310 is slidably engaged with the body 2304 within the recessed channel 2308. The body 2304 includes a partial wall 2328 that is disposed within the recessed channel 2308. The partial wall 2328 extends from a bottom of the recessed channel 2308, and the weight 2310 includes a recess 2330 shaped and sized to receive at least a portion of the partial wall 2328. By slidably engaging the partial wall 2328 and the recess 2330 of the weight 2310, the weight 2310 does not move with the cover 2312 when the cover is moved towards the unlocked configuration. This retention of the weight 2310 within the recessed channel 2308 enables the locating lugs 2324 of the cover 2312 to disengage with the weight 2310 and allow the weight 2310 to slide and change positions. Additionally, the orientation of the weight 2310 within the recessed channel 2308 can be held by the partial wall 2328 when the cover 2312 is in the unlocked configuration so that the weight 2310 can slide more easily to different positions.

Figure 62:
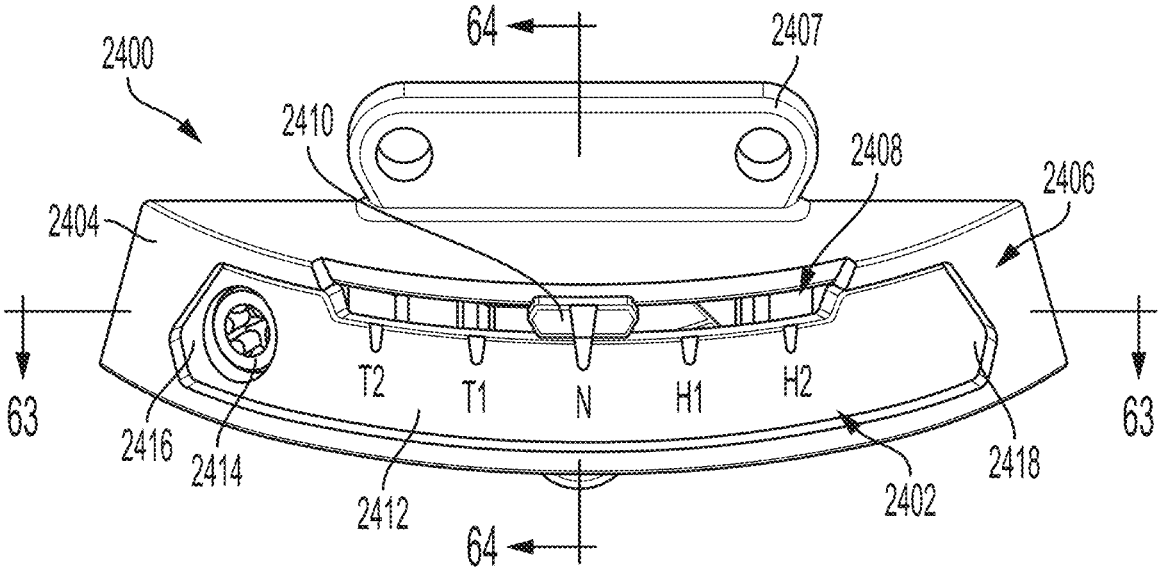
FIG. 62 is a schematic perspective view of another test mule with another weight assembly.

FIG. 62 is a schematic perspective view of another test mule 2400 with another weight assembly 2402. FIGS. 63A-E are cross-sectional views of the weight assembly 2402 taken along line 63-63 in FIG. 62 and with a weight 2410 in a variety of different positions. FIG. 64 is another cross-sectional view of the weight assembly 2402 taken along line 64-64 in FIG. 62. Referring concurrently to FIGS. 62-64, and similar to the example described above in FIGS. 59-61, the test mule 2400 represents a club head that can be any type of club head described herein as required or desired, and in an aspect, the weight assembly 2402 is disposed on a skirt of the club head and at a rear perimeter where the sole and the crown couple together. The test mule 2400 includes a body 2404 having an outer surface 2406 that represents the club head and a bracket 2407. A recessed channel 2408 is defined in the outer surface 2406 of the body 2404. The weight assembly 2402 includes the weight 2410 disposed at least partially within the channel 2408 and configured to slide therein, a cover 2412 that extends at least partially over the channel 2408, and a fastener 2414 configured to couple the cover 2412 to the body 2404. The cover 2412 has a first end 2416 and an opposite second end 2418. The fastener 2414 is coupled to the first end 2416 (e.g., via a lock washer) of the cover 2412 and so that the fastener 2414 is used for attaching the cover 2412 to the body 2404. The second end 2418 of the cover 2412 includes a projection 2420. The projection 2420 of the second end 2418 is configured to engage with a corresponding chamber 2422 defined at the end of the recessed channel 2408 and to secure the second end 2418 to the body 2404.

In this example, to assist in positioning the weight 2410 at preselected positions within the recessed channel 2408, the body 2404 includes at least one locating lug 2424 disposed within the recessed channel 2408. In an aspect, the locating lug 2424 extends from a back wall of the recessed channel 2408 relative to the outer surface 2406. In another aspect, the locating lug 2424 is substantially symmetrical with two similarly angled sides. The weight 2410 includes a corresponding hollow 2426 shaped and sized to receive at least a portion of the locating lug 2424. Furthermore, in this example, the weight 2410 has inclined surfaces 2432 on each end proximate the side of the hollow 2426. The inclined surfaces 2432 are similar to each other and configured to engage with the angled sides of the locating lugs 2424. As illustrated in FIGS. 63A-E, the cover 2412 has three spaced apart locating lugs 2424 so that the weight 2410 is selectively positionable at five discrete locations within the recessed channel 2408. Other numbers of locating lugs 2424 are also contemplated herein. The locating lugs 2424 are not evenly spaced apart in the heel-toe direction of the club head and have two different spacing distances. In the example, the locating lug 2424 proximate the fastener 2414 is spaced further apart from the locating lug 2424 in the middle than the locating lug 2424 proximate the projection 2420. In an aspect, the spacing between the fastener locating lug 2424 and the middle locating lug 2424 is approximately double the spacing between the projection locating lug 2424 and the middle locating lug 2424. Additionally, in some examples, the locating lugs 2424 can be substantially cone-shaped.

Figure 63A:
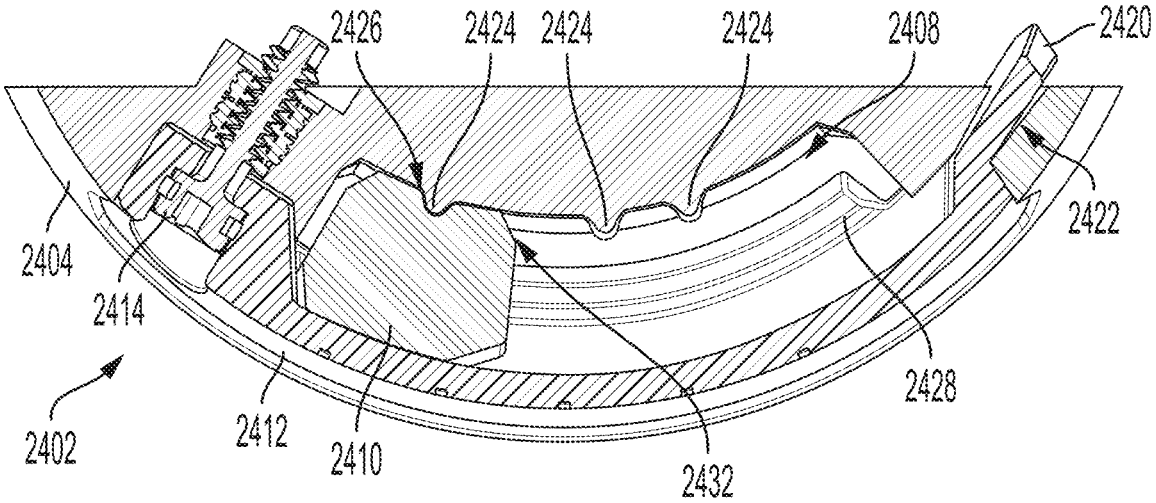
FIGS. 63A-E are cross-sectional views of the weight assembly taken along line 63-63 in FIG. 62 and with a weight in a variety of different positions.
Figure 63B:
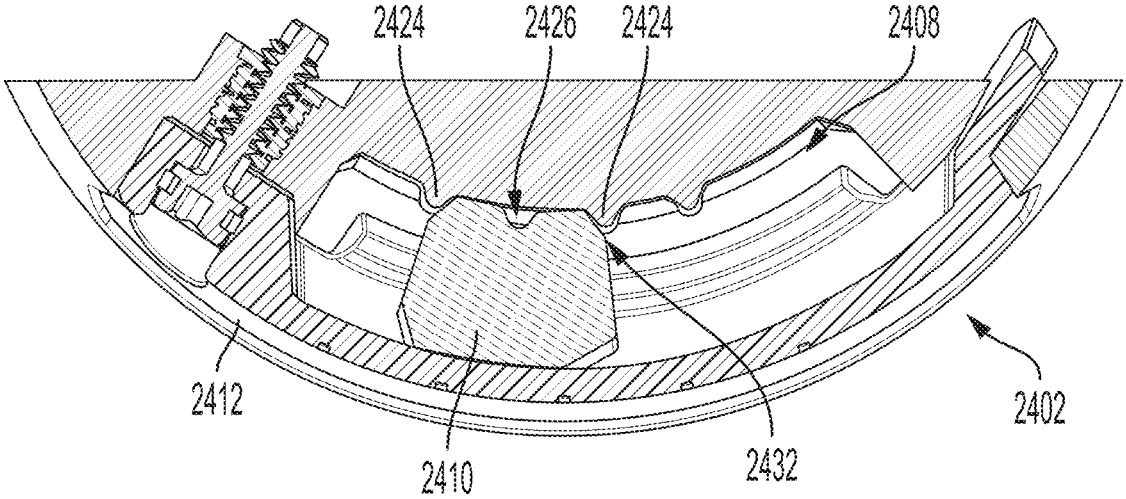
Figure 64:
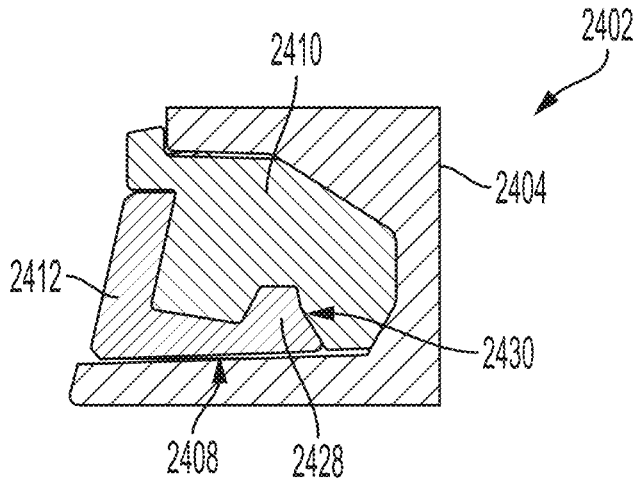
FIG. 64 is another cross-sectional view of the weight assembly taken along line 64-64 in FIG. 62.

Starting with FIG. 63A, the weight 2410 is disposed adjacent to the fastener 2414 and the hollow 2426 is engaged with the locating lug 2424 proximate the fastener 2414. As such, a portion of the weight 2410 is positioned on both sides of locating lug 2424. The weight assembly 2402 is in a locked configuration so that the position of the weight 2410 relative to the body 2404 is secured. In some aspects, the far side of the weight 2410 can be positioned directly against a portion of an end wall of the recessed channel 2408 and/or a portion of the cover 2412 that couples to the fastener 2414. Moving next to FIG. 63B, the weight assembly 2402 can be moved to an unlocked configuration (e.g., at least partially raising the cover 2412 out of the recessed channel 2408 to enable sliding movement of the weight 2410) for repositioning the weight 2410 and adjusting the CG and/or MOI of the club head. Once the weight 2410 is repositioned, the weight assembly 2402 can be moved into the locked configuration (as shown) to secure the position of the weight 2410. In this position, the weight 2410 is disposed between two locating lugs 2424 such that the hollow 2426 does not have a locating lug 2424 received therein. Rather, the inclined surfaces 2432 are engaged with a respective locating lug 2424.

Figure 63C:
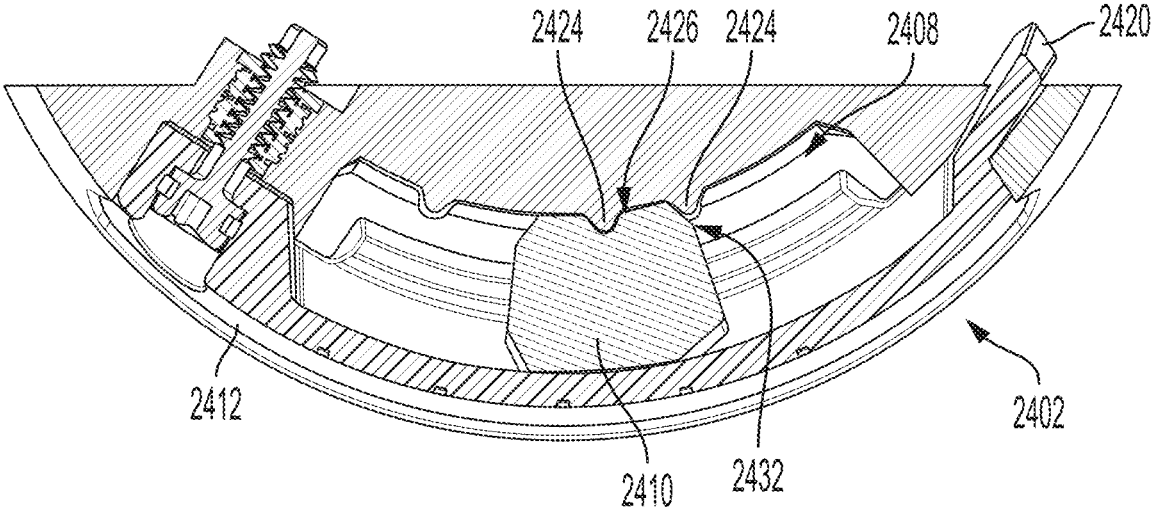
Figure 63D:
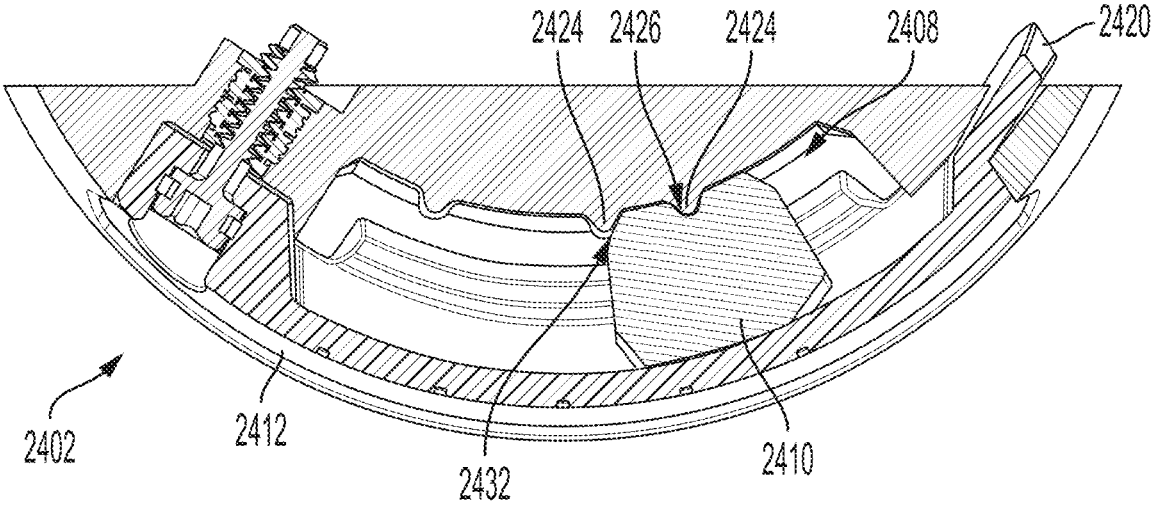
Figure 63E:
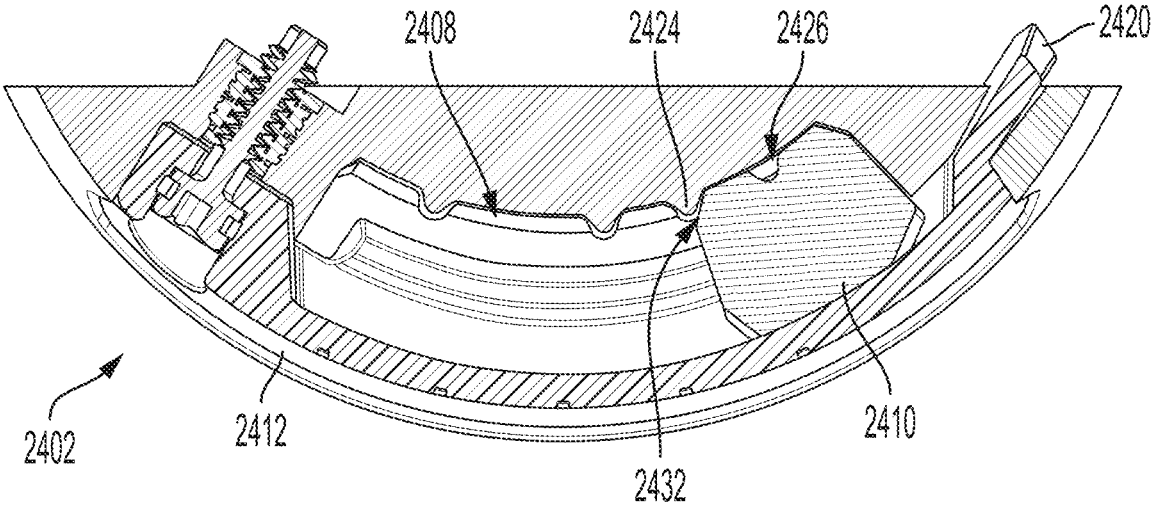

In FIG. 63C, the hollow 2426 of the weight 2410 is engaged with the locating lug 2424 in the middle. In this position, one of the inclined surfaces 2432 is also engaged with the locating lug 2424 proximate the projection 2420. In FIG. 63D, the hollow 2426 of the weight 2410 is engaged with the locating lug 2424 proximate the projection 2420. In this position, one of the inclined surfaces 2432 is engaged with the locating lug 2424 in the middle. Lastly, in FIG. 63E, the weight 2410 is disposed adjacent to the projection 2420 and between the locating lug 2424 and an end wall of the recessed channel 2408. The hollow 2426 does not have a locating lug 2424 received therein and one of the inclined surfaces 2432 is engaged with the locating lug 2424 proximate the projection 2420. In the example, the far side of the weight 2410 can be positioned directly against a portion of an end wall of the recessed channel 2408 and/or a portion of the cover 2412 proximate the projection 2420. When the locating lug(s) 2424 is engaged with the weight 2410, the weight 2410 is retained more tightly within the recessed channel 2408 to reduce or prevent rattling and further movement of the weight 2410 in the locked configuration. Additionally, one or more of the locating lugs 2424 can define a position of the weight 2410 on the golf club head. In the example, by shifting the locating lug 2424 proximate the projection 2420 inward, the weight 2410 can more easily slide between all positions without binding. It should be appreciated, that the spacing of the locating lugs 2424 can take on any other configuration as required or desired. For example, the recessed channel 2408 can have five spaced apart locating lugs 2424 such that in each position the hollow 2426 of the weight 2410 engages with a locating lug 2424. In other examples, three similarly spaced locating lugs 2424 can be used.

Additionally, the weight 2410 is slidably engaged with the cover 2412. The cover 2412 includes a flange 2428 that extends from an interior of the cover 2412 and the weight 2410 includes a groove 2430 shaped and sized to receive at least a portion of the flange 2428. By slidably engaging the flange 2428 and the groove 2430 of the weight 2410, the weight 2410 is configured to move with the cover 2412 when moved towards the unlocked configuration. This movement of the weight 2410 enables the weight 2410 to disengage with the locating lugs 2424 and so that the weight 2410 can slide and change positions.

Figure 65:
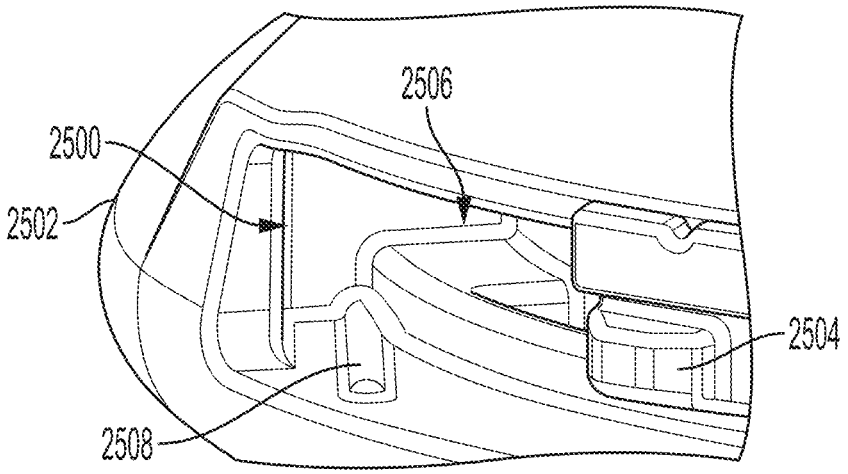
FIG. 65 is a partial perspective view of an exemplary recessed channel within a body of a test mule.
Figure 66:
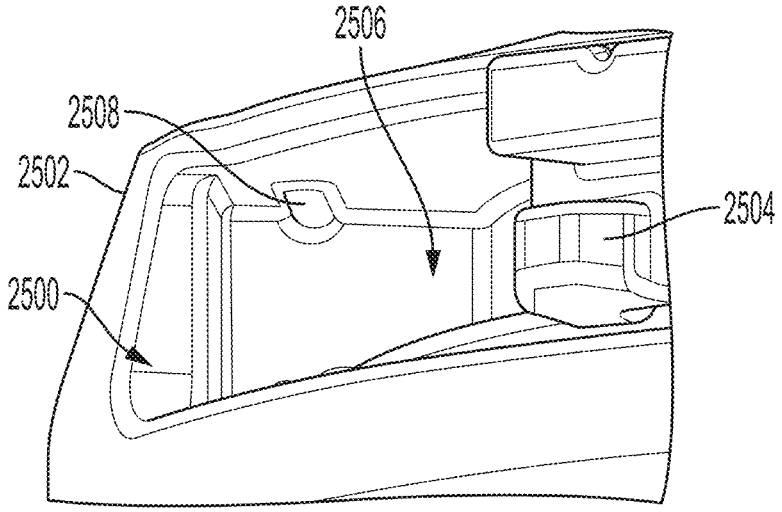
FIG. 66 is another partial perspective view of the recessed channel shown in FIG. 65.

FIG. 65 is a partial perspective view of an exemplary recessed channel 2500 within a body 2502 of a test mule. FIG. 66 is another partial perspective view of the recessed channel 2500. Referring concurrently to FIGS. 65 and 66, the body 2502 is illustrated schematically and the test mule represents a club head that can be any type of club head described herein as required or desired. The recessed channel 2500 is configured to receive a slidable weight 2504 and a cover (not shown) is configured to selectively retain the weight 2504 in different positions. The cover is coupled to the body 2502 with a fastener (not shown) that defines a fastener axis. The recessed channel 2500 includes a chamber 2506 that is sized and shaped to receive a corresponding projection (not shown) of the cover. The chamber 2506 is defined on the opposite end of the recessed channel 2500 from the fastener location so that both ends of the cover are engaged with the body 2502 and increase the retention of the weight 2504.

In this example, the recessed channel 2500 includes a lip 2508 proximate the chamber 2506. The lip 2508 extends into the recessed channel 2500 and is configured to engage with the cover at a corresponding duct (not shown). As such, when the cover is moved towards an unlocked configuration that allows the weight 2504 to slide within the recessed channel 2500, the end of the cover opposite the fastener remains at least partially engaged with the body 2502 to reduce or prevent the end of the cover from becoming loose relative to the body 2502. The lip 2508 is elongated in a direction that is substantially parallel to the fastener axis to enable movement of the cover as described herein. The lip 2508 can be positioned at a top wall of the recessed channel 2500, as illustrated in FIG. 65, at a bottom wall of the recessed channel 2500, as illustrated in FIG. 66, or both.

Figure 67:
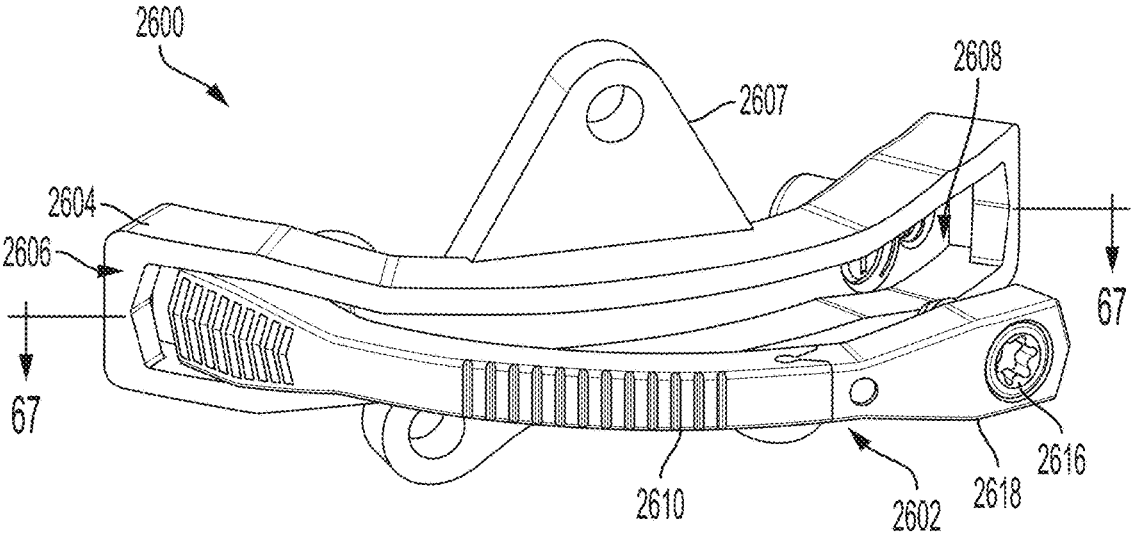
FIG. 67 is a schematic perspective view of another test mule with another weight assembly.
Figure 68:
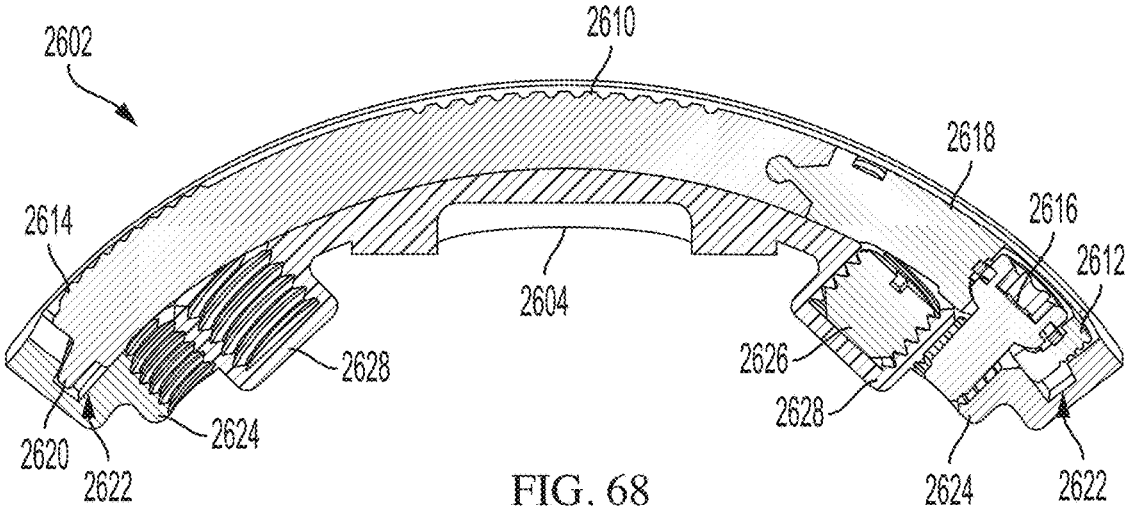
FIG. 68 is a cross-sectional view of the weight assembly in a first configuration taken along line 67-67 in FIG. 67.
Figure 69:
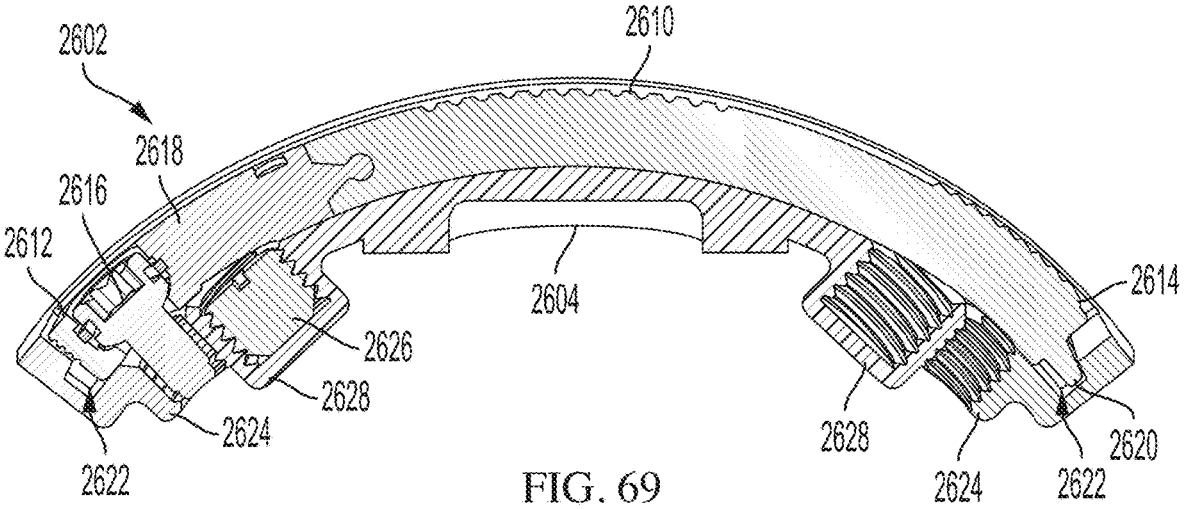
FIG. 69 is a cross-sectional view of the weight assembly in a second configuration taken along line 67-67 in FIG. 67.

FIG. 67 is a schematic perspective view of another test mule 2600 with another weight assembly 2602. FIG. 68 is a cross-sectional view of the weight assembly 2602 in a first configuration taken along line 67-67 in FIG. 67. FIG. 69 is a cross-sectional view of the weight assembly 2602 in a second configuration taken along line 67-67 in FIG. 67. Referring concurrently to FIGS. 67-69, and similar to the examples described above in FIGS. 59-64, the test mule 2600 represents a club head that can be any type of club head described herein as required or desired, and in an aspect, the weight assembly 2602 is disposed on a skirt of the club head and at a rear perimeter where the sole and the crown couple together. The test mule 2600 includes a body 2604 having an outer surface 2606 that represents the club head and a bracket 2607. A recessed channel 2608 is defined in the outer surface 2606 of the body 2604. In this example, however, the weight assembly 2602 includes a cover 2610 that is configured to be selectively oriented within the recessed channel 2608 and secured to the body 2604 to at least partially define a weight position of the club head and to adjust the CG and the MOI of the club head.

In this example, the weight assembly 2602 includes the cover 2610 that is removably coupled to the body 2604 and at least partially within the recessed channel 2608. The cover 2610 has a first end 2612 and an opposite second end 2614. A fastener 2616 is mounted (e.g., via a lock washer) on the first end 2612 of the cover 2610 and is configured to couple to the body 2604. Additionally, a first weight 2618 is disposed at the first end 2612 of the cover 2610. In this example, the first weight 2618 defines the first end 2612 of the cover 2610 itself and is removable from the second end 2614 of the cover 2610 so that different mass weights 2618 are interchangeable and can form the cover 2610 as required or desired. The second end 2614 of the cover 2610 includes a projection 2620 extending therefrom.

Each end of the recessed channel 2608 has a chamber 2622 and a fastener receiver 2624. The chamber 2622 is configured to engage with the projection 2620 of the cover 2610 and the fastener 2616 is configured to couple to the fastener receiver 2624. By having the recessed channel 2608 symmetrical at each end, the cover 2610 can be selectively coupled to the body 2604 so that the first weight 2618 can be oriented in either the first configuration (shown in FIG. 68) or the second configuration (shown in FIG. 69). In the first configuration, the first end 2612 of the cover 2610 is disposed on the heel side of the club head so that the first weight 2618 is positioned towards the heel side of the body 2604. In this configuration, the fastener 2616 is secured to the fastener receiver 2624 on the heel side and the projection 2620 of the cover 2610 engages with the chamber 2622 at the toe side. This leaves the fastener receiver 2624 on the toe side and the chamber 2622 on the heel side unused by the cover 2610. Conversely, in the second configuration, the first end 2612 of the cover 2610 is disposed on the toe side of the club head so that the first weight 2618 is positioned towards the toe side of the body 2604. In this configuration, the fastener 2616 is secured to the fastener receiver 2624 on the toe side and the projection 2620 of the cover 2610 engages with the chamber 2622 at the heel side. This leaves the fastener receiver 2624 on the heel side and the chamber 2622 on the toe side unused by the cover 2610. In this example, the cover 2610 has a dog-bone type shape so that is position within the recessed channel 2608 can be switched as required or desired.

Additionally or alternatively, a second weight 2626 may be coupled to a corresponding weight chamber 2628 defined in the body 2604 and within the recessed channel 2608. The weight chamber 2628 is positioned at both ends of the recessed channel 2608 proximate the fastener receiver 2624 and is covered by the cover 2610 when coupled to the body 2604. As such, the second weight 2626 is secured by the cover 2610 within the weight chamber 2628 and indirectly retained by the fastener 2616 of the weight assembly 2602. In an aspect, the second weight 2626 may thread at least partially into the weight chamber 2628. It should be appreciated that the position and use of the second weight 2626 does not necessarily need to correspond to the orientation of the cover 2610 and as illustrated in FIGS. 68 and 69. For example, the second weight 2626 can be used opposite of the first weight 2618 and retained at least partially by the second end 2614 of the cover 2610. In another example, only the first weight 2618 and no second weight 2626 can be utilized. In still another example, a pair of second weights 2626 may be used in the pair of weight chambers 2628. By using more than one weight 2618, 2626 the CG and the MOI of the club head can be more finely tuned as required or desired.

Figure 70:
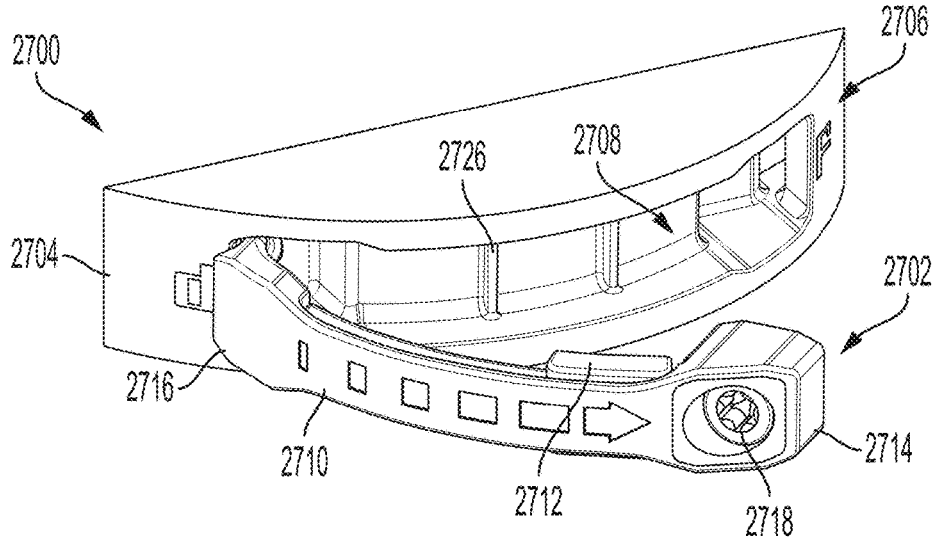
FIG. 70 is a schematic perspective view of another test mule with another weight assembly.
Figure 71:
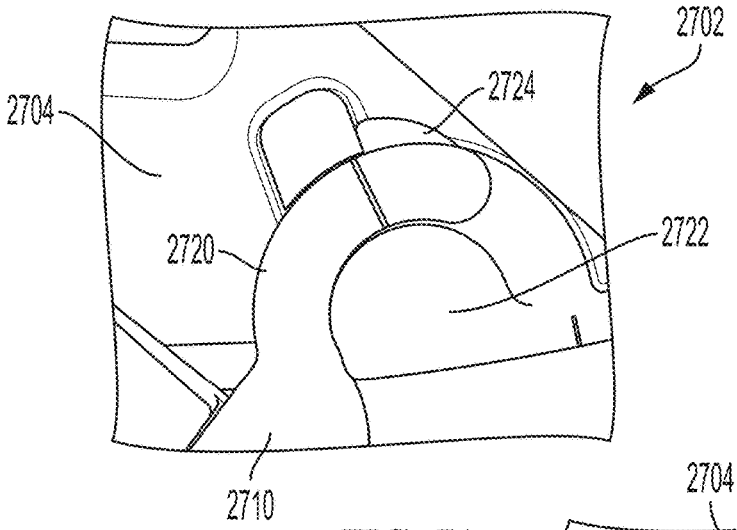
FIG. 71 is a partial cross-sectional view of the weight assembly shown in FIG. 70 in an unlocked configuration.
Figure 72:
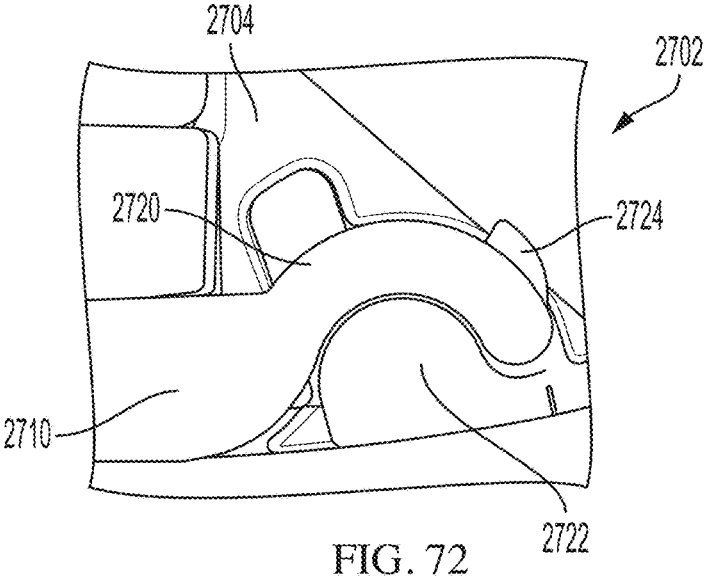
FIG. 72 is a partial cross-sectional view of the weight assembly shown in FIG. 70 in a locked configuration.

FIG. 70 is a schematic perspective view of another test mule 2700 with another weight assembly 2702. FIG. 71 is a partial cross-sectional view of the weight assembly 2702 in an unlocked configuration. FIG. 72 is a partial cross-sectional view of the weight assembly 2702 in a locked configuration. Referring concurrently to FIGS. 70-72, and similar to the examples described above in FIGS. 59-64 and 67-69, the test mule 2700 represents a club head that can be any type of club head described herein as required or desired, and in an aspect, the weight assembly 2702 is disposed on a skirt of the club head and at a rear perimeter where the sole and the crown couple together. The test mule 2700 includes a body 2704 having an outer surface 2706 that represents the club head. A recessed channel 2708 is defined in the outer surface 2706 of the body 2704. In this example, however, the weight assembly 2702 includes a cover 2710 that is pivotably coupled to the body 2704 and a slidable weight 2712 to adjust the CG and the MOI of the club head. In an aspect, the cover 2710 is lighter in density than the weight 2712 so that a larger amount of mass can be used to manipulate the CG and the MOI.

In this example, the cover 2710 has a first end 2714 and an opposite second end 2716. A fastener 2718 is mounted on the first end 2714 of the cover 2710 (e.g., via a lock washer) and is configured to secure the first end 2714 to the body 2704 of the club head. The second end 2716 of the cover 2710 is pivotably coupled to the body 2704. The weight 2712 is slidably coupled to the cover 2710 and is movable between the first end 2714 and the second end 2716. In operation, the cover 2710 is pivotable about its second end 2716 between at least a locked configuration and an unlocked configuration (shown in FIG. 70). In the locked configuration, the fastener 2718 secures the first end 2714 of the cover 2710 to the body 2704 and the weight 2712 is disposed at least partially within the recessed channel 2708 and retained therein by the cover 2710. The position of the weight 2712 within the recessed channel 2708 between the first end 2714 and the second end 2716 of the cover 2710 is thereby retained indirectly by the fastener 2718. In the unlocked configuration, the first end 2714 of the cover 2710 pivots out of the recessed channel 2708 to enable the weight 2712 to be repositioned (e.g., slide along the cover 2710) as required or desired. The unlocked configuration is illustrated in FIG. 70 and the weight 2712 moves with the cover 2710.

The second end 2716 of the cover 2710 can include a hook 2720 that pivotably engages with a post 2722 in the body 2704. The hook 2720 includes a hard stop 2724 that is configured to engage with the body 2704 in the unlocked position so as to define the pivot limit of the cover 2710. The hard stop 2724 can be tapered on one end so that the second end 2716 of the cover 2710 is more easily inserted into the body 2704 during assembly. In other example, the second end 2716 of the cover 2710 can be pivotably coupled to the body 2704 with a pin connection (not shown). The recessed channel 2708 can include one or more locating lugs 2726 to assist in positioning the weight 2712 as required or desired.

In aspects, the weight 2712 can be positionable in two, four, or six discrete positions at least partially defined by the locating lugs 2726. In this example, the weight 2712 is slidably engaged with the cover 2710 and pivots therewith. In other examples, the weight can be slidably engaged with the body so that it does not pivot with the cover. This example is described below in reference to FIG. 73.

Figure 73:
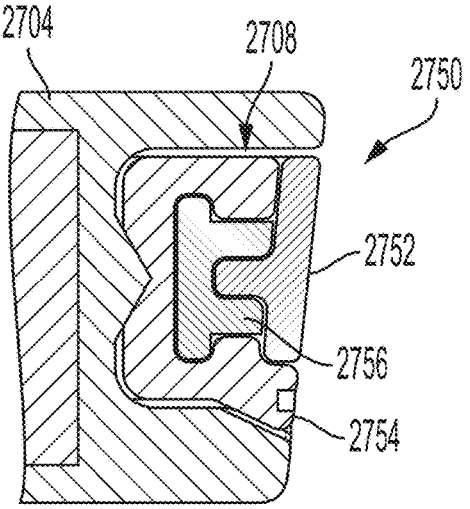
FIG. 73 is a cross-sectional view of another weight assembly that can be used with the test mule shown in FIG. 70.

FIG. 73 is a cross-sectional view of another weight assembly 2750 that can be used with the test mule 2700 (shown in FIG. 70). In this example, the weight assembly 2750 includes a pivotable cover 2752 and a slidable weight 2754. However, in this example, the weight 2754 is slidably engaged at least partially within the recessed channel 2708 of the body 2704 so that the weight 2754 does not pivot with the cover 2752. The weight assembly 2750 includes a rail 2756 that secures the weight 2754 to the body 2704 while still enabling the weight 2754 to slide. In the locked configuration as illustrated in FIG. 73, the cover 2752 secures the position of the weight 2754 relative to the body 2704 via the rail 2756.

Figure 74:
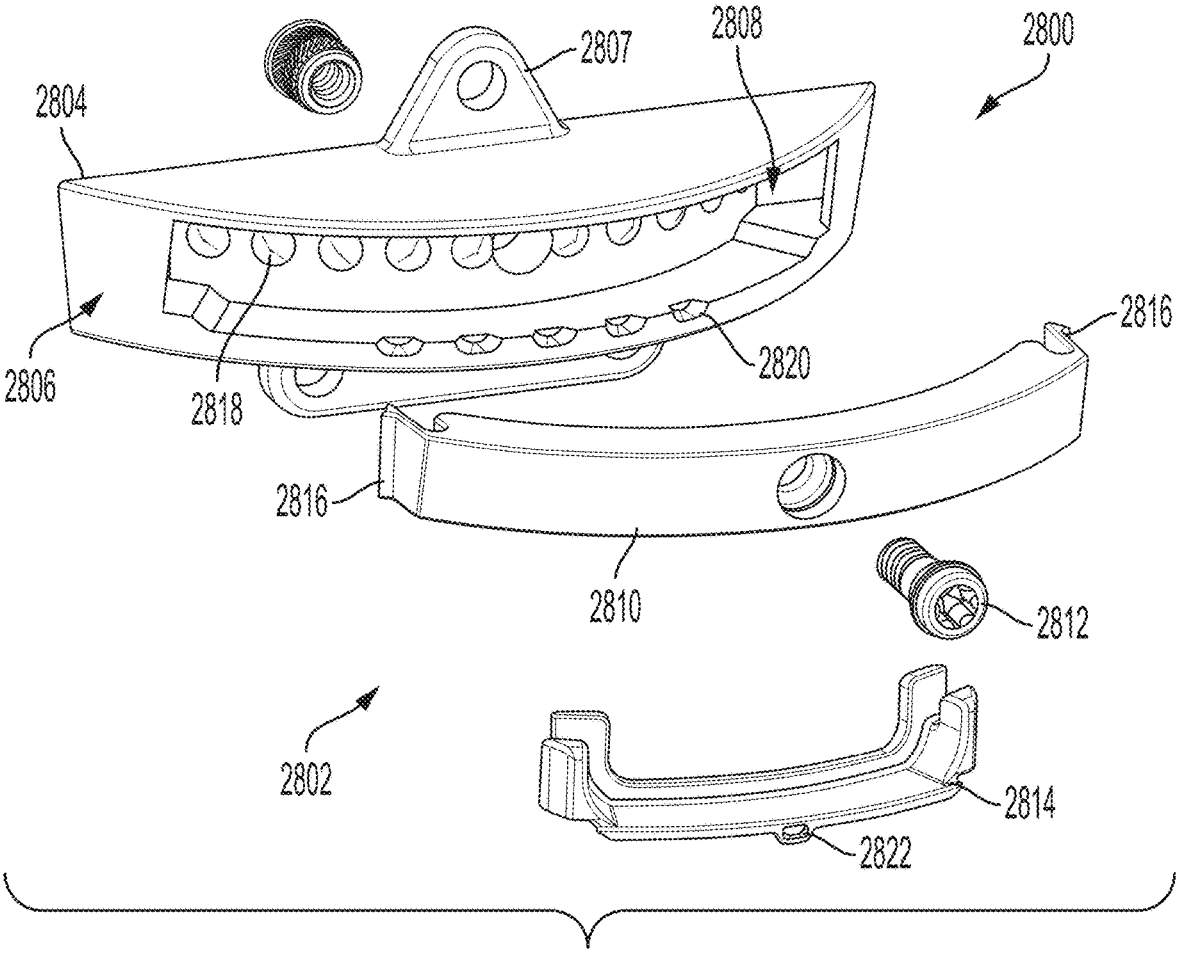
FIG. 74 is an exploded perspective view of another test mule with another weight assembly.

FIG. 74 is an exploded perspective view of another test mule 2800 with another weight assembly 2802. Similar to the examples described above in FIGS. 59-64 and 67-72, the test mule 2800 represents a club head that can be any type of club head described herein as required or desired, and in an aspect, the weight assembly 2802 is disposed on a skirt of the club head and at a rear perimeter where the sole and the crown couple together. The test mule 2800 includes a body 2804 having an outer surface 2806 that represents the club head and a bracket 2807. A recessed channel 2808 is defined in the outer surface 2806 of the body 2804. In this example, however, the weight assembly 2802 includes a cover 2810 that is coupled to the body 2804 via a fastener 2812 that is disposed proximate a center of the cover 2810. The cover 2810 is configured to secure a slidable weight 2814 while enabling a position of the weight 2814 to be selectively adjusted. The weight 2814 has an elongated U-shape so as to accommodate the center mounted fastener 2812 and a portion of the weight 2814 can be disposed on both sides of the fastener 2812. The cover 2810 has projections 2816 at each end to engage with the recessed channel 2808. The recessed channel 2808 includes locating lugs 2818 to assist in positioning the weight 2814 and dimples 2820 that receive at least a portion of a position indicator 2822 of the weight 2814.

Figure 75:
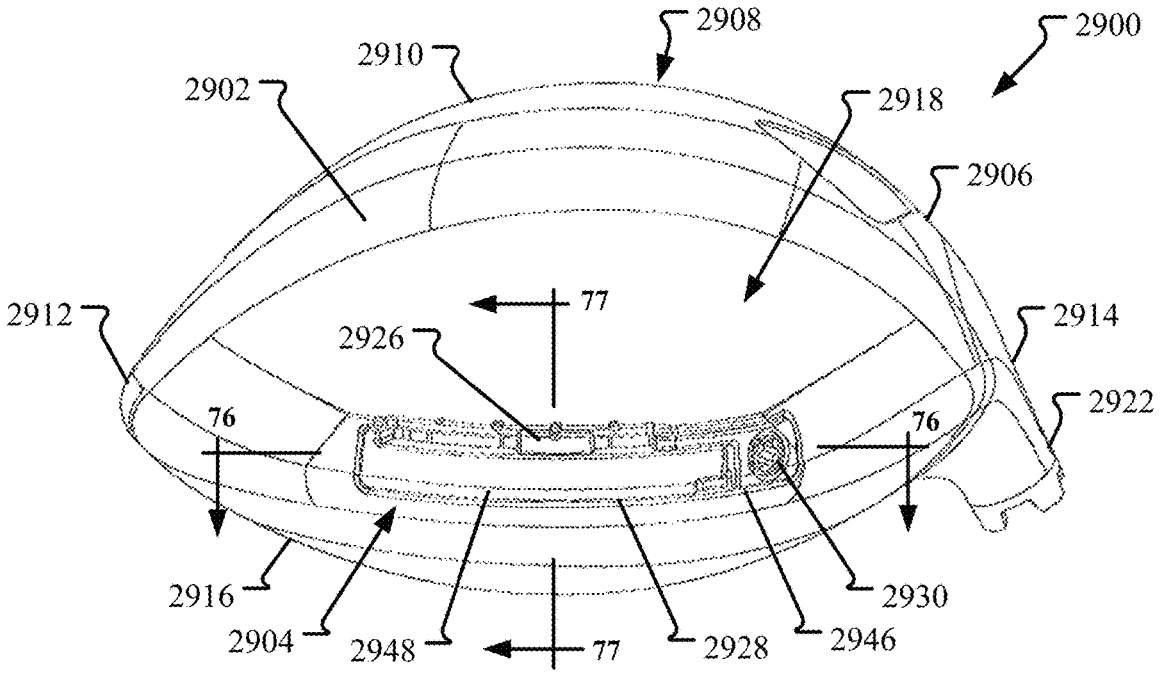
FIG. 75 is a perspective view of a sole of another golf club head with another weight assembly.
Figure 76:
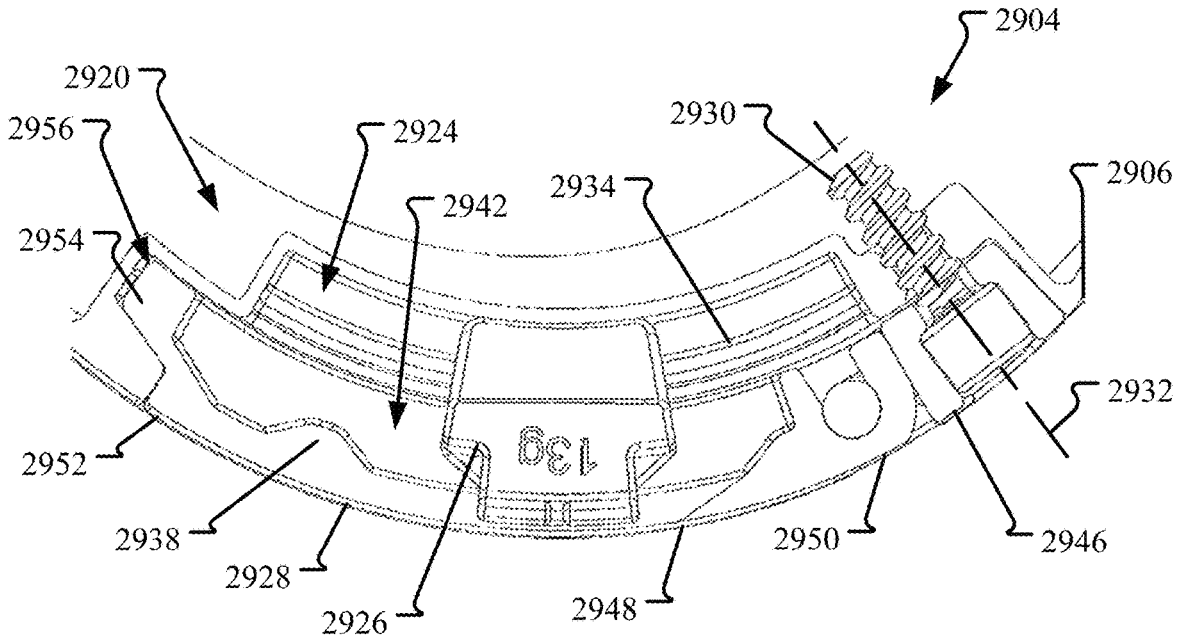
FIG. 76 is a cross-sectional view of the weight assembly taken along line 76-76 in FIG. 75.
Figure 77:
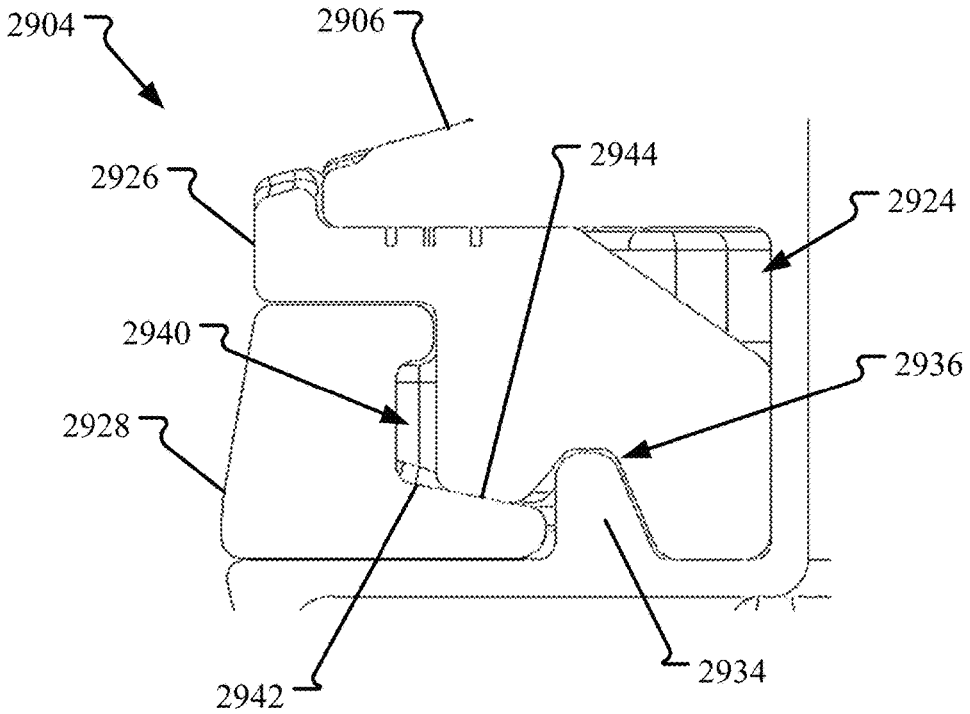
FIG. 77 is a cross-sectional view of the weight assembly taken along line 77-77 in FIG. 75.

FIG. 75 is a perspective view of a sole 2902 of another golf club head 2900 with another weight assembly 2904. FIG. 76 is a cross-sectional view of the weight assembly 2904 taken along line 76-76 in FIG. 75. FIG. 77 is a cross-sectional view of the weight assembly 2904 taken along line 77-77 in FIG. 75. Referring concurrently to FIGS. 75-77, the golf club head 2900 is a metalwood-type golf club head having a body 2906 that includes a striking face 2908 with a lower edge 2910 and an upper edge (not shown) extending between a toe 2912 and a heel 2914. The sole 2902 extends from the lower edge 2910 on the bottom side of the club head 2900 and a crown 2916 extends from the upper edge on the top of the club head 2900. The sole 2902, the striking face 2908, and the crown 2916 are coupled together so as to define an outer surface 2918 of the body 2906 with an interior cavity 2920 formed within. A hosel 2922 is disposed at the heel 2914 and is configured to couple to a shaft (not shown). The functions of the components (e.g., sole, striking face, crown, hosel, etc.) of the metalwood-type club head 2900 are similar to the component functions described above. The body 2906 may form any type club head, such as a fairway-metal type club head, an iron-type club head, or a hybrid-type club head as required or desired. Furthermore, the features of the weight assembly 2904 described below can additionally or alternatively be utilized in any type club head described herein as required or desired.

In this example, a recessed channel 2924 is defined within the sole 2902 of the body 2906 of the club head 2900. The channel 2924 extends in the toe 2912—heel 2914 direction so that the CG and the MOI of the club head 2900 can be adjusted for fade-draw bias. In an aspect, the recessed channel 2924 may be defined in a transition area where the sole 2902 and the crown 2916 couple together opposite the striking face 2908 and known as a skirt of the club head 2900. As such, the recessed channel 2924 and the weight assembly 2904 are disposed at a rear perimeter of the club head 2900 and proximate where the sole 2902 and the crown 2916 couple together. In an aspect, the recessed channel 2924 and the weight assembly 2904 are disposed substantially at a rear perimeter portion of the club head 2900 opposite the striking face 2908.

The weight assembly 2904 includes a slidable weight 2926 disposed at least partially within the recessed channel 2924 and configured to slide therein, a cover 2928 that extends at least partially over the channel 2924 and adapted to releasably secure the weight 2926 within the recessed channel 2924, and a fastener 2930 configured to couple the cover 2928 to the body 2906. The fastener 2930 retains the weight 2926 in the recessed channel 2924 indirectly via the cover 2928 and so that the weight 2926 can be used to adjust the CG and the MOI of the club head. Similar to the examples described above, the weight assembly 2904 is configured to move between at least a locked configuration, shown in FIG. 79 and described further below, and an unlocked configuration, shown in FIG. 80 and described further below. In the locked configuration, the cover 2928 is at least partially disposed within the recessed channel 2924, and the weight 2926 is secured within the channel 2924 with its movement restricted. In the unlocked configuration, the fastener 2930 enables the cover 2928 to move along a fastener axis 2932 so that the weight 2926 is released and can slide relative to cover 2928 and the body 2906. Additionally, in this example, the cover 2928 can also at least partially rotate relative to the recessed channel 2924 and the body 2906 towards a weight removal configuration, shown in FIG. 81 and described further below.

The body 2906 includes a partial wall 2934 that is disposed within the recessed channel 2924. The partial wall 2934 extends from a bottom of the recessed channel 2924, and the weight 2926 includes a recess 2936 shaped and sized to receive at least a portion of the partial wall 2934. By slidably engaging the partial wall 2934 and the recess 2936 of the weight 2926, the weight 2926 does not move with the cover 2928 when the cover is moved towards the unlocked configuration. To assist in positioning the weight 2926 at preselected positions within the recessed channel 2924, the cover 2928 includes at least one locating lug 2938 that extends from an inner surface of the cover 2928. The weight 2926 includes a corresponding hollow 2940 shaped and sized to receive at least a portion of the locating lug 2938. As such, when the weight 2926 is engaged with the cover 2928, the weight 2926 is retained more tightly within the cover 2928 to reduce or prevent rattling and further movement of the weight 2926 in the locked configuration. In the example, the inner surface of the cover 2928 includes an oblique surface 2942 that is configured to engage with a corresponding oblique surface 2944 on the weight 2926. The oblique surfaces 2942, 2944 taper in a direction such that their height above the bottom wall of the recessed channel 2924 is larger and increases along a direction that is away from the partial wall 2934. This configuration urges the weight 2926 in a direction towards the top wall of the recessed channel 2924 and induces a compression force on the weight 2926 between the cover 2928 and the recessed channel 2924 for securing the weight 2926 therein.

Figure 81:
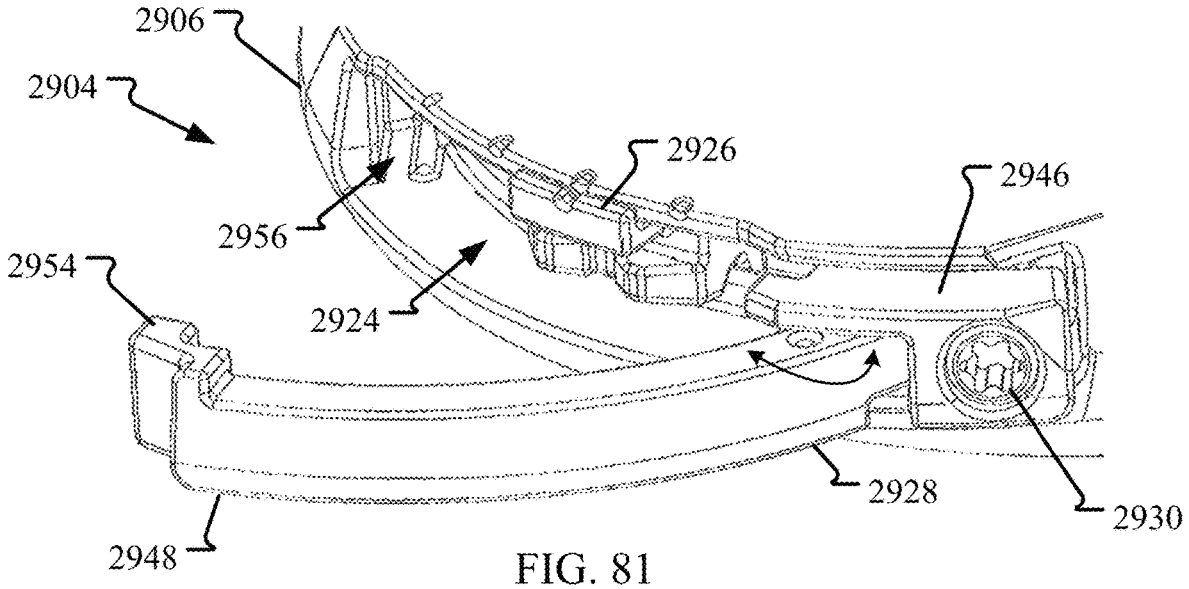
FIG. 81 is a perspective view of the weight assembly shown in FIG. 75 in a weight removal configuration.

In this example, the cover 2928 is formed from a first portion 2946 and a second portion 2948. The fastener 2930 engages with the first portion 2946 via a lock-washer (not shown) such that the entire cover 2928 is linearly moveable along the fastener axis 2932. The second portion 2948 has a first end 2950 that is rotatably coupled to the first portion 2946 and an opposite second end 2952 that has a projection 2954. Similar to the other examples described herein, the projection 2954 is configured to engage with a corresponding chamber 2956 defined in the body 2906 and within the recessed channel 2924, so that when the weight assembly 2904 is in the locked configuration, the second end 2952 more tightly secures the weight 2926 within the recessed channel 2924. By enabling the second portion 2948 of the cover 2928 to rotate relative to the first portion 2946 when the second end 2952 is not engaged with the recessed channel 2924, access to the weight 2926 is increased and allows for the weight 2926 to be completely removed from the club head 2900 as required or desired and as illustrated in FIG. 81.

Figure 78:
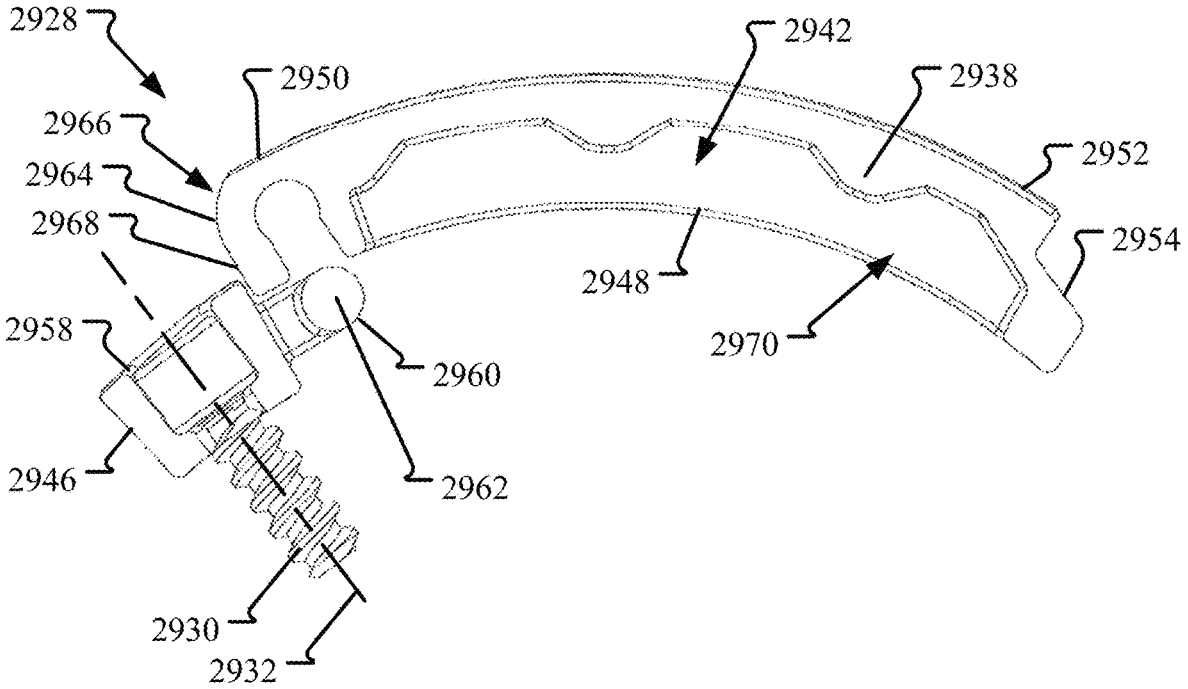
FIG. 78 is an exploded view of a cover of the weight assembly shown in FIG. 75.

FIG. 78 is an exploded view of the cover 2928 of the weight assembly 2904 (shown in FIGS. 75-77). The cover 2928 includes the first portion 2946 that couples to the fastener 2930 and the second portion 2948. In the example, the first portion 2946 and the second portion 2948 may be discrete and separable from one another. In other examples, the first portion 2946 and the second portion 2948 may be fixed to each other, while still being rotatable relative to one another. The first portion 2946 has a first end 2958 with a bore that is shaped and sized to receive and couple to the fastener 2930. The bore extends in a direction along the fastener axis 2932. The first portion 2946 also has an opposite second end 2960 that is configured to rotatably couple to the second portion 2948. The second end 2960 has a cylinder 2962 that is spaced away from the first end 2958 and that extends in a direction that is substantially orthogonal to the fastener axis 2932. The cylinder 2962 rotatably engages the second portion 2948 and defines a rotation axis for the second portion 2948 to rotate relative to the first portion 2946.

The second portion 2948 extends between the first end 2950 and the second end 2952. The first end 2950 has a hook 2964 that rotatably engages with the cylinder 2962 of the first portion 2946 such that the rotation axis of the second portion 2948 is substantially orthogonal to the fastener axis 2932. In an aspect, an outer surface 2966 of the hook 2964 is rounded so that the second portion 2948 can rotate around the cylinder 2962. The hook 2964 is formed at least partially by an arm 2968 that is elongated and engages with a sidewall of the bore of the first portion 2946 so that rotation of the second portion 2948 is partially limited. This configuration allows the second portion 2948 to move with the first portion 2946 when the first portion 2946 linearly moves along the fastener axis 2932. In some examples, the hook 2964 can snap-fit around the cylinder 2962 so that in order to separate the two portions 2946, 2948, a separation force is required. The second end 2952 of the second portion 2948 includes the projection 2954. Extending between the first end 2950 and the second end 2952 of the second portion 2948, a cutout 2970 is formed that is sized and shaped to at least partially receive the weight 2926 (shown in FIGS. 76 and 77). Within the cutout 2970, the locating lugs 2938 and the oblique surface 2942 of the cover 2928 are formed.

Figure 79:
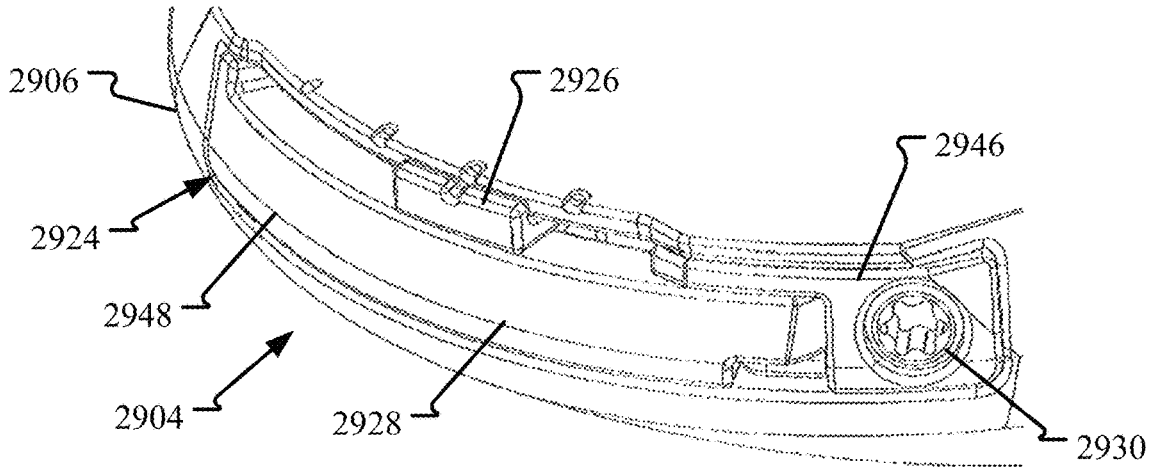
FIG. 79 is a perspective view of the weight assembly shown in FIG. 75 in a locked configuration.

FIG. 79 is a perspective view of the weight assembly 2904 in a locked configuration. In the locked configuration, the fastener 2930 is tightened to the body 2906 of the club head so that the cover 2928 is engaged to the body 2906 and at least partially within the recessed channel 2924 to secure a position of the weight 2926 within the recessed channel 2924. In the locked configuration, the fastener 2930 retains the weight 2926 in the recessed channel 2924 indirectly via the cover 2928. The first end of the first portion 2946 of the cover 2928 is secured to the body 2906 by the fastener 2930. The second end of the second portion 2948 of the cover 2928 is secured to the body 2906 via the projection 2954 (shown in FIG. 78) such that rotation of the second portion 2948 relative to the first portion 2946 is prevented. Between the first portion 2946 and the second portion 2948, the hook 2964 and cylinder 2962 (shown in FIG. 78) engagement restricts the portions 2946, 2948 from separating from one another in the locked configuration. In order to release the weight 2926 from its secured position, the fastener 2930 is used to move the weight assembly 2904 towards the unlocked configuration described below in reference to FIG. 80.

Figure 80:
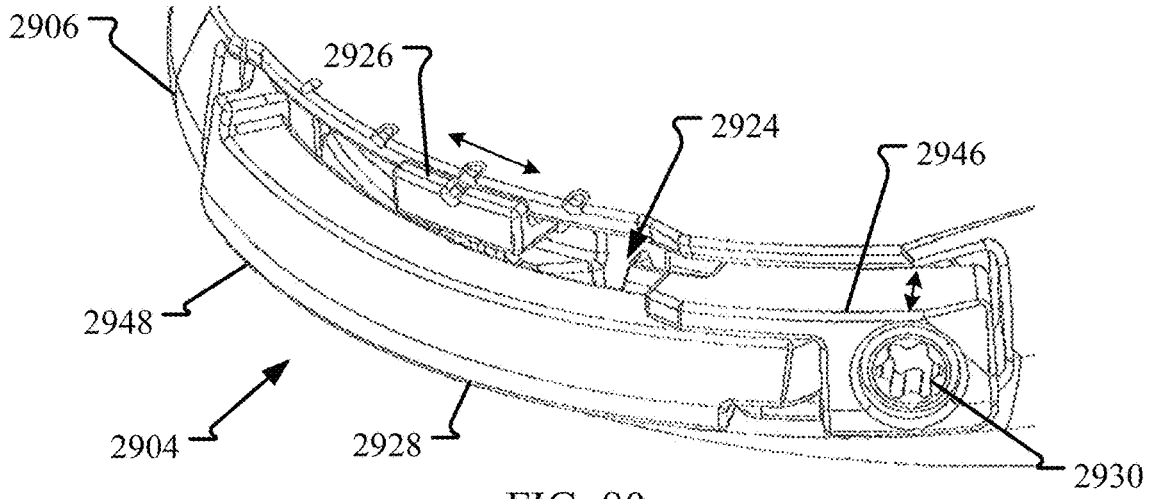
FIG. 80 is a perspective view of the weight assembly shown in FIG. 75 in an unlocked configuration.

FIG. 80 is a perspective view of the weight assembly 2904 in an unlocked configuration. In the unlocked configuration, the fastener 2930 is loosened with respect to the body 2906 of the club head. When the fastener 2930 is loosened, the cover 2928 linearly moves along the fastener axis 2932 (shown in FIG. 78) and at least partially raises out of the recessed channel 2924. In the unlocked configuration, the cover 2928 releases the weight 2926 so that the weight 2926 may slide within the recessed channel 2924. The first end of the first portion 2946 of the cover 2928 remains secured to the body 2906 by the fastener 2930 in the unlocked configuration.

In some examples, the second end of the second portion 2948 of the cover 2928 can remain partially engaged to the body 2906 via the projection 2954 (shown in FIG. 78) in the unlocked configuration so that rotation of the second portion 2948 relative to the first portion 2946 remains restricted and the weight 2926 cannot be removed from the recessed channel 2924. However, the weight 2926 is still enabled to slide and be repositioned as required or desired. In this example, to disengage the projection 2954 from the recessed channel 2924, the fastener 2930 is used to further raise the cover 2928 along the fastener axis 2932 so as to position the cover 2928 in a weight removal configuration as described below in reference to FIG. 81. In other examples, in the unlocked configuration the cover 2928 is raised such that the projection 2954 is disengaged from the recessed channel 2924 without any further movement along the fastener axis 2932. In this example, the cover 2928 is positioned such that it can be moved towards a weight removal configuration without further movement via the fastener 2930 as described below in reference to FIG. 81.

FIG. 81 is a perspective view of the weight assembly 2904 in a weight removal configuration. In the weight removal configuration, the first portion 2946 of the cover 2928 is raised at least partially out of the recessed channel 2924 such that the projection 2954 of the second portion 2948 is disengaged from the chamber 2956 defined within the recessed channel 2924. This disengagement enables the second portion 2948 of the cover 2928 to open towards the weight removal configuration by rotating relative to the first portion 2946 and in an outwards direction relative to the body 2906 of the club head. The fastener 2930 does not need to be used to open the second portion 2948 of the cover 2928. The rotation of the second portion 2948 is around a rotation axis that is substantially orthogonal to the fastener axis 2932 (shown in FIG. 78). By opening the cover 2928 the weight 2926 can be completely removed from the recessed channel 2924 as required or desired. Additionally, when the second portion 2948 is rotated relative to the first portion 2946 of the cover 2928, the hook 2964 and cylinder 2962 engagement (shown in FIG. 78) restricts the portions 2946, 2948 from separating from one another in the weight removal configuration.

Figure 82:
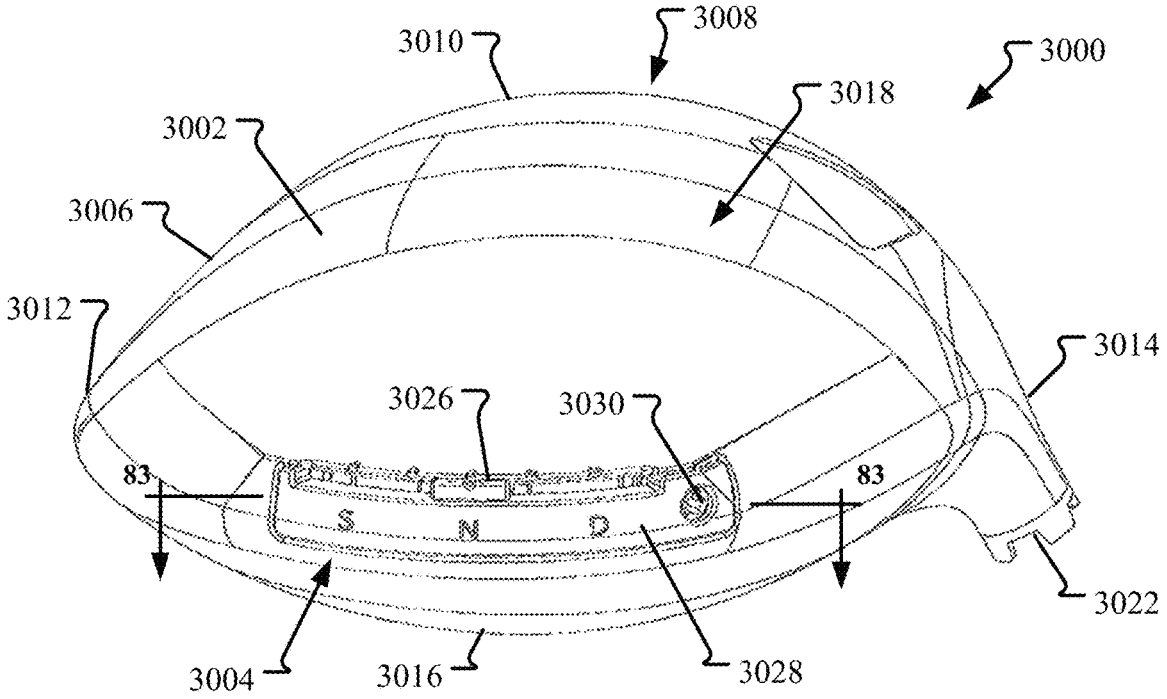
FIG. 82 is a perspective view of a sole of another golf club head with another weight assembly.
Figure 83:
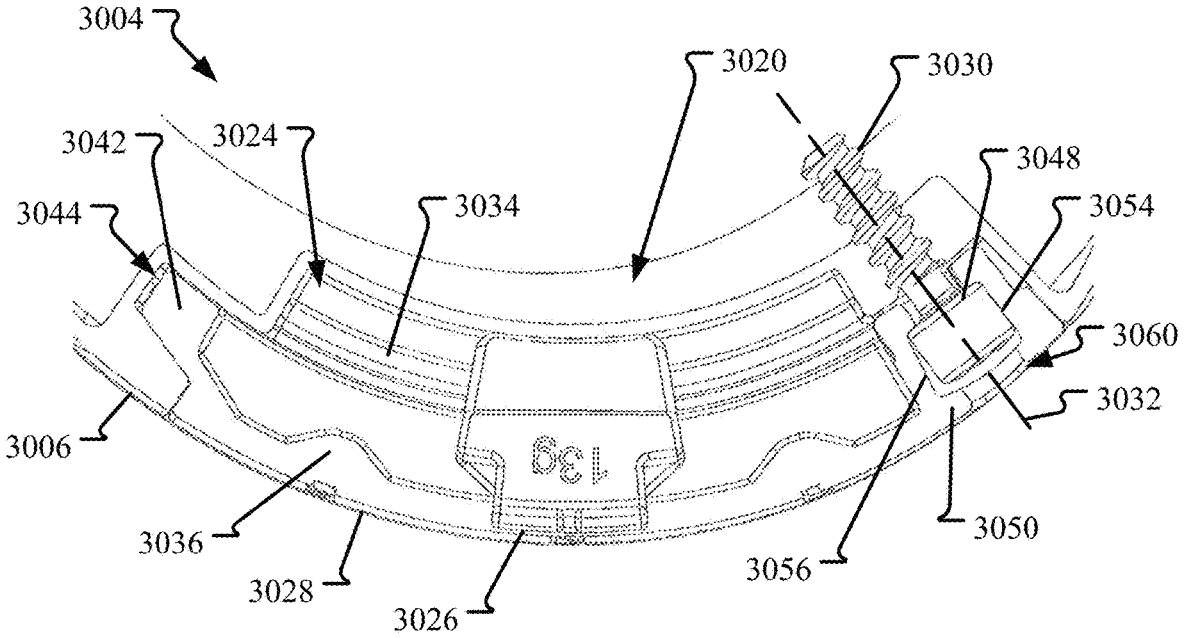
FIG. 83 is a cross-sectional view of the weight assembly taken along line 83-83 in FIG. 82.

FIG. 82 is a perspective view of a sole 3002 of another golf club head 3000 with another weight assembly 3004. FIG. 83 is a cross-sectional view of the weight assembly 3004 taken along line 83-83 in FIG. 82. Referring concurrently to FIGS. 82 and 83, the golf club head 3000 includes a body 3006, a striking face 3008, a lower edge 3010, an upper edge (not shown), a toe 3012, a heel 3014, a crown 3016, an outer surface 3018, an interior cavity 3020, and a hosel 3022, the functions of which are similar to the component functions described above. The body 3006 may form any type club head as described herein, such as, a metal-wood-type club head, a fairway-metal type club head, an iron-type club head, or a hybrid-type club head as required or desired. Furthermore, the features of the weight assembly 3004 described below can additionally or alternatively be utilized in any type club head described herein as required or desired.

In this example, a recessed channel 3024 is defined within the sole 3002, and/or a transition area (e.g., skirt) where the sole 3002 and the crown 3016 couple together. The channel 3024 extends in the toe 3012—heel 3014 direction so that the CG and the MOI of the club head 3000 can be adjusted for fade-draw bias. In an aspect, the recessed channel 3024 and the weight assembly 3004 are disposed substantially at a rear perimeter portion of the club head 3000 opposite the striking face 3008.

The weight assembly 3004 includes a slidable weight 3026 disposed at least partially within the recessed channel 3024 and configured to slide therein, a cover 3028 that extends at least partially over the channel 3024 and adapted to releasably secure the weight 3026 within the recessed channel 3024, and a fastener 3030 configured to couple the cover 3028 to the body 3006. Similar to the examples described above, the weight assembly 3004 is configured to move between at least a locked configuration, shown in FIG. 85 and described further below, and an unlocked configuration, shown in FIG. 86 and described further below. In the locked configuration, the cover 3028 is at least partially disposed within the recessed channel 3024, and the weight 3026 is secured within the channel 3024 with its movement restricted. In the unlocked configuration, the fastener 3030 enables the cover 3028 to move along a fastener axis 3032 so that the weight 3026 can slide relative to cover 3028 and the body 3006. Additionally, in this example, the cover 3028 can also at least partially rotate relative to the recessed channel 3024 and the body 3006 towards a weight removal configuration, shown in FIG. 87 and described further below. Additionally, the body 3006 includes a partial wall 3034 that slidably engages the weight 3026 and the cover 3028 includes at least one locating lug 3036 to facilitate positioning of the weight 3026.

Figure 84:
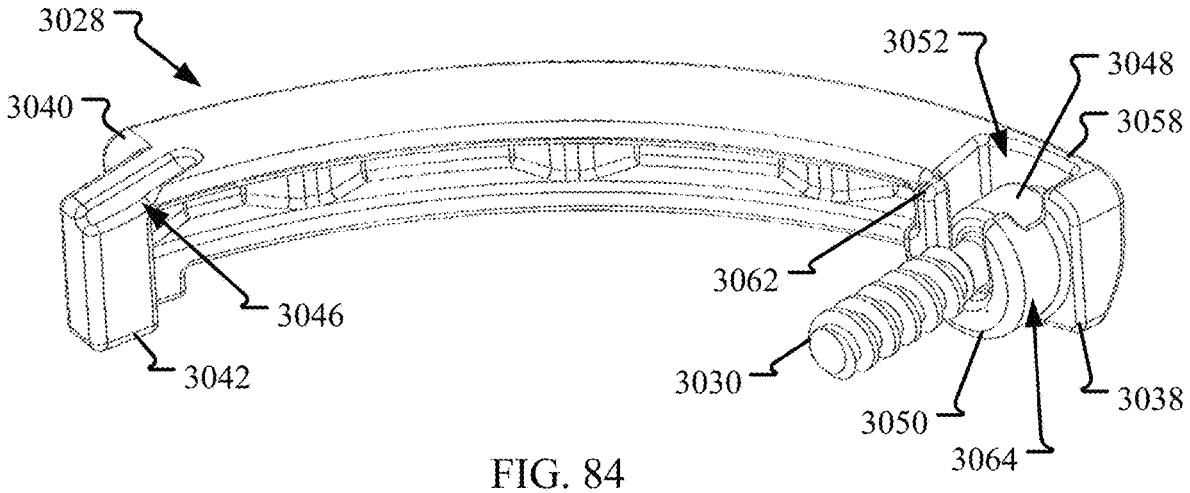
FIG. 84 is a perspective view of a cover of the weight assembly shown in FIG. 82.

FIG. 84 is a perspective view of the cover 3028 of the weight assembly 3004 (shown in FIGS. 82 and 83). With continued reference to FIG. 83, the cover 3028 has a first end 3038 and an opposite second end 3040. The second end 3040 has a projection 3042, which similar to the other examples herein, the projection 3042 is configured to engage with a corresponding chamber 3044 defined in the body 3006 and within the recessed channel 3024. As such, when the weight assembly 3004 is in the locked configuration, the second end 3040 more tightly secures the weight 3026 to the body 3006. In some examples, a duct 3046 is defined in the cover 3028 that is configured to engage with a corresponding lip (not shown) that extends from the recessed channel 3024. This duct and lip feature facilitates the sliding engagement of the second end 3040 of the cover 3028 with the recessed channel 3024 within the body 3006 and as described further above in reference to FIGS. 65 and 66. The first end 3038 of the cover 3028 engages with an enlarged head 3048 of the fastener 3030 and the fastener 3030 is freely rotatable relative to the cover 3028. In this example, the fastener 3030 is not coupled to the cover 3028 with a lock-washer, and the fastener 3030 is devoid of a lock-washer.

Figure 87:
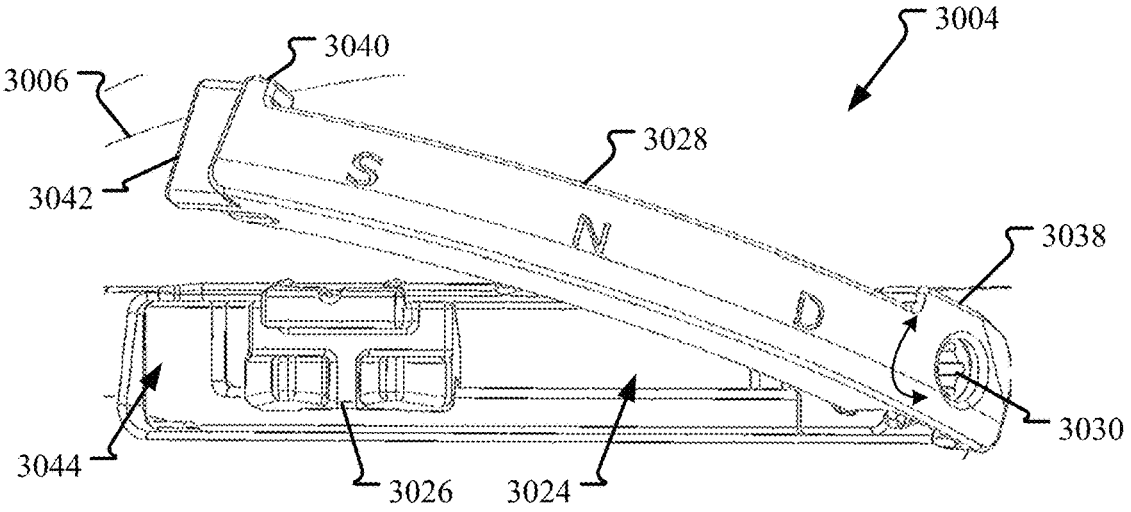
FIG. 87 is a perspective view of the weight assembly shown in FIG. 82 in a weight removal configuration.

The first end 3038 of the cover 3028 has a holder 3050 defined on an inner surface of the cover 3028 that is shaped and sized to receive the enlarged head 3048 of the fastener 3030. The holder 3050 has an inner surface 3052 that is larger than the enlarged head 3048 so that the enlarged head 3048 is freely rotatable within the holder 3050. In the example, the inner surface 3052 has a first sidewall 3054 that is substantially parallel to the fastener axis 3032 and an opposite second sidewall 3056 that is tapered relative to the fastener axis 3032. In an aspect, the second sidewall 3056 is oriented so as to increase the gap between the first sidewall 3054 and the second sidewall 3056 in a direction that is towards an outer surface of the cover 3028. When the fastener 3030 is tightened to or loosened from the body 3006 of the club head, the enlarged head 3048 is positioned against the first sidewall 3054 of the inner surface 3052, as illustrated in FIG. 83. This configuration aligns cover 3028 along the fastener axis 3032 so that the cover 3028 can linearly move along the fastener axis 3032 and engage or disengage the projection 3042 relative to the chamber 3044. However, when the fastener 3030 is loosened from the body 3006 (e.g., the enlarged head 3048 raised from the body 3006 along the fastener axis 3032) and the cover 3028 is disengaged from the body 3006, the second end 3040 of the cover 3028 can also be angled away from the body 3006 via the orientation of the second sidewall 3056. This movement of the cover 3028 enables the cover 3028 to at least partially rotate around the fastener axis 3032 towards a weight removal configuration as illustrated in FIG. 87 and described further below.

The inner surface 3052 of the holder 3050 also includes an outer axial wall 3058 that is substantially orthogonal to the fastener axis 3032. The outer axial wall 3058 confines the enlarged head 3048 within the holder 3050 in an axial direction along the fastener axis 3032 so that when the enlarged head 3048 is loosened and raised relative to the body 3006 of the club head, corresponding linear movement is induced on the cover 3028 even without use of a lock-washer. The outer axial wall 3058 can include an aperture 3060 so that a tool (not shown) can access the enlarged head 3048. In an aspect, the aperture 3060 has a diameter that is less than a diameter of the enlarged head 3048. An opposite inner axial wall 3062 is configured to at least partially hook around the enlarged head 3048 so that when the enlarged head 3048 is tightened and lowered relative to the body 3006, corresponding linear movement is induced on the cover 3028 even without use of a lock-washer. Additionally, the holder 3050 is a protruding component of the cover 3028 (e.g., via the inner axial wall 3062) with an outer surface 3064 that extends at least partially circumferentially around the fastener axis 3032. As such, the outer surface 3064 is curved and at least partially cylindrical in shape. In an aspect, the outer surface 3064 is curved and extends at least 180° around the fastener axis 3032. The outer surface 3064 facilitates rotation of the cover 3028 relative to the body 3006, when the cover 3028 is at least partially raised out of the recessed channel 3024.

In the example, the holder 3050 is accessible from either the top or bottom of the cover 3028 and allows the fastener 3030 to be at least partially inserted into the holder 3050 (e.g., the enlarged head 3048). When the cover 3028 is coupled to the body 3006 via the fastener 3030 and at least partially inserted within the recessed channel 3024, the holder 3050 is at least partially inserted within the recessed channel 3024 because it is a protruding feature so that the cover 3028 is restricted or prevented from being decoupled from the enlarged head 3048 without completely withdrawing the holder 3050 from the recessed channel 3024.

Figure 85:
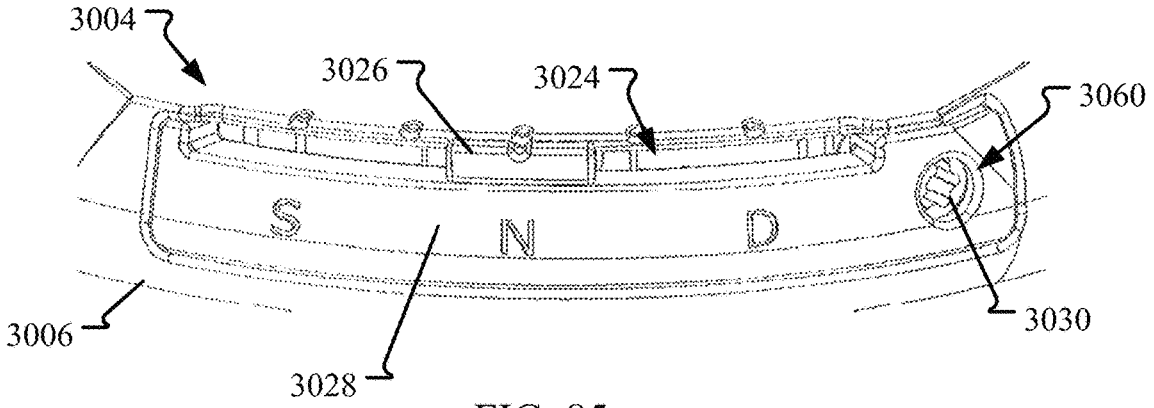
FIG. 85 is a perspective view of the weight assembly shown in FIG. 82 in a locked configuration.

FIG. 85 is a perspective view of the weight assembly 3004 in a locked configuration. In the locked configuration, the fastener 3030 is tightened to the body 3006 of the club head so that the cover 3028 is engaged to the body 3006 and at least partially within the recessed channel 3024 to secure a position of the weight 3026 within the recessed channel 3024. In the locked configuration, the fastener 3030 retains the weight 3026 in the recessed channel 3024 indirectly via the cover 3028. The first end of the cover 3028 is secured to the body 3006 by the fastener 3030. The second end of the cover 3028 is secured to the body 3006 via the projection 3042 (shown in FIG. 83) such that rotation of the cover 3028 is prevented. In order to release the weight 3026 from its secured position, the fastener 3030 via access by the aperture 3060 is used to move the weight assembly 3004 towards the unlocked configuration described below in reference to FIG. 86.

Figure 86:
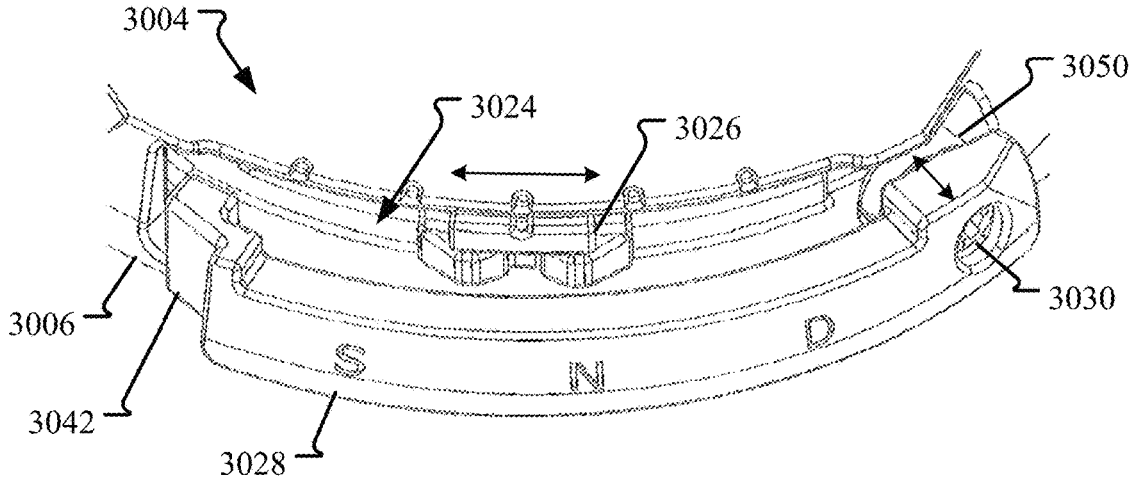
FIG. 86 is a perspective view of the weight assembly shown in FIG. 82 in an unlocked configuration.

FIG. 86 is a perspective view of the weight assembly 3004 in an unlocked configuration. In the unlocked configuration, the fastener 3030 is loosened with respect to the body 3006 of the club head. When the fastener 3030 is loosened, the cover 3028 linearly moves along the fastener axis 3032 (shown in FIG. 83) and at least partially raises out of the recessed channel 3024 by the fastener head engaging with the outer axial wall of the holder 3050. In the unlocked configuration, the cover 3028 releases the weight 3026 so that the weight 3026 may slide within the recessed channel 3024. The first end of the cover 3028 remains secured to the body 3006 by the fastener 3030 in the unlocked configuration.

In some examples, the second end of the cover 3028 can remain partially engaged to the body 3006 via the projection 3042 in the unlocked configuration so that rotation of the cover 3028 remains restricted and the weight 3026 cannot be removed from the recessed channel 3024. However, the weight 3026 is still enabled to slide and be repositioned as required or desired. In this example, to disengage the projection 3042 from the recessed channel 3024, the fastener 3030 is used to further raise the cover 3028 along the fastener axis 3032 so as to position the cover 3028 in a weight removal configuration as described below in reference to FIG. 87. In other examples, in the unlocked configuration the cover 3028 is raised such that the projection 3042 is disengaged from the recessed channel 3024 without any further movement along the fastener axis 3032. In this example, the cover 3028 is positioned such that it can be moved towards a weight removal configuration without further movement via the fastener 3030 as described below in reference to FIG. 87.

FIG. 87 is a perspective view of the weight assembly 3004 in a weight removal configuration. In the weight removal configuration, the first end 3038 of the cover 3028 is raised at least partially out of the recessed channel 3024 such that the projection 3042 of the second end 3040 is disengaged from the chamber 3044 defined within the recessed channel 3024. This disengagement enables the second end 3040 of the cover 3028 to be opened towards the weight removal configuration by angling away from the body 3006 of the club head and rotating it around the fastener axis of the fastener 3030. For example, the fastener head is positioned against the second sidewall 3056 (shown in FIG. 83) to angle the second end 3040 away from the body 3006 and the second end 3040 can be rotated around the fastener 3030. By opening the cover 3028, the weight 3026 can be completely removed from the recessed channel 3024 as required or desired. Additionally, the holder 3050 (shown in FIG. 83) of the fastener 3030 is still at least partially projecting into the recessed channel 3024 so that the cover 3028 cannot be completely removed from the body 3006 of the club head without further movement of the fastener 3030. This configuration enables both the cover 3028 and the fastener 3030 to remain coupled to the body 3006 in the weight removal configuration.

Figure 88:
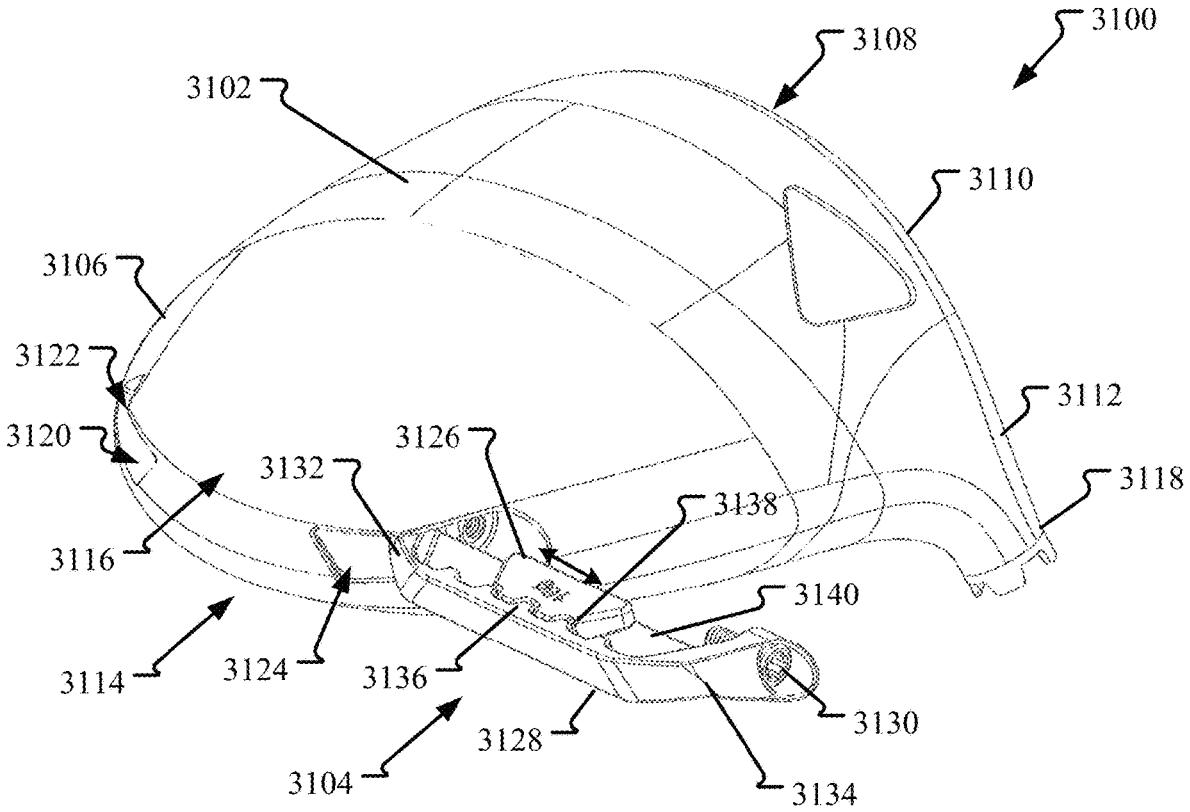
FIG. 88 is a perspective view of a sole of another golf club head with another weight assembly.

FIG. 88 is a perspective view of a sole 3102 of another golf club head 3100 with another weight assembly 3104. The golf club head 3100 includes a body 3106, a striking face 3108, a lower edge 3110, an upper edge (not shown), a toe (not shown), a heel 3112, a crown 3114, an outer surface 3116, an interior cavity (not shown), and a hosel 3118, the functions of which are similar to the component functions described above. The body 3106 may form any type club head as described herein, such as, a metalwood-type club head, a fairway-metal type club head, an iron-type club head, or a hybrid-type club head as required or desired. Furthermore, the features of the weight assembly 3104 described below can additionally or alternatively be utilized in any type club head described herein as required or desired.

In this example, a channel 3120 is defined by the body 3106 and the channel 3120 is a through-opening that extends through the body 3106 between a toe-side opening 3122 and a heel-side opening 3124. In some examples, the channel 3120 may be separated from the interior cavity of the body 3106 by a channel wall. In other examples, the channel 3120 may be at least partially open into the interior cavity of the body 3106. The channel 3120 may be disposed within the sole 3102, and/or a transition area where the sole 3102 and the crown 3114 couple together (e.g., skirt). The channel 3120 extends in the toe—heel direction so that the CG and the MOI of the club head 3100 can be adjusted for fade-draw bias. In an aspect, the channel openings 3122, 3124 are disposed substantially at a rear perimeter portion of the club head 3100 opposite the striking face 3108 and a front-rear centerline of the club head 3100.

The weight assembly 3104 includes a slidable weight 3126 slidably engaged with a cover 3128 and a fastener 3130 configured to couple the cover 3128 to the body 3106. The cover 3128 has a first end 3132 and an opposite second end 3134. The fastener 3130 is coupled to the first end 3132 (e.g., via a lock-washer) and the cover 3128 extends in a direction that is along the fastener axis. Both the first end 3132 and the second end 3134 of the cover 3128 have an outer surface that is shaped and sized to align with and not extend from the outer surface 3116 of the club head 3100 when secured thereto. Similar to the examples described above, the weight assembly 3104 is configured to move between at least a locked configuration (not illustrated) and an unlocked configuration (shown in FIG. 88). In the locked configuration, the cover 3128 inserted within the channel 3120 so that the weight 3126 is completely disposed within the channel 3120 and within the body 3106 of the club head 3100. The position of the weight 3126 on the cover 3128 is secured within the channel 3120 when the weight assembly 3104 is in the locked configuration. As such, the fastener 3130 retains the weight 3126 in the channel 3120 indirectly via the cover 3128. In the unlocked configuration, the fastener 3130 enables the cover 3128 to be at least partially withdrawn from the channel 3120 and along the fastener axis so that the weight 3126 is at least partially extracted from the channel 3120. When the weight 3126 is extracted from the body 3106, the weight 3126 can slide relative to cover 3128 for removal and/or repositioning on the cover 3128. As such, the position of the weight 3126 on the cover 3128 is adjustable so that the weight assembly 3104 is used to adjust the GC and MOI of the club head 3100.

In this example, an inner surface of the cover 3128 includes at least one locating lug 3136 spaced along the fastener axis. The weight 3126 includes one or more corresponding hollows 3138 shaped and sized to receive at least a portion of the locating lug 3136. Additionally, when the locating lug 3136 is engaged with the hollow 3138, the weight 3126 is retained more tightly by the cover 3128 to reduce or prevent rattling and further movement of the weight 3126 in the locked configuration. In an aspect, the cover 3128 can include a shelf 3140 that the weight 3126 is supported by. The shelf 3140 allows the weight 3126 to be extracted from within the channel 3120 when the weight assembly 3104 is moved into the unlocked configuration.

In some examples, the first end 3132 of the cover 3128 may be engaged at least partially with the channel 3120 so that the cover 3128 is coupled to the body 3106 of the club head 3100 in the unlocked configuration. In other example, the cover 3128 can be completely removable from the body 3106 of the club head 3100 as required or desired. By securing the slidable weight 3126 within the body 3106 of the club head 3100 aerodynamic performance of the outer surface 3116 of the club head 3100 can be increased.

Figure 89:
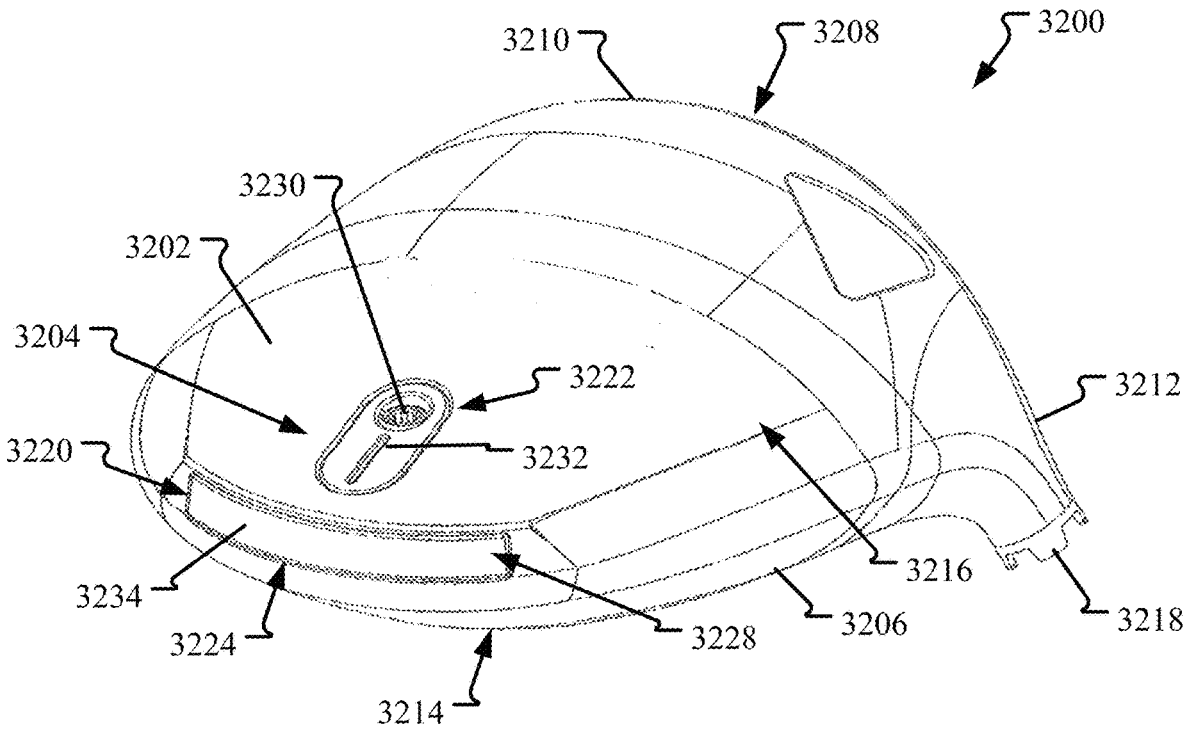
FIG. 89 is a perspective view of a sole of another golf club head with another weight assembly in a locked configuration.

FIG. 89 is a perspective view of a sole 3202 of another golf club head 3200 with another weight assembly 3204 in a locked configuration. The golf club head 3200 includes a body 3206, a striking face 3208, a lower edge 3210, an upper edge (not shown), a toe (not shown), a heel 3212, a crown 3214, an outer surface 3216, an interior cavity (not shown), and a hosel 3218, the functions of which are similar to the component functions described above. The body 3206 may form any type club head as described herein, such as, a metalwood-type club head, a fairway-metal type club head, an iron-type club head, or a hybrid-type club head as required or desired. Furthermore, the features of the weight assembly 3204 described below can additionally or alternatively be utilized in any type club head described herein as required or desired.

In this example, a channel 3220 is defined by the body 3206 for supporting the weight assembly 3204. The channel 3220 can include a first channel 3222 and a second channel 3224 that are in communication with one another. The first channel 3222 is defined in the sole 3202 of the body 3206 and extends in a front-rear direction of the club head 3200 with the striking face 3208 being the front of the club head 3200. The second channel 3224 is defined in the sole 3202, and/or a transition area (e.g., skirt) where the sole 3202 and the crown 3214 couple together. The second channel 3224 extends in the toe—heel direction so that the CG and the MOI of the club head 3200 can be adjusted for fade-draw bias. In an aspect, the second channel 3224 is disposed substantially at a rear perimeter portion of the club head 3200 opposite the striking face 3208. As such, the first channel 3222 and the second channel 3224 are oriented in substantially orthogonal directions and on different planes of the club head 3200.

The weight assembly 3204 includes a slidable weight 3226 (shown in FIG. 91) slidably engaged with a cover 3228 and a fastener 3230 configured to couple the cover 3228 to the body 3206. In this example, the cover 3228 includes a fastener tab 3232 and a weight tray 3234. The fastener tab 3232 is sized and shaped to be received within the first channel 3222 and the weight tray 3234 is sized and shaped to be received within the second channel 3224. The fastener 3230 is coupled to the fastener tab 3232 (e.g., via a lock washer) and the weight tray 3234. The fastener 3230 is configured to cooperate with both the fastener tab 3232 and the weight tray 3234 to retain and secure the weight 3226 within the body 3206 of the club head 3200. Similar to the examples described above, the weight assembly 3204 is configured to move between at least a locked configuration, shown in FIG. 89, and an unlocked configuration, shown in FIG. 90 and described further below. In the locked configuration, the cover 3228 is at least partially disposed within the recessed channel 3220, and the weight 3226 is secured within the body 3206 of the club head 3200 with its movement restricted. In the unlocked configuration, the fastener 3230 releases the cover 3228 from the body 3206 so that the weight assembly 3204 can move towards a weight adjustment configuration, shown in FIG. 91 and described further below. In the weight adjustment configuration, the position of the weight 3226 within the weight tray 3234 can be adjusted as required or desired.

In the locked configuration, both the fastener tab 3232 and the weight tray 3234 are positioned within the body 3206 of the club head 3200 so that they are not protruding and aligned with the outer surface 3216 of the club head 3200. Additionally, the weight 3226 is completely disposed within the body 3206 of the club head 3200, and secured therein, in the locked configuration. The fastener 3230 retains the weight 3226 in the recessed channel 3220 indirectly via the cover 3228 and so that the weight 3226 can be used to adjust the CG and the MOI of the club head 3200.

Figure 90:
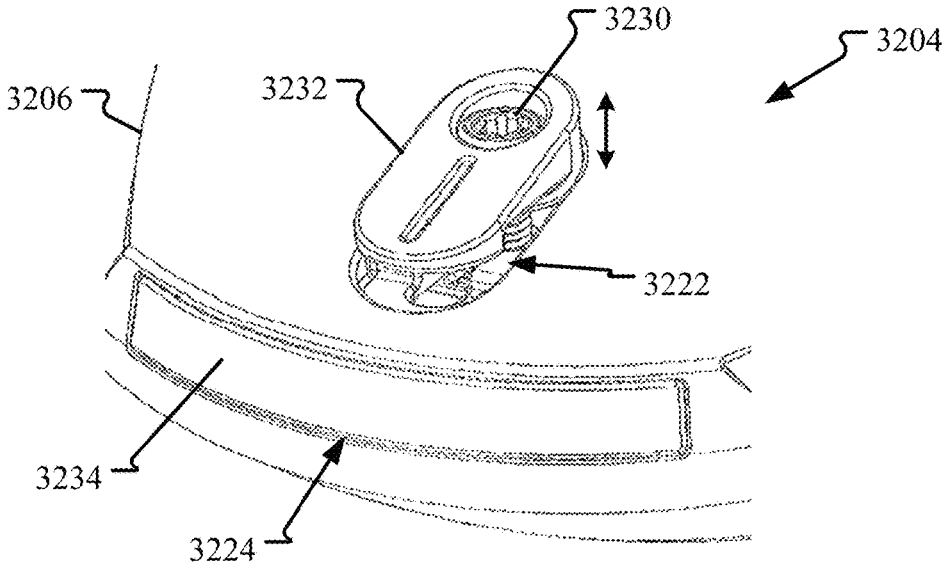
FIG. 90 is a perspective view of the weight assembly shown in FIG. 89 in an unlocked configuration.
Figure 91:
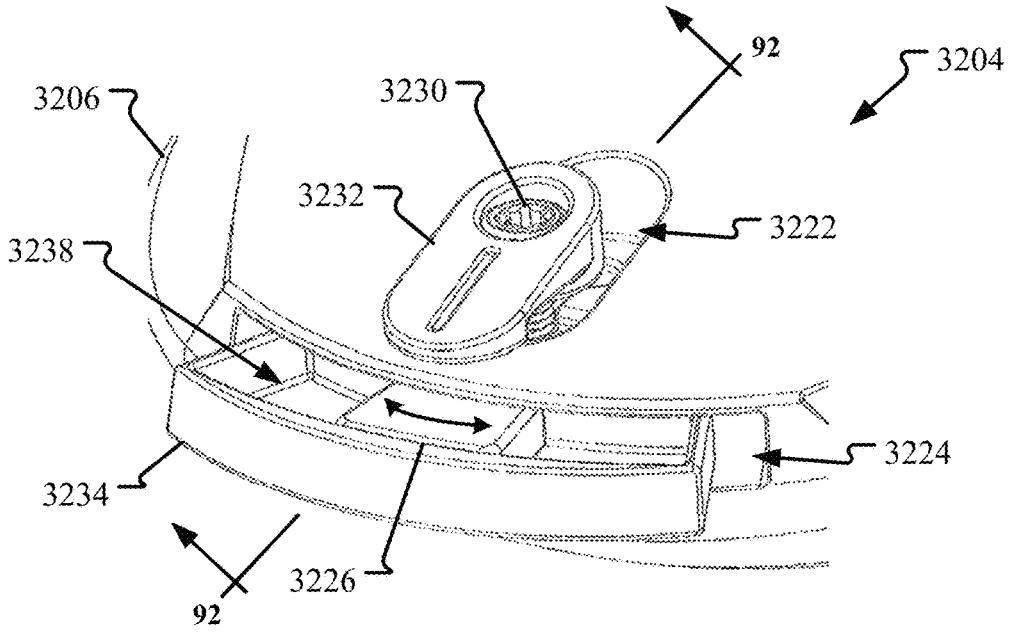
FIG. 91 is a perspective view of the weight assembly shown in FIG. 89 in a weight adjustment configuration.

FIG. 90 is a perspective view of the weight assembly 3204 in an unlocked configuration. In the unlocked configuration, the fastener 3230 is loosened such that it at least partially raises out of the first channel 3222 along the fastener axis. Because the fastener tab 3232 is coupled to the fastener 3230, the fastener tab 3232 also raises at least partially out of the first channel 3222. In the example, the fastener 3230 is positioned towards a front section of the first channel 3222. This movement of the fastener 3230 and the fastener tab 3232, however, does not correspond to the weight tray 3234 moving within the second channel 3224. Rather, once the weight assembly 3204 is in the unlocked configuration, the user can utilize the fastener tab 3232 to pull the weight tray 3234 at least partially out of the second channel 3224 and access the weight 3226 as illustrated in FIG. 91. In the unlocked configuration, the weight 3226 may still be disposed completely within the body 3206 of the club head.

Figure 92:
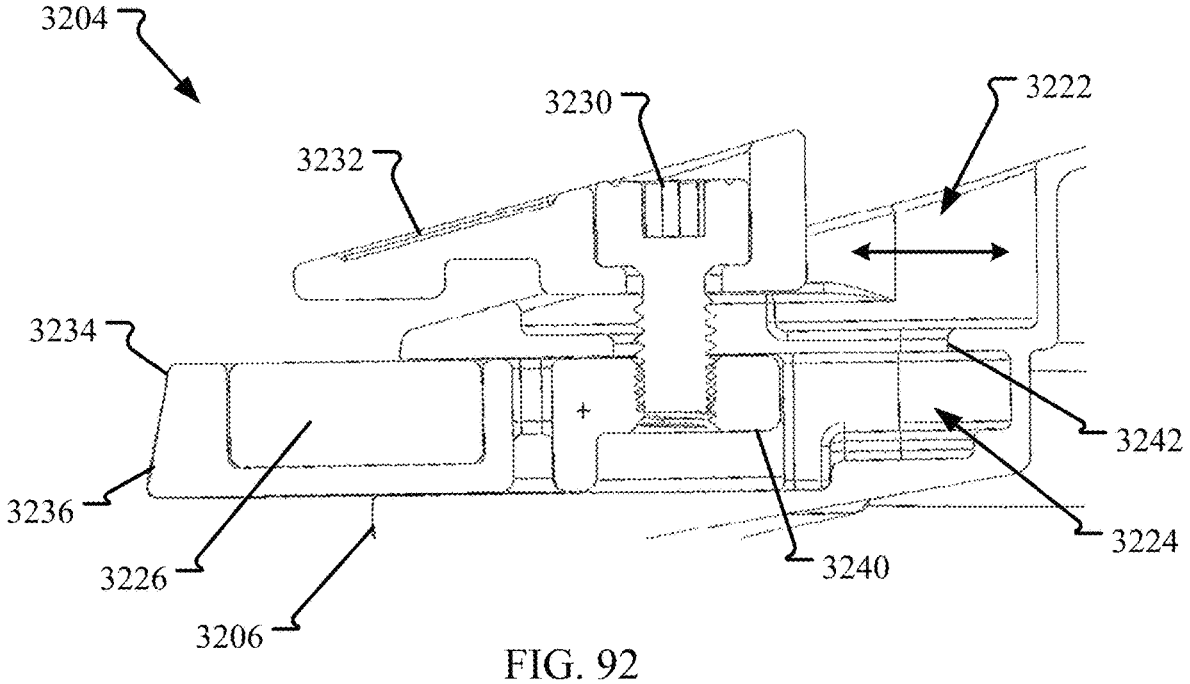
FIG. 92 is a cross-sectional view of the weight assembly taken along line 92-92 in FIG. 91.

FIG. 91 is a perspective view of the weight assembly 3204 in a weight adjustment configuration. FIG. 92 is a cross-sectional view of the weight assembly 3204 taken along line 92-92 in FIG. 91. Referring concurrently to FIGS. 91 and 92, the weight tray 3234 has a first end 3236 with a pool 3238 that is sized and shaped to receive the weight 3226 and allow the weight to be selectively positionable (e.g., via sliding) therein. A second end 3240 of the weight tray 3234 threadably engages with the fastener 3230 so that the fastener 3230 can rotate relative thereto. A slot 3242 is defined between the first channel 3222 and the second channel 3224 so that the fastener 3230 can extend between the two and couple to both the fastener tab 3232 and the weight tray 3234. The slot 3242 extends in a similar front-rear direction to the first channel 3222 so that the weight assembly 3204 can be linearly movable in a rearwards direction towards the weight adjustment configuration when the weight assembly 3204 is unlocked (e.g., disengage the fastener tab 3232 from the first channel 3222).

In operation, when the weight assembly 3204 is unlocked and then moved towards the weight adjustment configuration, the first end 3236 of the weight tray 3234 projects from the body 3206 so that the weight 3226 is accessible within the pool 3238 and its position can be adjusted. In some examples, the weight 3226 can be completely removable from the weight assembly 3204 as required or desired in the weight adjustment configuration.

Figure 93:
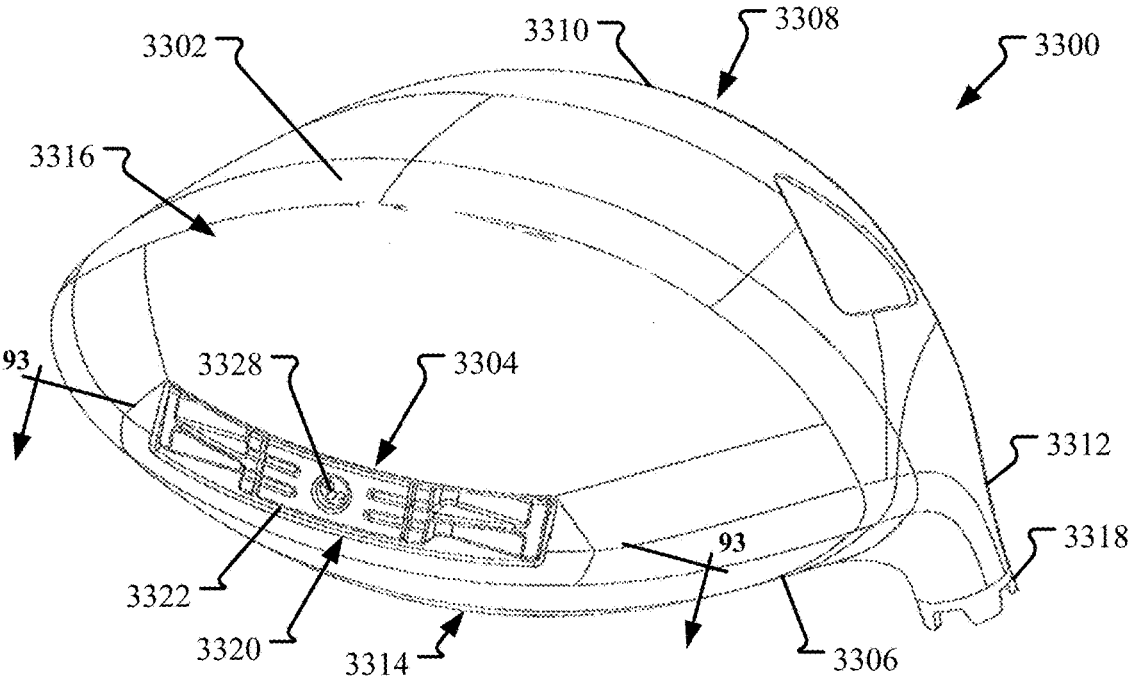
FIG. 93 is a perspective view of a sole of another golf club head with another weight assembly.
Figure 94:
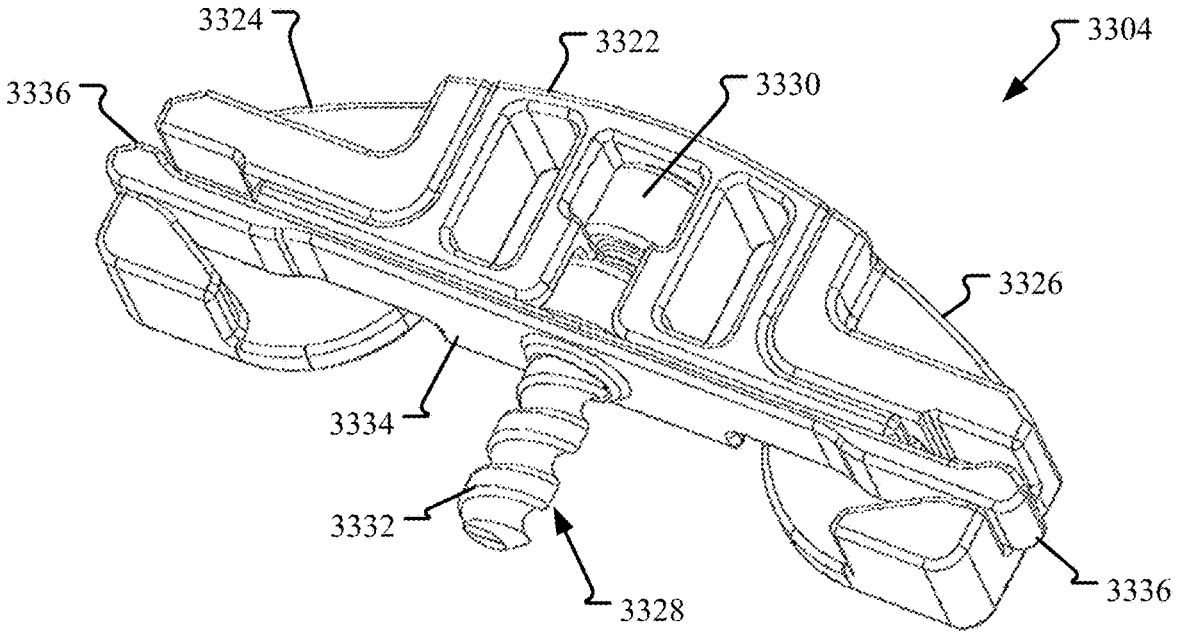
FIG. 94 is a perspective view of the weight assembly shown in FIG. 93.

FIG. 93 is a perspective view of a sole 3302 of another golf club head 3300 with another weight assembly 3304. FIG. 94 is a perspective view of the weight assembly 3304. Referring concurrently to FIGS. 93 and 94, the golf club head 3300 includes a body 3306, a striking face 3308, a lower edge 3310, an upper edge (not shown), a toe (not shown), a heel 3312, a crown 3314, an outer surface 3316, an interior cavity (not shown), and a hosel 3318, the functions of which are similar to the component functions described above. The body 3306 may form any type club head as described herein, such as, a metalwood-type club head, a fairway-metal type club head, an iron-type club head, or a hybrid-type club head as required or desired. Furthermore, the features of the weight assembly 3304 described below can additionally or alternatively be utilized in any type club head described herein as required or desired.

In this example, a recessed channel 3320 is defined within the sole 3302, and/or a transition area (e.g., skirt) where the sole 3302 and the crown 3314 couple together. The channel 3320 extends in the toe-heel direction so that the CG and the MOI of the club head 3300 can be adjusted for fade-draw bias. In an aspect, the recessed channel 3320 and the weight assembly 3304 are disposed substantially at a rear perimeter portion of the club head 3300 opposite the striking face 3308.

The weight assembly 3304 includes an insert 3322 that is configured to be inserted into the recessed channel 3320 and coupled to the body 3306 of the club head 3300. The insert 3322 has one or more weights coupled thereto. In this example, a first weight 3324 and a second weight 3326 are coupled to the insert 3322. The first weight 3324 may be a different mass than the second weight 3326. An actuator 3328 is also coupled to the insert 3322 and disposed between the weights 3324, 3326. In the example, the actuator 3328 is rotatable relative to the insert 3322 with an enlarged head 3330 and a leadscrew 3332. The enlarged head 3330 is captured within the insert 3322 and the leadscrew 3332 extends in a direction away from the insert 3322. The actuator 3328, however, is not used to couple the weight assembly 3304 to the body 3306 of the club head 3300. Rather, the insert 3322 includes a locking member 3334 configured to selectively engage with the body 3306 of the club head 3300 and secure the weight assembly 3304 within the recessed channel 3320. The locking member 3334 is engaged with the leadscrew 3332 and has a pair of opposing ends 3336 that project from the insert 3322.

In operation, the weight assembly 3304 is configured to move between a locked configuration, shown in FIG. 95 and described further below, and an unlocked configuration, shown in FIG. 96 and described further below. In the locked configuration, the insert 3322 is secured within the recessed channel 3320 via the ends 3336 of the locking member 3334 so that the weights 3324, 3326 are coupled to the golf club head 3300. In the unlocked configuration, the ends 3336 of the locking member 3334 disengage with the body 3306 of the club head 3300 so that the insert 3322 can be removed from the recessed channel 3320. Once the insert 3322 is removed, one or more of the weights 3324, 3326 can be changed out and replaced to adjust the weight in the weight assembly 3304. In other examples, the insert 3322 can be flipped around and inserted back into the recessed channel 3320 so as to adjust the position of the weights 3324, 3326 within the golf club head 3300.

Figure 95:
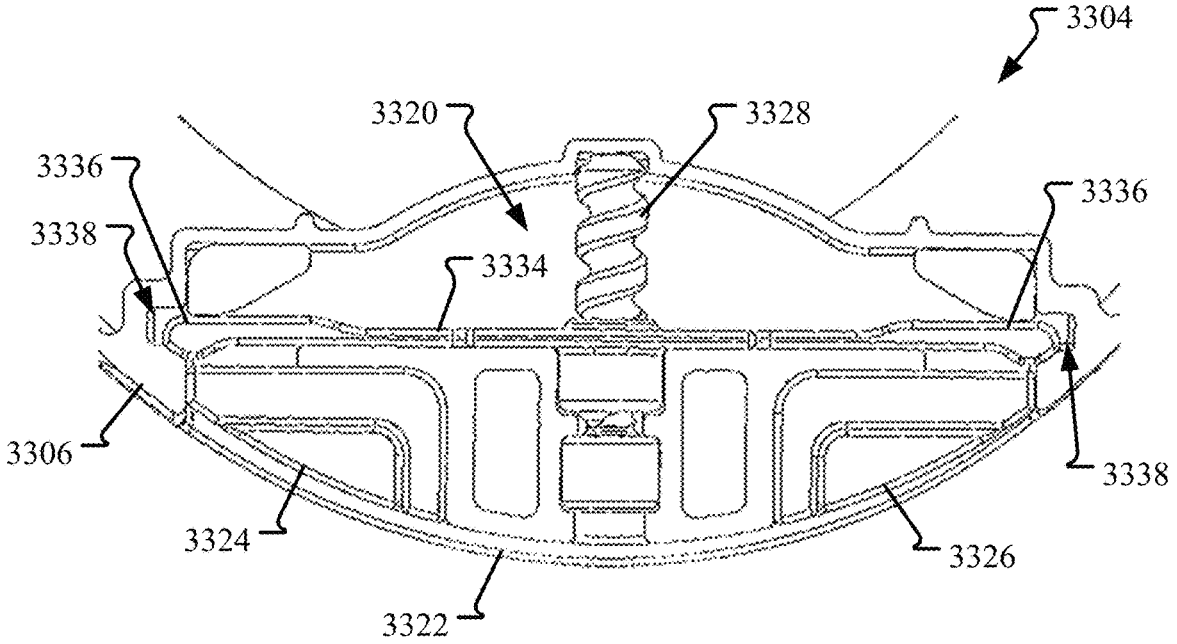
FIG. 95 is a cross-sectional view of the weight assembly taken along line 93-93 in FIG. 93 in a locked configuration.

FIG. 95 is a cross-sectional view of the weight assembly 3304 taken along line 93-93 in FIG. 93 in a locked configuration. In the locked configuration, the actuator 3328 is rotated such that the locking member 3334 is positioned substantially orthogonal to the rotation axis and in a linear orientation. This position of the locking member 3334 as illustrated in FIG. 95, results in the ends 3336 projecting from the insert 3322 and engaging with corresponding chambers 3338 defined in the body 3306 of the club head and within the recessed channel 3320. The locking member 3334 engaging with the body 3306 couples the weight assembly 3304 to the club head and secure the position and orientation of the weights 3324, 3326. The actuator 3328 is rotatable so as to move the locking member 3334 towards an unlocked configuration as described below to enable the insert 3322 to be removed and decoupled from the body 3306 of the club head.

Figure 96:
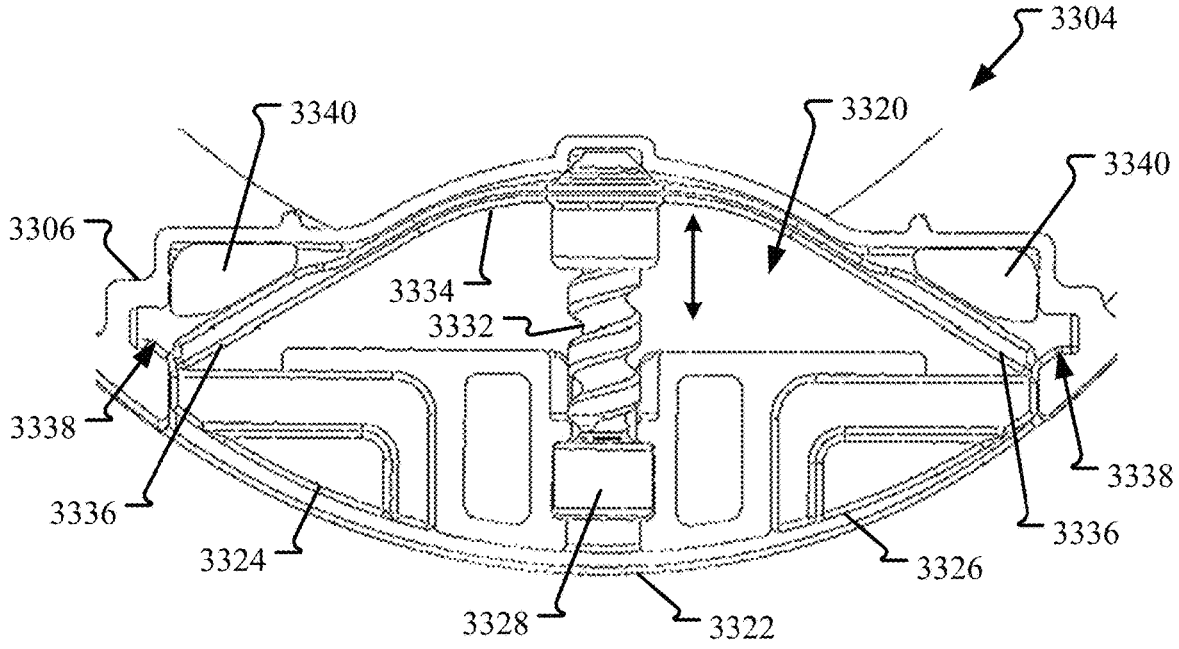
FIG. 96 is a cross-sectional view of the weight assembly taken along line 93-93 in FIG. 93 in an unlocked configuration.

FIG. 96 is a cross-sectional view of the weight assembly 3304 taken along line 93-93 in FIG. 93 in an unlocked configuration. The locking member 3334 is a flexible member such that when the actuator 3328 is rotated, the rotational movement of the leadscrew 3332 induces corresponding linear movement on the center of the locking member 3334. As such, the locking member 3334 can curve so as to retract the ends 3336 into the insert 3322. This retraction of the ends 3336 of the locking member 3334 disengages the ends 3336 from the chambers 3338 and allows the weight assembly 3304 to be removed from the recessed channel 3320 and the body 3306 of the club head. In the example, the ends 3336 of the locking member 3334 are stiffer relative to the middle section so that the ends 3336 are able to engage and secure to the recessed channel 3320.

The unlocked configuration allows the weights 3324, 3326 to be replaced or for the insert 3322 to be reinserted into the recessed channel 3320 in a flipped position and adjust the GC and MOI of the club head. The insert 3322 can include a pair of stops 3340 that engage with the ends 3336 of the locking member 3334 so as to help impart the curve into the locking member 3334 in the unlocked configuration. In this example, the weight assembly 3304 can be substantially systematical in both the toe-heel direction and sole-crown direction so that the insert 3322 can be used to reposition the weights 3324, 3326 within the body 3306. Additionally, the shape and size of the recessed channel 3320 enables the locking member 3334 to move as described herein.

Figure 97:
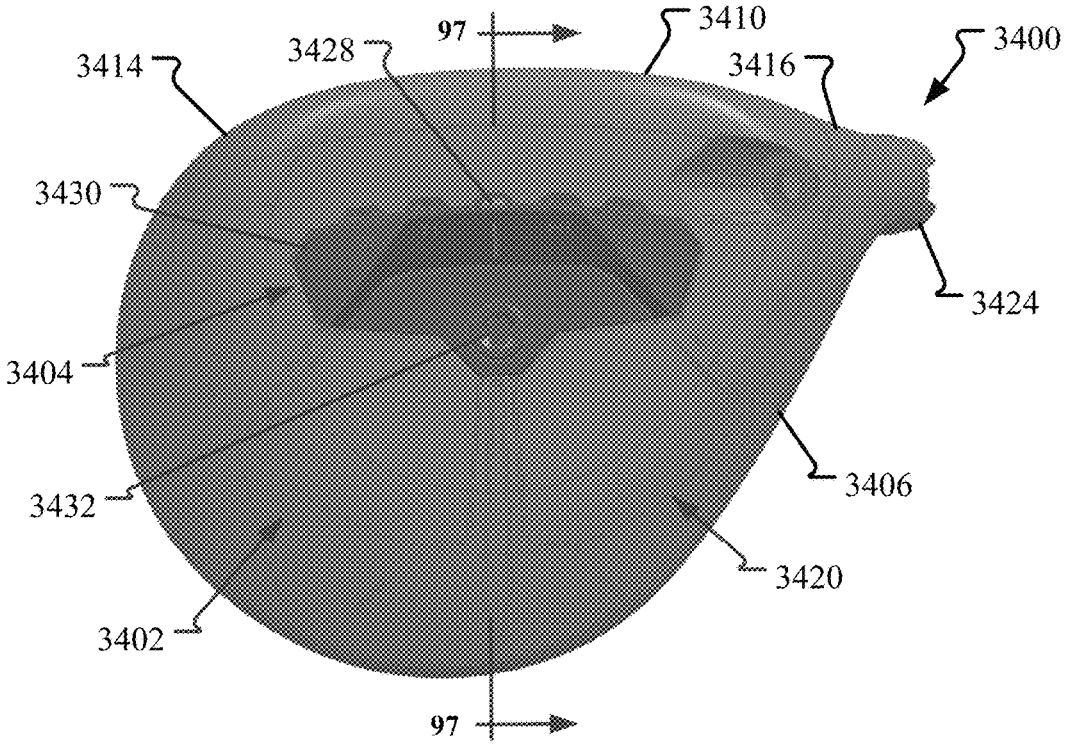
FIG. 97 is a bottom view of a sole of a golf club head with another weight assembly.
Figure 98:
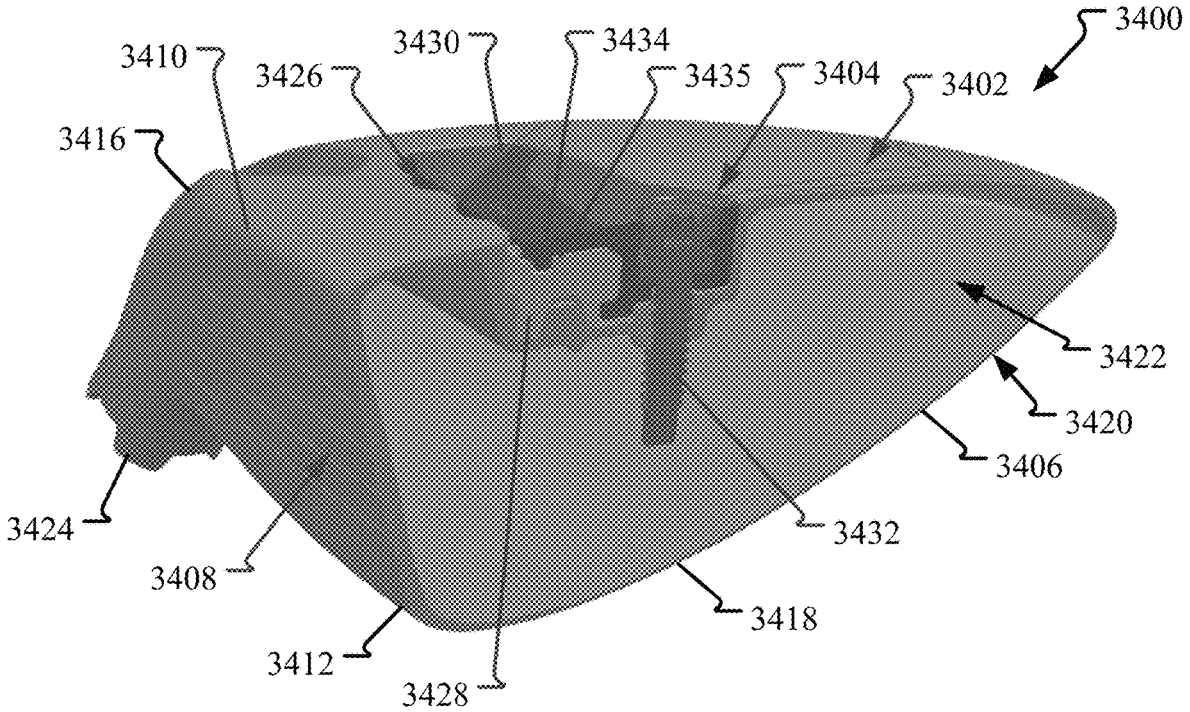
FIG. 98 is a perspective cross-sectional view of the golf club head taken along line 97-97 in FIG. 97 and in an locked configuration.
Figure 99:
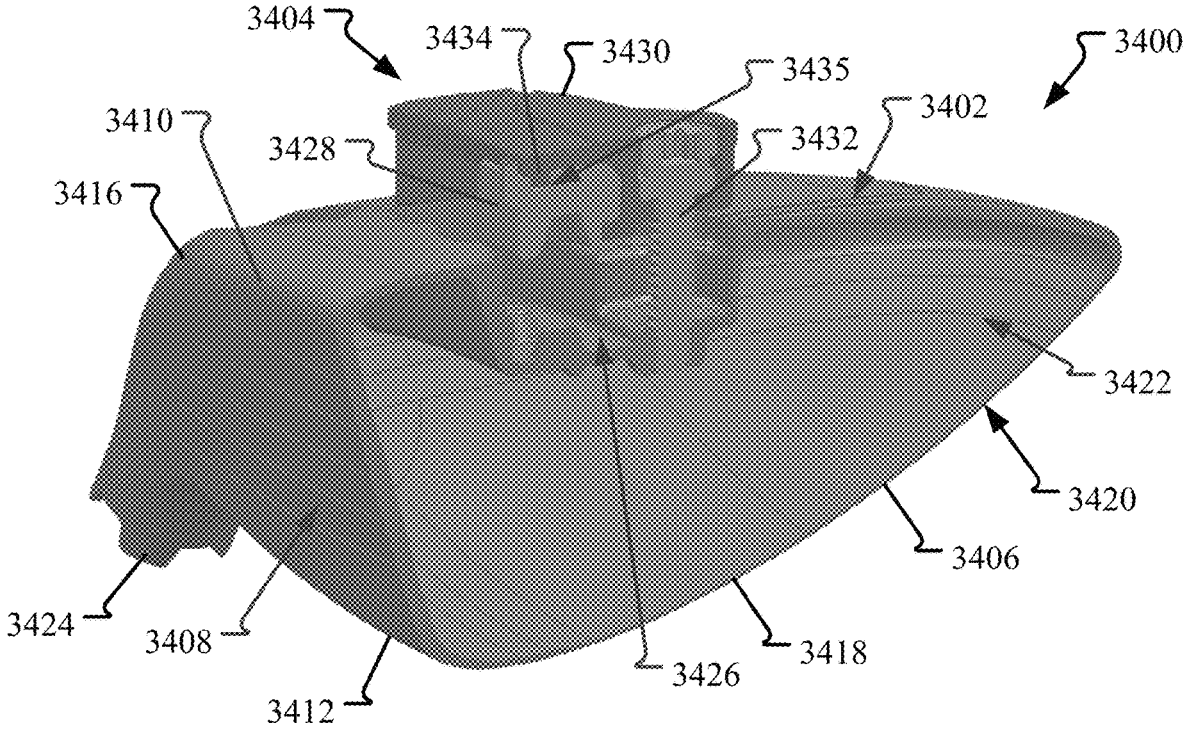
FIG. 99 is another perspective cross-sectional view of the golf club head taken along line 97-97 in FIG. 97 and in an unlocked configuration.

FIG. 97 is a bottom view of a sole 3402 of a golf club head 3400 with another weight assembly 3404. FIG. 98 is a perspective cross-sectional view of the golf club head 3400 taken along line 97-97 in FIG. 97 and in an locked configuration. FIG. 99 is another perspective cross-sectional view of the golf club head 3400 taken along line 97-97 in FIG. 97 and in an unlocked configuration. Referring concurrently to FIGS. 97-99, the golf club head 3400 is a fairway-metal type golf club head having a body 3406 that includes a striking face 3408 with a lower edge 3410 and an upper edge 3412 extending between a toe 3414 and a heel 3416. The sole 3402 extends from the lower edge 3410 on the bottom side of the club head 3400 and a crown 3418 extends from the upper edge 3412 on the top of the club head 3400. The sole 3402, the striking face 3408, and the crown 3418 are coupled together so as to define an outer surface 3420 of the body 3406 with an interior cavity 3422 formed within. A hosel 3424 is disposed at the heel 3416 and is configured to couple to a shaft (not shown). The functions of the components (e.g., sole, striking face, crown, hosel, etc.) of the fairway-metal type golf club head 3400 are similar to the component functions described above. The body 3406 may form any type club head, such as a metalwood-type club head, an iron-type club head, or a hybrid-type club head as required or desired. Furthermore, the features of the weight assembly 3404 described below can additionally or alternatively be utilized in any type club head described herein as required or desired.

In this example, a recessed channel 3426 is defined within the sole 3402 of the body 3406 of the club head 3400. The channel 3426 extends in the toe 3414—heel 3416 direction so that that the CG and the MOI of the club head 3400 can be adjusted for fade-draw bias. The weight assembly 3404 includes a slidable weight 3428 disposed at least partially within the channel 3426 and configured to slide therein, a cover 3430 that extends at least partially over the channel 3426 and adapted to releasably secure the weight 3428 within the channel 3426, and a fastener 3432 configured to couple the cover 3430 to the body 3406. The fastener 3432 retains the weight 3428 in the recessed channel 3426 indirectly via the cover 3430 so that the weight 3428 can be used to adjust the CG and the MOI of the club head 3400. In this example, the weight assembly 3404 and the recessed channel 3426 are located at a frontal section of the golf club head 3400.

Similar to the examples described above, the weight assembly 3404 is configured to move between at least two positions via the fastener 3432, for example, a locked configuration, shown in FIG. 98, and an unlocked configuration, shown in FIG. 99. In the locked configuration, the cover 3430 is at least partially disposed within the recessed channel 3426 in a secured position, and the weight 3428 is secured within the channel 3426 with its movement restricted. When the weight assembly 3404 is in the locked configuration, the weight 3428 is completely disposed within the channel 3426 and no portion of the weight 3428 extends above the outer surface 3420 of the body 3406. Because the weight 3428 is completely disposed within the recessed channel 3426 and at least aligned with, or below, the outer surface 3420 of the body 3406, the smoothness of the outer surface 3420 of the club head 3400 is maintained so as to promote good ground interaction. In the unlocked configuration, the fastener 3432 enables the cover 3430 to move along the fastener axis towards a raised position so that the weight 3428 is released and can slide relative to the cover 3430 and the body 3406. The fastener 3432 is coupled to cover 3430 with a retaining clip 3433. The retaining clip 3433 is configured to couple the fastener 3432 to the cover 3430 so that the fastener 3432 can rotate around the fastener axis and relative to the cover 3430, however, the fastener 3432 and cover 3430 are coupled together for corresponding linear movement along the fastener axis. In an aspect, the retaining clip 3433 includes a lock washer. In this example, the cover 3430 includes a retention rib 3434 that is configured to slidably engage with a slit 3435 defined in the weight 3428. The retention rib 3434 improves retention of the weight 3428 with the cover 3430 and as the weight assembly 3404 moves between configurations. The retention rib 3434 is described in further detail below.

Figure 100:
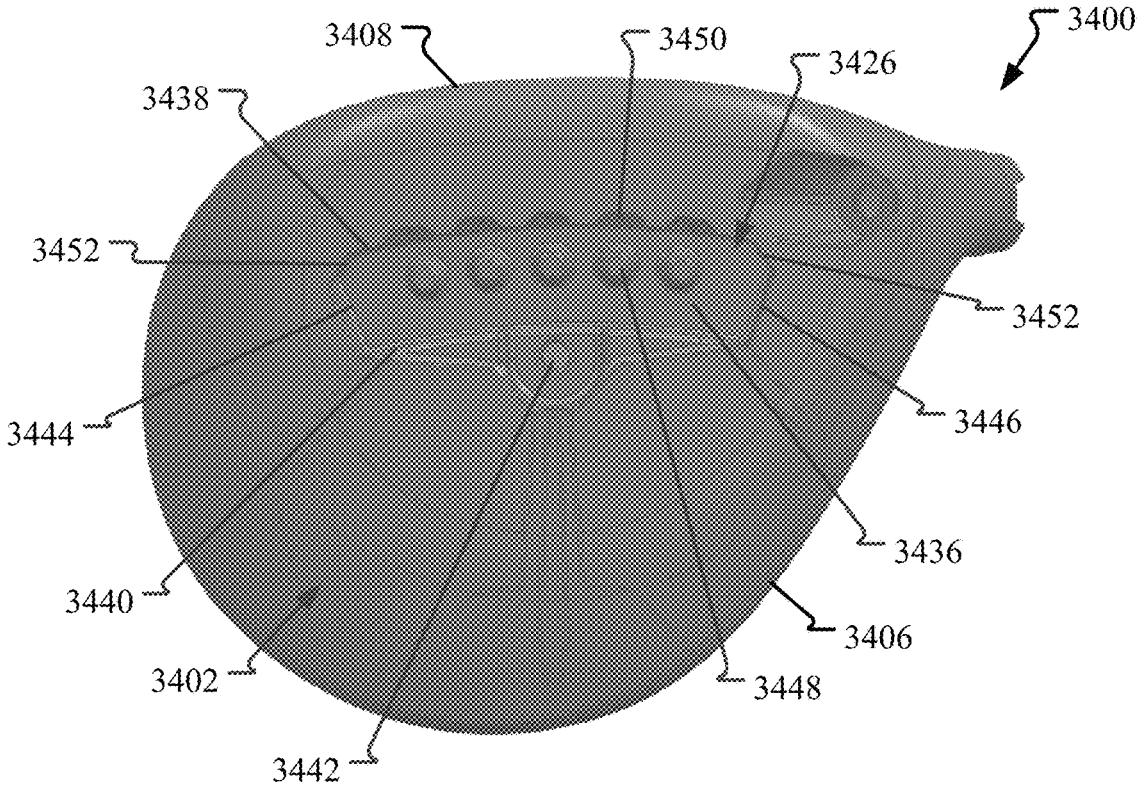
FIG. 100 is another bottom view of the sole of the golf club head shown in FIG. 97.

FIG. 100 is another bottom view of the sole 3402 of the golf club head 3400. The weight assembly 3404 (shown in FIGS. 97-99) is not shown for clarity. The recessed channel 3426 is defined by a bottom track 3436 and two opposing sidewalls 3438, 3440. A first sidewall 3438 is adjacent the striking face 3408 and a second sidewall 3440 is adjacent to the rear of the sole 3402. A nut 3442 is formed within the sole 3402 of the body 3406 proximate the second sidewall 3440. The nut 3442 is configured to engage the fastener 3432 so that the cover 3430 (both shown in FIGS. 97-99) is directly coupled to the body 3406. Additionally, the recessed channel 3426 is defined by two opposing end walls 3444, 3446. A toe end wall 3444 is located on the toe side of the club head 3400 and a heel end wall 3446 is located on the heel side of the club head 3400. In this example, no chambers or openings are defined at the ends of the recessed channel 3426 and the cover 3430 does not have any corresponding projections. In an aspect, the fastener 3432 is the only component of the weight assembly 3404 that extends into the interior cavity of the body 3406, for example, via the nut 3442. This configuration of the club head 3400 reduces dirt and debris from accumulating within the channel 3426 and within the body 3406.

The bottom track 3436 includes a plurality of bosses 3448 projecting into the channel 3426. In this example, there are five bosses 3448 equally spaced in the toe-heel direction. The bosses 3448 are configured to selectively engage with the weight 3428 when in the locked configuration (shown in FIG. 98) and so as to assist with positioning and retaining the weight 3428 within the recessed channel 3426 as described herein. In the example, the bosses 3448 can have a substantially frustoconical shape. Additionally, the first sidewall 3438 includes a plurality of dimples 3450 that correspond to the plurality of bosses 3448. The dimples 3450 are configured to selectively engage with the weight 3428 when in the locked configuration and so as to assist with positioning and retaining the weight 3428 within the recessed channel 3426 as described herein. In the example, there are five bosses 3448 and five dimples 3450 so that the weight 3428 is selectively positionable at five predefined positions. It should be appreciated that any other number of predefined positions, (e.g., three) can be utilized as required or desired.

Between the first sidewall 3438 and the end walls 3444, 3446, the recessed channel 3426 is defined by an oblique wall 3452. The oblique walls 3452 are formed at the terminal end of the channel 3426 in the toe-heel direction. Because the projections and chambers have been eliminated from the weight assembly 3404 when compared to prior examples, the oblique walls 3452 are configured to engage with the cover 3430 and secure the ends of the cover 3430 when in the locked configuration.

Figure 101:
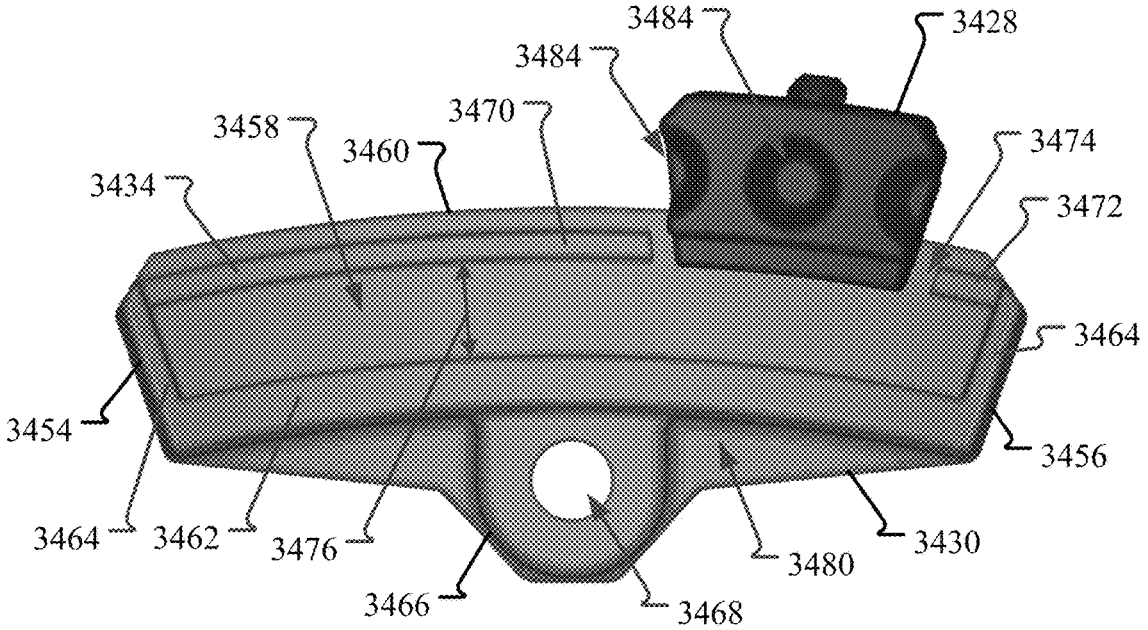
FIG. 101 is an inside surface view of a cover and a weight of the weight assembly shown in FIGS. 97-99.
Figure 102:
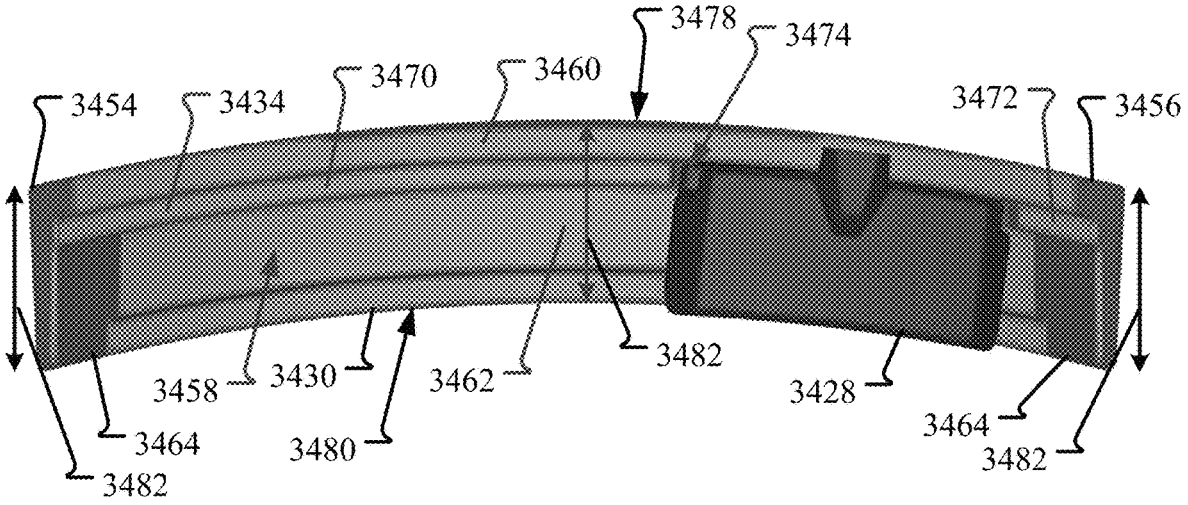
FIG. 102 is a side view of the cover and the weight shown in FIG. 101.

FIG. 101 is an inside surface view of the cover 3430 and the weight 3428 of the weight assembly 3404 (shown in FIGS. 97-99). FIG. 102 is a side view of the cover 3430 and the weight 3428. Referring concurrently to FIGS. 101 and 102, the cover 3430 has a first end 3454 and an opposite second end 3456. A rabbet 3458 is formed on one side of the cover 3430 and extends at least partially between the first end 3454 and the second end 3456. The rabbet 3458 is defined by at least an outer wall 3460 that forms an exterior surface of the cover 3430 and a sidewall 3462 of the cover 3430. The rabbet 3458 is sized and shaped to at least partially receive the weight 3428 and allow the weight 3428 to slide therein. An end wall 3464 is defined at both the first end 3454 and the second end 3456 and define a terminal end of the rabbet 3458. A fastener receiver 3466 is disposed opposite of the rabbet 3458 on the cover 3430 and is configured to support the fastener 3432 (shown in FIGS. 97-99) at an aperture 3468. The fastener 3432 couples the cover 3430 to the body of the club head at the fastener receiver 3466.

The retention rib 3434 projects from the outer wall 3460 within the rabbet 3458 and is elongated extended in a direction between the first end 3454 and the second end 3456 of the cover 3430. The retention rib 3434 is configured to engage the weight 3428 so as to improve the retention of the weight 3428 to the cover 3430. The retention rib 3434 is shaped and sized to be at least partially received within the slit 3435 (shown in FIGS. 98-99) of the weight 3428. This engagement between the weight 3428 and the cover 3430 via the retention rib 3434 enables the weight 3428 to move with the cover 3430 between the locked and unlocked configuration and so that the weight 3428 can be slidably repositioned when in the unlocked configuration. In this example, the retention rib 3434 is discontinuous in the elongated direction so that the weight 3428 can be completely removed from the weight assembly as required or desired.

In the example, the retention rib 3434 can include two discrete sections, a first rib 3470 and a second rib 3472 separated by a gap 3474 that is configured to allow the weight 3428 to be at least partially removably received within the rabbet 3458. As shown in FIG. 101, the retention rib 3434 is disposed proximate a distal end of the outer wall 3460 and on the opposite side of the cover 3430 from the fastener receiver 3466. As such, the retention rib 3434 is spaced 3476 from the sidewall 3462 of the cover 3430. The retention rib 3434 extends from each of the end walls 3464 and the gap 3474 is disposed proximate the second end 3456 of the cover 3430. In another aspect, the gap 3474 can be disposed proximate the first end 3454 of the cover 3430, or proximate a midpoint of the cover 3430. In other aspects, the gap 3474 can be disposed at one of the end walls 3464 such that the retention rib 3434 only extends from one end wall 3464, or more than one gap 3474 can be present within the retention rib 3434. In still another example, two or more parallel retention ribs 3434 can be used as required or desired.

The cover 3430 has an outside surface 3478 that is configured to align with the outer surface of the club head when in the locked configuration, and an opposite inside surface 3480 that faces the recessed channel 3426 (shown in FIG. 100) of the club head. A thickness 3482 of the cover 3430 is defined between the outside surface 3478 and the inside surface 3480 in a direction that is substantially parallel to a fastener axis of the fastener 3432 (shown in FIGS. 97-99). The thickness 3482 of the cover 3430 at the end walls 3464 is substantially equal to the thickness 3482 of the cover 3430 at a midpoint of the rabbet 3458 between the first end 3454 and the second end 3456. As such, the end walls 3464 of the cover 3430 are devoid of any projections and engage directly with the recessed channel 3426 of the club head.

At least one hollow 3484 is defined in the weight 3428 and in a surface that is opposite of the slit 3435 (shown in FIGS. 98-99). The hollow 3484 is sized and shaped to engage with the boss 3448 disposed within the channel 3426 (both shown in FIG. 100). In the example, the hollow 3484 includes a fully defined hollow 3484 and two partially defined hollows 3484 that flank the fully defined hollow 3484. This configuration enables for use of a more elongated weight 3428 while accommodating an increase in the amount of weight positioning locations, e.g., five and as illustrated in the depicted example.

Figure 103:
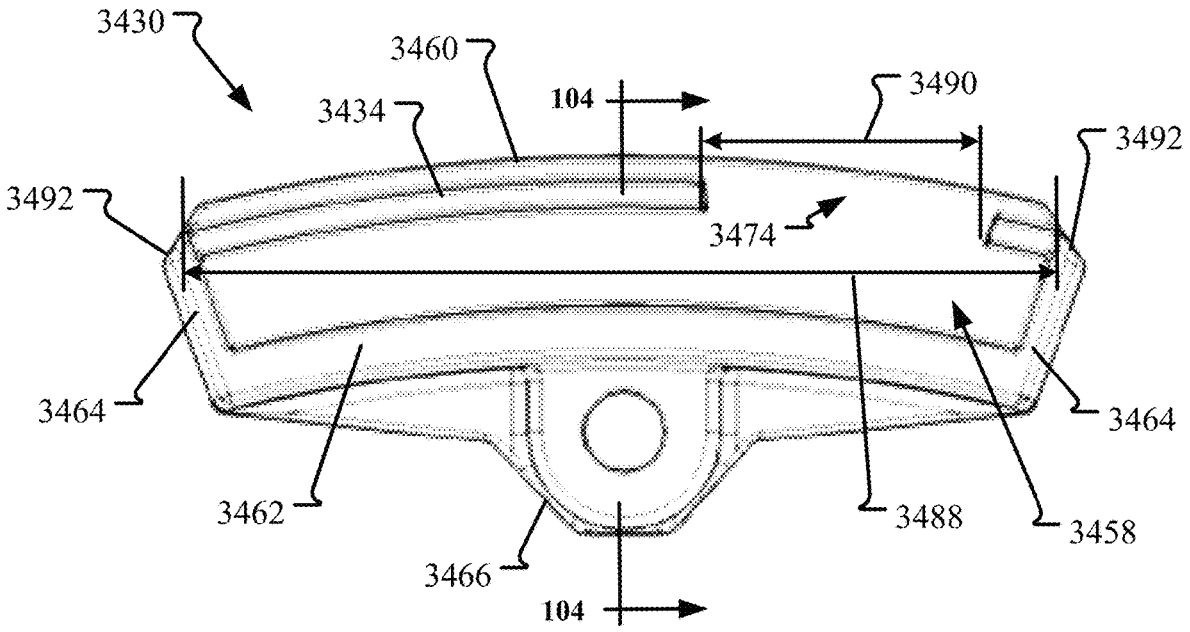
FIG. 103 is another inside surface view of the cover shown in FIG. 101.
Figure 104:
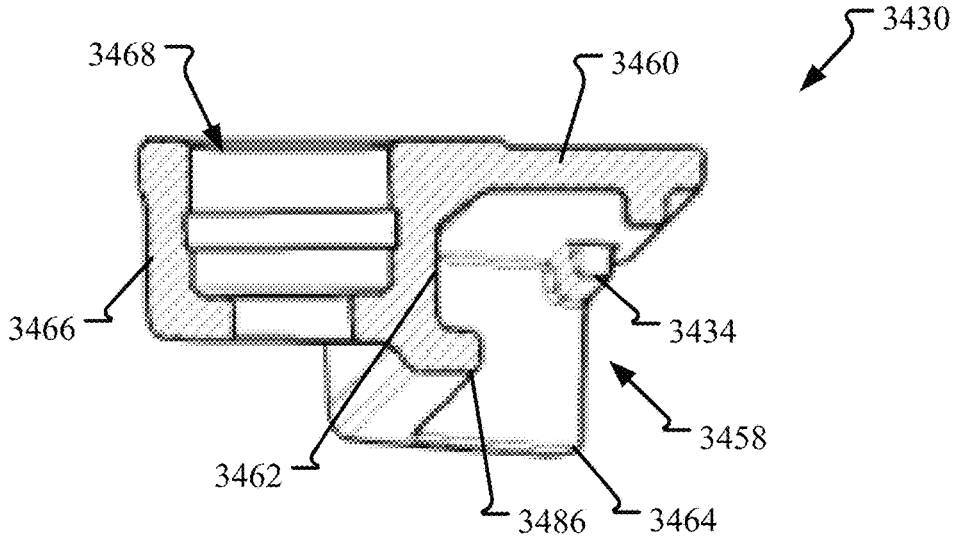
FIG. 104 is a cross-sectional view of the cover taken along line 104-104 in FIG. 103.

FIG. 103 is another inside surface view of the cover 3430. FIG. 104 is a cross-sectional view of the cover 3430 taken along line 104-104 in FIG. 103. Referring concurrently to FIGS. 103 and 104, certain components are described above, and thus, are not necessarily described further. The rabbet 3458 is formed by the outer wall 3460 and the sidewall 3462. The retention rib 3434 is disposed proximate the distal end of the outer wall 3460. A shelf 3486 extends from the distal end of the sidewall 3462 and is configured to at least partially support the weight 3428 (shown in FIGS. 101-102). The retention rib 3434 and the shelf 3486 extend in substantially orthogonal directions. In the example, the retention rib 3434 has a substantially square-shaped cross-section. It should be appreciated that the retention rib 3434 can have any other cross-sectional shape as required or desired.

In this example, the rabbet 3458 has a length 3488 that is defined between the end walls 3464 at the first and second ends of the cover 3430. The gap 3474 of the retention rib 3434 also has a length 3490 that is defined between the two sections of the rib. In an example, the length 3488 of the rabbet 3458 is between about two to four times the length 3490 of the gap 3474. In an aspect, the length 3488 of the rabbet 3458 is about three times the length 3490 of the gap 3474. As shown in FIG. 103, the retention rib 3434 has an arcuate shape in plan view that corresponds to the elongated shape of the rabbet 3458 defined within the cover 3430.

The end walls 3464 at each end of the cover 3430 have their inner surface aligned with the inner surface of the sidewall 3462 such that the end walls 3464 directly engage with the recessed channel 3426 (shown in FIG. 100) without the use of projections. Each end of the cover 3430 also includes a chamfer 3492 that corresponds to the oblique walls 3452 (shown in FIG. 100) of the channel 3426 which enables the ends of the cover to securely engage with the club head in the locked configuration and reduce weight rattling therein.

Figure 105:
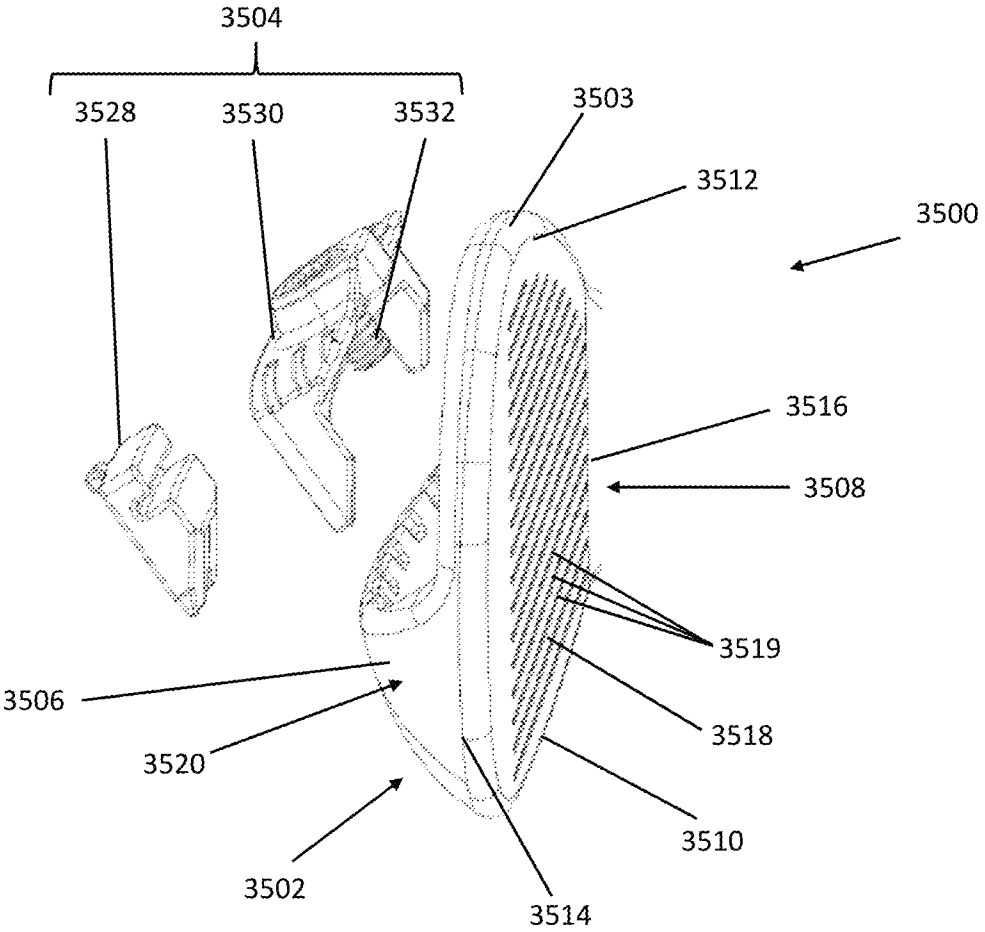
FIG. 105 is a partially exploded, perspective view of an iron-type golf club head with another weight assembly.
Figure 106:
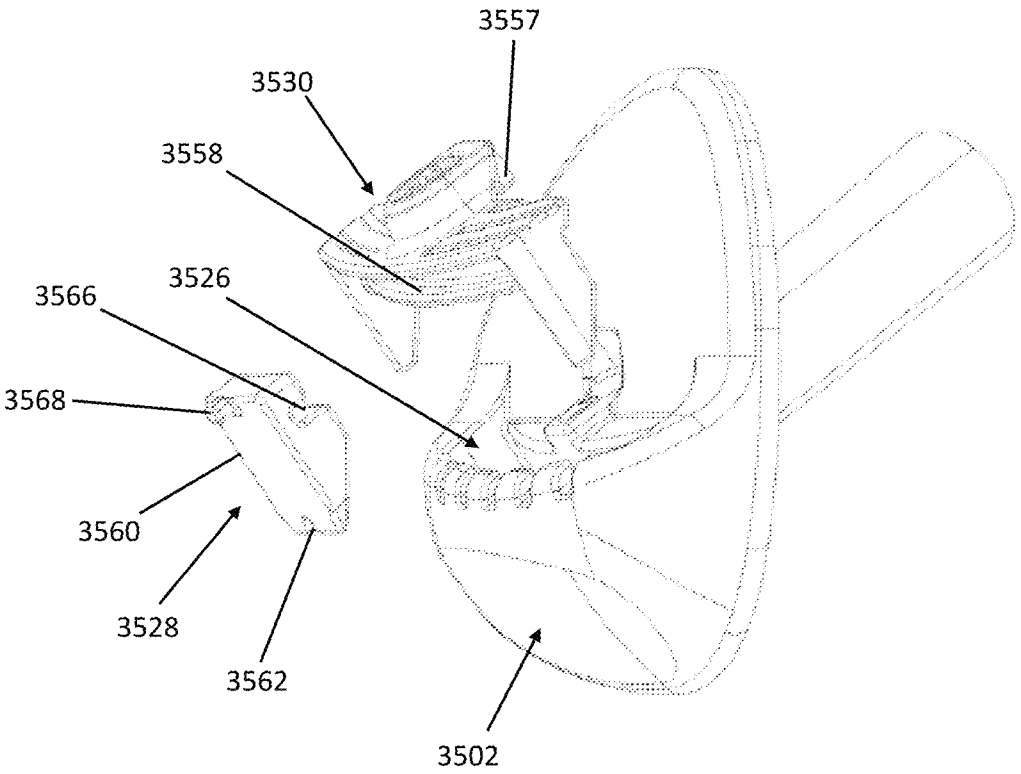
FIG. 106 is another partially exploded, perspective view of the golf club head of FIG. 105.
Figure 107:
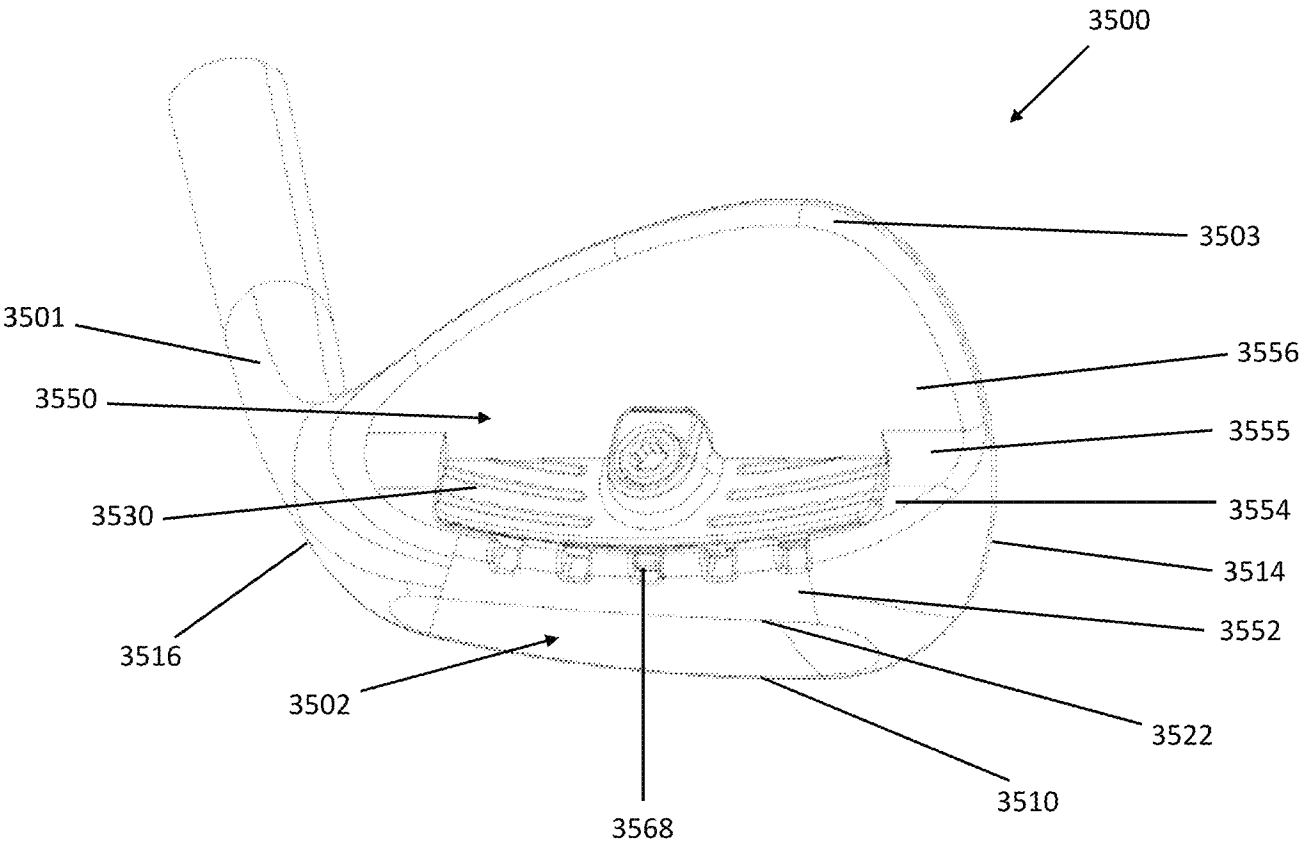
FIG. 107 is a back view of the golf club head of FIG. 105 with the weight assembly in a locked configuration.
Figure 108:
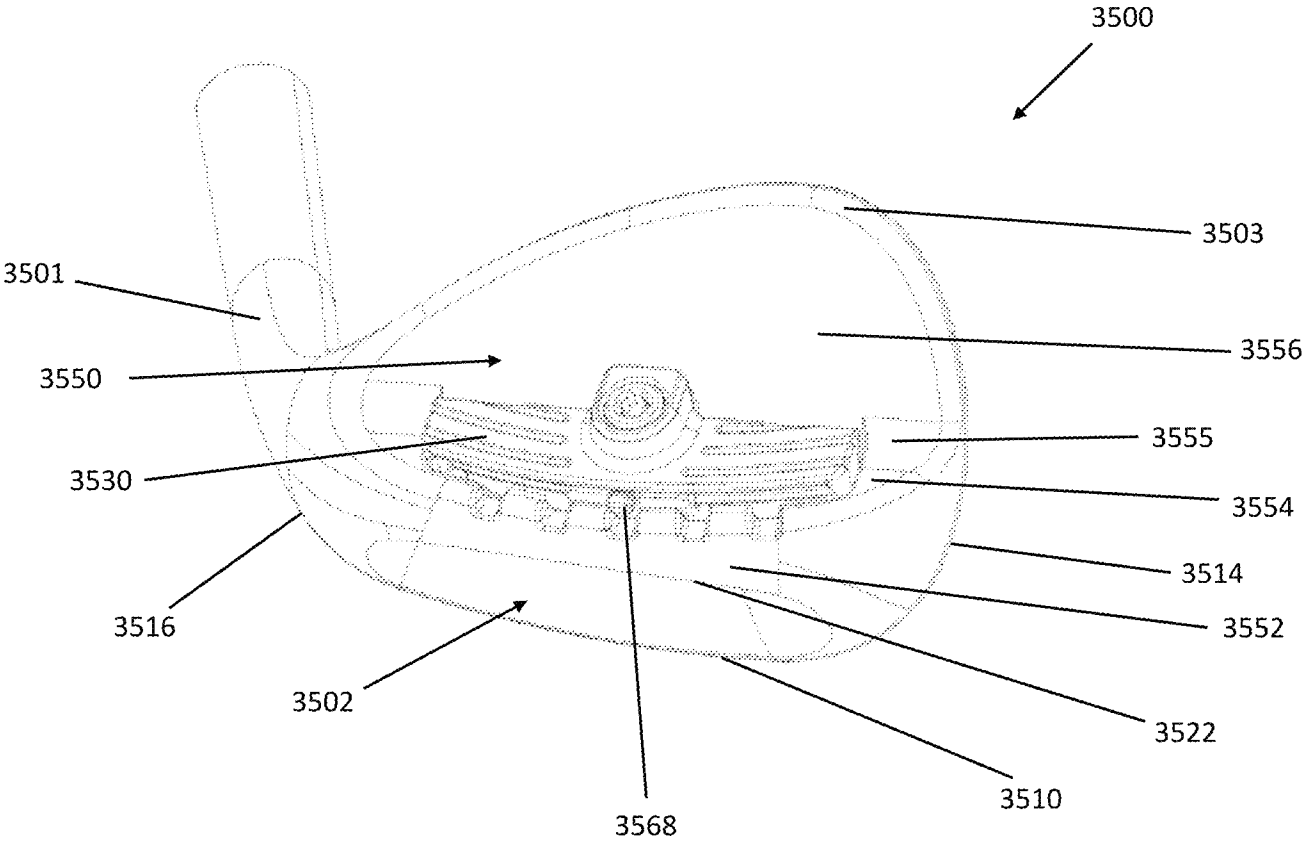
FIG. 108 is another back view of the golf club head of FIG. 105 with the weight assembly in an unlocked configuration.
Figure 109:
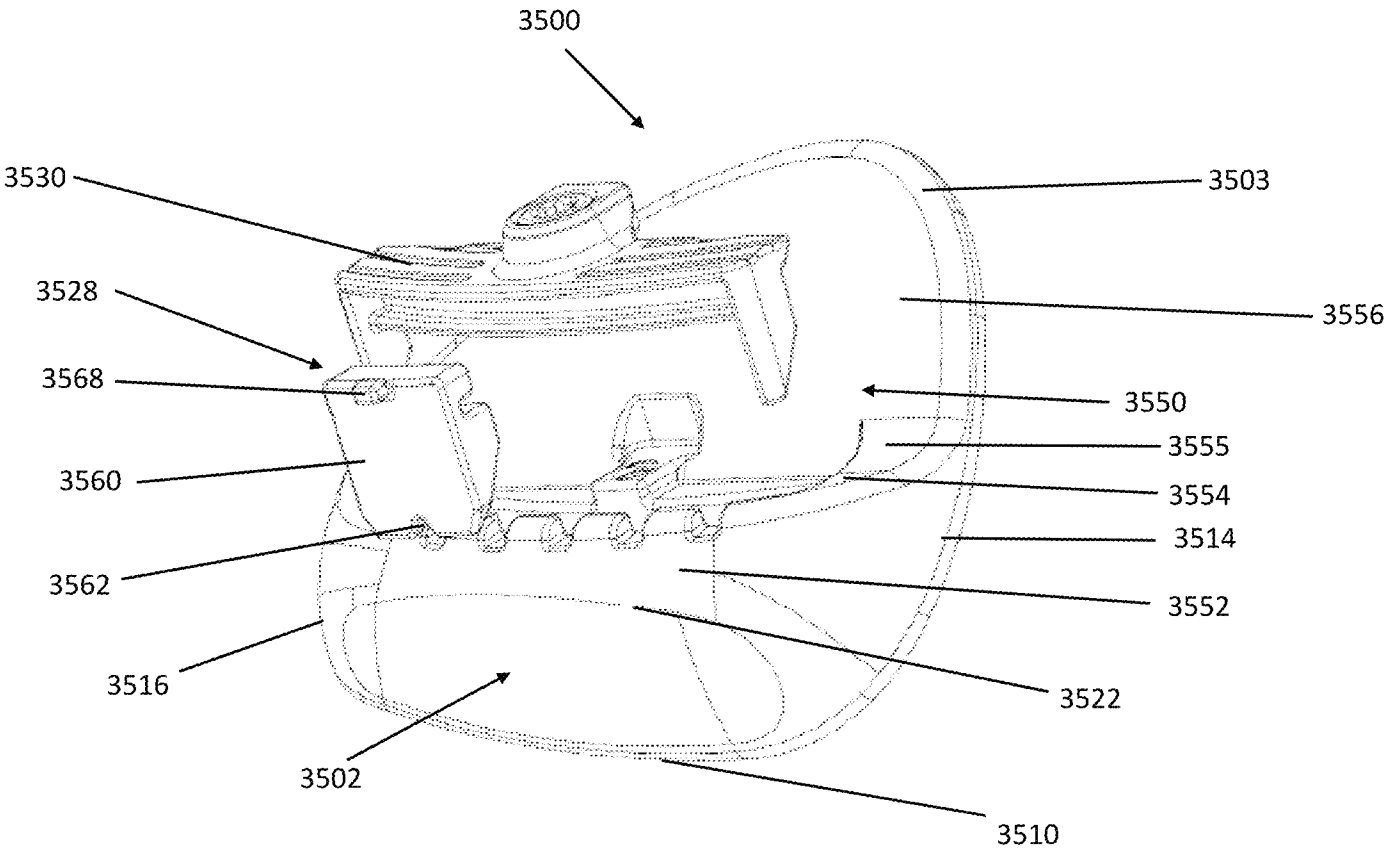
FIG. 109 is another partially exploded, perspective view of the golf club head of FIG. 105.
Figure 110:
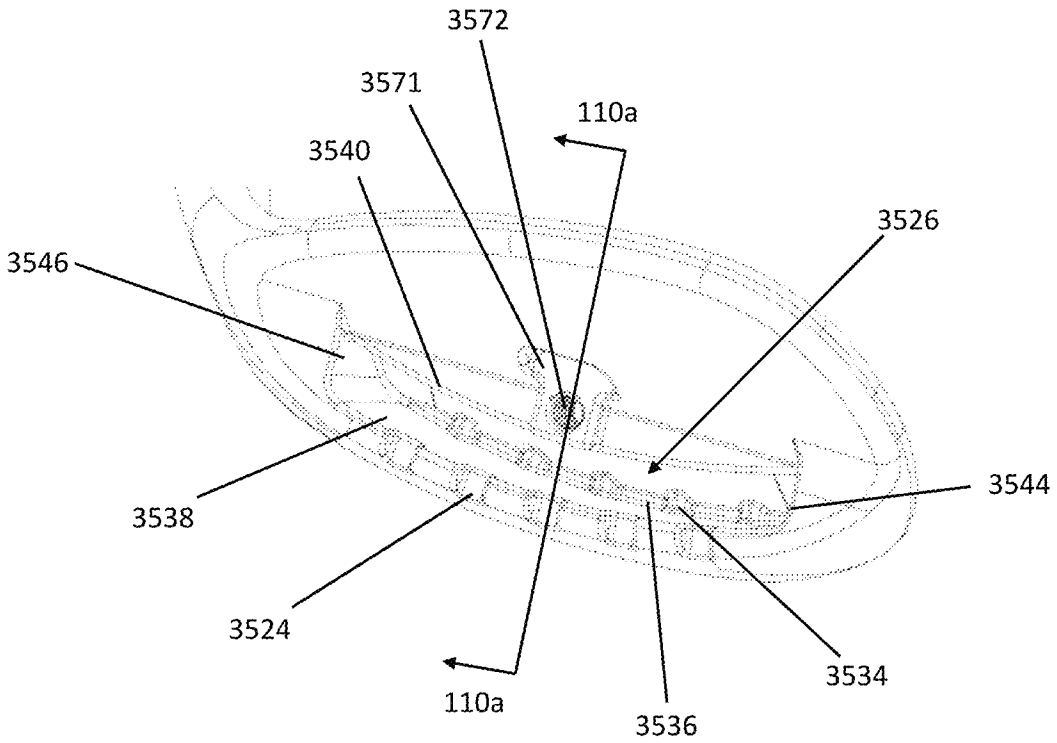
FIG. 110 is a top view of the golf club head of FIG. 105 without the weight assembly.

FIG. 105 is a partially exploded, perspective view of an iron-type golf club head 3500 with another weight assembly 3504. In particular, the golf club head 3500 is a wedge type golf club head. FIG. 106 is another partially exploded, perspective view of the golf club head 3500 of FIG. 105. FIG. 107 is a back view of the golf club head 3500 of FIG. 105 with the weight assembly 3504 in a locked configuration. FIG. 108 is another back view of the golf club head 3500 of FIG. 105 with the weight assembly 3504 in an unlocked configuration. FIG. 109 is another partially exploded, perspective view of the golf club head 3500 of FIG. 105. FIG. 110 is a top view of the golf club head 3500 of FIG. 105 without the weight assembly 3504. FIG. 111 is a cross-sectional view in the toe-to-heel direction of the golf club head 3500 of FIG. 105 taken along line **110*a*-110*a* in FIG. 110 and with the weight assembly 3504 in the locked configuration. FIG. 112 is a cross-sectional view in the toe-to-heel direction of the golf club head 3500 of FIG. 105 taken along line 110***a*-110*a* in FIG. 110 and with the weight assembly 3504 in the unlocked configuration. In FIG. 111 and FIG. 112, the golf club head is shown with the loft being perpendicular to the ground plane, which is different from the setup at an address position that usually has the shaft that is vertical to the ground plane. The address position, as defined by the current application, sets up the golf club head at an orientation that has a lie angle of 60 degrees similar to the requirements of the USGA. Once the lie angle is set at 60 degrees, the face angle of the golf club head is set to be square, which is defined as having a face angle of 0 degrees.

Referring concurrently to FIGS. 105-112, the golf club head 3500 is an iron-type golf club head. The iron-type golf club head may be, for example, a wedge-type golf club head. The golf club head 3500 includes a body 3506 having a striking face 3508 with a lower leading edge 3510 and an opposite upper topline edge 3512 extending between a toe 3514 and a heel 3516. The striking face 3508 may have multiple grooves 3519 formed therein to help impart spin on a golf ball when struck by the striking face. The body 3506 has a sole 3502 extending from the lower leading edge 3510 on the bottom side of the golf club head 3500 to a rearward portion 3522 of the sole 3502. The rearward portion 3522 may be defined as an edge or corner on the body 3506. A back portion 3550 is between the rearward portion 3522 of the sole 3502 and the top portion 3503. The back portion 3550 comprises all surfaces of an outer surface 3520 of the body 3506 of the golf club head 3500 that are both between the rearward portion 3522 of the sole 3502 and the top portion 3503 and also between the toe 3514 and the heel 3516. Specific examples of the back portion 3550 will be described in more detail below. A top portion 3503 of the body 3506 is coupled between the upper topline edge 3512 and the back portion 3550. In some embodiments, the top portion 3503 is a thin surface. In some other embodiments, the top portion 3503 is not present, and the upper topline edge 3512 may be directly connected to the back portion 3550. The striking face 3508, the sole 3502, the back portion 3550, and the top portion 3503 are coupled together so as to define at least part of the outer surface 3520 of the body 3506. A hosel 3501 is disposed at the heel 3516 and is configured to couple to a shaft (not shown).

A recessed channel 3526 is defined in the outer surface 3520 of the body 3506, and in particular, in the back portion 3550. The channel 3526 extends along the toe 3514—heel 3516 direction so that the CG and the MOI of the golf club head 3500 can be adjusted for fade-draw bias. The weight assembly 3504 is adapted to be coupled to the body 3506 at the channel 3526. The weight assembly 3504 includes a weight 3528 disposed at least partially within the channel 3526 and configured to be movable along the toe 3514—heel 3516 direction within the channel 3526, a cover 3530 that extends at least partially over the channel 3526 and is adapted to releasably secure the weight 3528 in the channel 3526, and a fastener 3532 configured to couple the cover 3530 to the body 3506. The fastener 3532 retains the weight 3528 in the recessed channel 3526 only indirectly via the cover 3530. The fastener 3532 can therefore be used to secure the weight 3528 in the channel 3526 or to release the weight 3528 so that the weight 3528 can be moved at least along the toe 3514—heel 3516 direction in the channel 3526. As used herein, references to movement along the toe-heel direction includes along the heel-toe direction as well.

The weight assembly 3504 is configured to move between at least two positions via the fastener 3532, for example, a locked configuration as shown in FIGS. 107 and 111, and an unlocked configuration as shown in FIGS. 108 and 112. In some embodiments, the weight assembly 3504 may also be configured to move to a weight removable configuration in which the weight assembly 3504 may be removed entirely from channel 3526. In other embodiments, however, the fastener 3532 may be configured to not allow the weight assembly 3504 to be removed entirely from channel 3526, so as to prevent the weight 3528 from being accidentally lost, among other reasons. In the locked configuration, the cover 3530 is at least partially disposed within the recessed channel 3526 so that its movement is restricted. When the weight assembly 3504 is in the locked configuration, the weight 3528 is disposed in the channel 3526, and the position of the weight 3528 is secured by the cover 3530 so that it cannot move. The locked configuration may be used when a golf club including the golf club head 3500 is being swung so that the CG and the MOI of the golf club head 3500 is set during the swing. The fastener 3532 is selectively moveable along a fastener axis 3570 (see FIGS. 111 and 112). The fastener 3532 may be coupled to the cover 3530 with a retaining clip 3533 so that the fastener 3532 can rotate around the fastener axis 3570 and relative to the cover 3530. Accordingly, the fastener 3532 and the cover 3530 are coupled together so that the cover 3530 moves with the fastener 3532 along the fastener axis 3570.

In other embodiments, the retaining clip 3533 may not be present so that the cover 3530 does not necessarily move with the fastener 3532 when the fastener 3532 moves. However, in such embodiments, when the fastener 3532 is partially moved to a raised position to at least partially release the cover 3530, the cover 3530 may be moveable along the fastener axis 3570 to the extent that the fastener 3532 has been moved.

The weight assembly 3504 is moved from the locked configuration to the unlocked configuration by adjusting the position of the fastener 3532 to the raised position so that the weight 3528 is released and can move inside the channel 3526 at least along the toe 3514—heel 3516 direction and relative to the body 3506 and cover 3530. The unlocked configuration may be used to adjust the CG and MOI of the golf club head 3500 when a golf club including the golf club head 3500 is not being swung.

The weight assembly 3504 may be moved from the unlocked configuration to the weight removable configuration by further adjusting the position of the fastener 3532 to a position high enough so that the weight 3528 can be removed from the channel 3526 and/or decoupled from the cover 3530. In some embodiments, the weight assembly 3504 may be entirely decoupled from the body 3506 in the weight removable configuration. The weight removable configuration may be used to allow the weight 3528 to be replaced. For example, a plurality of weights having different masses may be usable with the weight assembly 3504, and the weights having different masses may be interchanged for greater control of the CG and MOI of the golf club head 3500.

In this nonexclusive example, and as shown for example in FIG. 107, the back portion 3550 includes a lower back surface 3552 coupled between the rearward portion 3522 of the sole 3502 and the top portion 3503, a first back surface 3554 coupled between the lower back surface 3552 and the top portion 3503, an intermediate surface 3555 coupled between the first back surface 3554 and the top portion 3503, and a second back surface 3556 coupled between the intermediate surface 3555 and the top portion 3503.

The lower back surface 3552 may be substantially flat in some embodiments. In some other embodiments, the lower back surface 3552 may be substantially flat except for a curve along the toe 3514—heel 3516 direction. A height (when viewed in the orientation of FIG. 105) of the lower back surface 3552 may be the lowest among heights of the lower back surface 3552, the first back surface 3554, the intermediate back surface 3555, and the second back surface 3556. In some embodiments, the lower back surface 3552 may not be present, and the first back surface 3554 may extend from the rearward portion 3522 of the sole 3502.

The first back surface 3554 may be substantially flat and may extend from an edge of the lower back surface 3552 distal to the rearward portion 3522 toward the intermediate surface 3555 along a direction such that at least part of a virtual extension of the first back surface 3554 intersects the striking face 3508. The first back surface 3554 may also extend towards (e.g., may extend along a direction to be closer to) the upper topline edge 3512 of the golf head club 3500.

The intermediate back surface 3555 may be a curved or substantially flat surface extending from an edge of the first back surface 3554 distal to the lower back surface 3552 to the second back surface 3556. In some embodiments, the intermediate back surface 3555 is not present, and the second back surface 3556 extends from the first back surface 3554.

The second back surface 3556 may be substantially flat and parallel to the striking face 3508. The second back surface 3556 extends from an edge of the intermediate back surface 3555 distal to the first back surface 3554 to the top portion 3503. The first and second surfaces 3554 and 3556 generally form an obtuse angle. For example, an obtuse angle may be formed where virtual extensions of the first and second surfaces 3554 and 3556 meet.

Although the back portion 3550 has been described as including the lower back surface 3552, the first back surface 3554, the intermediate back surface 3555, and the second back surface 3556, and the recessed channel 3526 has been described as being formed in the first back surface 3554, embodiments of the present disclosure are not limited thereto. The back portion 3550 may include any one or more of the lower back surface 3552, the first back surface 3554, the intermediate back surface 3555, and the second back surface 3556. Although lower back surface 3552, the first back surface 3554, the intermediate back surface 3555, and the second back surface 3556 have been illustrated and described as having certain features, the lower back surface 3552, the first back surface 3554, the intermediate back surface 3555, and the second back surface 3556 are not limited thereto. These features are provided for purpose of describing example embodiments, not for purpose of limitation. Furthermore, the recessed channel 3526 may be formed in any one or more surfaces included in the back portion 3550.

In this example, and as shown for example in FIG. 110, the recessed channel 3526 is formed in the back portion 3550, for example, in the first back surface 3554. A fastener receiver 3572 adapted to receive and engage with the fastener 3532 is also defined in the back portion 3550, for example, at a junction between the first and second surfaces 3554 and 3556 or at the intermediate back surface 3555. A fastener cutout 3571 is formed around the fastener receiver 3572 and is shallower than the fastener receiver 3572. The fastener cutout 3571 forms a hollow in the second back surface 3556. The cover 3530 includes a positioner protrusion 3557 having a shape and size corresponding to the fastener cutout 3571 so that the positioner protrusion 3557 can engage with the fastener cutout 3571 to at least partially define the position of the cover 3530 in the locked configuration and, in some embodiments, the unlocked configuration.

The channel 3526 has first and second opposing sidewalls 3538 and 3540 that extend along the toe 3514—heel 3516 direction. The second sidewall 3540 is adjacent to the fastener receiver 3572 and the first sidewall 3538 is adjacent to the rearward portion 3522 of the sole 3502. The channel 3526 also has toe and heel opposing end walls 3544 and 3546, where the toe end wall 3544 is adjacent to the toe 3514 and the heel end wall 3536 is adjacent to the heel 3516. The channel 3526 has a bottom track 3536 offset from the outer surface 3520 of the body 3506 and disposed both between the first and second sidewalls 3538 and 3540 and also between the toe and heel end walls 3544 and 3546.

The body 3506 includes multiple locating lugs 3534 on the bottom track 3536. The locating lugs 3534 protrude from the bottom track 3536 towards an opening of the recessed channel 3526. As shown in FIG. 109, the weight 3528 has a bottom indent 3562 shaped and sized to allow the weight 3528 to selectively engage with the locating lugs 3534 to thereby at least partially define the position of the weight 3528 in the recessed channel 3526. The first sidewall 3538 has multiple dimples 3524 at a top of the first sidewall 3524 at the opening of the recessed channel 3526. The dimples 3524 are cutouts or hollows in the first sidewall 3538 and have positions arranged along the toe 3514—heel 3516 direction that respectively correspond to the locating lugs 3534. The weight 3528 comprises a main body 3560 and a position indicator 3568 that protrudes from the main body 3560. The position indicator 3568 is shaped and sized to selectively engage with the dimples 3524 to visually indicate the position of the weight 3528 inside the channel 3526. In the locked configuration, the cover 3530 may cover and conceal the main body 3560 of the weight 3528, but the position indicator 3568 may extend from under the cover 3568 and be positioned at least partially in one of the dimples 3524. In the locked configuration, between 0% and 30% of an outer surface of the weight 3528 is visible.

As shown in FIGS. 111 and 112, the cover 3530 includes a flange 3558, and the weight 3528 has a groove 3566 shaped and sized to receive at least part of the flange 3558 to slidingly engage the weight 3528 with the cover 3530. Accordingly, when the weight assembly 3504 is in the unlocked configuration, the weight 3528 is able to slide back and forth inside the recessed channel 3526.

As shown in FIGS. 111 and 112, the striking face 3508 has an outermost surface 3518 and a plurality of grooves 3519, each having a longitudinal axis extending along the toe 3514— heel 3516 direction. The outermost surface 3518 may be substantially flat except for the grooves 3519. A striking face plane 3580 is tangential to the outermost surface 3518 and extends beyond the bounds of the striking face 3508 itself. In the example toe-to-heel cross-sectional views of FIG. 111 and FIG. 112, a Y coordinate is defined as extending up and down (generally top to bottom), a Z coordinate is defined as extending left and right (generally front to back), and an X coordinate is defined as extending into and out of the page (generally toe-to-heel). In the examples of FIG. 111 and FIG. 112, with the club head 3500 oriented as shown, the striking face plane 3580 is within the X-Y plane, and the Z axis is orthogonal to the striking face plane (the X-Y plane, as depicted). In examples, the fastener axis 3570, which includes a virtual extension of an axis along which the fastener 3532 moves between a locked and unlocked position, intersects the striking face plane 3580. In some examples, the intersection of the fastener axis 3570 and the striking face plane 3580 occurs at a point closer to the lower leading edge 3510 of the striking face 3508 than to the upper topline edge 3512 of the striking face 3508. In some embodiments, the fastener axis 3570 intersects the striking face 3508 itself. In some other embodiments, the fastener axis 3570 does not intersect the striking face 3508 but still intersects the striking face plane 3580 closer to the lower leading edge 3510 than the upper topline edge 3512, e.g., at a point below the lower leading edge 3510.

A fastener angle 3584 of the fastener axis 3570 may be measured in a cross-sectional plane. For example, as used herein, the cross-sectional plane is a plane that is orthogonal to the longitudinal axis of at least one groove 3519 (such as the groove 3519A nearest to the lower leading edge 3510, or the groove 3519B that is second-nearest to the lower leading edge 3510). That is, the longitudinal axis of the at least one groove 3519 may be normal to the cross-sectional plane. In the examples of FIGS. 111 and 112, the cross-sectional plane is depicted as the Y-Z plane. The fastener axis 3570 forms the fastener angle 3584 with the striking face plane 3580 in the cross-sectional plane. It is recognized that the fastener axis 3570 may not lie entirely within the cross-sectional plane (here, the Y-Z plane), and the vector of the fastener axis 3570 may include some component in the X direction (e.g., the fastener axis 3570 may tilt in a toe 3514— heel 3516 direction); however, as used herein, the fastener angle 3584 is measured only in the cross-sectional plane, ignoring any toe-to-heel (or "X") component of the vector defining the fastener axis 3570. The fastener angle 3584 is defined in the cross-sectional plane and is measured in a counter-clockwise direction from the striking face plane 3580 to the fastener axis 3570 when the cross-sectional plane is viewed in a toe-to-heel direction, as shown in FIGS. 111 and 112. The fastener angle 3584 may range from about 0 degrees to about 90 degrees. For example, the fastener angle 3584 of the fastener axis 3570 relative to the striking face plane 3580 may be from about 5 degrees to about 85 degrees, about 10 degrees to about 80 degrees, about 15 degrees to about 75 degrees, about 20 degrees to about 70 degrees, about 25 degrees to about 65 degrees, about 30 degrees to about 60 degrees, about 35 degrees to about 55 degrees, about 40 degrees to about 50 degrees, or about 45 degrees. In further examples, the fastener angle of the fastener axis 3570 relative to the striking face plane 3580 may be non-negative and may be less than about 80 degrees, less than about 70 degrees, less than about 60 degrees, less than about 50 degrees, less than about 45 degrees, less than about 40 degrees, less than about 30 degrees, less than about 20 degrees, less than about 10 degrees, less than about 5 degrees, or about zero degrees. In other examples, the fastener angle 3584 of the fastener axis 3570 relative to the striking face plane 3580 may even be negative, depending on the configuration of the back portion 3550 of the club-head 3500, for example, about 0 degrees to about −5 degrees, about 0 degrees to about −10 degrees, about 0 degrees to about −20 degrees, about 0 degrees to about −30 degrees, or about 0 degrees to about −45 degrees. The foregoing recited ranges of the fastener angle 3584 are non-limiting example ranges, and the fastener angle 3584 may be within any range subsumed within the range of −45 degrees to about 135 degrees, for example, about 28 degrees to about 63 degrees or about 85 degrees to about 115 degrees. By forming the recessed channel 3526, and disposing the weight assembly 3504, in the back portion 3550 of the iron-type golf club head 3500 instead of in the sole 3502, interaction between the weight assembly 3504 and the ground may be reduced when a golf club including the golf club head 3500 is swung. Accordingly, dirt and other materials may be substantially prevented from entering into the recessed channel 3526 and interfering with the weight assembly 3504.

In examples, the fastener 3532 may have a height that can be measured in the cross-sectional plane along the direction from the lower leading edge 3510 to the upper leading edge 3512. In examples, the height of the fastener 3532 increases when the weight assembly 3504 moves from the locked configuration to the unlocked configuration.

Figure 113:
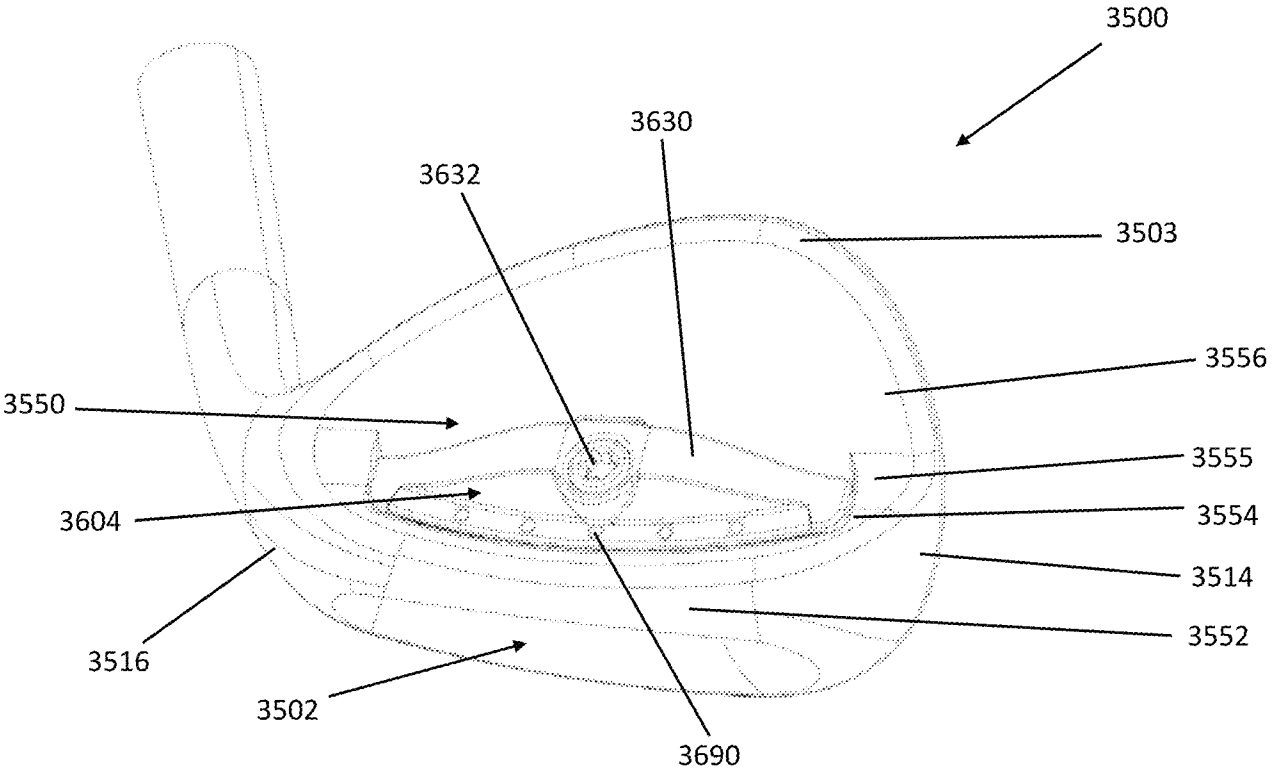
FIG. 113 is a back view of a golf club head with another weight assembly in the locked configuration.

FIG. 113 is a back view of a golf club head 3500 with another weight assembly 3604 in the locked configuration. The golf club head 3500 of the embodiment illustrated in FIG. 113 may include some features similar to, or the same as, features illustrated and described above with respect to the golf club head 3500 of FIGS. 105-112. Certain components are described above, and thus, are not necessarily described further. Referring to the example of FIG. 113, the golf club head 3500 has a body including a toe 3514, a heel 3516, a top portion 3503, a striking face (not shown), a sole 3502, and a back portion 3550. The back portion 3550 includes a lower back surface 3552, a first back surface 3554, an intermediate back surface 3555, and a second back surface 3556. A recessed channel (not shown) is formed in the first back surface 3554, and the weight assembly 3604 is couplable to the body of the golf club head 3500 at the recessed channel. The weight assembly 3604 includes a weight (not shown), a cover 3630, and a fastener 3632.

In this example, the weight assembly 3604 is similar to weight assembly 3504, except that when the weight assembly 3604 is in the locked configuration, the cover 3630 entirely covers the weight and the recessed channel, including a bottom track (not shown) of the recessed channel. In examples, the cover 3630 may comprise one or more see-through openings 3690 to provide an indication of where the weight is located within the recessed channel. For example, the body of the golf club head 3500 may have a plurality of locating lugs (similar to the locating lugs 3534 shown in FIG. 110) at a bottom track of the recessed channel to engage with the weight and at least partially define the position of the weight when the weight assembly 3604 is in the locked configuration, and the cover 3630 may include a plurality of see-through openings 3690 at positions respectively corresponding to the plurality of locating lugs. In examples, the weight may be adapted to slidingly engage with a flange on the cover 3730 (e.g., similar to how the weight 3528 in the embodiment shown in FIG. 106 is adapted to slidingly engage with the flange 3558 of the cover 3530), may be adapted to slidingly engage with a rail on the body (e.g., a rail protruding from the bottom track or from a sidewall of the recessed channel), or may not be adapted to slidingly engage with either the cover or the body. The weight assembly 3604 may include one or more of the weight assembly features described herein to enable the CG and the MOI of the golf club head 3500 to be adjustable for fade-draw bias, while securing the weight in the locked configuration indirectly by the cover 3630. In examples, faster 3632 forms a fastener angle measured in a cross-sectional plane with respect to a striking face and/or striking face plane of the golf club head 3500 in the manner described above with respect to weight assembly 3504.

Figure 114:
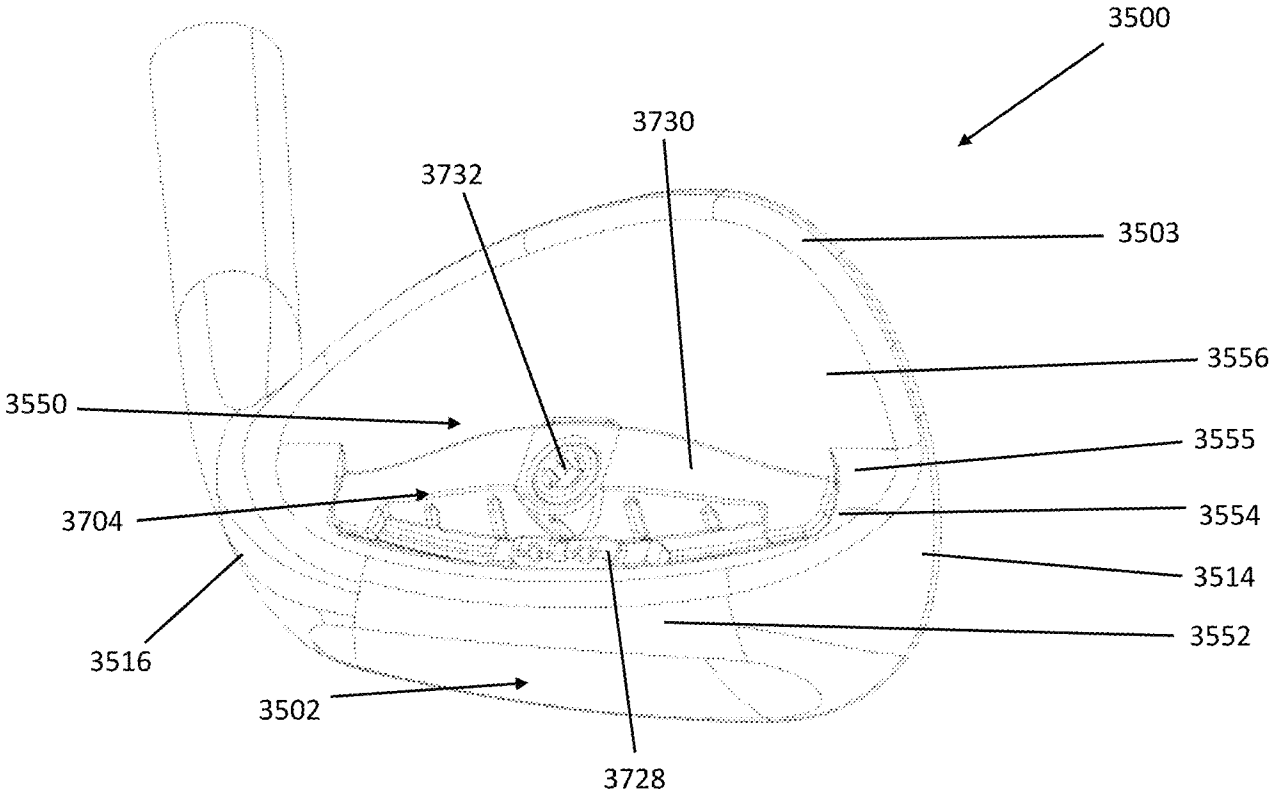
FIG. 114 is a back view of a golf club head with another weight assembly.
Figure 115:
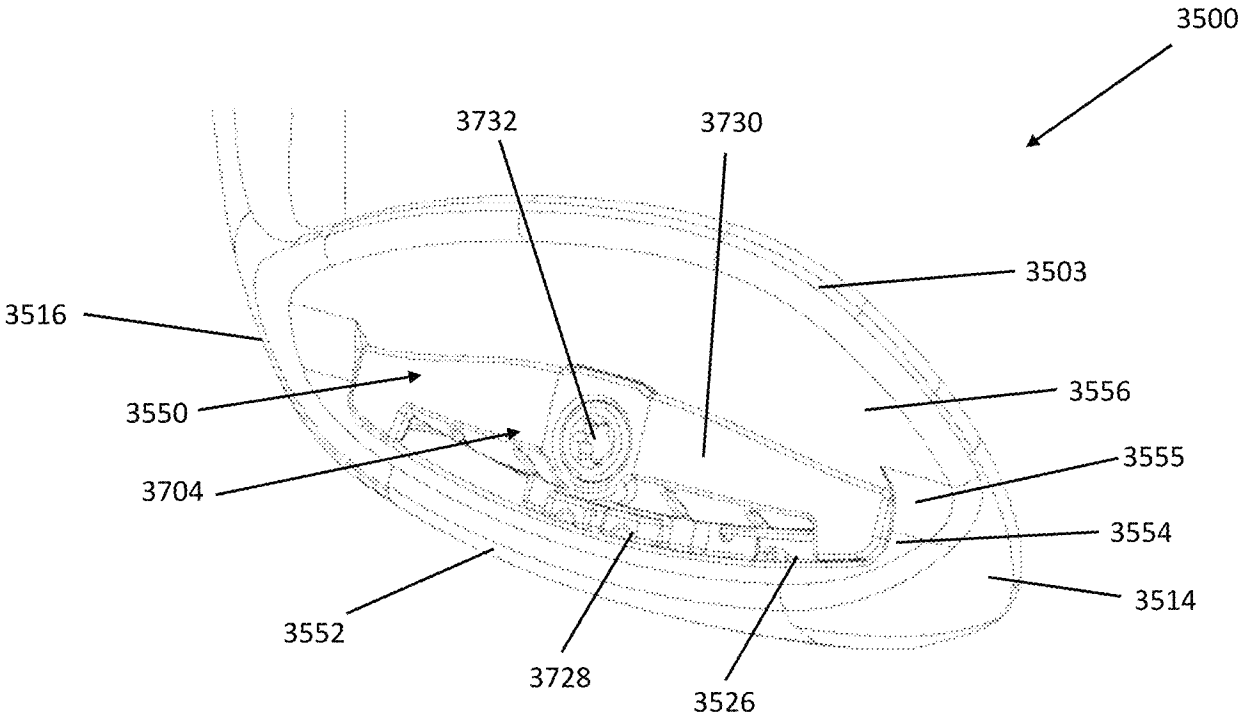
FIG. 115 is a top view of the golf club head of FIG. 114.

FIG. 114 is a back view of a golf club head 3500 with another weight assembly 3704, and FIG. 115 is a top view of the golf club head 3500 of FIG. 114. The golf club head 3500 of the embodiment illustrated in FIGS. 114 and 115 may include some features similar to, or the same as, features illustrated and described above with respect to the golf club head 3500 of FIGS. 105-112. Certain components are described above, and thus, are not necessarily described further. Referring to the example of FIGS. 114 and 115, the golf club head 3500 has a body including a toe 3514, a heel 3516, a top portion 3503, a striking face (not shown), a sole 3502, and a back portion 3550. The back portion 3550 includes a lower back surface 3552, a first back surface 3554, an intermediate back surface 3555, and a second back surface 3556. A recessed channel 3526 is formed in the first back surface 3554, and the weight assembly 3604 is couplable to the body of the golf club head 3500 at the recessed channel 3526. The weight assembly 3704 includes a weight 3728, a cover 3730, and a fastener 3732.

In this example, when the weight assembly 3704 is in the locked configuration, the cover 3730 exposes at least part of the weight 3728 and at least part of the recessed channel (e.g., at least part of a bottom track of the recessed channel 3526). For example, the cover 3730 may have a cutout portion overlapping at least part of the recessed channel 3526 while still allowing the cover 3730 to releasably secure the weight 3728 in the recessed channel 3526. Accordingly, a position of the weight 3728 in the recessed channel 3526 when the weight assembly 3704 is in the locked configuration may be visible through the cutout portion of the cover 3730. In examples, the weight 3728 may be adapted to slidingly engage with a flange on the cover 3730 (e.g., similar to how the weight 3528 in the embodiment shown in FIG. 106 is adapted to slidingly engage with the flange 3558 of the cover 3530), may be adapted to slidingly engage with a rail on the body (e.g., a rail protruding from the bottom track or from a sidewall of the recessed channel), or may not be adapted to slidingly engage with either the cover 3730 or the body. The weight assembly 3704 may include one or more of the weight assembly features described herein to enable the CG and the MOI of the golf club head 3500 to be adjustable for fade-draw bias, while securing the weight 3728 in the locked configuration. In examples, the faster 3732 forms a fastener angle measured in a cross-sectional plane with respect to a striking face and/or striking face plane of the golf club head 3500 in the manner described above with respect to weight assembly 3504.

Figure 116:
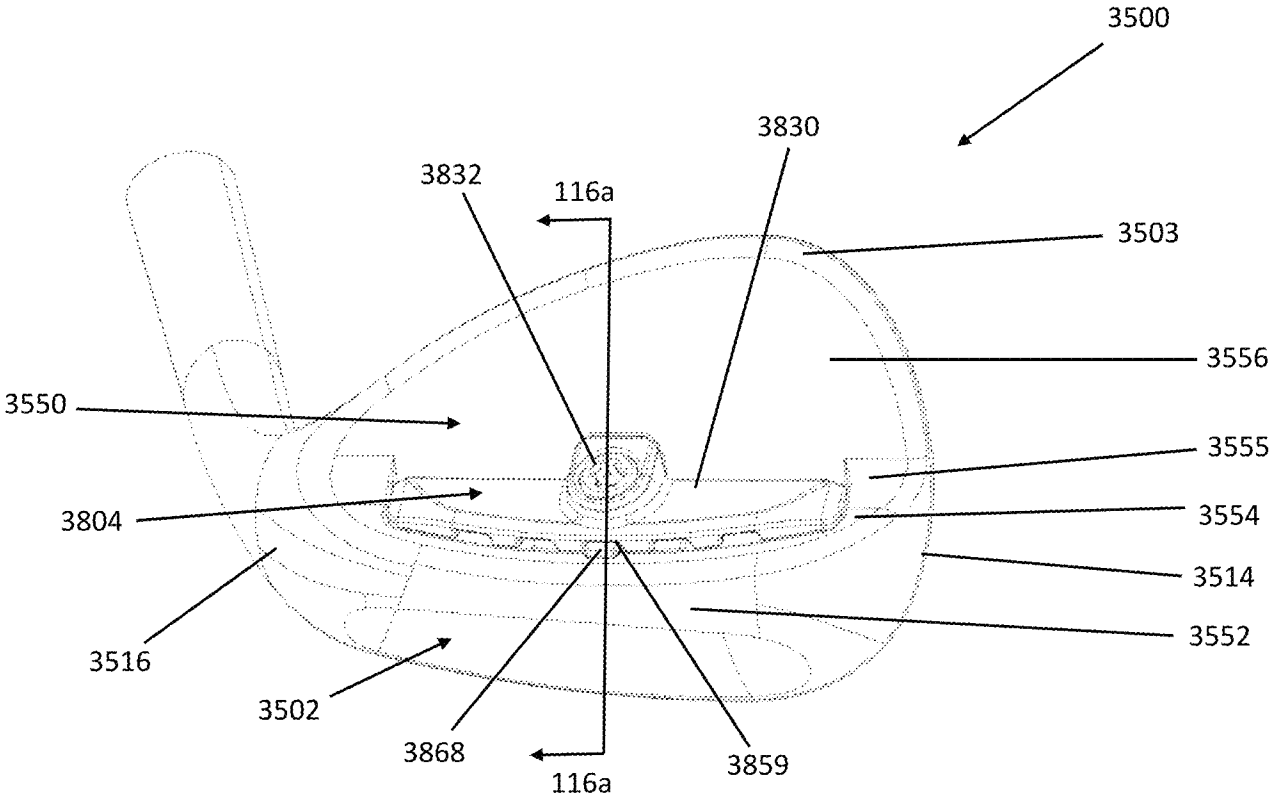
FIG. 116 is a back view of a golf club head with another weight assembly in the locked configuration.
Figure 117:
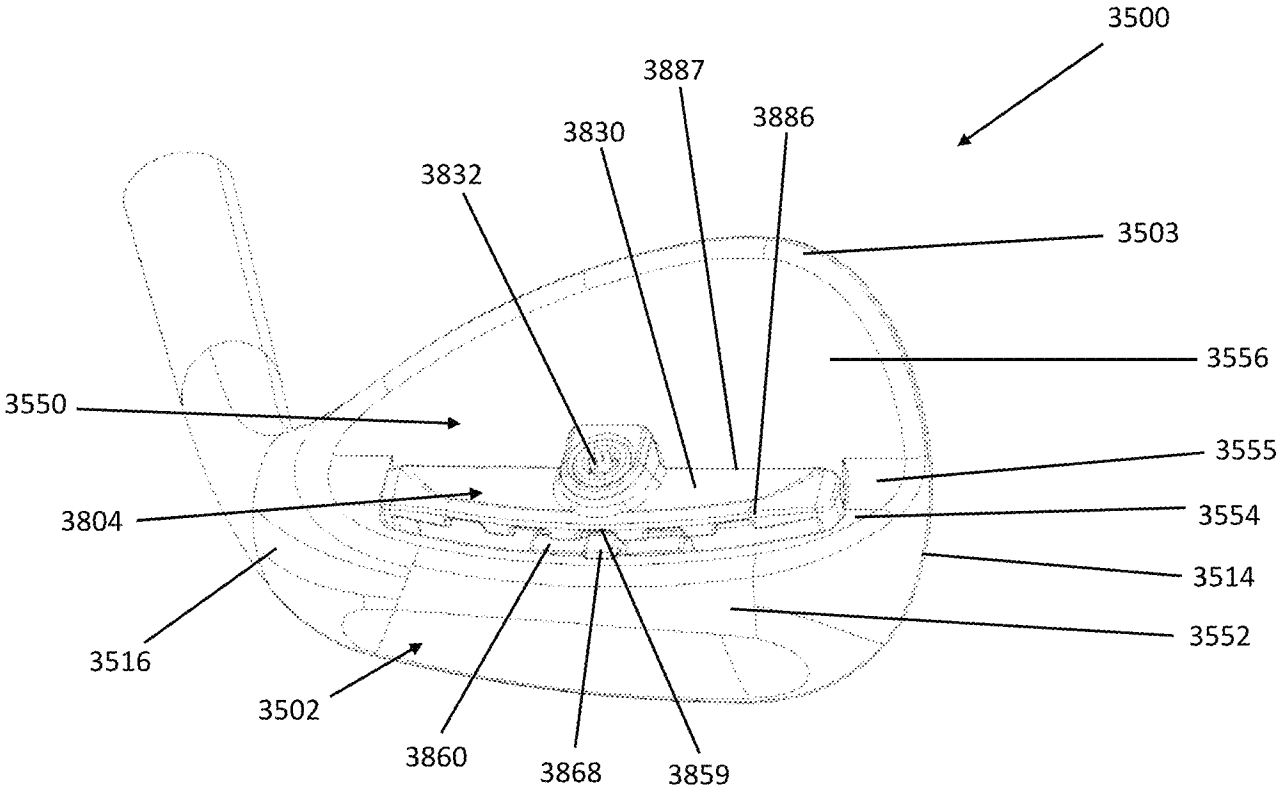
FIG. 117 is a back view of the golf club head of FIG. 116 when the weight assembly is in the unlocked configuration.
Figure 118:
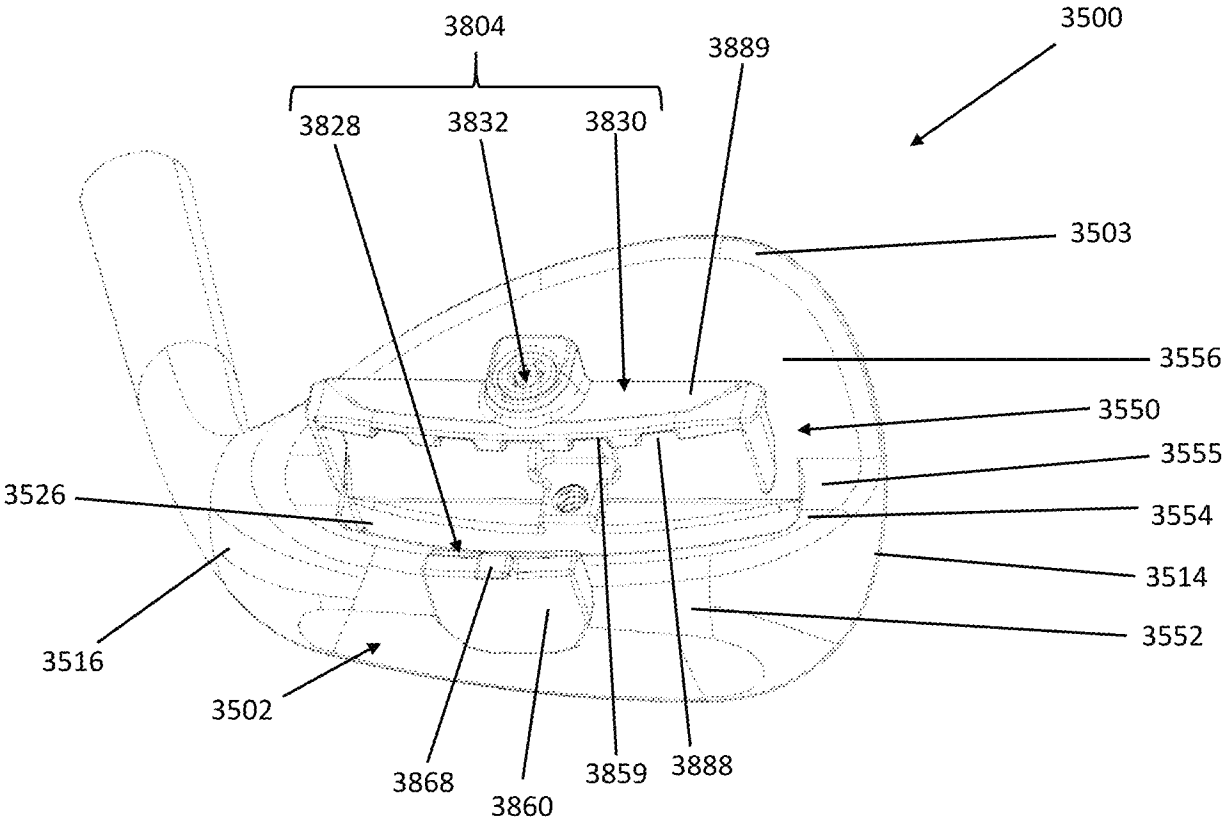
FIG. 118 is a partially exploded, back view of the golf club head of FIG. 116.
Figure 119:
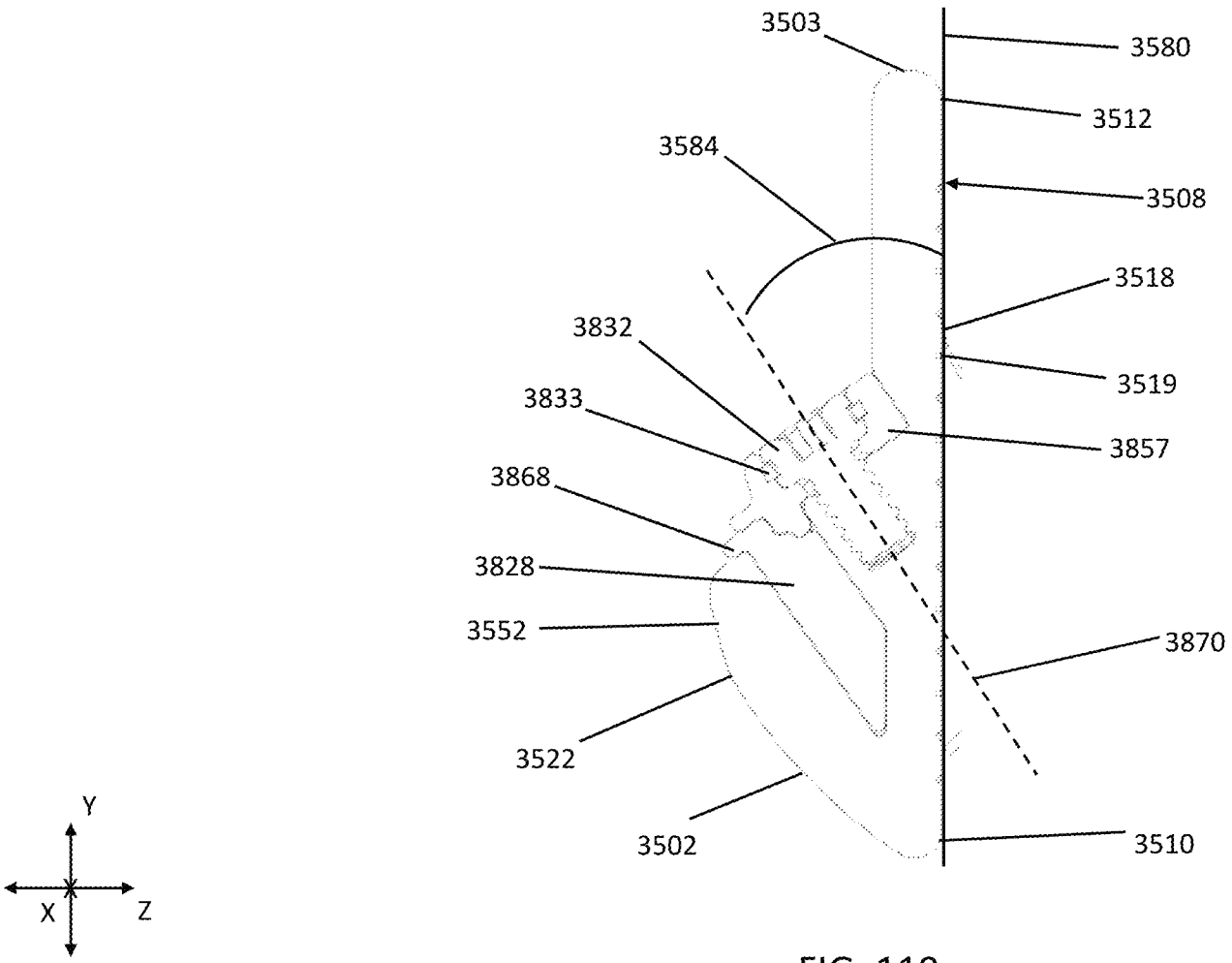

FIG. 116 is a back view of the golf club head 3500 with another weight assembly 3804 in the locked configuration. FIG. 117 is a back view of the golf club head 3500 of FIG. 116 when the weight assembly 3804 is in the unlocked configuration. FIG. 118 is a partially exploded, back view of the golf club head 3500 of FIG. 116. FIG. 119 is a cross-sectional view in the toe-to-heel direction of the golf club head 3500 of FIG. 116 taken along line **116*a*-116*a* when the weight assembly 3804 is in the locked configuration. FIG. 120 is a cross-sectional view in the toe-to-heel direction of the golf club head 3500 of FIG. 116 taken along line 116*a*-116*a* when the weight assembly 3804 is in the unlocked configuration. The golf club head 3500 of the embodiment illustrated in FIGS. 116-120 may include some features similar to, or the same as, features illustrated and described above with respect to the golf club head 3500 of FIGS. 105-112. Certain components are described above, and thus, are not necessarily described further. Referring to the example of FIGS. 116-120, the golf club head 3500 has a body including a toe 3514, a heel 3516, a top portion 3503, a striking face 3508 (see FIG. 119), a sole 3502, and a back portion 3550. The back portion 3550 includes a lower back surface 3552, a first back surface 3554, an intermediate back surface 3555, and a second back surface 3556. A recessed channel 3526 is formed in the first back surface 3554, and the weight assembly 3804 is coupled to the body of the golf club head 3500 at the recessed channel 3526**.

The weight assembly 3804 includes a weight 3828, a cover 3830, and a fastener 3832. The fastener 3832 is coupled to the cover 3830 via a retaining clip 3533. In this example, the weight includes a main body 3860 and a protruding position indicator 3868 extending from an upper portion of the main body 3860. The upper portion of the main body 3860 refers to a portion of the main body 3860 closest to the cover 3830 and/or to the opening of the recessed channel 3526 when the weight assembly 3804 is in the locked configuration. A lower portion of the main body 3860 refers to a portion of the main body 3860 closest to a bottom of the recessed channel 3526 when the weight assembly 3804 is in the locked configuration. The recessed channel 3526 extends along a toe 3514—heel 3516 direction and the cover 3830 has two opposing long sides extending along the toe 3514—heel 3516 direction—a first long side 3886 distal to the striking face 3508 and a second long side 3887 proximal to the striking face 3508. The cover 3830 also has an interior surface 3888 facing the recessed channel 3526 when the weight assembly 3804 is in the locked configuration, and an exterior surface 3889 facing away from the recessed channel 3526 when the weight assembly 3804 is in the locked configuration. In some embodiments, when the weight assembly 3804 is in the locked configuration, at least part of the exterior surface 3889 may be level with the first back surface 3554, and at least part of the interior surface 3888 is offset from the first back surface 3554 and is inside the recessed channel 3526.

In the locked configuration, the cover 3830 covers and conceals at least part of the main body 3860, and at least part of the protruding position indicator 3868 extends from under the cover 3830 to be exposed. Accordingly, the protruding position indicator 3868 may indicate the position of the weight 3828 in the recessed channel 3526 when the weight assembly 3804 is in the locked configuration. The protruding position indicator 3868 may be on (e.g., in contact with) part of the outer surface (e.g., the first back surface 3554) of the body of the golf club head 3500 in the locked configuration. In this example, the weight 3828 is not adapted to slidingly engage with the cover 3830. When the cover 3830 is moved from the locked configuration to the unlocked configuration, the weight 3828 remains in the recessed channel 3526. In the unlocked configuration, the weight 3828 can be gripped by the protruding position indicator 3868 and moved along the toe 3514—heel 3516 direction. In some embodiments where the body includes locating lugs (similar to the locating lugs 3534 shown in FIG. 10) at a bottom track of the recessed channel 3526, the weight 3828 can be lifted up slightly by the protruding position indicator 3868 prior to being moved along the toe 3514—heel 3516 direction. The cover 3830 has at least one locating groove 3859 in the interior surface 3888 shaped and sized to receive at least part of the protruding position indicator 3868 and adapted to engage with the protruding position indicator 3868 to at least partially define the position of the weight 3828. The at least one locating groove 3859 may include a plurality (e.g., five) locating grooves, and the protruding position indicator 3868 can selectively engage with the locating grooves 3859. The locating grooves 3859 may extend from the first side 3886 toward (e.g., at least part way to) the second side 3887. The weight assembly 3804 may include one or more of the weight assembly features described herein to enable the CG and the MOI of the golf club head 3500 to be adjustable for fade-draw bias, while securing the weight in the lock configuration. In examples, the faster 3832 forms a fastener angle 3584 measured in a cross-sectional plane with respect to a striking face 3508 and/or striking face plane 3580 of the golf club head 3500 in the manner described above with respect to weight assembly 3504.

Figure 121:
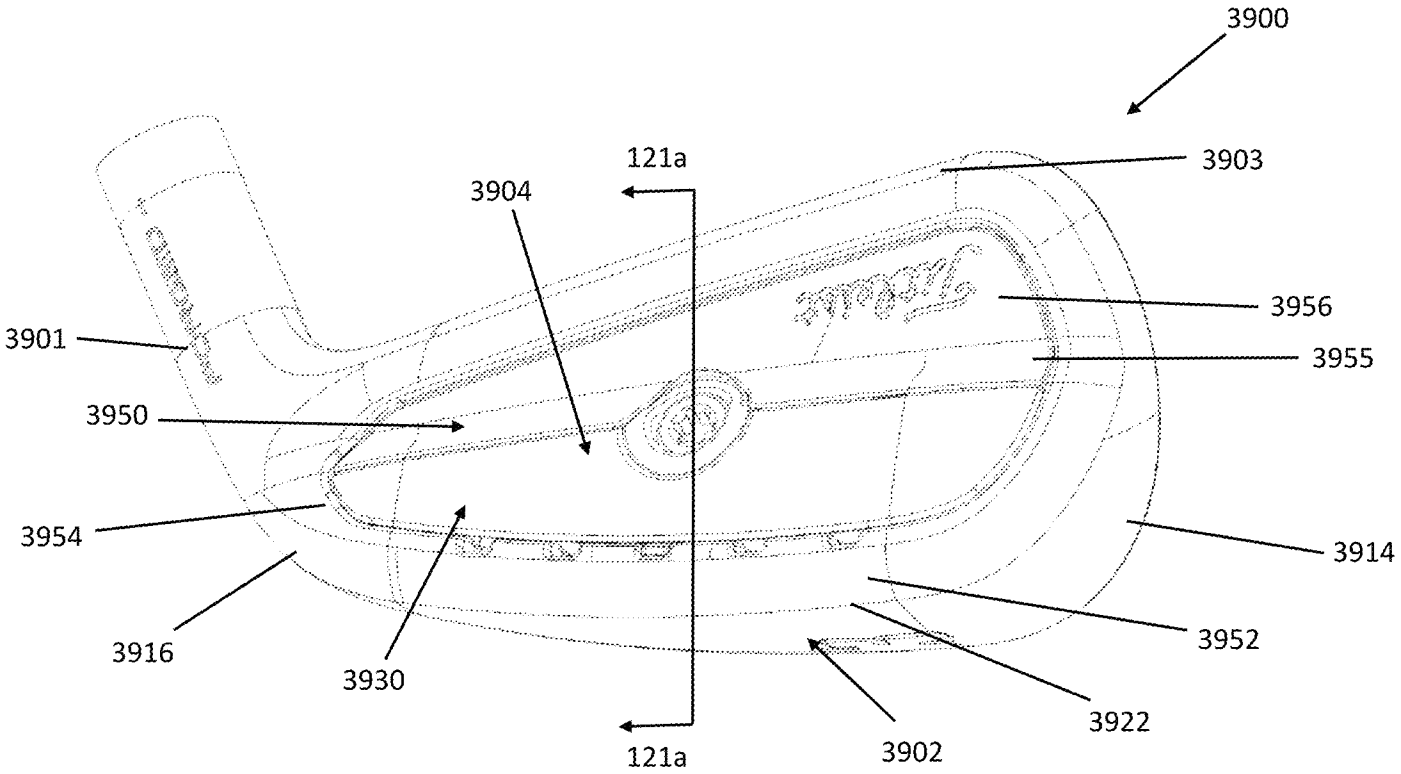
Figure 122:
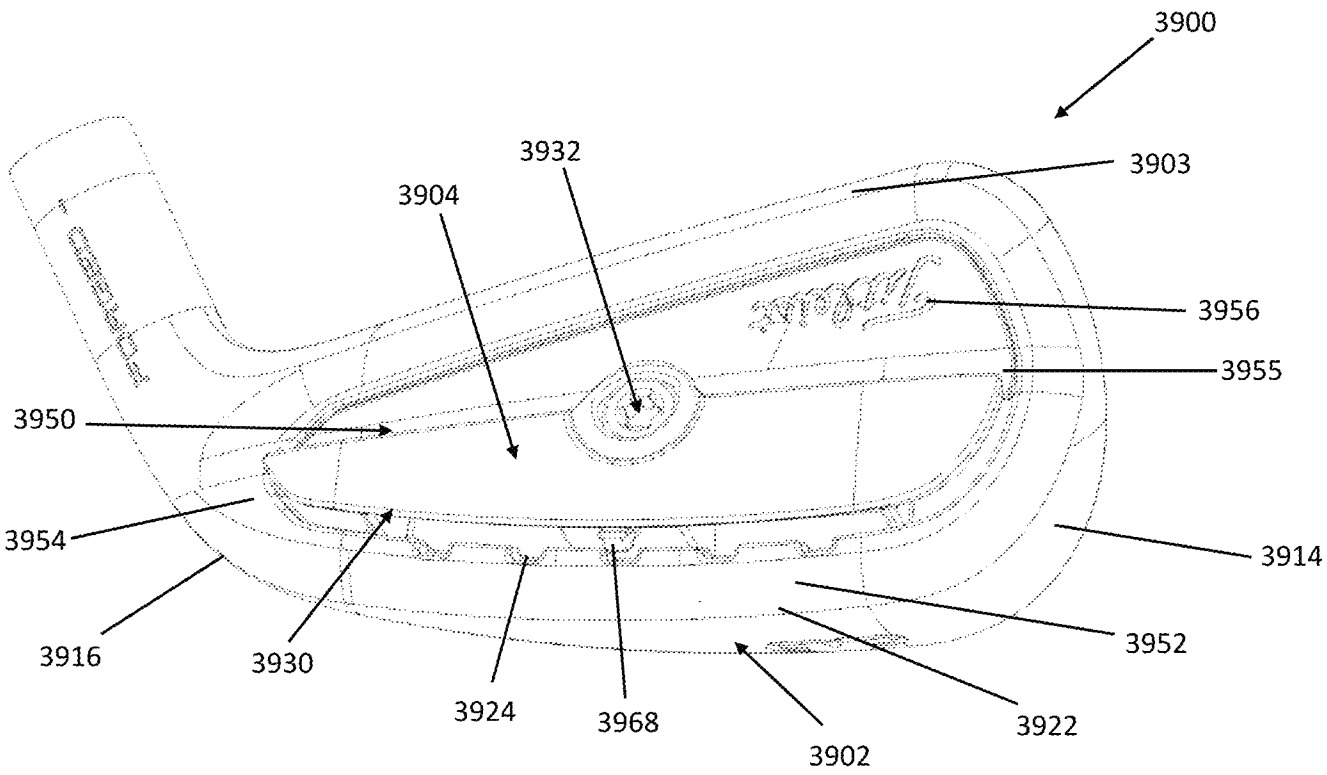
Figure 123:
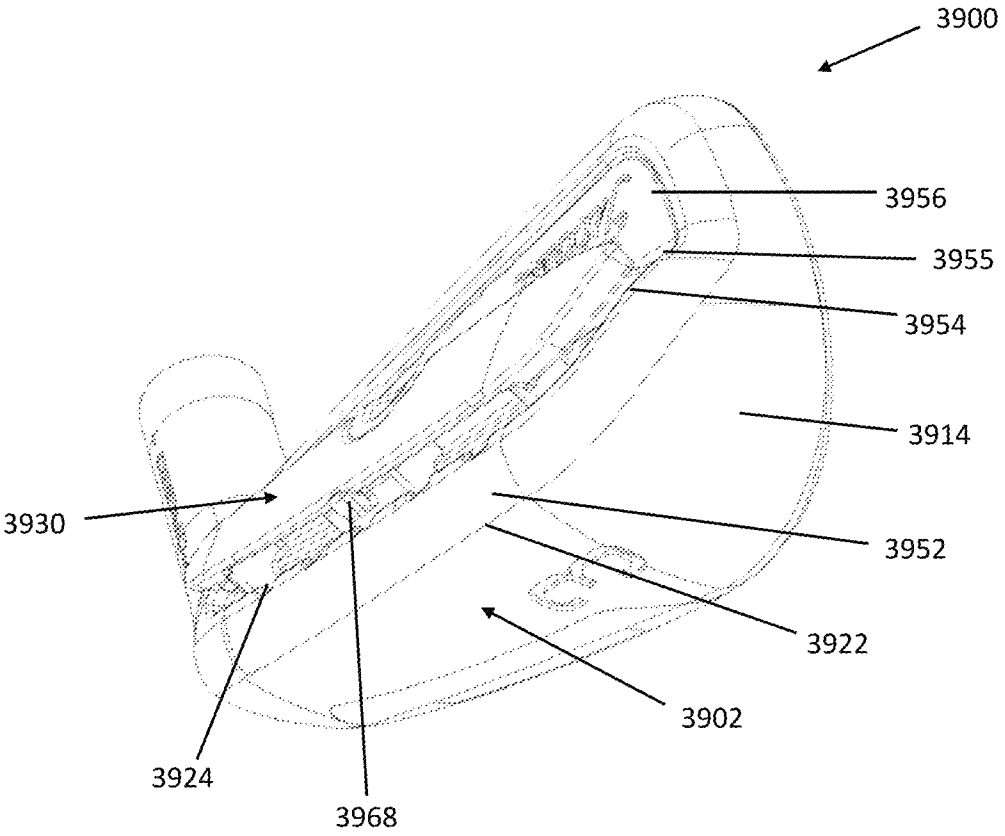
Figure 124:
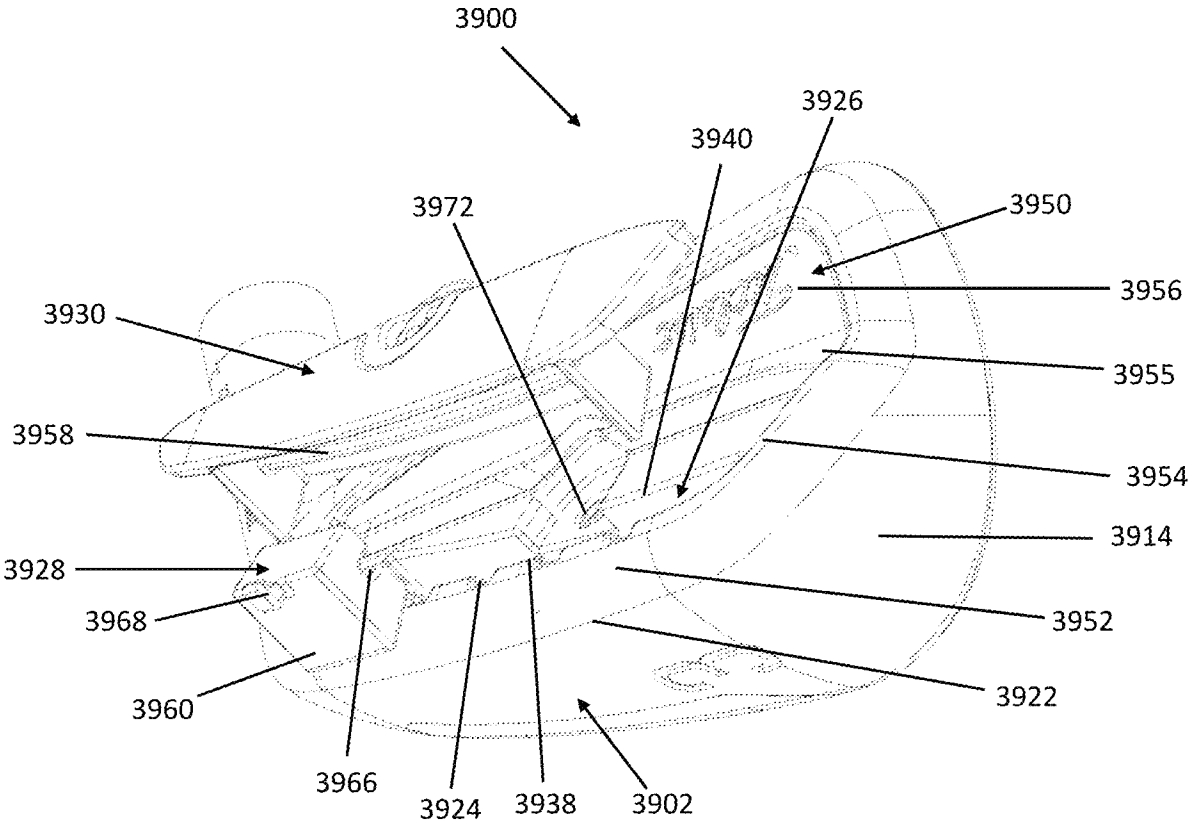
Figure 125:
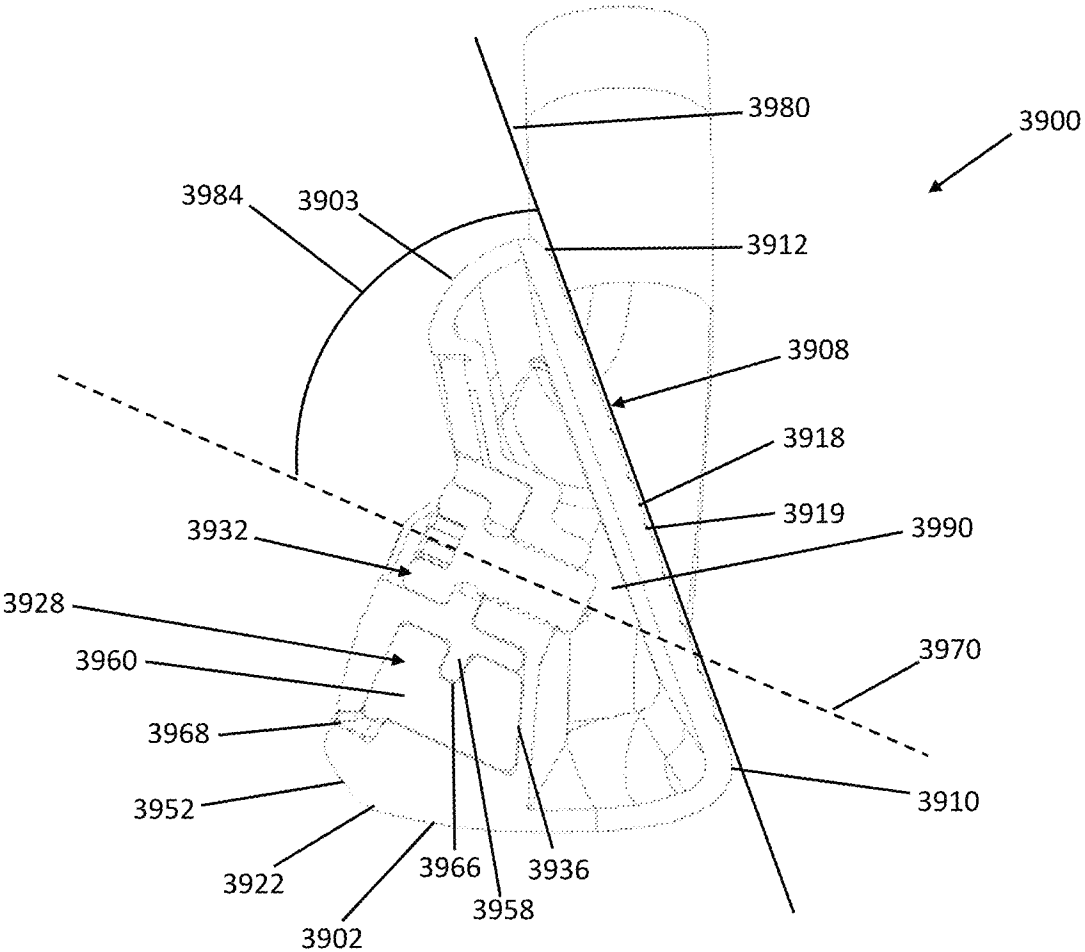
Figure 126:
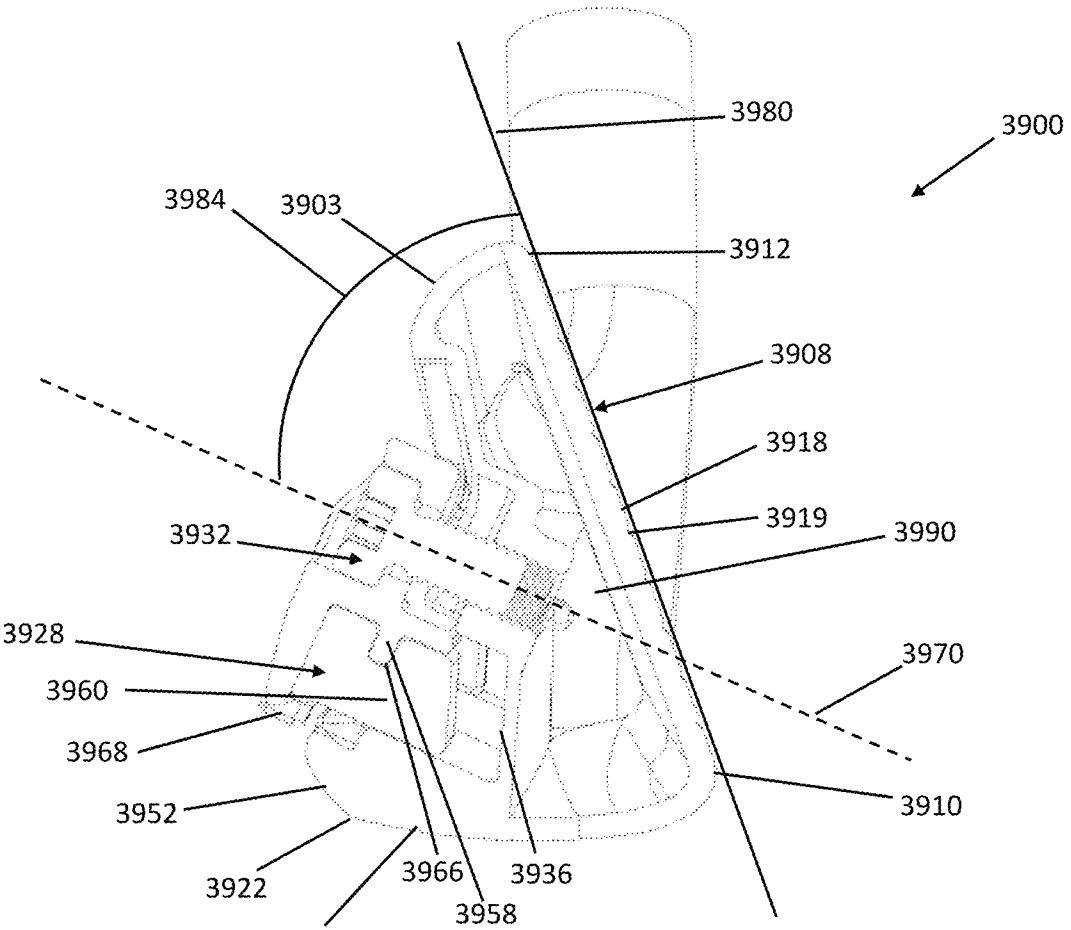

FIG. 121 is a back view of a golf club head 3900 with another weight assembly 3904 in the locked configuration. In this example, the golf club head 3900 is an iron-type golf club head, but not a wedge-type golf club head. In particular, the golf club head 3900 is illustrated as a 3-iron, Titleist® (Trademark of Acushnet) golf club head, but the embodiment is not limited thereto. FIG. 122 is a back view of the golf club head 3900 of FIG. 121 when the weight assembly 3904 is in the unlocked configuration. FIG. 123 is a perspective view of the golf club head 3900 of FIG. 121 when the weight assembly 3904 is in the unlocked configuration. FIG. 124 is a partially exploded, perspective view of the golf club head 3900 of FIG. 121. FIG. 125 is a cross-sectional view in the toe-to-heel direction of the golf club head 3900 of FIG. 121 along line 121*a*-121*a* when the weight configuration 3904 is in the locked configuration. FIG. 126 is a cross-sectional view of the golf club head 3900 of FIG. 121 along line 121*a*-121*a* when the weight configuration 3904 is in the unlocked configuration. The golf club head 3900 of the embodiment illustrated in FIGS. 121-126 may include some features similar to, or the same as, features illustrated and described above with respect to the golf club head 3500 of FIGS. 105-112.

Referring to FIGS. 121-126, the golf club head 3900 has a body including a toe 3914, a heel 3916, a top portion 3903, a striking face 3908, a sole 3902, and a back portion 3950. A hosel 3901 is disposed at the heel 3916 and is configured to couple to a shaft (not shown). The striking face 3908 has an upper topline edge 3912 and an opposite lower leading edge 3910. As shown in FIGS. 125 and 126, the striking face 3908 also has an outermost surface 3918 and grooves 3919 extending along the toe 3914—heel 3916 direction. The sole 3902 extends from the lower leading edge 3910 and has a rearward portion 3922 distal to the lower leading edge 3910.

The back portion 3950 is positioned between the rearward portion 3922 of the sole 3902 and the top portion 3903 and includes all surfaces of an outer surface of the body of the golf club head 3900 that are both between the rearward portion 3922 of the sole 3902 and the top portion 3903 and also between the toe 3914 and the heel 3916. In this example, the back portion 3950 includes a lower back surface 3952, a first back surface 3954, an intermediate back surface 3955, and a second back surface 3956. In examples, the second back surface 3956, along with the cover 3930, acts to conceal the cavity formed in the rear of the club head 3900; however, second back surface 3956 stays stationary, while the cover 3930 moves between a locked and unlocked position.

A recessed channel 3926 is formed in the first back surface 3954, and the weight assembly 3904 is couplable to the body of the golf club head 3900 at the recessed channel 3926. The recessed channel 3926 has bottom track 3936 offset from the outer surface of the body of the golf club head 3900. The recessed channel 3926 also has opposing first and second sidewalls 3938 and 3940 extending along the toe 3914—heel 3916 direction, the first sidewall 3938 being proximal or adjacent to the lower back surface 3952 and the second sidewall 3940 being distal to the lower back surface 3952. At least one dimple 3924 may be formed in the first sidewall 3938 at an upper end of the first sidewall 3938 where an opening of the recessed channel 3926 is formed in the outer surface of the body.

The weight assembly 3904 includes a weight 3928, a cover 3930, and a fastener 3932. A fastener receiver 3972 is formed in the body of the golf club head 3900 and is adapted to receive at least part of the fastener 3932 and to engage with the fastener 3932. The cover 3930 includes a flange 3958, and the weight 3928 has a groove 3966 shaped and sized to receive at least part of the flange 3958 and to slidingly engage the weight 3928 with the cover 3930. The weight 3928 has a main body 3960 and a protruding position indicator 3968 protruding from the main body 3960. The at least one dimple 3924 are shaped and sized to receive at least part of the protruding position indicator 3968. In the locked configuration of the weight assembly 3904, the cover 3930 may cover and conceal the main body 3960 of the weight 3928, and the protruding position indicator 3968 may at least partially protrude from under the cover 3930 and engage with a dimple of the at least one dimple 3924 to visibly indicate the position of the weight 3928 in the locked configuration. The weight assembly 3904 may include one or more of the weight assembly features described herein to enable the CG and the MOI of the golf club head 3900 to be adjustable for fade-draw bias, while securing the weight in the lock configuration.

In examples, the fastener 3932 forms a fastener angle 3984 measured in a cross-sectional plane with respect to a striking face 3908 and/or a striking face plane 3980 of the golf club head 3900 in the manner described above with respect to weight assembly 3504.

Figure 128:
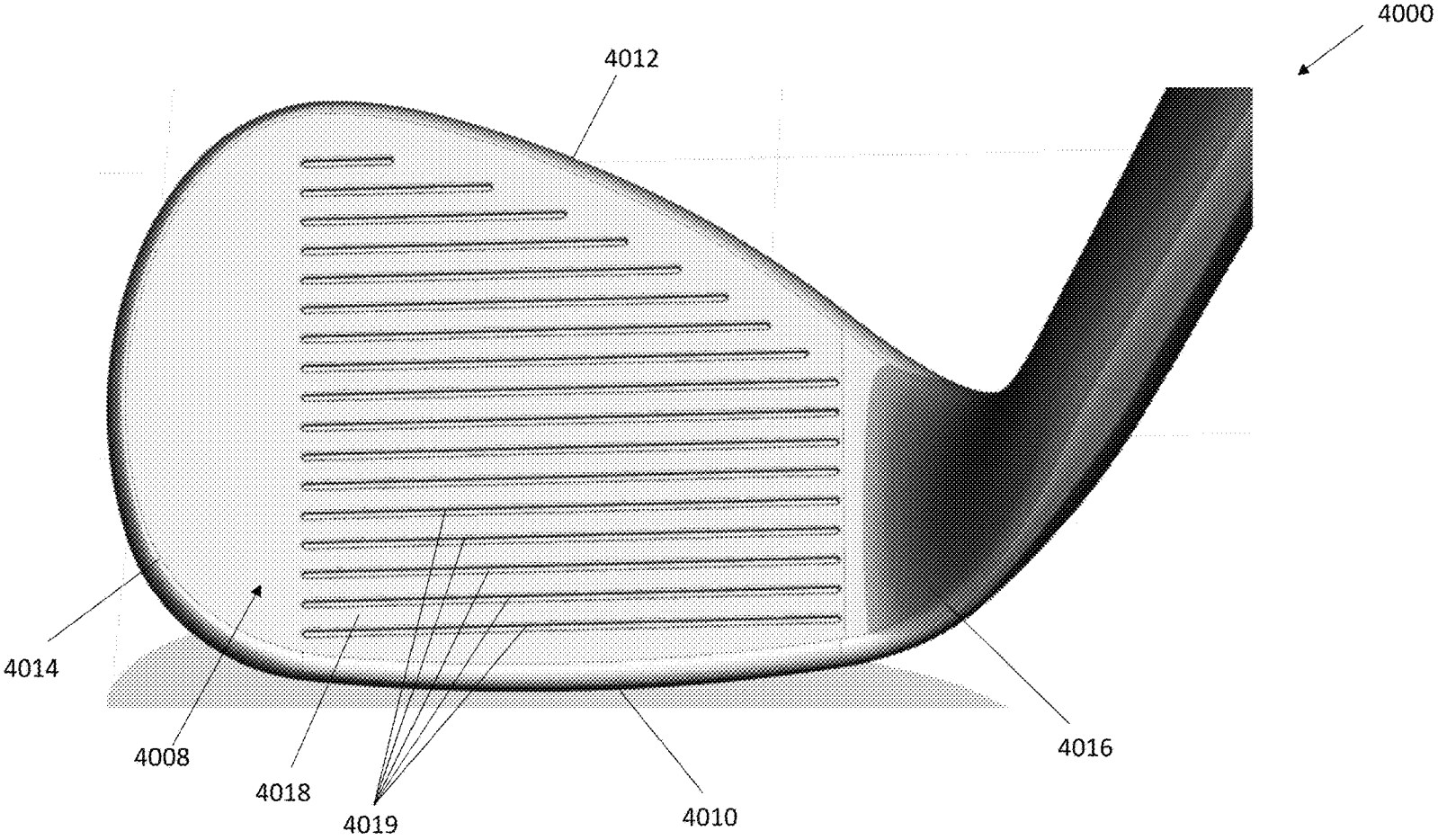
Figure 129:
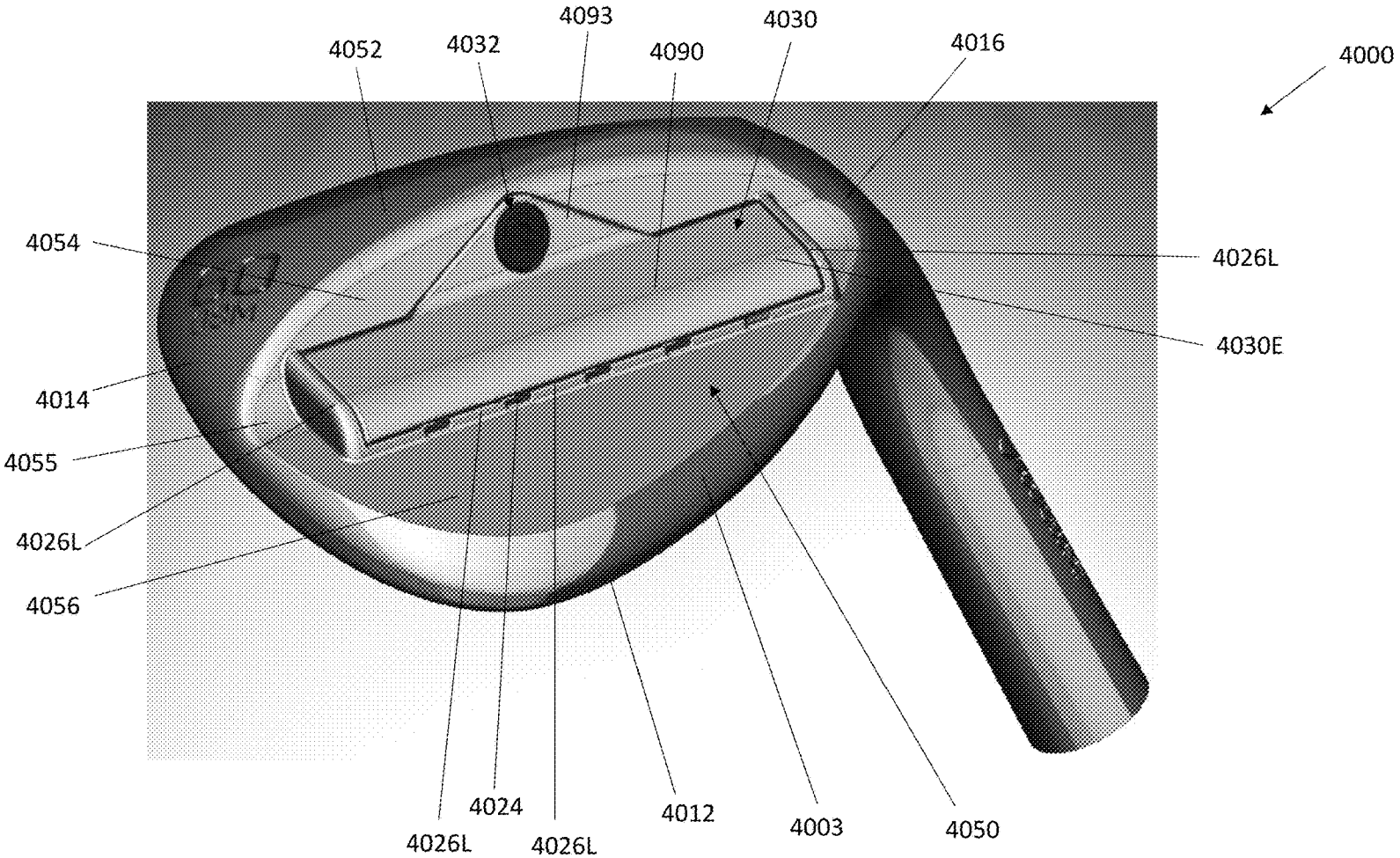
Figure 130:
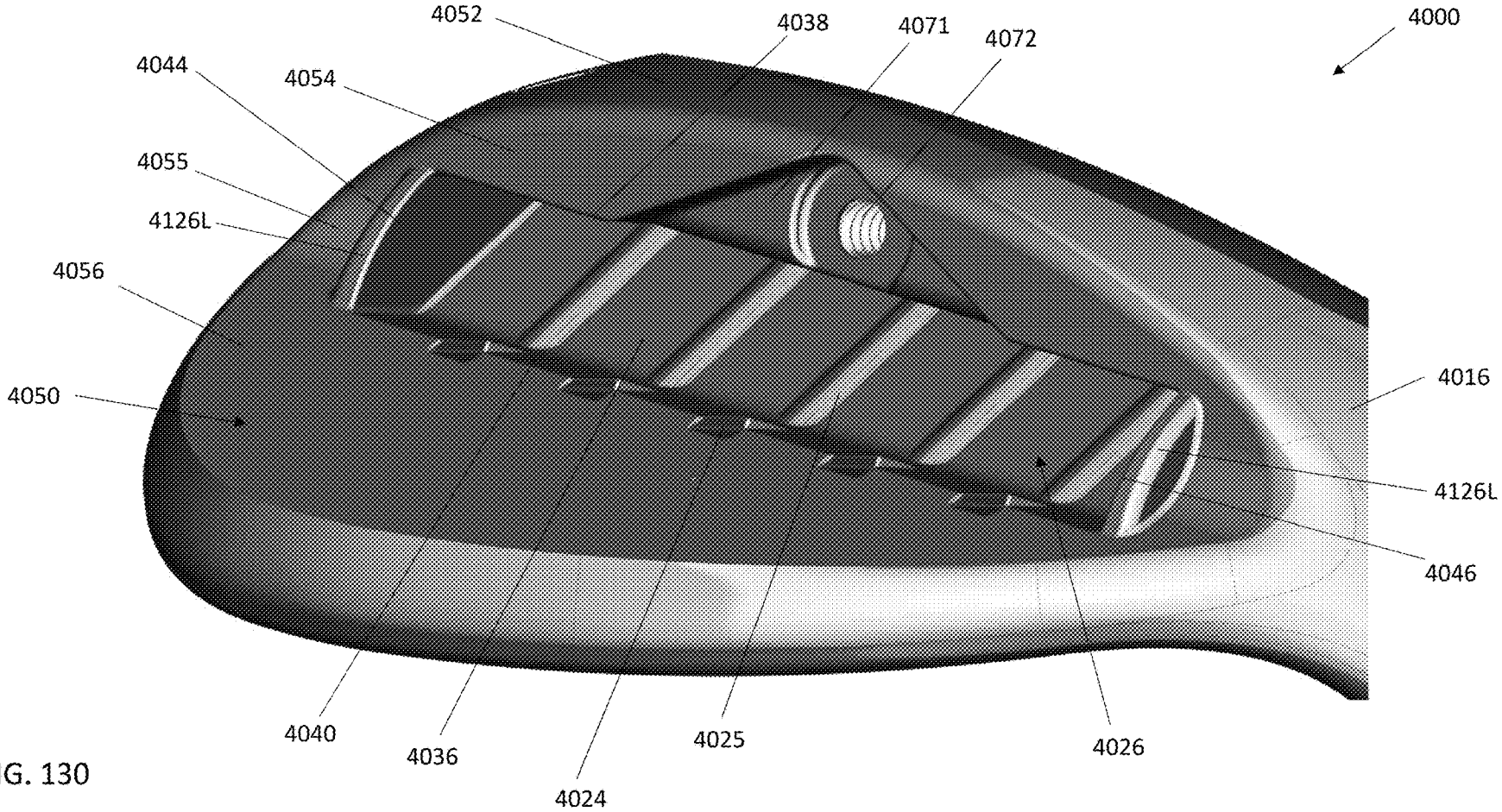

FIG. 127 is a back view of a golf club head 4000 with another weight assembly 4004 in the locked configuration. The golf club head 4000 is depicted as being an iron type golf club head, in particular, a wedge type golf club head. In some examples, the present disclosure is not limited thereto. In some examples, the golf club head may be a metal wood type golf club head, a hybrid type golf club head, or an iron type golf club head. FIG. 128 is a front view of the golf club head 4000 of FIG. 127. FIG. 129 is a perspective back view of the golf club head 4000 of FIG. 127 when the weight assembly 4004 is in the locked configuration. FIG. 130 is a perspective back view of a golf club head 4000 without a weight assembly. FIG. 131 is a partially transparent perspective view of the golf club head 4000 of FIG. 127 when the weight assembly 4004 is in the locked configuration. FIG. 132 is a partially transparent side view of the golf club head 4000 of FIG. 127 in a heel-to-toe direction when the weight assembly 4004 is in the locked configuration. FIG. 133 is another partially transparent side view of the golf club head 4000 of FIG. 127 in the heel-to-toe direction when the weight assembly 4004 is in the locked configuration. FIG. 134 is a perspective view of the weight assembly 4004 of the golf club head 4000 of FIG. 127. FIG. 135 is a perspective view of the weight assembly 4004 of the golf club head 4000 of FIG. 127. FIG. 136 is a perspective view of the weight assembly 4004 of the golf club head 4000 of FIG. 127. FIG. 137 is a perspective view of the weight assembly 4004 of the golf club head 4000 of FIG. 127. The golf club head 4000 shown in FIG. 130 may be similar to, or the same as, the golf club head 4000 depicted in FIGS. 127-129 and 131-137, except for differences depicted and described herein. Therefore, identical reference numbers used in FIG. 130 and in FIGS. 127-129 and 131-137 refer to identical features.

Referring concurrently to FIGS. 127-137, the golf club head 4000 may have some features similar to, or the same as, the features of other golf club heads disclosed herein. The golf club head 4000 may include a body 4006 having an outer surface 4020. The body 4006 may include a toe 4014, a heel 4016, a hosel 4001 disposed at the heel 4016 and configured to couple to a shaft (not shown), a striking face 4008 with a lower leading edge 4010 and an opposite upper topline edge 4012 extending between the toe and the heel 4016, a sole 4002 extending rearward from the lower leading edge 4010 to a rearward portion 4022 opposite to the lower leading edge 4010, a top portion 4003 extending rearward from the upper topline edge 4012, and a back portion 4050 positioned rearward to the striking face 4008 and coupled between the rearward portion 4022 of the sole 4002 and the top portion 4003. In some examples, the top portion 4003 is omitted, and the back portion 4050 is coupled between the rearward portion 4022 of the sole 4002 and the upper topline edge 4012. The striking face 4008, the sole 4002, and the back portion 4050 may be coupled together so as to define at least part of the outer surface 4020 of the body 4006.

The striking face 4008 may have an outermost surface 4018 and a plurality of grooves 4019 (or score lines) formed in the striking face 4008 to help impart spin on a golf ball when struck by the striking face 4008. The grooves 4019 may extend in a toe-heel direction along the striking face 4008 and may be arranged in a pattern extending from near the lower leading edge 4010 toward the upper topline edge 4012.

The back portion 4050 may include all surfaces of the outer surface 4020 of the body 4006 that are both between the rearward portion of the sole 4002 and the top portion 4003 (or the upper topline edge 4012 in examples where the top portion 4003 is omitted) and also between the toe 4014 and the heel 4016. In some examples, the back portion 4050 includes a lower back surface 4052 coupled between the rearward portion 4022 and the upper topline edge 4012 (e.g., between the rearward portion 4022 and the top portion 4003), a first back surface 4054 coupled between the lower back surface 4052 and the upper topline edge 4012, an intermediate back surface 4055 coupled between the first back surface 4054 and the upper topline edge 4012, and a second back surface 4056 coupled between the intermediate back surface 4055 and the upper topline edge 4012.

The body 4006 may include a flange 4088 (see FIG. 132) that protrudes rearward from the striking face 4008. The flange 4088 may form at least part of the sole 4002 and at least part of the back portion 4050. In the depicted nonexclusive example, the flange 4088 includes at least part of the sole 4002, at least part of the lower back surface 4052, and at least part of the first back surface 4054.

A recessed channel 4026 may be defined in the outer surface 4020 of the body 4006 and may generally extend in the toe-heel direction. The golf club head 4000 may include a weight assembly 4004 adapted to couple to the body 4006 at the recessed channel 4026. The recessed channel 4026 and the weight assembly 4004 may respectively have some features similar to, or the same as, the features of other recessed channels and weight assemblies disclosed herein.

In some examples, the weight assembly 4004 includes a weight 4028, a cover 4030, and a fastener 4032. The weight 4028 may be disposed at least partially within the recessed channel 4026 and may be configured to be movable along the toe-heel direction within the recessed channel 4026. The cover 4030 may extend at least partially over the recessed channel 4026 and may be adapted to releasably secure the weight 4028 within the recessed channel 4026. The fastener 4032 may be configured to couple the cover 4030 to the body 4006 and may be selectively movable along a fastener axis 4070. In some examples, the fastener 4032 is adapted to releasably secure the weight 4028 within the recessed channel 4026 only indirectly by the cover 4030. For example, the fastener 4032 may be configured to retain the weight 4028 within the recessed channel 4026 without directly engaging with the weight 4028. The weight assembly 4004 may be configured to allow a person to adjust the COG of the golf club head 4000 along the toe-heel direction by selectively positioning the weight 4028 in the recessed channel 4026 along the toe-heel direction.

The weight assembly 4004 may be configured to be positionable in at least an unlocked configuration whereby the cover 4030 is raised at least partially out of the recessed channel 4026 and the weight 4028 is selectively movable within the recessed channel 4026, and a locked configuration whereby the cover 4030 is at least partially disposed within the recessed channel 4026 and the weight 4028 is secured within the recessed channel 4026. In some examples, the weight assembly 4004 may be configured to be positionable in a weight removable configuration whereby the cover is sufficiently raised at least partially (e.g., entirely) out of the recessed channel 4026 such that the weight 4028 may be removed entirely from the recessed channel 4026.

The cover 4030 may include a cover main body 4090 and a cover protrusion 4093 protruding from the cover main body 4090. The cover main body 4090 may extend at least partially over the recessed channel 4026 and be adapted to releasably secure the weight 4028 within the recessed channel 4026. The cover protrusion 4093 may have an opening shaped and sized to receive at least part of the fastener 4032. The outer surface 4020 of the body 4006 may have a fastener cutout 4071 defining an indent shaped and sized to at least partially receive the cover protrusion 4093, and a fastener receiver 4072 may be defined as a hole in the outer surface 4020, for example, in the fastener cutout 4071, that is shaped and sized to receive at least part of the fastener 4032. The opening in the cover protrusion 4093 may align with the fastener receiver 4072 when the cover protrusion 4093 is at least partially fitted in the fastener cutout 4071, and the fastener 4032 may be fitted through the opening in the cover protrusion 4093 and at least partially into the body 4006 through the fastener receiver 4072 to couple the cover 4030 to the body 4006.

The fastener cutout 4071 and the fastener receiver 4072 may be provided in the back portion 4050 and on the flange 4088. The fastener 4032 may be configured to penetrate at least partially into the flange 4088 via the fastener receiver 4072 from the back portion 4050, for example, from the first back surface 4054. In some examples, the fastener 4032 is configured to penetrate into the flange 4088 in a direction normal (e.g., perpendicular) to an adjacent portion of the back portion 4050, such as the first back surface 4054.

The fastener 4032 may include a shaft (e.g., threaded shaft) and a head at one end of the shaft and having a larger breadth (e.g., diameter) than that of the shaft. In some examples, the fastener 4032 may be rotatably coupled to the cover 4030 with a retaining clip such that the fastener 4032 is rotatable relative to the cover 4030 and so that the cover 4030 is linearly movable with the fastener 4032 when the fastener 4032 moves along the fastener axis 4070. For example, the retaining clip may be coupled between the head of the fastener 4032 and the cover protrusion 4093. In some other examples, the retaining clip is omitted.

The cover 4030 may have an exterior surface 4030E configured to face the outside of the golf club head 4000, and to protrude outwardly from the golf club head 4000 to form a bump on the back portion 4050, when the weight assembly 4004 is in the locked configuration.

The cover 4030 may include a first rail 4091 protruding from the cover main body 4090 and extending along the toe-heel direction, and a second rail 4092 protruding from the cover main body 4090 and extending along the toe-heel direction. In some examples, the first rail 4091 protrudes from the cover main body 4090 in a first direction perpendicular to a longitudinal direction of the first rail 4091, the second rail 4092 protrudes from the cover main body 4090 in a second direction perpendicular to a longitudinal direction of the second rail 4092, and the first and second rails 4091 and 4092 are oriented such that an extension (e.g., a virtual extension) of the first rail 4091 along the first direction intersects an extension (e.g., a virtual extension) of the second rail 4092 along the second direction. For example, referring to FIG. 133, the respective longitudinal directions of the first and second rails 4091 and 4092 may extend along the X-axis direction as shown in FIG. 133, and the first and second directions by which the first and second rails 4091 and 4092 respectively protrude from the cover main body 4090 may extend along the Y-Z plane as shown in FIG. 133. In the example depicted in FIGS. 133 and 134, the X-axis and the Y-axis may each be parallel to the striking face plane 4080, the Z-axis may be perpendicular to the striking face plane 4080, and the side view depicted in FIGS. 133 and 134 may be parallel to the Y-Z plane.

The weight 4028 may have a first groove 4058 shaped and sized to receive at least part of the first rail 4091, and a second groove 4059 shaped and sized to receive at least part of the second rail 4092. The weight 4028 may be configured to slidingly engage with the cover 4030 along the toe-heel direction by the first and second rails 4091 and 4092.

The weight 4028 may be configured to couple (e.g., fixedly couple) to the cover 4030 by the first and second rails 4091 and 4092 such that the weight 4028 moves with the cover 4030 when the weight assembly 4004 moves between the locked and unlocked configurations. For example, the weight 4028 may be coupled to the cover 4030 such that it is linearly movable with the cover 4030 at least along a direction parallel to the fastener axis 4070. Because the weight 4028 may be slidingly engaged with the cover 4030, the weight 4028 may be linearly movable with the cover 4030 along the direction parallel to the fastener axis 4070 while also being movable relative to the cover 4030 along the toe-heel direction.

The weight 4028 may include a weight main body 4060, a weight protruding body 4062 (see FIG. 136), and a bridge 4061 connecting the weight main body 4060 and the weight protruding body 4062. The first groove 4058 may extend at least partially between the weight main body 4060 and the weight protruding body 4062, and the second groove 4059 may extend at least partially between the weight main body 4060 and the weight protruding body 4062. The bridge 4061 may extend between the first and second grooves 4058 and 4059, for example, between a bottom 4058B of the first groove 4058 and a bottom 4059B of the second groove 4059.

The weight protruding body 4062 may be shaped and sized such that it cannot move substantially or entirely between the first and second rails 4091 and 4092 without being blocked by the first and second rails 4091 and 4092. However, in some examples, the weight protruding body 4062 may be shaped and sized such that it can be forcibly moved between the first and second rails 4091 and 4092 with a sufficient force to deform the weight protruding body 4062 enough to couple and decouple the weight 4028 from the cover 4030. In other examples, the weight 4028 may be decoupled from the cover 4030 by sliding the weight past the end of the rails 4091 and 4092, e.g., by first removing one of the tabs 4082 or 4084 (discussed below).

The cover 4030 may include a first tab 4082 between the first and second rails 4091 and 4092 at a toe end 4030T of the cover 4030, and a second tab 4084 between the first and second rails 4091 and 4092 at a heel end 4030H of the cover 4030. The toe end 4030T and the heel end 4030H of the cover 4030 may be ends of the cover 4030 respectively proximal to the toe 4014 and the heel 4016 when the weight assembly 4004 is in the locked configuration. The first and second tabs 4082 and 4084 may block movement of the weight 4028 along the toe-heel direction at the ends of the cover 4030 so that the weight 4028 does not slide off and disengage from the cover 4030 at the ends of the cover 4030, such as when the weight assembly 4004 is in the unlocked configuration. In some examples, the weight 4028 may therefore be configured to slidingly engage with the cover 4030 along the toe-heel direction and only between the first and second tabs 4082 and 4084. Each of the first and second tabs 4082 and 4084 may be different in material from the cover 4030 and may include, for example, a polymer. The first and second tabs 4082 and 4084 may be installed on the cover 4030 by force fitting them between the first and second rails 4091 and 4092. In some examples, one or both of the first and second tabs 4082 and 4084 may be configured to be removed from, and reinstalled on, the cover 4030 so that the weight 4028 can be coupled onto, and decoupled from, the cover 4030 by sliding the weight 4028 onto, or off from, the first and second rails 4091 and 4092 at an end of the cover 4030.

In some examples, the weight 4028 includes a position indicator 4068 protruding from the weight main body 4060. The position indicator 4068 may be configured (e.g., shaped and sized) to extend out from under the cover 4030 when the weight assembly 4004 is in the locked configuration so that the position of the weight 4028 within the recessed channel 4026 may be apparent from the position indicator 4068. In some examples, the second sidewall 4040 has one or more dimples 4024 shaped and sized to at least partially receive the position indicator 4068, and the position indicator 4068 is configured to selectively engage with the one or more dimples 4024. In some examples, the weight assembly 4004 is configured such that, when the weight assembly 4004 is in the locked configuration, the weight 4028 is positionable in only discrete positions in the recessed channel 4026 corresponding to positions where the position indicator 4068 engages with one of the dimples 4024. In some other examples, the weight assembly 4004 is configured such that, when the weight assembly 4004 is in the locked configuration, the weight 4028 is positionable along a continuum of positions in the recessed channel 4026 extending along the toe-heel direction.

In some examples, the weight 4028 may have a bottom protrusion (not shown) protruding from the weight main body 4060, and the bottom track 4036 may have one or more indents 4025 (see FIG. 130) shaped and sized to at least partially receive the bottom protrusion of the weight 4028. The bottom protrusion of the weight 4028 may be configured to selectively engage with the one or more indents 4025 to help fix the position of the weight 4028 within the recessed channel 4026. In some examples, positions of the one or more indents 4025 may respectively correspond to positions of the one or more dimples 4024 along the toe-heel direction. In the depicted nonexclusive example, there are five dimples 4024 and five indents 4025. The golf club head 4000 depicted in FIG. 130 differs from the golf club head 4000 depicted in FIGS. 127-129 and 131-137 in that the golf club head 4000 depicted in FIG. 130 has the one or more indents 4025 in the bottom track 4036, but the golf club head 4000 depicted in FIGS. 127-129 and 131-137 does not have the one or more indents 4025. For example, the bottom track 4036 of the golf club head 4000 depicted in FIGS. 127-129 and 131-137 may be substantially flat. The golf club head 4000 depicted in FIG. 130 also differs from the golf club head 4000 depicted in FIGS. 127-129 and 131-137 in that a weight of a weight assembly of the golf club head 4000 depicted in FIG. 130 may have the bottom protrusion shaped and sized to be at least partially inserted into the one or more indents 4025, but the weight 4028 of the weight assembly 4004 of the golf club head 4000 depicted in FIGS. 127-129 and 131-137 may not have the bottom protrusion. Those of skill in the art will understand that the unique features of the golf club head 4000 in FIG. 130 may be incorporated into, and used with, one or more features of the golf club head 4000 depicted in FIGS. 127-129 and 131-137, and vice versa.

The recessed channel 4026 may be at least partially provided in the back portion 4050, but the present disclosure is not limited thereto. In the depicted nonexclusive example, the recessed channel 4026 is provided in at least part of the first back surface 4054, at least part of the intermediate back surface 4055, and at least part of the second back surface 4056. The recessed channel 4026 may extend at least part way between the striking face 4008 and the flange 4088.

The recessed channel 4026 may have a first sidewall 4038 and the second sidewall 4040 opposite to the first sidewall 4038, and the first and second opposing sidewalls 4038 and 4040 may extend along the toe-heel direction. The first sidewall 4038 may be closer to the sole 4002 than the second sidewall 4040. The recessed channel 4026 may also have opposing toe and heel end walls 4044 and 4046, where the toe end wall 4044 is adjacent or proximal to the toe 4014, and the heel end wall 4046 is adjacent or proximal to the heel 4016. The recessed channel 4026 may have a bottom track 4036 offset from the outer surface 4020 of the body 4006 and disposed both between the first and second sidewalls 4038 and 4040 and between the toe and heel end walls 4044 and 4046. The body 4006 may include a raised lip 4026L that at least partially surrounds, and forms part of, the recessed channel 4026. In the depicted nonexclusive example of FIGS. 127-129 and 131-137, the raised lip 4026L extends along the second sidewall 4040, the toe end wall 4044, and the heel end wall 4046. The golf club head 4000 depicted in FIG. 130 differs from the golf club head 4000 depicted in FIGS. 127-129 and 131-137 in that the raised lip 4126L of the golf club head 4000 depicted in FIG. 130 extends along the toe end wall 4044 and the heel end wall 4046, but not along the second sidewall 4040. Those of skill in the art will understand that the unique features of the golf club head 4000 in FIG. 130 may be incorporated into, and used with, one or more features of the golf club head 4000 depicted in FIGS. 127-129 and 131-137, and vice versa.

Referring to FIGS. 130 and 131, the recessed channel 4026 may define a longitudinal axis 4026LA, and the recessed channel 4026 may be configured (e.g., shaped and oriented) such that the longitudinal axis 4026LA is parallel to a striking face plane 4080. The striking face plane 4080 may be tangential to the outermost surface 4018 of the striking face 4008. For example, the striking face plane 4080 may be parallel to the Y-X plane shown in FIG. 132. The longitudinal axis 4026LA of the recessed channel 4026 may be defined as a straight line (e.g., a straight virtual line) that extends at least partially, mostly, or completely through the recessed channel 4026 while maintaining both a substantially constant distance to the bottom track 4036 and a substantially constant distance to at least one of the first sidewall 4038 or the second sidewall 4040. In some examples, the longitudinal axis 4026LA passes through a center of the recessed channel 4026. In some other examples, the recessed channel 4026 may have a curved shape such that it does not define a straight longitudinal axis. In some such examples, a curved line (e.g., a curved virtual line) may extend at least partially, mostly, or completely through the recessed channel 4026 while maintaining both a substantially constant distance to the bottom track 4036 and a substantially constant distance to at least one of the first sidewall 4038 or the second sidewall 4040, and the curved line may be on (e.g., entirely on) a plane that is parallel to the striking face plane 4080. In some examples, a bottom track plane tangential to the bottom track 4036 may be parallel to the striking face plane 4080. In some examples, a junction line defined by a junction between the bottom track 4036 and the first sidewall 4038 or the second sidewall 4040 may be a straight or curved line that is on (e.g., entirely on) a plane parallel to the striking face plane 4080. Reference herein to a line being a "substantially constant distance" to another element may include examples where the distance is within 5 percent, less than 3 percent, less than 1 percent, or less than 0.5 percent different along the line.

By defining the recessed channel 4026 to have such a configuration (e.g., shape and orientation), the weight 4028 may be movable, or positionable in a locked configuration, within the recessed channel 426 along a path such that it substantially maintains a constant distance relative to the striking face plane 4080. Therefore, a player may adjust the toe-heel position of the COG of the golf club head 4000 without undesirably changing a depth position of the COG of the golf club head 4000. The depth of the COG of the golf club head 4000 may refer to a position of the COG positioned along a direction (e.g., the Z-axis direction as shown in FIG. 132) perpendicular to the striking face plane 4080. Reference herein to a plane being "substantially parallel" to the striking face plane 4080 may include examples where the plane is oriented to be less than 5 degrees, less than 3 degrees, less than 1 degree, or less than 0.5 degrees relative to an orientation where the plane is exactly parallel to the striking face plane 4080.

In some examples, the longitudinal axis 4026LA of the recessed channel 4026 may be substantially parallel (e.g., within 5 degrees, within 3 degrees, within 1 degree, or within 0.5 degrees) to a longitudinal axis 4019LA (e.g. see FIG. 131) of at least one groove from among the plurality of grooves 4019, for example, the groove closest to the lowest leading edge 4010. Accordingly, a user may be able to adjust the COG of the golf club head 4000 along the toe-heel direction without affecting the position of the COG of the golf club head 4000 along a direction between the lower leading edge 4010 and the upper topline edge 4012. However, in some other examples, the longitudinal axis 4026LA of the recessed channel 4026 may be nonparallel to the longitudinal axis 4019LA, for example, in order to improve aesthetics of the overall golf club head 4000, to not interfere with the sole-portion of the flange 4088, or to simplify the manufacturing process of the golf club head 4000.

The recessed channel 4026 may define a path generally extending along the toe-heel direction, and the weight 4028 may be positionable in at least a first position on the path at a toe-end of the path, a second position on the path at a heel-end of the path, and a third position on the path between the toe-end of the path and the heel end of the path.

The first position of the weight 4028 on the path of the recessed channel 4026 may be defined as a position closest to the toe 4014 or to the toe end wall 4044 from among positions on the path that the weight 4028 is positionable in (e.g., positionable in when the weight assembly 4004 is in the locked configuration or in the unlocked configuration). For example, the first position of the weight 4028 may be defined as a position whereby the weight 4028 is in contact with the toe end wall 4044. In some examples, the first position of the weight 4028 may be defined to be a position that the weight 4028 is configured to be in when the position indicator 4068 is engaged with a dimple closest to the toe 4014 or to the toe end wall 4044 from among the one or more dimples 4024.

The second position of the weight 4028 on the path of the recessed channel 4026 may be defined as a position closest to the heel 4016 or to the heel end wall 4046 from among positions on the path of the recessed channel 4026 that the weight 4028 is positionable in (e.g., positionable in when the weight assembly 4004 is in the locked configuration or in the unlocked configuration). For example, the second position of the weight 4028 may be defined as a position whereby the weight 4028 is in contact with the heel end wall 4046. In some examples, the second position of the weight 4028 may be defined to be a position that the weight 4028 is configured to be in when the position indicator 4068 is engaged with a dimple closest to the heel 4016 or to the heel end wall 4046 from among the one or more dimples 4024.

The third position of the weight 4028 on the path of the recessed channel 4026 may be defined as a position between the first and second positions of the weight 4028 (e.g., when the weight assembly 4004 is in the locked configuration or in the unlocked configuration), for example, a middle position centered between the first and second positions of the weight 4028. In some examples, the third position of the weight 4028 may be defined to be a position that the weight 4028 is in both when the weight 4028 is between the first and second positions of the weight 4028 and also when the position indicator 4068 is engaged with a dimple from among the one or more dimples 4024. For example, in the depicted nonexclusive example, the one or more dimples 4024 include five dimples 4024, the first position of the weight 4028 may be defined to be a position that the weight 4028 is configured to be in when the position indicator 4068 is engaged with a first dimple closest to the toe end wall 4044 from among the five dimples 4024, the second position may be defined to be a position that the weight 4028 is configured to be in when the position indicator 4068 is engaged with a second dimple closest to the heel end wall 4046 from among the five dimples 4024, and the third position may be defined to be a position that the weight 4028 is configured to be in when the position indicator 4068 is engaged with any one of the three dimples between the first and second dimples from among the five dimples 4024.

A first distance may be defined to be a minimum distance between the weight 4028, when the weight 4028 is at the first position on the path of the recessed channel 4026, and the striking face plane 4080; a second distance may be defined to be a minimum distance between the weight 4028, when the weight 4028 is at the second position on the path of the recessed channel 4026, and the striking face plane 4080; and a third distance may be defined to be a minimum distance between the weight 4028, when the weight 4028 is at the third position on the recessed channel 4026, and the striking face plane 4080. The first distance, the second distance, and the third distance may be substantially equal. In some examples, the recessed channel 4026 is configured (e.g., shaped and oriented) such that the first distance, the second distance, and the third distance are substantially equal. For example, one of the first distance, the second distance, and the third distance may deviate by less than 5 percent, less than 3 percent, less than 1 percent, or less than 0.5 percent from the value of each of the remaining two of the first distance, the second distance, and the third distance. In some examples, each of the first distance, the second distance, and the third distance deviates by less than 5 percent, less than 3 percent, less than 1 percent, or less than 0.5 percent from the value of an average of the first distance, the second distance, and the third distance.

Translational movement of the weight 4028 along the toe-heel direction in the recessed channel 4026 may be substantially parallel to the striking face plane 4080. In some examples, a set point 4095 (see FIG. 132) may be defined on or relative to the weight 4028. The set point 4095 may be defined as a point on the weight 4028 that is closest to the striking face plane 4080 when the weight 4028 is at the first position, the second position, or the third position. For example, the first distance may be measured between the striking face plane 4080 and the set point 4095 when the weight 4028 is in the first position. In some other examples, the set point 4095 may be a point at a center (e.g., geometric center) of the weight 4028, regardless of whether the point is on the weight 4028. When the weight 4028 moves between the first and second positions within the recessed channel 4026 (e.g., while being raised just high enough out of the recessed channel 4026 so that the weight disengages with the one or more dimples 4024 and, in embodiments where the one or more indents 4025 are included, from the one or more indents 4025, and while maintaining such a height), the set point 4095 may move along a straight or curved line on a plane that is substantially parallel to the striking face plane 4080. In some examples, the weight 4028 is slidingly engaged with the cover 4030, and the set point 4095 moves along a straight or curved line on a plane that is substantially parallel to the striking face plane 4080 when the weight assembly 4004 is in the unlocked configuration and the weight 4028 slides along the cover 4030 between the toe end 4030T and the heel end 4030H of the cover 4030 (e.g., while a position of the cover 4030 relative to the fastener 4032 is fixed). The set point 4095 may move along a straight line that is substantially parallel to the striking face plane 4080 and parallel or nonparallel to the longitudinal axis 4019LA of a groove from among the plurality of grooves 4019.

FIG. 138 is a back perspective view of a golf club head 4100 with another weight assembly 4104 in a locked configuration. The golf club head 4100 is depicted as being an iron type golf club head, in particular, a wedge type golf club head. In some examples, the present disclosure is not limited thereto. In some examples, the golf club head may be a metal wood type golf club head, a hybrid type golf club head, or an iron type golf club head. FIG. 139 is a top-down perspective view of the golf club head 4100 of FIG. 138 with the weight assembly 4104 in an unlocked configuration. FIG. 140 is a heel-to-toe cross-sectional view of the golf club head 4100 of FIG. 138 along line 140-140 in FIG. 138 with the weight assembly 4104 in the locked configuration. FIG. 141 is another heel-to-toe cross-sectional view of the golf club head 4100 of FIG. 138 along the line 140-140 in FIG. 138 with the weight assembly in the unlocked configuration. FIG. 142 is a rotated heel-to-toe cross-sectional view of the weight assembly 4104 of the golf club head 4100 of FIG. 138 along the line 140-140 in FIG. 138. FIG. 143 is another rotated heel-to-toe cross-sectional view of the weight assembly 4104 of the golf club head 4100 of FIG. 138 along the line 140-140 in FIG. 138. FIG. 144 is another rotated heel-to-toe cross-sectional view of the weight assembly 4104 of the golf club head 4100 of FIG. 138 along the line 140-140 in FIG. 138. FIG. 145 is a perspective view of the weight assembly 4104 of the golf club head 4100 of FIG. 138. FIG. 146 is another perspective view of the weight assembly 4104 of the golf club head 4100 of FIG. 138.

Referring concurrently to FIGS. 138-146, the golf club head 4100 may have some features similar to, or the same as, the features of other golf club heads disclosed herein. The golf club head 4100 may include a body 4106 having an outer surface 4120. The body 4106 may include a toe 4114, a heel 4116, a hosel 4101 disposed at the heel 4116 and configured to couple to a shaft (not shown), a striking face 4108 with a lower leading edge 4110 and an opposite upper topline edge 4112 extending between the toe 4114 and the heel 4116, a sole 4102 extending rearward from the lower leading edge 4110 to a rearward portion 4122 opposite to the lower leading edge 4110, a top portion 4103 extending rearward from the upper topline edge 4112, and a back portion 4150 positioned rearward to the striking face 4108 and coupled between the rearward portion 4122 of the sole 4102 and the top portion 4103. In some examples, the top portion 4103 is omitted, and the back portion 4150 is coupled between the rearward portion 4122 of the sole 4102 and the upper topline edge 4112. The striking face 4108, the sole 4102, and the back portion 4150 may be coupled together so as to define at least part of the outer surface 4120 of the body 4106.

The striking face 4108 may have an outermost surface 4118 and a plurality of grooves 4119 (or score lines) formed in the striking face 4108 to help impart spin on a golf ball when struck by the striking face 4108. The grooves 4119 may extend in a toe-heel direction along the striking face 4108 and may be arranged in a pattern extending from near the lower leading edge 4110 toward the upper topline edge 4112.

The back portion 4150 may include all surfaces of the outer surface 4120 of the body 4106 that are both between the rearward portion of the sole 4102 and the top portion 4103 (or the upper topline edge 4112 in examples where the top portion 4103 is omitted) and also between the toe 4114 and the heel 4116. In some examples, the back portion 4150 includes a lower back surface 4152 coupled between the rearward portion 4122 and the upper topline edge 4112 (e.g., between the rearward portion 4122 and the top portion 4103), a first back surface 4154 coupled between the lower back surface 4152 and the upper topline edge 4112, an intermediate back surface 4155 coupled between the first back surface 4154 and the upper topline edge 4112, and a second back surface 4156 coupled between the intermediate back surface 4155 and the upper topline edge 4112.

A recessed channel 4126 may be defined in the outer surface 4120 of the body 4106 and may generally extend in the toe-heel direction. For example, the recessed channel 4126 may be defined at least in part in the back portion 4150. In the non-limiting example depicted, the recessed channel 4126 is formed at least partially in the first back surface 4154. The golf club head 4100 may include a weight assembly 4104 adapted to couple to the body 4106 at the recessed channel 4126. The recessed channel 4126 and the weight assembly 4104 may respectively have some features similar to, or the same as, the features of other recessed channels and weight assemblies disclosed herein.

In some examples, the weight assembly 4104 includes a weight 4128, a cover 4130, and a fastener 4132. The weight 4128 may be disposed at least partially within the recessed channel 4126 and may be configured to be movable along the toe-heel direction within the recessed channel 4126. The cover 4130 may extend at least partially over the recessed channel 4126 and may be adapted to releasably secure the weight 4128 within the recessed channel 4126. For example, when the weight 4128 is installed in the recessed channel 4126, the cover 4130 may at least partially cover the weight 4128. The fastener 4132 may be configured to couple the cover 4130 to the body 4106 and may be controllably movable along a fastener axis. In some examples, the fastener 4132 is adapted to releasably secure the weight 4128 within the recessed channel 4126 only indirectly by the cover 4130. For example, the fastener 4132 may be configured to retain the weight 4128 within the recessed channel 4126 without directly engaging with the weight 4128. In the non-limiting example depicted, the fastener 4132 is configured to penetrate into the back portion 4150 at a position between the recessed channel 4126 and the rearward portion 4122 of the sole 4102. In some other examples, the fastener 4132 may be configured to penetrate into the back portion 4150 at a position between the recessed channel 4126 and the upper topline edge 4112. In some examples, the cover 4130 is coupled to the fastener 4132 (e.g., via a retaining clip) so that the cover 4130 moves with the fastener 4132 when the fastener 4132 is moved along the fastener axis and so that the fastener 4132 is rotatable relative to the cover 4130. The weight assembly 4104 may be configured to allow a person to adjust the COG of the golf club head 4100 along the toe-heel direction by selectively positioning the weight 4128 in the recessed channel 4126 along the toe-heel direction.

The weight assembly 4104 may be configured to be positionable in at least an unlocked configuration whereby the cover 4130 is raised at least partially out of the recessed channel 4126 and the weight 4128 is selectively movable within the recessed channel 4126, and a locked configuration whereby the cover 4130 is at least partially disposed within the recessed channel 4126 and the weight 4128 is secured within the recessed channel 4126. In some examples, the weight assembly 4104 may be configured to be positionable in a weight removable configuration whereby the cover 4130 is sufficiently raised at least partially (e.g., entirely) out of the recessed channel 4126 such that the weight 4128 may be removed entirely from the recessed channel 4126.

The weight 4128 may include a weight main body 4160 and a protruding tongue 4168 that protrudes from the weight main body 4160. The protruding tongue 4168 may include a proximal tongue portion 4168P and a distal tongue portion 4168D, where the proximal tongue portion 4168P extends between the weight main body 4160 and the distal tongue portion 4168D. For example, the proximal tongue portion 4168P may extend directly from the weight main body 4160, and the distal tongue portion 4168D may extend directly from the proximal tongue portion 4168P. The distal tongue portion 4168D may be bent relative to the proximal tongue portion 4168P. For example, the distal tongue portion 4168D may form any angle within a range of 30 degrees to 150 degrees (e.g., 90 degrees) relative to the proximal tongue portion 4168P at least at where the distal tongue portion 4168D and the proximal tongue portion 4168P are joined. In some embodiments, the protruding tongue 4168 may be integrally formed with weight main body 4160. For example, the weight main body 4160 and the protruding tongue 4168 may be the same in material and form a single, indivisible component. In some examples, the weight main body 4160 and the protruding tongue 4168 are formed utilizing a single mold or cast, or the weight main body 4160 and the protruding tongue 4168 may be formed by removing material from a single piece of material.

The cover 4130 may have a window cutout 4190 penetrating through the cover 4130. For example, the cover 4130 may have an exterior surface 4130E configured to face outwardly from the golf club head 4100 when the weight assembly 4104 is in the locked configuration and an interior surface 41301 configured to face inwardly into the golf club head 4100 (e.g., toward the recessed channel 4126) when the weight assembly 4104 is in the locked configuration, and the window cutout 4190 may extend through the cover 4130 from the exterior surface 4130E to the interior surface 41301. At least part of the weight 4128 and/or the recessed channel 4126 may be exposed by the window cutout 4190. In some embodiments, a longitudinal axis of the window cutout 4190 extends in a substantially same direction as the longitudinal axis of the recessed channel 4126 (e.g., the toe-heel direction).

The cover 4130 may have a slot cutout 4193 penetrating through the cover 4130 (e.g., from the exterior surface 4130E to the interior surface 41301) and joined to (e.g., extending from) a portion of the window cutout 4190. The slot cutout 4193 and the portion of the window cutout 4190 that the slot cutout 4193 is joined to may form an opening 4195 in the cover 4130 that is shaped and sized for at least part of the protruding tongue 4168 to extend through. As explained in more detail below, the opening 4195 may allow the weight 4128 to be coupled to or installed onto the cover 4130 (e.g., during manufacturing of the golf club head 4100 or by a golfer).

The slot cutout 4193 may extend from any portion of the window cutout 4190 and may extend in a direction substantially perpendicular to the toe-heel direction. In the non-limiting example depicted, the slot cutout 4193 extends from a middle portion of the window cutout 4190 between a toe end of the window cutout 4190 proximal to the toe 4114 and a heel end of the window cutout 4190 proximal to the heel 4116. In some other examples, the slot cutout 4193 extends from toe end of the window cutout 4190 or from the heel end of the window cutout 4190. In the non-limiting example depicted, the slot cutout 4193 extends towards the rearward portion 4122 of the sole 4102 (or toward the fastener 4132 or away from the upper topline edge 4112 of the striking face 4108). In some other examples, the slot cutout 4193 extends away from the rearward portion 4122 of the sole 4102 (or away from the fastener 4132 or toward the upper topline edge 4112 of the striking face 4108).

The weight assembly 4104 may include a slot wedge 4185 configured to be coupled to the cover 4130 (e.g., configured to be fitted into the slot cutout 4193) and to at least partially fill the slot cutout 4193 when coupled to the cover 4130. For example, the slot wedge 4185 may correspond in shape and size to at least part of the slot cutout 4193. In some examples, the slot wedge 4185 may be couplable to the cover 4130 via at least one of a force fit, a snap fit, an adhesive, or a fastener. In the non-limiting depicted example, the slot wedge 4185 is a snap clip (e.g., a double tapered clip) including a hooked arm 4185A and having an indent 41851 adjacent to the hooked arm 4185A. The snap clip is configured such that the hooked arm 4185A bends toward the indent 41851 while the slot wedge 4185 is pressed through the slot cutout 4193 from the exterior surface 4130E toward the interior surface 41301, and the hooked arm 4185A snaps back into place after the slot wedge 4185 is pressed through the slot cutout 4193 by a set distance (e.g., after a hook of the hooked arm 4185A extends beyond the interior surface 41301). When the hooked arm 4185A snaps back into place, the hook of the hooked arm 4185A may wrap around part of the interior surface 41301. In some examples, the cover 4130 and slot wedge 4185 may be configured so that the slot wedge 4185 can be fixedly coupled to the cover 4130, or the cover 4130 and the slot wedge 4185 may be configured so that the slot wedge 4185 is couplabe to, and decouplable from, the cover 4130.

The window cutout 4190 may be defined at least in part by the slot wedge 4185 when the slot wedge 4185 is coupled to the cover 4130. The window cutout 4190 may be shaped and sized for a first part of the protruding tongue 4168 to extend through window cutout 4190 while blocking movement through the window cutout 4190 of a second part of the protruding tongue 4168 coupled to the weight main body 4160 via the first part. For example, the window cutout 4190 may be shaped and sized to block at least part of the distal tongue portion 4168D from moving through the window cutout 4190 when the proximal tongue portion 4168P extends through the window cutout 4190 and the slot wedge 4185 is coupled to the cover 4130. The slot wedge 4185 may therefore block the weight 4128 from falling through the opening 4195 and decoupling from the cover 4130. In some examples, the slot wedge 4185 may be omitted so that the weight 4128 is at least partially movable through the opening 4195 and attachable and detachable from the cover 4130 via the opening 4195.

Because the slot wedge 4185 prevents the weight 4128 from decoupling from the cover 4130, the weight assembly 4104 may be configured such that, when the weight 4128 is coupled onto the cover 4130 and the slot wedge 4185 is fitted into the slot cutout 4193, the weight 4128 moves with the cover 4130 when the cover 4130 moves between the locked configuration and the unlocked configuration.

The weight 4128 may be slidingly engaged with the cover 4130. For example, the weight 4128 may have a groove 4163 at least partially defined by the protruding tongue 4168 (e.g., by the protruding tongue 4168 together with at least a portion of the weight main body 4160). The groove 4163 may slidingly engage the weight 4128 with the cover 4130, for example, by slidingly engaging with part of a perimeter of the window cutout 4190. In some examples, the distal tongue portion 4168D and the proximal tongue portion 4168P form part of the groove 4163 together with a portion of the weight main body 4160 such that the proximal tongue portion 4168P forms a bottom of the groove 4163 and the distal tongue portion 4168D extends over part of the exterior surface 4130E of the cover 4130. In the non-limiting example depicted, the distal tongue portion 4168D extends over part of the exterior surface 4130E toward the upper topline edge 4112 of the striking face 4108 (or away from the fastener 4132 or away from the rearward portion 4122 of the sole 4102). In some other examples, the distal tongue portion 4168D is configured, when the weight 4128 is coupled to the cover 4130, to extend over part of the exterior surface 4130E of the cover 4130 away from the upper topline edge 4112 of the striking face 4108 (or toward the fastener 4132 or toward the rearward portion 4122 of the sole 4102).

The cover 4130 may have one or more position markings 4130M on the exterior surface 4130E of the cover 4130, and the weight 4128 may have one or more position markings 4128M on the protruding tongue 4168. The weight assembly 4104 may be configured such that the weight 4128 is positionable relative to the cover 4130 to align the one or more position markings 4128M on the weight 4128 with the one or more position markings 4130M on the cover 4130. The one or more position markings 4128M on the weight 4128 and the one or more position markings 4130M on the cover 4130 may allow the position of the weight 4128 in the recessed channel 4126 to be indicated. In the non-limiting example depicted, the weight 4128 has one position marking 4128M on the distal tongue portion 4168D, and the cover 4130 has five position markings 4130M on the exterior surface 4130E of the cover 4130.

The golf club head 4100 may include one or more locating lugs 4134 in the recessed channel 4126 (e.g., protruding into the recessed channel 4126, for example, from a bottom track of the recessed channel 4126), and the weight 4128 may have an indent 4162 shaped and sized to receive at least part of the one or more locating lugs 4134. The weight 4128 may be configured to selectively engage with the one or more locating lugs 4134 via the indent 4162. The one or more locating lugs 4134 may define positions in the recessed channel 4126 that the weight 4128 may be positioned at when the cover 4130 is in the locked configuration. In some examples, the weight assembly 4104 is configured such that, when the cover 4130 is in the unlocked configuration, the weight 4128 is raised with the cover 4130 above the one or more locating lugs 4134 and is movable relative to the cover 4130.

FIG. 147 is a back perspective view of another golf club head 4200 with a weight assembly 4204 in a locked configuration. The golf club head 4200 is depicted as being an iron type golf club head, in particular, a wedge type golf club head. In some examples, the present disclosure is not limited thereto. In some examples, the golf club head may be a metal wood type golf club head, a hybrid type golf club head, or an iron type golf club head. FIG. 148 is another back perspective view of the golf club head 4200 of FIG. 147 with the weight assembly 4204 in the locked configuration. FIG. 149 is a heel-to-toe cross-sectional view of the golf club head 4200 of FIG. 147 along the line 149-149 in FIG. 148 and with the weight assembly 4204 in the locked configuration.

Referring concurrently to FIGS. 147-149, the golf club head 4200 may have some features similar to, or the same as, the features of other golf club heads disclosed herein, including, without limitation, the golf club head 4100. The golf club head 4200 may include a body 4206 having an outer surface 4220. The body 4206 may include a toe 4214, a heel 4216, a hosel 4201 disposed at the heel 4216 and configured to couple to a shaft (not shown), a striking face 4208 with a lower leading edge 4210 and an opposite upper topline edge 4212 extending between the toe 4214 and the heel 4216, a sole 4202 extending rearward from the lower leading edge 4210 to a rearward portion 4222 opposite to the lower leading edge 4210, a top portion 4203 extending rearward from the upper topline edge 4212, and a back portion 4250 positioned rearward to the striking face 4208 and coupled between the rearward portion 4222 of the sole 4202 and the top portion 4203. In some examples, the top portion 4203 is omitted, and the back portion 4250 is coupled between the rearward portion 4222 of the sole 4202 and the upper topline edge 4212. The striking face 4208, the sole 4202, and the back portion 4250 may be coupled together so as to define at least part of the outer surface 4220 of the body 4206.

The striking face 4208 may have an outermost surface 4218 and a plurality of grooves 4219 (or score lines) formed in the striking face 4208 to help impart spin on a golf ball when struck by the striking face 4208. The grooves 4219 may extend in a toe-heel direction along the striking face 4208 and may be arranged in a pattern extending from near the lower leading edge 4210 toward the upper topline edge 4212.

The back portion 4250 may include all surfaces of the outer surface 4220 of the body 4206 that are both between the rearward portion 4222 of the sole 4202 and the top portion 4203 (or the upper topline edge 4212 in examples where the top portion 4203 is omitted) and also between the toe 4214 and the heel 4216. In some examples, the back portion 4250 includes a lower back surface 4252 coupled between the rearward portion 4222 and the upper topline edge 4212 (e.g., between the rearward portion 4222 and the top portion 4203), a first back surface 4254 coupled between the lower back surface 4252 and the upper topline edge 4212, an intermediate back surface 4255 coupled between the first back surface 4254 and the upper topline edge 4212, and a second back surface 4256 coupled between the intermediate back surface 4255 and the upper topline edge 4212.

A recessed channel 4226 may be defined in the outer surface 4220 of the body 4206 and may generally extend in the toe-heel direction. For example, the recessed channel 4226 may be defined at least in part in the back portion 4250. In the non-limiting example depicted, the recessed channel 4226 is formed at least partially in the first back surface 4254. The golf club head 4200 may include a weight assembly 4204 adapted to couple to the body 4206 at the recessed channel 4226. The recessed channel 4226 and the weight assembly 4204 may respectively have some features similar to, or the same as, the features of other recessed channels and weight assemblies disclosed herein, including, without limitation, the recessed channel 4126 and the weight assembly 4104.

In some examples, the weight assembly 4204 includes a weight 4228, a cover 4230, and a fastener 4232. The weight 4228 may be disposed at least partially within the recessed channel 4226 and may be configured to be movable along the toe-heel direction within the recessed channel 4226. The cover 4230 may extend at least partially over the recessed channel 4226 and may be adapted to releasably secure the weight 4228 within the recessed channel 4226. For example, the cover 4230 may at least partially cover the weight 4228. The fastener 4232 may be configured to couple the cover 4230 to the body 4206 and may be controllably movable along a fastener axis. In some examples, the fastener 4232 is adapted to releasably secure the weight 4228 within the recessed channel 4226 only indirectly by the cover 4230. For example, the fastener 4232 may be configured to retain the weight 4228 within the recessed channel 4226 without directly engaging with the weight 4228. In some examples, the cover 4230 is coupled to the fastener 4232 (e.g., via a retaining clip) so that the cover 4230 moves with the fastener 4232 when the fastener 4232 is moved along the fastener axis and so that the fastener 4232 is rotatable relative to the cover 4230. The weight assembly 4204 may be configured to allow a person to adjust the COG of the golf club head 4200 along the toe-heel direction by selectively positioning the weight 4228 in the recessed channel 4226 along the toe-heel direction.

The weight assembly 4204 may be configured to be positionable in at least an unlocked configuration whereby the cover 4230 is raised at least partially out of the recessed channel 4226 and the weight 4228 is selectively movable within the recessed channel 4226, and a locked configuration whereby the cover 4230 is at least partially disposed within the recessed channel 4226 and the weight 4228 is secured within the recessed channel 4226. In some examples, the weight assembly 4204 may be configured to be positionable in a weight removable configuration whereby the cover 4230 is sufficiently raised at least partially (e.g., entirely) out of the recessed channel 4226 such that the weight 4228 may be removed entirely from the recessed channel 4226.

The weight 4228 may include a weight main body 4260 and a protruding tongue 4268 protruding from the weight main body 4260. In some examples, the protruding tongue 4268 includes a distal tongue portion 4268D and a proximal tongue portion 4268P extending between (e.g., directly between) the weight main body 4260 and the distal tongue portion 4268D. The protruding tongue 4268 may be integrally formed with the weight main body 4260.

The cover 4230 may have a window cutout 4290 penetrating through the cover 4230 and having a longitudinal axis extending in substantially a same direction as a longitudinal axis of the recessed channel 4226 (e.g., the toe-heel direction), and the cover 4230 may have a slot cutout 4293 joined to a portion of the window cutout 4290 and forming, together with the portion of the window cutout 4290, an opening 4295 in the cover 4230. The opening 4295 may be shaped and sized for the protruding tongue 4268 to move through the opening 4295 so that the weight 4228 can be coupled to the cover 4230. One or more portions of the window cutout 4290 adjacent to the opening 4295 may be shaped and sized to block a first portion of the protruding tongue 4268 (e.g., the distal tongue portion 4268D) from moving therethrough while allowing a second portion of the protruding tongue 4268 (e.g., the proximal tongue portion 4268P) that extends between the weight main body 4260 and the first portion to extend therethrough.

In the non-limiting example depicted, the slot cutout 4293 extends away from the rearward portion 4222 of the sole 4202 (or away from the fastener 4232 or toward the upper topline edge 4212). In some examples, the weight assembly 4204 has a slot wedge similar to slot wedge 4185 (not show) couplable to the cover 4230 (e.g., configured to be fitted into the slot cutout 4293) to at least partially fill the slot cutout 4293, and the window cutout 4290 may be partially defined by the slot wedge when the slot wedge is coupled to the cover 4230. In some other examples, the slot wedge is omitted.

The weight 4228 may be slidingly engaged with the cover 4230. For example, the weight 4228 may have a groove 4263 formed at least in part by the protruding tongue 4268 (e.g., in part by the protruding tongue 4268 and in part by the weight main body 4260), and the weight 4228 may slidingly engage with the cover 4230 via the groove 4263. For example, the groove 4263 may be shaped and sized to receive a side of the cover 4230 that forms at least part of a perimeter of the window cutout 4290.

In some examples, the body 4206 may include one or more locating lugs 4234 in the recessed channel 4226 (e.g., protruding into the recessed channel 4226 from a bottom track of the recessed channel 4226), and the weight 4228 may have an indent 4262 shaped and sized to receive at least part of the one or more locating lugs 4234. The one or more locating lugs 4234 may define positions within the recessed channel 4226 that the weight 4228 is positionable at when the cover 4230 is in the locked configuration.

In some examples, the cover 4230 has one or more position markings 4230M, the weight 4228 has one or more position markings 4228M, and the weight 4228 is positionable relative to the cover 4230 such that the one or more position markings 4228M on the weight 4228 are alignable with the one or more position markings 4230M on the cover 4230. The position of the weight 4228 may be indicated by which position markings 4230M on the cover 4230 are aligned with the one or more position markings 4228M on the weight 4228. Positions of the one or more position markings 4230M on the cover 4230 may respectively correspond to positions of the one or more locating lugs 4234 in the recessed channel 4226.

FIG. 150 is a back perspective view of another golf club head 4300 with a weight assembly 4304 in a locked configuration. The golf club head 4300 is depicted as being an iron type golf club head, in particular, a wedge type golf club head. In some examples, the present disclosure is not limited thereto. In some examples, the golf club head may be a metal wood type golf club head, a hybrid type golf club head, or an iron type golf club head. FIG. 151 is a heel-to-toe cross-sectional view of the golf club head 4300 of FIG. 150 along the line 151-151 in FIG. 150 and when the weight assembly 4304 is in the locked configuration. FIG. 152 is a perspective view of the weight assembly 4304 of the golf club head 4300 of FIG. 150. FIG. 153 is another back perspective view of the golf club head 4300 of FIG. 150. FIG. 154 is a cross-sectional view of the golf club head 4300 of FIG. 150 along line 154-154 in FIG. 153.

Referring concurrently to FIGS. 150-154, the golf club head 4300 may have some features similar to, or the same as, the features of other golf club heads disclosed herein, including, without limitation, the golf club heads 4100 and 4200. The golf club head 4300 may include a body 4306 having an outer surface 4320. The body 4106 may include a toe 4314, a heel 4316, a hosel 4301 disposed at the heel 4316 and configured to couple to a shaft (not shown), a striking face 4308 with a lower leading edge 4310 and an opposite upper topline edge 4312 extending between the toe 4314 and the heel 4316, a sole 4302 extending rearward from the lower leading edge 4310 to a rearward portion 4322 opposite to the lower leading edge 4310, a top portion 4303 extending rearward from the upper topline edge 4312, and a back portion 4350 positioned rearward to the striking face 4308 and coupled between the rearward portion 4322 of the sole 4302 and the top portion 4303. In some examples, the top portion 4303 is omitted, and the back portion 4350 is coupled between the rearward portion 4322 of the sole 4302 and the upper topline edge 4312. The striking face 4308, the sole 4302, and the back portion 4350 may be coupled together so as to define at least part of the outer surface 4320 of the body 4306.

The striking face 4308 may have an outermost surface 4318 and a plurality of grooves 4319 (or score lines) formed in the striking face 4308 to help impart spin on a golf ball when struck by the striking face 4308. The grooves 4319 may extend in a toe-heel direction along the striking face 4308 and may be arranged in a pattern extending from near the lower leading edge 4310 toward the upper topline edge 4312.

The back portion 4350 may include all surfaces of the outer surface 4320 of the body 4306 that are both between the rearward portion of the sole 4302 and the top portion 4303 (or the upper topline edge 4312 in examples where the top portion 4303 is omitted) and also between the toe 4314 and the heel 4316. In some examples, the back portion 4350 includes a lower back surface 4352 coupled between the rearward portion 4322 and the upper topline edge 4312 (e.g., between the rearward portion 4322 and the top portion 4303), a first back surface 4354 coupled between the lower back surface 4352 and the upper topline edge 4312, an intermediate back surface 4355 coupled between the first back surface 4354 and the upper topline edge 4312, and a second back surface 4356 coupled between the intermediate back surface 4355 and the upper topline edge 4312.

A recessed channel 4326 may be defined in the outer surface 4320 of the body 4306 and may generally extend in the toe-heel direction. For example, the recessed channel 4326 may be defined at least in part in the back portion 4350. In the non-limiting example depicted, the recessed channel 4326 is formed at least partially in the first back surface 4354. The golf club head 4300 may include a weight assembly 4304 adapted to couple to the body 4306 at the recessed channel 4326. The recessed channel 4326 and the weight assembly 4304 may respectively have some features similar to, or the same as, the features of other recessed channels and weight assemblies disclosed herein, including, without limitation, the recessed channels 4126 and 4226 and the weight assemblies 4104 and 4204.

In some examples, the weight assembly 4304 includes a weight 4328, a cover 4330, and a fastener 4332. The weight 4328 may be disposed at least partially within the recessed channel 4326 and may be configured to be movable along the toe-heel direction within the recessed channel 4326. The cover 4330 may extend at least partially over the recessed channel 4326 and may be adapted to releasably secure the weight 4328 within the recessed channel 4326. For example, the cover 4330 may at least partially cover the weight 4328. The fastener 4332 may be configured to couple the cover 4330 to the body 4306 and may be controllably movable along a fastener axis. In some examples, the fastener 4332 is adapted to releasably secure the weight 4328 within the recessed channel 4326 only indirectly by the cover 4330. For example, the fastener 4332 may be configured to retain the weight 4328 within the recessed channel 4326 without directly engaging with the weight 4328. In some examples, the cover 4330 is coupled to the fastener 4332 (e.g., via a retaining clip) so that the cover 4330 moves with the fastener 4332 when the fastener 43332 is moved along the fastener axis and so that the fastener 4332 is rotatable relative to the cover 4330. The weight assembly 4304 may be configured to allow a person to adjust the COG of the golf club head 4300 along the toe-heel direction by selectively positioning the weight 4328 in the recessed channel 4326 along the toe-heel direction.

The weight assembly 4304 may be configured to be positionable in at least an unlocked configuration whereby the cover 4330 is raised at least partially out of the recessed channel 4326 and the weight 4328 is selectively movable within the recessed channel 4326, and a locked configuration whereby the cover 4330 is at least partially disposed within the recessed channel 4326 and the weight 4328 is secured within the recessed channel 4326. In some examples, the weight assembly 4304 may be configured to be positionable in a weight removable configuration whereby the cover 4330 is sufficiently raised at least partially (e.g., entirely) out of the recessed channel 4326 such that the weight 4328 may be removed entirely from the recessed channel 4326.

The weight 4328 may include a weight main body 4360 and a protruding tongue 4368 that protrudes from the weight main body 4360. In some examples, the protruding tongue includes a proximal tongue portion 4368P and a distal tongue portion 4368D. The distal tongue portion 4368D may extend from the proximal tongue portion 4368P and may be bent relative to the proximal tongue portion 4368P. In some examples, the protruding tongue 4368 is not integrally formed with the weight main body 4360. For example, the weight main body 4360 and the protruding tongue 4368 may be separately fabricated. The protruding tongue 4368 may be couplable to the weight main body 4360, for example, via at least one of a force fit, a snap fit, an adhesive, or a fastener. In some examples, the protruding tongue 4368 may be configured to be fixedly coupled to the weight main body 4360 such that the protruding tongue 4368 is not configured to be decouplable from the weight main body 4360 after being coupled to the weight main body 4360. In some other examples, the protruding tongue 4368 is couplable to, and decouplable from, the weight main body 4360. The protruding tongue 4368 may be configured to couple to the weight main body 4360 via the proximal tongue portion 4368P such that, when the protruding tongue 4368 is coupled to the weight main body 4360, the proximal tongue portion 4368P extends between (e.g., directly between) the weight main body 4360 and the distal tongue portion 4368D.

In some examples, the weight main body 4360 has a weight pocket 4360P shaped and sized to receive at least part of the protruding tongue 4368 (e.g., at least part of the protruding tongue portion 4368P). The weight 4328 may be configured for the protruding tongue 4368 to couple to the weight main body 4360 when inserted into (e.g., inserted a set distance into) the weight pocket 4360P. For example, referring to FIGS. 152 and 154, in the non-limiting example depicted, the protruding tongue 4368 may be a snap-in tab configured to lock onto the weight main body 4360 in response to being inserted into the weight pocket 4360P. In some examples, the snap-in tab may include one or more hooked arms 4368A that are configured to bend while being inserted through the weight pocket 4360P and to snap back into place in response to the protruding tongue 4368 being inserted past a set distance through the weight pocket 4360P. The weight 4328 may be configured such that hooks at ends of the one or more hooked arms 4368A latch onto corresponding surfaces within the weight main body 4360 after snapping back into place. In the non-limiting example depicted, the protruding tongue 4368 includes two hooked arms 4368A, a center piece 4368C between the two hooked arms 4368A, and two indents 43681 respectively between the two hooked arms 4368A and the center piece 4368C. The weight 4328 is configured such that, as the protruding tongue 4368 is inserted through the weight pocket 4360P, the two hooked arms 4368A bend into the two indents 43681 towards the center piece 4368C, and the two hooked arms 4368A snap back into place once the protruding tongue 4368 is inserted through the weight pocket 4360P by a set distance. When the two hooked arms 4368A snap back into place, hooks at the ends of the two hooked arms 4368A may wrap around respective interior surfaces in the weight pocket 4360P to resist movement of the protruding tongue 4368 outwards from the weight pocket 4360P.

The cover 4330 may have a window cutout 4390 penetrating through the cover 4330 and having a longitudinal axis extending in a substantially similar direction as a longitudinal axis of the recessed channel 4326 (e.g., the toe-heel direction). The window cutout 4390 may be shaped and sized to block movement of a first portion of the protruding tongue 4368 (e.g., the distal tongue portion 4368D) from moving through the window cutout 4390 while allowing a second portion of the protruding tongue 4368 (e.g., the proximal tongue portion 4368P) extending between the weight main body 4360 and the first portion to extend through the window cutout 4390. For example, when the protruding tongue 4368 is coupled to the weight main body 4360, the window cutout 4390 may be shaped and sized for at least part of the proximal tongue portion 4368P to extend therethrough but to block at least part of the distal tongue portion 4368D from moving therethrough. The window cutout 4390 may therefore allow the weight 4328 to couple to the cover 4330 such that the weight 4328 is movable with the cover 4330 (e.g., when the cover 4330 moves between the locked configuration and the unlocked configuration) by blocking the distal tongue portion 4368D from moving through (e.g., falling through) the window cutout 4390.

In the non-limiting example depicted, the cover 4330 does not include a slot cutout that forms, together with a portion of the window cutout 4390, an opening shaped and sized for the distal tongue portion 4368D to move therethrough. However, because the weight main body 4360 and the protruding tongue 4368 are separate and couplable together, the weight 4328 can be installed onto the cover 4330 by positioning the weight main body 4360 on one side of the cover 4330 (e.g., an interior side of the cover 4330), positioning the protruding tongue 4368 on another side of the cover 4330 (e.g., an exterior side of the cover 4330), and coupling the protruding tongue 4368 to the weight main body 4360 through the window cutout 4390. For example, the proximal tongue portion 4368P can be inserted through the window cutout 4390 and then coupled to (e.g., inserted into the weight pocket 4360P) the weight main body 4360. In some other examples, the cover 4330 may include a slot cutout similar to, or the same as, other slot cutouts described herein, and the weight assembly 4304 may include a slot wedge similar to, or the same as, other slot wedges described herein.

The weight 4328 may be slidingly engaged with the cover 4330. For example, the weight 4328 may have a groove 4363 formed at least in part by the protruding tongue 4368 (e.g., in part by the protruding tongue 4368 and in part by the weight main body 4360), and the weight 4328 may slidingly engage with the cover 4330 via the groove 4363. For example, the groove 4363 may be shaped and sized to receive a side of the cover 4330 that forms at least part of a perimeter of the window cutout 4390.

In some examples, the body 4306 may include one or more locating lugs 4334 in the recessed channel 4326 (e.g., protruding into the recessed channel 4326 from a bottom track of the recessed channel 4326), and the weight 4328 may have an indent 4362 shaped and sized to receive at least part of the one or more locating lugs 4334. The one or more locating lugs 4334 may define positions within the recessed channel 4326 that the weight 4328 is positionable at when the cover 4330 is in the locked configuration.

In some examples, the cover 4330 has one or more position markings 4330M, the weight 4328 has one or more position markings 4328M, and the weight 4328 is positionable relative to the cover such that the one or more position markings 4328M on the weight 4328 are alignable with the one or more position markings 4330M on the cover 4330. The position of the weight 4328 may be indicated by which position markings 4330M on the cover 4330 are aligned with the one or more position markings 4328M on the weight 4328. Positions of the one or more position markings 4330M on the cover 4330 may respectively correspond to positions of the one or more locating lugs 4334 in the recessed channel 4326.

FIG. 155 is a back perspective view of another golf club head 4400 with a weight assembly 4404 in a locked configuration. The golf club head 4400 is depicted as being an iron type golf club head, in particular, a wedge type golf club head. In some examples, the present disclosure is not limited thereto. In some examples, the golf club head may be a metal wood type golf club head, a hybrid type golf club head, or an iron type golf club head. FIG. 156 is a partially exploded toe perspective view of the golf club head 4400 of FIG. 155. FIG. 157 is a toe-to-heel cross-sectional view of a body 4406 of the golf club head 4400 of FIG. 155 along line 157-157 in FIG. 155, and a partially exploded view of the weight assembly 4404. FIG. 158 is a toe-to-heel cross-sectional view of the golf club head 4400 of FIG. 155 along line 157-157 in FIG. 155 and with the weight assembly 4404 in an unlocked configuration. FIG. 159 is a partially exploded back perspective view of the golf club head 4400 of FIG. 155. FIG. 160 is a back perspective view of the golf club head 4400 of FIG. 155 with the weight assembly 4404 in the locked configuration. FIG. 161 is another back perspective view of the golf club head 4400 of FIG. 155 with the weight assembly 4404 part way between the locked configuration and the unlocked configuration. FIG. 162 is another back perspective view of the golf club head 4400 of FIG. 155 with the weight assembly 4404 in the unlocked configuration.

Referring concurrently to FIGS. 155-162, the golf club head 4400 may have some features similar to, or the same as, the features of other golf club heads disclosed herein. The golf club head 4400 may include a body 4406 having an outer surface 4420. The body 4406 may include a toe 4414, a heel 4416, a hosel 4401 disposed at the heel 4416 and configured to couple to a shaft (not shown), a striking face 4408 with a lower leading edge 4410 and an opposite upper topline edge 4412 extending between the toe 4414 and the heel 4416, a sole 4402 extending rearward from the lower leading edge 4410 to a rearward portion 4422 opposite to the lower leading edge 4410, a top portion 4403 extending rearward from the upper topline edge 4412, and a back portion 4450 positioned rearward to the striking face 4408 and coupled between the rearward portion 4422 of the sole 4402 and the top portion 4403. In some examples, the top portion 4403 is omitted, and the back portion 4450 is coupled between the rearward portion 4422 of the sole 4402 and the upper topline edge 4412. The striking face 4408, the sole 4402, and the back portion 4450 may be coupled together so as to define at least part of the outer surface 4420 of the body 4406.

The striking face 4408 may have an outermost surface 4418 and a plurality of grooves 4419 (or score lines) formed in the striking face 4408 to help impart spin on a golf ball when struck by the striking face 4408. The grooves 4419 may extend in a toe-heel direction along the striking face 4408 and may be arranged in a pattern extending from near the lower leading edge 4410 toward the upper topline edge 4412.

The back portion 4450 may include all surfaces of the outer surface 4420 of the body 4406 that are both between the rearward portion of the sole 4402 and the top portion 4403 (or the upper topline edge 4412 in examples where the top portion 4403 is omitted) and also between the toe 4414 and the heel 4416. In some examples, the back portion 4450 includes a lower back surface 4452 coupled between the rearward portion 4422 and the upper topline edge 4412 (e.g., between the rearward portion 4422 and the top portion 4403), a first back surface 4454 coupled between the lower back surface 4452 and the upper topline edge 4412, an intermediate back surface 4455 coupled between the first back surface 4454 and the upper topline edge 4412, and a second back surface 4456 coupled between the intermediate back surface 4455 and the upper topline edge 4412.

A recessed channel 4426 may be defined in the outer surface 4420 of the body 4406 and may generally extend in the toe-heel direction. For example, the recessed channel 4426 may be defined at least in part in the back portion 4450. In the non-limiting example depicted, the recessed channel 4426 is formed at least partially in the first back surface 4454. The golf club head 4400 may include a weight assembly 4404 adapted to couple to the body 4406 at the recessed channel 4426. The recessed channel 4426 and the weight assembly 4404 may respectively have some features similar to, or the same as, the features of other recessed channels and weight assemblies disclosed herein.

In some examples, the weight assembly 4404 includes a weight 4428, a cover 4430, and a fastener 4432. The weight 4428 may be disposed at least partially within the recessed channel 4426 and may be configured to be movable along the toe-heel direction within the recessed channel 4426. The cover 4430 may extend at least partially over the recessed channel 4426 and may be adapted to releasably secure the weight 4428 within the recessed channel 4426. For example, the cover 4430 may at least partially cover the weight 4428. The fastener 4432 may be configured to couple the cover 4430 to the body 4406 and may be controllably movable along a fastener axis. In some examples, the fastener 4432 is adapted to releasably secure the weight 4428 within the recessed channel 4426 only indirectly by the cover 4430. For example, the fastener 4432 may be configured to retain the weight 4428 within the recessed channel 4426 without directly engaging with the weight 4428. The weight assembly 4404 may be configured to allow a person to adjust the COG of the golf club head 4400 along the toe-heel direction by selectively positioning the weight 4428 in the recessed channel 4426 along the toe-heel direction.

The weight assembly 4404 may be configured to be positionable in at least an unlocked configuration whereby the cover 4430 is raised at least partially out of the recessed channel 4426 and the weight 4428 is selectively movable within the recessed channel 4426, and a locked configuration whereby the cover 4430 is at least partially disposed within the recessed channel 4426 and the weight 4428 is secured within the recessed channel 4426. In some examples, the weight assembly 4404 may be configured to be positionable in a weight removable configuration whereby the cover 4430 is sufficiently raised at least partially (e.g., entirely) out of the recessed channel 4426 such that the weight 4428 may be removed entirely from the recessed channel 4426.

The weight 4428 may be configured to engage (e.g., slidingly engage) with the cover 4430 so that the weight 4428 moves with the cover 4430 between the locked configuration and the unlocked configuration. For example, the cover 4430 may include a protruding rail 4458 extending along a substantially same direction as the recessed channel 4426 (e.g., in the toe-heel direction), and the weight 4428 may have a groove 4466 shaped and sized to receive at least part of the protruding rail 4458. The weight 4428 may slidingly engage with the cover 4430 via the groove 4466 engaging with the rail 4458. The cover 4430 may have an exterior surface 4430E facing outwardly from the golf club head 4400 and an interior surface 44301 facing inwardly into the golf club head 4400 (e.g., toward the recessed channel 4426), and the protruding rail 4458 may protrude from the interior surface 44301 of the golf club head 4400. In some examples, the weight 4428 may have a protruding rail, and the cover 4430 may have a groove shaped and sized to receive at least part of the protruding rail of the cover to sliding engage the weight 4428 to the cover 4430.

The weight 4428 may be configured to engage the cover 4430 at an upper portion of the weight 4428. For example, the weight 4428 may have a lower end 4428L proximal to a bottom track 4436 of the recessed channel 4426 (e.g., proximal to the lower leading edge 4410 or distal from the upper topline edge 4412) when the weight assembly 4404 is in the locked configuration, and the weight 4428 may have an upper end 4428U distal from the bottom track 4436 (e.g., distal from the lower leading edge 4410 or proximal to the upper topline edge 4412) when the weight assembly 4404 is in the locked configuration. The weight 4428 may engage with the cover 4430 at a position on the weight 4428 closer to the upper end 4428U of the weight 4428 than to the lower end 4428L of the weight 4428. The bottom track 4436 of the recessed channel 4426 may be a portion (e.g., floor) of the recessed channel 4426 offset from the outer surface 4420 of the body 4406. In some examples, the weight 4428 has a weight opening 44280 between the lower end 4428L of the weight 4428 and the upper end 4428U of the weight 4428, and the groove 4466 is positioned between the weight opening 44280 and the upper end 4428U of the weight 4428. In some examples, the weight 4428 only directly engages with the cover 4430 at the groove 4466, and a portion of the weight 4428 between the groove 4466 and the lower end 4428L of the weight 4428 may be only indirectly coupled to the cover 4430 via the groove 4466.

The cover 4430 may have a window cutout 4490 penetrating through the cover 4430 from the exterior surface 4430E to the interior surface 44301 and have a longitudinal axis extending in a substantially same direction as the longitudinal axis of the recessed channel 4426 (e.g., the toe-heel direction). The weight assembly 4404 may be configured such that the weight opening 44280 aligns with the window cutout 4490 when the weight 4428 is engaged with the cover 4430. In some examples, the weight opening 44280 extends entirely through the weight 4428 to define a hole penetrating through the weight 4428. In some other examples, the weight opening 44280 extends part way through the weight 4428 from a surface of the weight 4428 facing the window cutout 4490 to define an indent in the weight 4428. The weight opening 44280 may be shaped and sized to be engaged via a tool (e.g., a pencil or other object) or a person's finger to allow the weight 4428 to be moved (e.g., slid) relative to the cover 4430 via the tool or person's finger, and the window cutout 4490 may be shaped and sized for the tool or person's finger to extend through the window cutout 4490 to enable the tool or person's finger to engage the weight 4428 via the weight opening 44280.

The body 4406 may have a slide panel 4487 in the recessed channel 4426. For example, the slide panel 4487 may protrude into, and at least partially through, the recessed channel 4426 from at least one of the surfaces defining the recessed channel 4426. In some examples, the slide panel 4487 protrudes from the bottom track 4436 through the recessed channel 4426 and past an opening of the recessed channel 4426 in the outer surface 4420 of the body 4406. The longitudinal axis of the slide panel 4487 may extend within the recessed channel 4426 along a substantially same direction as the longitudinal axis of the recessed channel 4426 (e.g., the toe-heel direction). In some examples, the slide panel 4487 extends at least partly (e.g., partly or entirely) between a toe-end wall of the recessed channel 4426 and a heel-end wall of the recessed channel 4426.

The weight assembly 4404 may be configured for the cover 4430 and the weight 4428 to move (e.g., slide) up and down along the slide panel 4487 as the cover 4430 moves between the locked configuration and the unlocked configuration. For example, a portion of cover 4430 and a portion of the weight 4428 may be positionable on opposite sides of the slide panel 4487 and may contact (e.g., press up against) the slide panel 4487. As the cover 4430 moves from the locked configuration to the unlocked configuration, the weight 4428 and the cover 4430 may move up along the slide panel 4487. The weight 4428 may be slidingly engaged with the cover 4430 so that the weight 4428 is slidable relative to the cover 4430 along a first direction (e.g., the toe-heel direction), and the weight assembly may be configured for the cover 4430 and the weight 4428 to slide along the slide panel 4487 along a second direction different from the first direction (e.g., a direction substantially perpendicular to the toe-heel direction).

The slide panel 4487 may be shaped and sized so that, when the cover 4430 is in the locked configuration, the slide panel 4487 is at least partially positioned between window cutout 4490 and the weight opening 44280 to visibly block the weight opening 44870. This can enhance the aesthetics of the golf club head 4400, and block dirt or other matter from entering the weight opening 44280 and the recessed channel 4426, when the cover 4430 is in the locked configuration. The slide panel 4487 may be shaped and sized so that, when the cover 4430 is in the locked configuration, the cover 4430 and the weight 4428 are raised sufficiently high so that the weight opening 44280 is at least partially exposed through the window cutout 4490. This can allow the weight opening 44280 to be engaged through the window cutout 4490 via a tool or person's finger to adjust the position of the weight 4428 in the recessed channel 4426.

The golf club head 4400 may include one or more locating lugs 4434 in the recessed channel 4426 (e.g., protruding into the recessed channel 4426, for example, from a portion of the bottom track of the recessed channel 4426 that is on a same side of the slide panel 4487 as the weight 4428), and the weight 4428 may have an indent 4462 shaped and sized to receive at least part of the one or more locating lugs 4434. The indent 4462 may be in the lower end 4428L of the weight 4428. The weight 4428 may be configured to selectively engage with the one or more locating lugs 4434 via the indent 4462. The one or more locating lugs 4434 may define positions in the recessed channel 4426 that the weight 4428 may be positioned at when the cover 4430 is in the locked configuration. In some examples, the weight assembly 4404 is configured such that, when the cover 4430 is in the unlocked configuration, the weight 4428 is raised with the cover 4430 above the one or more locating lugs 4434 and is movable relative to the cover 4430.

The golf club head 4400 may have a fastener receiver 4472 in the body 4406 that is shaped and sized to receive at least part of the fastener 4432, and the cover 4430 may have an opening that is alignable with the fastener receiver 4472 and shaped and sized to receive at least part of the fastener 4432. The fastener 4432 may be configured to couple the cover 4430 to the body 4406 by penetrating at least partly through each of the opening in the cover 4430 and the fastener receiver 4472. The opening in the cover 4430 may be in a surface of the cover 4430 defining part of a perimeter (e.g., a lower portion of the perimeter) of the window cutout 4490. The cover 4430 may have a fastener indent 4431 in an overhanging portion of the cover 4430 (e.g., an upper portion of the perimeter of the window cutout 4490) to improve access to the fastener 4432 via a tool (e.g., a screwdriver). For example, the overhanging portion of the cover 4430 may at least partially cover the fastener 4432 (or would otherwise at least partially cover the fastener 4432 if the fastener indent 4431 were not provided), and the fastener indent 4431 may provide a space in the overhanging portion above the fastener 4432 to allow the tool to access the fastener 4432 or to enhance the tool's accessibility to the fastener 4432. In some examples, the cover 4430 is coupled to the fastener 4432 (e.g., via a retaining clip) so that the cover 4430 moves with the fastener 4432 when the fastener 4432 is moved along the fastener axis and so that the fastener 4432 is rotatable relative to the cover 4430.

Although specific embodiments and aspects were described herein and specific examples were provided, the scope of the technology is not limited to those specific embodiments and examples. For instance, while many of the present examples have been depicted particularly for use with a driver, a fairway metal, and an iron, any the present technology may be applied to any metal wood, fairway metal or wood, iron, or hybrid golf club. Further, each of the above examples may be combined with another and/or one or more features of some examples may be combined with other examples. One skilled in the art will recognize other embodiments or improvements that are within the scope and spirit of the present technology. Therefore, the specific structure, acts, or media are disclosed only as illustrative embodiments. In addition, if the limits of the terms "about," "substantially," or "approximately" as used in the following claims are unclear from the foregoing specification to one having skill in the art, those terms shall mean within ten percent of the value described. The scope of the technology is defined by the following claims and any equivalents therein.

What is claimed is:

1. A golf club head comprising:

a body having an outer surface;

a recessed channel formed in the outer surface; and a weight assembly comprising:

a weight at least partially disposed within the recessed channel and configured to move therein, the weight comprising a main body and a protruding tongue, the protruding tongue comprising a distal tongue portion and a proximal tongue portion extending between the main body and the distal tongue portion, a cover extending at least partially over the recessed channel and the main body, having a window cutout shaped and sized to block at least part of the distal tongue portion from moving through the window cutout, and having a slot cutout forming, together with a portion of the window cutout, an opening in the cover that is shaped and sized to allow movement of the distal tongue portion through the opening, a slot wedge at least partially filling the slot cutout and forming a portion of the window cutout, and a fastener coupling the cover to the body, wherein at least part of the proximal tongue portion extends through the window cutout.

2. The golf club head of claim 1, wherein the slot wedge is fitted into the slot cutout via at least one of a force fit, a snap fit, an adhesive, or a fastener.

3. The golf club head of claim 1, wherein the window cutout extends along a toe-heel direction and the slot cutout extends from the window cutout in a direction different from the toe-heel direction.

4. The golf club head of claim 1, wherein the protruding tongue forms at least part of a groove of the weight, and the weight is configured to slidingly engage with the cover via the groove.

5. The golf club head of claim 1, wherein the protruding tongue is integrally formed with the main body.

6. The golf club head of claim 1, wherein the fastener is adapted to retain the weight in the recessed channel only indirectly by the cover.

7. The golf club head of claim 1, wherein the cover is positionable in at least an unlocked configuration whereby the cover is raised at least partially out of the recessed channel and the weight is selectively movable within the recessed channel, and a locked configuration whereby the cover is at least partially disposed within the recessed channel and the weight is secured within the recessed channel.

8. The golf club head of claim 7, wherein the weight engages with the cover via the protruding tongue so that the weight moves with the cover between the locked configuration and the unlocked configuration.

9. The golf club head of claim 7, wherein between about 0% and about 30% of an outer surface of the weight is visible in the locked configuration.

10. A golf club head comprising:

a body having an outer surface;

a recessed channel formed in the outer surface; and a weight assembly comprising:

a weight at least partially disposed within the recessed channel and configured to move therein, the weight comprising a main body and a protruding tongue that is couplable to the main body, the protruding tongue comprising a distal tongue portion and a proximal tongue portion that, when the protruding tongue is coupled to the main body, extends between the main body and the distal tongue portion, a cover extending at least partially over the recessed channel and the main body, and having a window cutout shaped and sized to block at least part of the distal tongue portion from moving through the window cutout when the protruding tongue is coupled to the main body, and a fastener coupling the cover to the body, wherein at least part of the proximal tongue portion extends through the window cutout when the protruding tongue is coupled to the main body, and wherein the protruding tongue, when coupled to the main body, forms at least part of a groove of the weight, and the weight is configured to slidingly engage with the cover via the groove.

11. The golf club head of claim 10, wherein the protruding tongue is couplable to the main body via at least one of a force fit, a snap fit, an adhesive, or a fastener.

12. The golf club head of claim 10, wherein the fastener is adapted to retain the weight in the recessed channel only indirectly by the cover.

13. The golf club head of claim 10, wherein the fastener is controllably movable along a fastener axis, and the cover is coupled to the fastener so that the cover moves with the fastener in response to the fastener moving along the fastener axis.

14. The golf club head of claim 13, wherein the cover is positionable in at least an unlocked configuration whereby the cover is raised at least partially out of the recessed channel and the weight is selectively movable within the recessed channel, and a locked configuration whereby the cover is at least partially disposed within the recessed channel and the weight is secured within the recessed channel, and wherein, when the protruding tongue is coupled to the main body, the weight is coupled to the cover so that the weight moves with the cover in response to the cover moving between the unlocked configuration and the locked configuration.

15. A golf club head comprising:

a body having an outer surface;

a recessed channel formed in the outer surface;

a slide panel protruding into and at least partially through the recessed channel from at least one surface of the recessed channel; and a weight assembly comprising:

a weight at least partially disposed within the recessed channel and configured to move therein, a cover adapted to releasably secure the weight within the recessed channel and to slide along the slide panel, and a fastener coupling the cover to the body.

16. The golf club head of claim 15, wherein the fastener is adapted to retain the weight in the recessed channel only indirectly by the cover.

17. The golf club head of claim 15, wherein the weight is slidingly engaged with the cover so that the weight moves with the cover in response to the cover sliding along the slide panel, and at least a portion of the weight and a portion of the cover are positioned on opposite sides of the slide panel.

18. The golf club head of claim 17, wherein the cover has a window cutout, wherein the weight has a weight opening, and wherein the cover is positionable in at least:

an unlocked configuration whereby the cover is raised at least partially out of the recessed channel, the weight opening is at least partially exposed through the window cutout, and the weight is controllably slidable relative to the cover; and a locked configuration whereby the cover is at least partially disposed within the recessed channel, the slide panel is positioned at least partially between the weight opening and the window cutout, and the weight is secured within the recessed channel.

19. The golf club head of claim 17, wherein the weight is configured to slide relative to the cover along a first direction, and the cover is adapted to slide relative to the slide panel along a second direction different from the first direction.

* * * * *